US007509891B2

(12) United States Patent
Miyake et al.

(10) Patent No.: US 7,509,891 B2
(45) Date of Patent: Mar. 31, 2009

(54) BUTTON MAKING DEVICE, BUTTON, AND METHOD OF MOUNTING PRESSING MOLD IN BUTTON MAKING DEVICE

(75) Inventors: Suyako Miyake, Chofu (JP); Kenji Kaneko, Shiroishi (JP); Kaori Ojima, Hitachinaka (JP); Yukie Momoi, Adachi ku (JP); Keiichi Kazami, Kasukabe (JP); Kenetsu Kikuchi, Nagareyama (JP); Mitsuo Tamura, Noda (JP); Iwakichi Ogawa, Kashiwa (JP)

(73) Assignees: Bandai Co., Ltd., Tokyo (JP); Kikuchi Co., Ltd., Nagareyama-shi (JP)

( * ) Notice: Subject to any disclaimer, the term of this patent is extended or adjusted under 35 U.S.C. 154(b) by 311 days.

(21) Appl. No.: 10/545,301

(22) PCT Filed: Feb. 13, 2004

(86) PCT No.: PCT/JP2004/001567

§ 371 (c)(1),
(2), (4) Date: Jul. 21, 2006

(87) PCT Pub. No.: WO2004/071230

PCT Pub. Date: Aug. 26, 2004

(65) Prior Publication Data

US 2006/0260102 A1 Nov. 23, 2006

(30) Foreign Application Priority Data

Feb. 14, 2003 (JP) ..... 2003-037387
Jul. 15, 2003 (JP) ..... 2003-275020

(51) Int. Cl.
*A44B 1/00* (2006.01)

(52) U.S. Cl. ..... 79/3

(58) Field of Classification Search ..... 79/1–5, 79/18
See application file for complete search history.

(56) References Cited

U.S. PATENT DOCUMENTS 1,765,325 A 6/1930 Day
3,550,483 A 12/1970 Humbel (Continued)

FOREIGN PATENT DOCUMENTS

CH 2554 A 12/1890

(Continued)

*Primary Examiner*—Mark Rosenbaum
(74) *Attorney, Agent, or Firm*—Smith Patent Office

(57) ABSTRACT

A button making device capable of simply exchanging a first pressed mold, a second pressed mold, and a pressing mold so as to produce buttons of different sizes; a polygonal button whose front surface plate is dome-wise curved and has its shape fixed; and such a button making device, are provided. The button making device has a sliding platform, two pressed molds, a fixed member, a pressing shaft, a pressing mold, and an operation mechanism. The pressed molds are provided on an attachment member which is removably attached to the sliding platform. The pressing mold is removably attached to a lower end of the pressing shaft using magnetic force. The present invention can be used for a button making device which can easily form a metal button by press processing which can be used as an accessory adhered to clothes or the like by a pin or the like.

4 Claims, 70 Drawing Sheets

U.S. PATENT DOCUMENTS

| | | | | |
|---|---|---|---|---|
| 5,067,265 | A | 11/1991 | Harms | |
| 5,283,966 | A | 2/1994 | Rader et al. | |
| 6,038,944 | A | 3/2000 | Braunberger | |
| 2005/0155218 | A1 * | 7/2005 | Kaneko et al. | 29/708 |

FOREIGN PATENT DOCUMENTS

| | | | |
|---|---|---|---|
| CH | 8401 | A | 10/1894 |
| EP | 1 374 715 | A | 1/2004 |
| FR | 1 295 402 | A | 6/1962 |
| JP | 53-65139 | A | 6/1978 |
| JP | 58-218906 | A | 12/1983 |
| JP | 61-29606 | U | 2/1986 |
| JP | 61-32005 | B | 7/1986 |
| JP | 2-94609 | U | 7/1990 |
| JP | 7-33450 | U | 6/1995 |
| JP | 8-145234 | A | 6/1996 |

* cited by examiner

BUTTON MAKING DEVICE, BUTTON, AND METHOD OF MOUNTING PRESSING MOLD IN BUTTON MAKING DEVICE

BACKGROUND OF THE INVENTION

1. Field of the Invention

The present invention relates to a button comprising a front cover and a rear cover, with a peripheral edge of the front cover bent and attached to a peripheral edge of the rear cover so that the front cover is fixed into the rear cover, and a button making device making such a button.

2. Discussion of the Related Art

Conventionally, a button comprises a front cover having a substantially circular front surface plate and a peripheral edge extending downward from the front surface plate, and a rear cover having a substantially circular rear surface plate and a peripheral edge extending upward from the rear surface plate, and the button is formed in the following way. The peripheral edge of the front cover is bent and held fast to the peripheral edge of the rear cover by catching peripheries of a design sheet and a transparent cover body provided on the front surface of the front cover in the peripheral edge of the front cover and the peripheral edge of the rear cover. A button making device which produces the above-mentioned conventional button, as disclosed in Japanese Patent Publication No. 61-32005, comprises a base, an arm fixed to the base, a pressing mold assembly attached to a tip of the arm and being moved up and down by a handle, a plate provided in a freely rotatable manner on the base, and first and second pressed mold assemblies provided on the plate. The pressing mold assembly moves up and down by a pinion rotated by the handle and a rack for engaging with the pinion.

In this conventional button making device, the second pressed mold assembly has a processing platform which bends the peripheral edge of the front cover to a side of the peripheral edge of the rear cover, and the processing platform has a substantially annularly inclined processing edge. The angle of inclination of the inclined processing edge of the second pressed mold assembly is all the same, and the inclined processing edge bends the peripheral edge of the front cover toward substantially the center of the front cover. Thus, in the conventional button making device, since the peripheral edge of the front cover is bent toward substantially the center, the front surface plate is dome-wise curved and has its shape fixed, and the cover plate can be held fast to the front surface plate.

With the above-described button making device of the related art, it was not possible to easily remove a pressing mold assembly which moves up and down by a handle, and a first pressed mold assembly and a second pressed mold assembly provided on a plate. Thus, if the pressed mold assembly or the first pressed mold assembly and the second pressed mold assembly were broken, there was a problem that they could not be replaced with new ones. Also, since it was not possible to replace the pressing mold assembly, the first pressed mold assembly and the second pressed mold assembly, there was a problem that it was not possible to make buttons of different sizes. Further, there was a problem that buttons could be broken because too much force was applied without realizing the extent of the force of the handle.

Also, the above-described button making device of the related art produced a circular button, and there was a problem that it was not able to produce a polygonal button. That is, for the above-described button making device of the related art to produce a polygonal button, a processing platform must be formed having a polygonal inclined processing edge which bent a peripheral edge of the polygonal front surface plate. This polygonal inclined processing edge has straight-line inclined edges and corner inclined edges. When bending the peripheral edge of the front surface plate by the straight-line inclined edges, the peripheral edge of the front surface plate was bent substantially perpendicularly against the bending line, and are not bent toward substantially the center. Thus, there was a problem that the front surface plate was not dome-wise curved but shaped like a wave, and thus a button was not be able to be produced uniformly. When the front surface plate was shaped like a wave, a cover plate was not able to be held fast to the front surface plate. Thus, there was a problem that when a design sheet printed with a representation of characters, a pattern, a design, or any combination thereof was placed between the front surface plate and the cover plate, it was not able to stay in place.

The present invention takes the above described problems into consideration, and a first object is to provide a button making device with which it is possible to easily remove a first pressed mold and a second pressed mold, and easily replace them with a new first pressed mold and a second pressed mold. A second object is to provide a button making device with which it is possible to easily remove a pressing mold and easily replace it with a new pressing mold. A third object is to provide a button making device with which it is possible to easily remove a first pressed mold, a second pressed mold and a pressing mold, and to replace them with a separate first pressed mold, a second pressed mold and a pressing mold of different sizes, to make it possible to make buttons of different sizes. A fourth object is to provide a button making device that prevents a pressing force from being applied onto the pressing mold which is greater than that for forming and processing.

Further, the present invention takes the above described problems into consideration, and a fifth object is to provide a polygonal button having the following characteristics: a front surface plate is dome-wise curved and has its shape fixed; a cover plate can be held fast to the front surface plate; and a design sheet can be placed between the front surface plate and the cover plate so as not to move. Also, a sixth object is to provide a button making device which can produce the above-mentioned button.

SUMMARY OF THE INVENTION

In order to achieve the above described objects, the button making device defined by claim 1 of this application is a button making device, for making a button having a rear cover and a front cover, comprising: a base; a first pressed mold on which the front cover can be placed; a second pressed mold on which the rear cover can be placed; an attachment member on which the first pressed mold and the second pressed mold are provided; a pressing mold for making the button by independently engaging with each of the first pressed mold and the second pressed mold; and a pressing shaft for causing the pressing mold to move so as to engage with one of the first pressed mold and the second pressed mold; wherein the attachment member is removably attached to a sliding platform capable of reciprocating on an upper surface of the base by an attaching and detaching member.

In order to achieve the above described objects, in the button making device defined by claim 2 of this application, the attaching and detaching member comprises an engagement member which engages with one side of the attachment member; and a locking member which locks the other side of the attachment member.

In order to achieve the above described objects, in the button making device defined by claim 3 of this application, the first pressed mold and the second pressed mold are provided on the attachment member to be positioned at both ends of the sliding platform.

In order to achieve the above described objects, in the button making device defined by claim 4 of this application, the pressing mold is removably attached to a lower end of the pressing shaft.

In order to achieve the above described objects, the button making device defined by claim 5 of this application is a button making device for making a button having a rear cover and a front cover, comprising: a base; a pressed mold provided on the base; a pressing mold for making the button by engaging with the pressed mold; and a pressing shaft for causing the pressing mold to move so as to engage with the pressed mold; wherein the pressing mold is removably attached to a lower end of the pressing shaft using magnetic force.

In order to achieve the above described objects, the button making device defined by claim 6 of this application is a button making device for making a button having a rear cover and a front cover, comprising: a base; a sliding platform provided on an upper surface of the base capable of reciprocating; a first pressed mold and a second pressed mold positioned at both ends of the sliding platform; a pressing mold for making the button by engaging with each of the first pressed mold and the second pressed mold; and a pressing shaft for causing the pressing mold to move so as to engage with one of the first pressed mold and the second pressed mold; wherein the pressing mold is removably attached to a lower end of the pressing shaft using magnetic force.

In order to achieve the above described objects, the button making device defined by claim 7 of this application further comprises a detachment member for detaching the pressing mold which is removably attached to the lower end of the pressing shaft using magnetic force from the lower end of the pressing shaft.

In order to achieve the above described objects, in the button making device defined by claim 8 of this application, the pressing mold comprises an outer layer frame which engages with the first pressed mold and an inner layer frame which engages with the second pressed mold, the outer layer frame has a guide hole formed at an upper part, the inner layer frame has a guide projection formed at an upper part, and the guide projection is guided in the guide hole of the outer layer frame and is capable of up and down movement inside the outer layer frame.

In order to achieve the above described objects, the button making device defined by claim 9 of this application is a button making device for making a button having a rear cover and a front cover, comprising: a base; a pressed mold arranged on an upper surface of the base; a pressing mold for making the button by engaging with the pressed mold; and a pressing shaft for causing the pressing mold to move so as to engage with the pressed mold; wherein the pressing shaft has a male threaded section capable of moving in an axial direction by being screwed into a female threaded section provided in a fixed member fixed above the base, and the male threaded section is formed so that before the pressing shaft moves upwards and the pressing mold comes into contact with the fixed member, the pressing shaft slackens off by moving away from the female threaded section of the fixed member.

In order to achieve the above described objects, in the button making device defined by claim 10 of this application, the pressing shaft comprises the male threaded section, and a non-threaded section which removes the male threaded section from the female threaded section of the fixed member and slackens off the pressing shaft before the pressing shaft moves upwards and the pressing mold comes into contact with the fixed member.

In order to achieve the above described objects, the button making device defined by claim 11 of this application is a button making device for making a button having a rear cover and a front cover, comprising: a base; a pressed mold arranged on an upper surface of the base; a fixed member fixed to an upper part of the base; a pressing shaft having a male threaded section capable of moving in an axial direction by being screwed into a female threaded section provided in the fixed member, a pressing mold, provided at a lower end of the pressing shaft, for forming a button by engaging with the pressed mold; and an operation means for causing the pressing shaft to move in an axial direction, further comprising a clutch for transmitting an operational force applied to the operation means to the pressing shaft provided between the operation means and the pressing shaft, wherein the clutch causes the operation means to slip with respect to the pressing shaft if an operational force greater than a specified value is applied to the operation means.

In order to achieve the above described objects, in the button making device defined by claim 12 of this application, the clutch comprises a latch projection pressed by an elastic member and a latch indent for engaging and disengaging with the latch projection, one of the latch projection and the latch indent is provided on the operation means, another one of the latch projection and the latch indent is provided in a rotating body attached to the pressing shaft; and the rotating body is combined with the operation means so that the latch projection and the latch indent engage with each other.

In order to achieve the above described objects, the button making device defined by claim 13 of this application makes such a button that a sheet body formed of a transparent material is placed on a front surface plate of the front cover, and a design sheet printed with a representation of characters, a pattern, a design, or any combination thereof, is arranged between the sheet body and the front surface plate of the front cover.

In order to achieve the above described objects, the button making device defined by claim 14 of this application is a button making device for making a button by fitting a first rear cover and a first front cover together, comprising: a base; a sliding platform movably attached to the base; a first attachment member connecting a first front cover mounting mold suitable for mounting the first front cover and a first rear cover mounting mold suitable for mounting the first rear cover; and an attachment means for removably attaching the first attachment member to the sliding platform; wherein the first front cover mounting mold and the first rear cover mounting mold slide along with the sliding platform and move to a button making position by turns by having the attachment means attach the first attachment member to the sliding platform so that the button can be produced.

In order to achieve the above described objects, the button making device defined by claim 15 of this application further comprises a pressing member capable of making the button by engaging with the first front cover mounting mold and the first rear cover mounting mold, wherein the button making position is substantially right below the pressing member.

In order to achieve the above described objects, in the button making device defined by claim 16 of this application, the first attachment member is exchangeable with a second attachment member which connects a second front cover mounting mold suitable for mounting a second front cover different from the first front cover and a second rear cover mounting mold suitable for mounting a second rear cover different from the first rear cover.

In order to achieve the above described objects, the button defined by claim 17 of this application is a polygonal button comprising a front cover and a rear cover, the front cover having a polygonal front surface plate and a peripheral edge extending downward from the front surface plate, the peripheral edge comprising straight line sections and curved corner sections connecting the straight line sections, the rear cover having a polygonal rear surface plate and a peripheral edge extending upward from the rear surface plate, the peripheral edge comprising straight line sections and curved corner sections which connect the straight line sections, wherein the front cover is attached to the rear cover with the corner section of the peripheral edge held fast to the corner section of the peripheral edge of the rear cover.

In order to achieve the above described objects, the button defined by claim 18 of this application is a polygonal button comprising a front cover, a rear cover, and a sheet body, the front cover having a polygonal front surface plate and a peripheral edge extending downward from the front surface plate, the peripheral edge comprising straight line sections and curved corner sections connecting the straight line sections, the sheet body placed on the front surface plate of the front cover, the rear cover having a polygonal rear surface plate and a peripheral edge extending upward from the rear surface plate, the peripheral edge comprising straight line sections and curved corner sections which connect the straight line sections, wherein the front cover is attached to the rear cover with the corner sections of the peripheral edge held fast to the corner sections of the peripheral edge of the rear cover, and a peripheral edge of the sheet body is gripped by the peripheral edge of the front cover and the peripheral edge of the rear cover.

In order to achieve the above described objects, in the button defined by claim 19 of this application, the sheet body is formed of a transparent material, and a design sheet printed with a representation of characters, a pattern, a design, or any combination thereof, is arranged between the sheet body and the front surface plate of the front cover.

In order to achieve the above described objects, the button making device defined by claim 20 of this application is a button making device for making a button of claims 17, 18, or 19, comprising: a base; a pressed mold provided on the base; and a pressing mold for making the button by engaging with the pressed mold; wherein the pressed mold comprises a mounting platform for mounting the rear cover, and a processing platform which is provided in a periphery of the mounting platform and bends the peripheral edge of the front cover to a side of the peripheral edge of the rear cover, and the processing platform has a straight-line inclined edge which bends straight line sections of the peripheral edge of the front cover and a corner inclined edge which bends corner sections of the peripheral edge of the front cover, and holds the corner section of the peripheral edge of the front cover fast to the corner sections of the peripheral edge of the rear cover by the corner inclined edge.

In order to achieve the above described objects, the button making device defined by claim 21 of this application is a button making device for making a button of claims 17, 18, or 19, comprising: a base; a first pressed mold and a second pressed mold provided on the base; and a pressing mold for making the button by engaging with each of the first pressed mold and the second pressed mold; wherein the first pressed mold has a first mounting platform for mounting the front cover, the second pressed mold comprises a second mounting platform for mounting the rear cover and a processing platform which is provided in a periphery of the second mounting platform and bends the peripheral edge of the front cover to a side of the peripheral edge of the rear cover, and the processing platform has a straight-line inclined edge which bends straight line sections of the peripheral edge of the front cover and a corner inclined edge which bends corner sections of the peripheral edge of the front cover, and holds the corner section of the peripheral edge of the front cover fast to the corner sections of the peripheral edge of the rear cover by the corner inclined edge.

In order to achieve the above described objects, the method of mounting a pressing mold of a button making device defined by claim 22 of this application is a method of mounting a pressing mold of a button making device having: a base; a sliding platform provided on an upper surface of the base capable of reciprocating; a first pressed mold suitable for mounting the front cover and a second pressed mold suitable for mounting the rear cover, arranged at both ends of the sliding platform; a pressing mold for making a button by independently engaging with each of the first pressed mold and the second pressed mold; a pressing shaft which is positioned at an upper side of the sliding platform, has a joining means (magnetic body) for joining with the pressing mold formed at a lower end, and is capable of moving close to or away from the sliding platform by reciprocating in an axial direction; an operation means for causing the pressing shaft to reciprocate in the axial direction; and a cover which prevents a hand from reaching substantially right below the pressing shaft; the method comprising: a step of mounting the pressing mold to either one of the pressed molds; a step of causing the pressing mold and the pressed mold on which the pressing mold is mounted to move to substantially right below the pressing shaft by sliding the sliding platform; and a step of joining the pressing mold with a lower end of the pressing shaft by the joining means (magnetic body), by operating the operation means and bringing the lower end of the pressing shaft close to the sliding platform.

In order to achieve the above described objects, the method of mounting a pressing mold of a button making device defined by claim 23 of this application is a method of mounting a pressing mold of a button making device having: a base; a sliding platform provided on an upper surface of the base capable of reciprocating; a first pressed mold suitable for mounting the front cover and a second pressed mold suitable for mounting the rear cover, arranged at both ends of the sliding platform; a pressing mold for making a button by independently engaging with each of the first pressed mold and the second pressed mold; a pressing shaft which is positioned at an upper side of the sliding platform, has a joining means (magnetic body) for joining with the pressing mold formed at a lower end, and is capable of moving close to or away from the sliding platform by reciprocating in an axial direction; an operation means for causing the pressing shaft to reciprocate in the axial direction; and a cover which prevents a hand from reaching substantially right below the pressing shaft; the method comprising: a step of mounting the front cover on the first pressed mold; a step of mounting the pressing mold on the first pressed mold on which the front cover is mounted; a step of causing the pressing mold and the first pressed mold on which the pressing mold is mounted to move to substantially right below the pressing shaft by sliding the sliding platform; and a step of joining the pressing mold with a lower end of the pressing shaft by the joining means (magnetic body), by operating the operation means and bringing the lower end of the pressing shaft close to the sliding platform.

Further, in order to solve the above described problems, there are means having the following structures.

[First Means of Solution]

A button making device makes a button having the following characteristics. The button comprises a front cover having a substantially circular front surface plate and an edge extending further down than the front surface plate, and a rear cover having a substantially circular rear surface plate and an edge extending further up than the rear surface plate. The front cover of the button is engaged with the rear cover so that the edge of the rear cover and the edge of the front cover come into contact. A button making device comprises a base, a pressed mold arranged on an upper surface of the base, a fixed member fixed to an upper part of the base via a strut, a pressing shaft capable of moving in a vertical direction provided on the fixed member, a pressing mold provided on a lower end of the pressing shaft for making a button by joining with the pressed mold, and an operation means for operating the pressing shaft. The pressed mold is provided on an attachment member removably attached to the base.

[Second Means of Solution]

A button making device makes a button having the following characteristics. The button comprises a front cover having a substantially circular front surface plate and an edge extending further down than the front surface plate, and a rear cover having a substantially circular rear surface plate and an edge extending further up than the rear surface plate. The front cover of the button is engaged with the rear cover so that the edge of the rear cover and the edge of the front cover come into contact. The button making device comprises a base, a sliding platform provided on an upper surface of the base capable of reciprocating, first and second pressed molds arranged on either side in the direction of reciprocation of the sliding platform, a fixed member fixed to an upper part of the base via a strut, a pressing shaft capable of movement in a vertical direction provided on the fixed member, a pressing mold provided on a lower end of the pressing shaft for making a button by joining with the first pressed mold and the second pressed mold, and an operation means for operating the pressing shaft. The first pressed mold and the second pressed mold are provided on attachment members removably attached to the sliding platform.

[Third Means of Solution]

A button making device makes a button having the following characteristics. The button comprises a front cover having a substantially circular front surface plate and an edge extending further down than the front surface plate, and a rear cover having a substantially circular rear surface plate and an edge extending further up than the rear surface plate. The front cover of the button is engaged with the rear cover so that the edge of the rear cover and the edge of the front cover come into contact. The button making device comprises a base, a pressed mold arranged on an upper surface of the base, a fixed member fixed to an upper part of the base via a strut, a pressing shaft capable of movement in a vertical direction provided on the fixed member, a pressing mold provided on a lower end of the pressing shaft for making a button by joining with the pressed mold, and an operation means for operating the pressing shaft. The pressing mold is removably attached to the lower end of the pressing shaft by magnetic force.

[Fourth Means of Solution]

A button making device makes a button having the following characteristics. The button comprises a front cover having a substantially circular front surface plate and an edge extending further down than the front surface plate, and a rear cover having a substantially circular rear surface plate and an edge extending further up than the rear surface plate. The front cover of the button is engaged with the rear cover so that the edge of the rear cover and the edge of the front cover come into contact. The button making device comprises a base, a sliding platform capable of reciprocating on an upper surface of the base, first and second pressed molds arranged on either side in the direction of reciprocation of the sliding platform, a fixed member fixed to an upper part of the base via a strut, a pressing shaft capable of movement in a vertical direction provided on the fixed member, a pressing mold provided on a lower end of the pressing shaft for making a button by joining with the first pressed mold and the second pressed mold, and an operation means for operating the pressing shaft. The pressing mold is removably attached to the lower end of the pressing shaft by magnetic force.

[Fifth Means of Solution]

A button making device makes a button having the following characteristics. The button comprises a front cover having a substantially circular front surface plate and an edge extending further down than the front surface plate, and a rear cover having a substantially circular rear surface plate and an edge extending further up than the rear surface plate. The front cover of the button is engaged with the rear cover so that the edge of the rear cover and the edge of the front cover come into contact. The button making device comprises a base, a sliding platform capable of reciprocating on an upper surface of the base, first and second pressed molds arranged on either side in the direction of reciprocation of the sliding platform, a fixed member fixed to an upper part of the base via a strut, a pressing shaft capable of movement in a vertical direction provided on the fixed member, a pressing mold provided on a lower end of the pressing shaft for making a button by joining with the first pressed mold and the second pressed mold, and an operation means for operating the pressing shaft. The first pressed mold and the second pressed mold are provided on attachment members removably attached to the sliding platform, and the pressing mold is removably attached to the lower end of the pressing shaft by magnetic force.

[Sixth Means of Solution]

The button making device, as defined in any of the first to fifth means of solution described above, makes a button by placing a sheet body on an upper surface plate of the front cover, and by fitting the rear cover and front cover together so that the edge of the sheet body is gripped between the edge of the rear cover and the edge of the front cover.

[Seventh Means of Solution]

In the button making device as defined in any one of the fourth, fifth and sixth means of solution described above, the pressing mold comprises an outer layer frame joining with the first pressed mold, and an inner layer frame joining with the second pressed mold. The outer layer frame has a guide hole formed at an upper part. The inner layer frame has a guide projection formed at an upper part, and the guide projection is guided in the guide hole of the outer layer frame and is capable of up and down movement inside the outer layer frame.

[Eighth Means of Solution]

In the button making device as defined in the above described sixth or seventh means of solution, the first pressed mold comprises a first mounting platform for placing the front cover, and a guide platform provided around the first mounting platform for placing a sheet body. The guide platform is capable of moving in the vertical direction and pressed upwards by an elastic member. The second pressed mold comprises a second mounting platform for placing the rear cover, and a processing platform provided around the second mounting platform for bending the edge of the front cover towards the edge of the rear cover, so that the edge of the sheet body is gripped by the edge of the front cover and the edge of the rear cover. The processing platform is capable of moving in the vertical direction and pressed upwards by an elastic member.

[Ninth Means of Solution]

In the button making device as defined in the above described eighth means of solution, the pressing mold has an outer layer frame and an inner layer frame that is shallower than the outer layer frame and is provided inside the outer layer frame. The inner layer frame is provided on a lower end of the pressing shaft. The pressing mold further has a switching member for switching the outer layer frame or the inner layer frame to be pressed by the pressing shaft depending on the position of the first pressed mold or the second pressed mold. The switching member is configured so that when the first pressed mold is positioned substantially directly below the pressing mold, contact is made with an upper end of the outer layer frame and pressed by the pressing shaft. When the sliding platform moves and the second pressed mold is positioned substantially directly below the pressing mold, the switching member moves away from the upper end of the outer layer frame and is not pressed by the pressing shaft. When the first pressed mold is positioned substantially directly below the pressing mold, if the operation means is operated to cause the pressing shaft to move downwards, the outer layer frame moves downwards to contact the guide platform of the first pressed mold, presses the guide platform downwards against the elasticity of the elastic member, and bends the sheet body along the edge of the front cover. When the second pressed mold is positioned substantially directly below the pressing mold, if the operation means is operated to cause the pressing shaft to move downwards, the inner layer frame moves downwards to contact the processing platform of the second pressed mold, presses the processing platform downwards against the elasticity of the elastic member, and grips the edge of the sheet body in between the edge of the front cover and the edge of the rear cover so as to bend the edge of the front cover towards the edge of the rear cover.

[Tenth Means of Solution]

In the button making device as defined in the ninth means of solution described above, the pressing mold comprises a pressing mold body, an outer layer frame and an inner layer frame. The outer layer frame and the inner layer frame are removably attached to the pressing mold body by magnetic force.

[Eleventh Means of Solution]

In the button making device as defined in the tenth means of solution described above, the pressing mold body has a detachment means for detaching the outer layer frame that is attached by magnetic force, against that magnetic force.

[Twelfth Means of Solution]

In the button making device as defined in any one of the first to eleventh means of solution described above, the pressing shaft has a male threaded section capable of moving in an axial direction by being screwed into a female threaded section provided on the fixed member. The pressing shaft has the pressing mold rotatably provided on the lower end, and an operating handle on the top.

[Thirteenth Means of Solution]

In the button making device as defined in the twelfth means of solution described above, the male threaded section is formed so that before the pressing shaft moves upwards and the pressing mold comes into contact with the fixed member, the pressing shaft slackens off by moving away from the female threaded section of the fixed member.

[Fourteenth Means of Solution]

A button making device makes a button having the following characteristics. The button comprises a front cover having a substantially circular front surface plate and an edge extending further down than the front surface plate, and a rear cover having a substantially circular rear surface plate and an edge extending further up than the rear surface plate. The front cover of the button is engaged with the rear cover so that the edge of the rear cover and the edge of the front cover come into contact. The button making device comprises a base, a pressed mold arranged on an upper surface of the base, a fixed member fixed to an upper part of the base via a strut, a pressing shaft capable of movement in a vertical direction provided on the fixed member, a pressing mold provided on a lower end of the pressing shaft for making a button by joining with the pressed mold, and an operation means for operating the pressing shaft. A clutch for transmitting rotational force of the operation means to the pressing shaft is provided between the operation means and the pressing shaft. The clutch is so configured that it is possible to transmit rotational force of the pressing shaft to supply pressing force to the pressing mold at the time of fabrication of the front cover and the rear cover, while it is not possible to transmit rotational force of the pressing shaft to supply pressing force greater than that at the time of fabrication to the pressing mold once fabrication of the front cover and the rear cover has been completed.

[Fifteenth Means of Solution]

In the button making device as defined in the fourteenth means of solution described above, the clutch comprises a latch projection pressed by an elastic member, and an engagement indent for engaging and disengaging with this latch projection. The latch projection is provided on one of either the operation means or the pressing shaft, while the engagement indent is provided on the other of the operation means or the pressing shaft.

[Sixteenth Means of Solution]

A button making device makes a button having the following characteristics. The button comprises a front cover having a substantially circular front surface plate and an edge extending further down than the front surface plate, and a rear cover having a substantially circular rear surface plate and an edge extending further up than the rear surface plate. The front cover of the button is engaged with the rear cover so that the edge of the rear cover and the edge of the front cover come into contact. The button making device comprises a base, a sliding platform capable of reciprocating on an upper surface of the base, first and second pressed molds arranged on either side in the direction of reciprocation of the sliding platform, a fixed member fixed to an upper part of the base via a strut, a pressing shaft capable of movement in a vertical direction provided on the fixed member, a vertically movable member provided on a lower part of the pressing shaft, a pressing mold removably attached to the vertically movable member by magnetic force for making a button by contacting the first pressed mold and the second pressed mold, and an operation means for operating the pressing shaft. The pressing mold comprises an outer layer frame for contacting the first pressed mold and an inner layer frame for contacting the second pressed mold. The outer layer frame has a guide hole formed in an upper part, and is provided with a magnetic body for attachment to the vertically movable member on an upper surface. The inner frame has a guide projection formed at an upper part. The guide projection is guided in the guide hole of the outer layer frame, is provided inside the outer frame and capable of moving vertically, and is pressed by a lower end of the pressing shaft.

[Seventeenth Means of Solution]

The button making device as defined in the sixteenth means of solution described above makes a button by placing a sheet body on a front surface plate of the front cover, and by engaging the rear cover with the front cover so as to grip the edge of the sheet body between the edge of the rear cover and the edge of the front cover.

[Eighteenth Means of Solution]

In the button making device as defined in the fourteenth or seventeenth means of solution described above, the first pressed mold comprises a first mounting platform for placing the front cover, and a guide platform provided around the first mounting platform for placing a sheet body. The guide platform is capable of moving in the vertical direction and pressed upwards by an elastic member. The second pressed mold comprises a second mounting platform for placing the rear cover, and a processing platform provided around the second mounting platform for bending the edge of the front cover towards the edge of the rear cover, so that the edge of the sheet body is gripped by the edge of the front cover and the edge of the rear cover. The processing platform is capable of moving in the vertical direction and pressed upwards by an elastic member.

[Nineteenth Means of Solution]

In the button making device as defined in the eighteenth means of solution described above, the vertically movable member has a switching member for switching the outer layer frame or the inner layer frame to be pressed by the pressing shaft depending on the position of the first pressed mold or the second pressed mold. The switching member is configured so that when the first pressed mold is positioned substantially directly below the pressing mold, contact is made with the vertically movable member, and the outer layer frame is pressed by the pressing shaft. When the sliding platform moves and the second pressed mold is positioned substantially directly below the pressing mold, it moves away from the vertically movable member, and the inner layer frame is not pressed by the pressing shaft. If the operation means is operated to cause the pressing shaft to move downwards when the first pressed mold is positioned substantially directly below the pressing mold, the outer layer frame moves downwards to contact the guide platform of the first pressed mold, presses the guide platform downwards against the elasticity of the elastic member, and bends the sheet body along the edge of the front cover. If the operation means is operated to cause the pressing shaft to move downwards when the second pressed mold is positioned substantially directly below the pressing mold, the inner layer frame moves downwards to contact the processing platform of the second pressed mold, presses the processing platform downwards against the elasticity of the elastic member, and grips the edge of the sheet body in between the edge of the front cover and the edge of the rear cover so as to bend the edge of the front cover towards the edge of the rear cover.

[Twentieth Means of Solution]

In the button making device as defined in the nineteenth means of solution described above, the vertically movable member has a detachment means for detaching the pressing mold that is attached by magnet force, against that magnetic force.

[Twenty-first Means of Solution]

In the button making device as defined in the nineteenth means of solution described above, the detachment means comprises a ring provided around the pressing mold, an elastic member for causing the ring to contact the vertically movable member, and an operation means for causing the ring to separate from the vertically movable member against the elastic member to detach the pressing mold.

[Twenty-second Means of Solution]

In the button making device as defined in the first to twenty-first means of solution described above, a sheet body is formed of a transparent material, and a design sheet printed with a representation of characters, a pattern, a design, or any combination thereof, is arranged between the sheet body and a surface plate of the front cover.

DETAILED DESCRIPTION OF THE PREFERRED EMBODIMENTS

Figure 1:
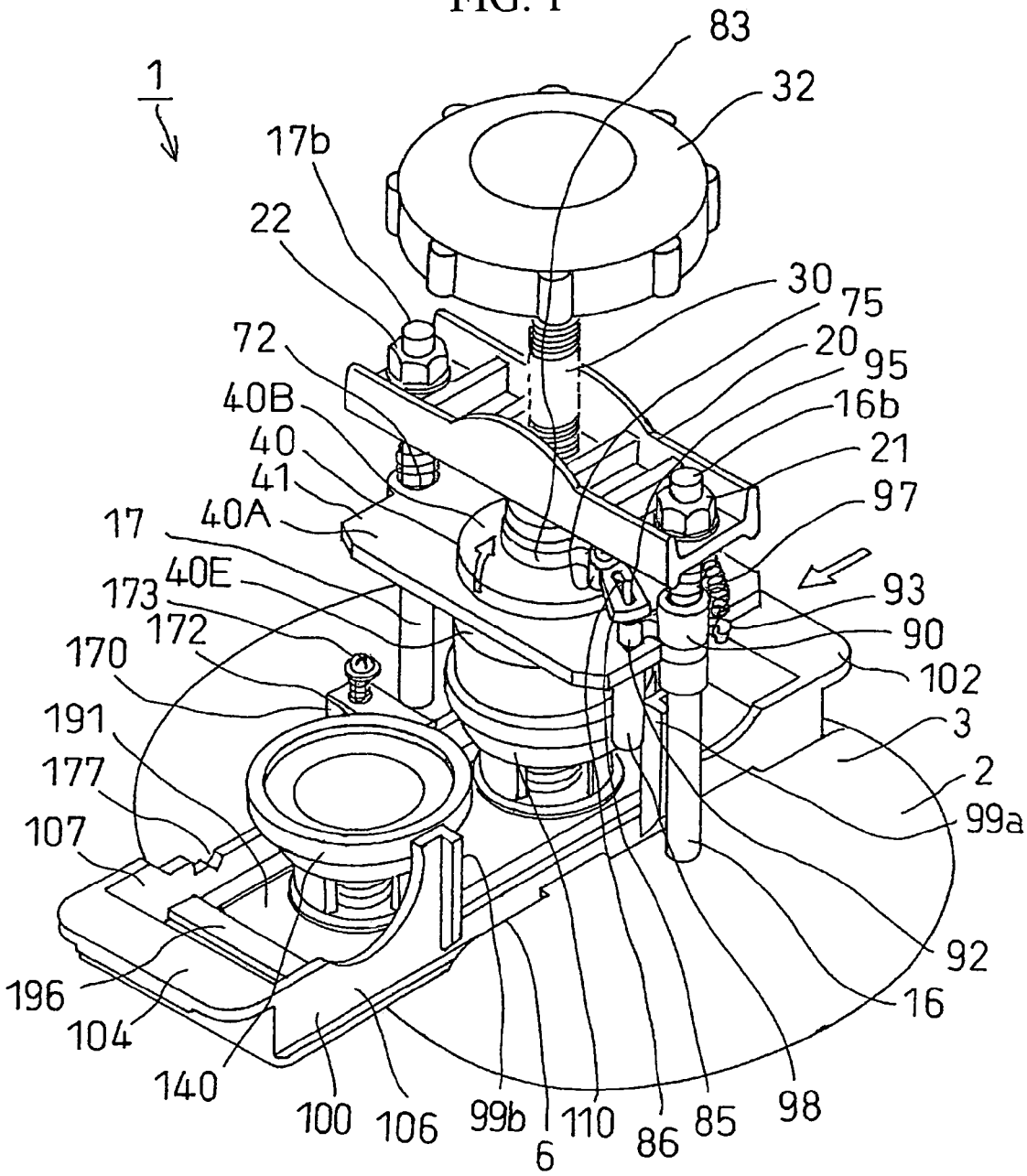
FIG. 1 is an overall perspective view showing a button making device of the present invention.
Figure 2:
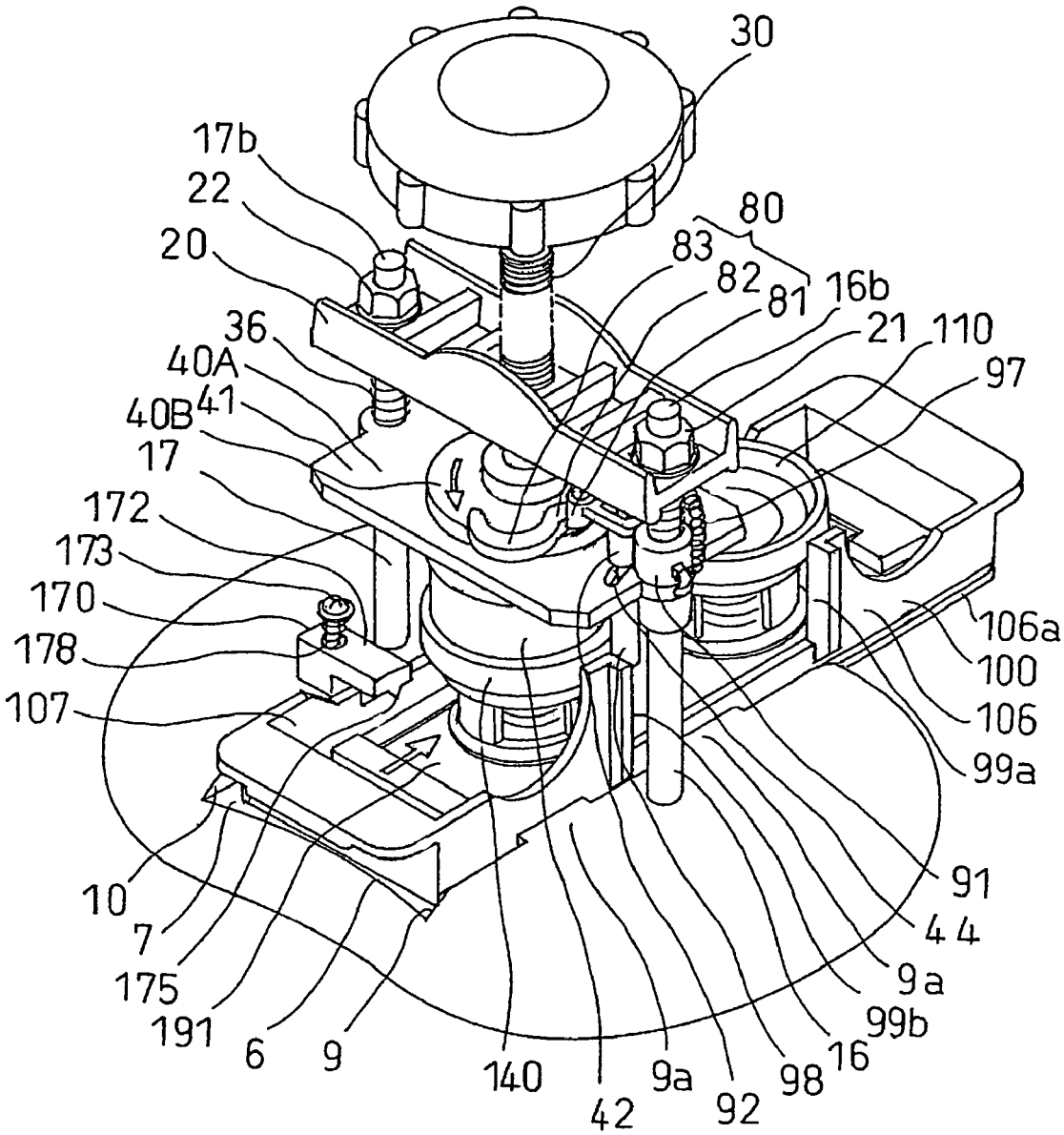
FIG. 2 is an overall perspective view describing the movement in FIG. 1.
Figure 3:
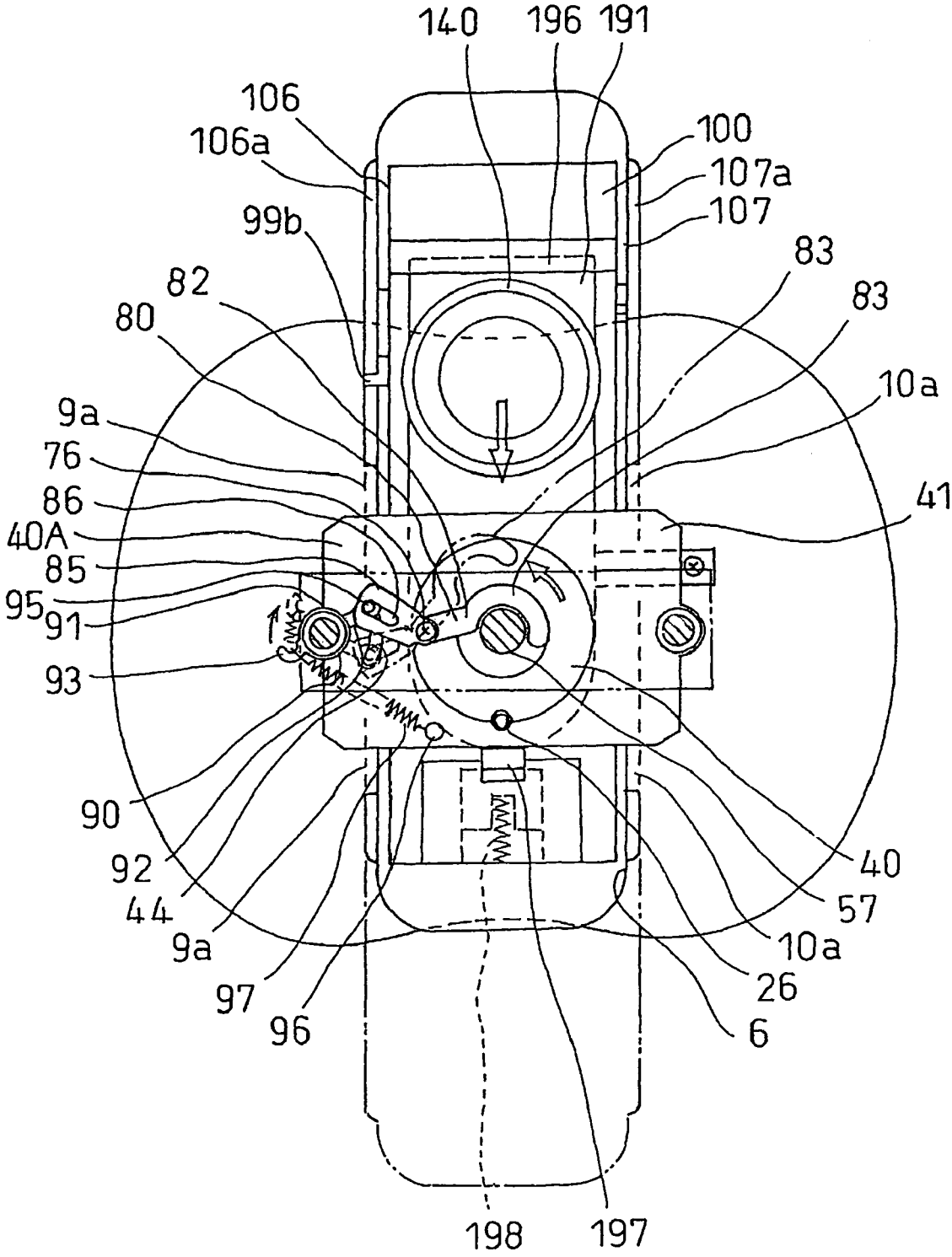
FIG. 3 is an overall plan view describing the movement in FIG. 1.
Figure 4:
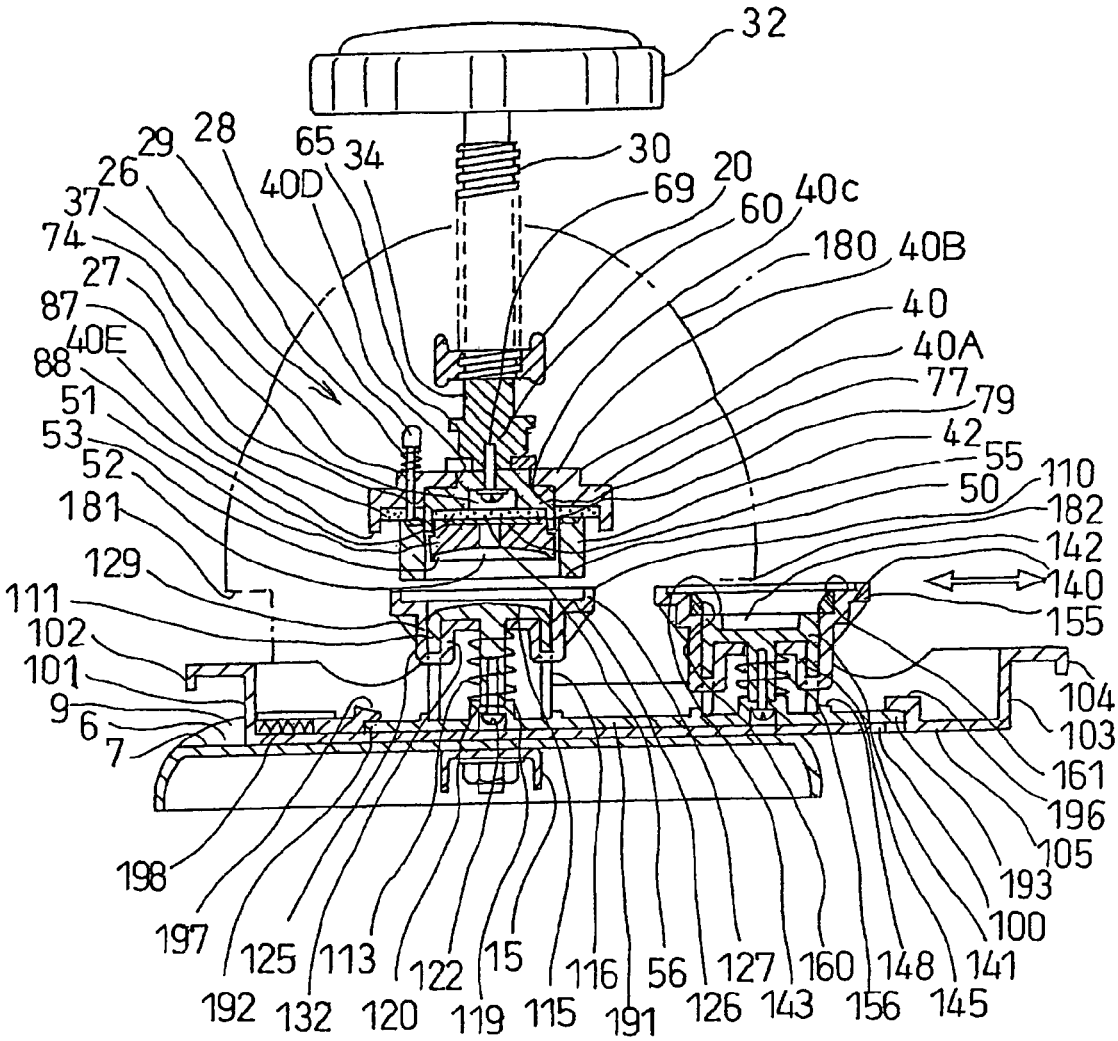
FIG. 4 is an overall cross sectional side view of FIG. 1.
Figure 5:
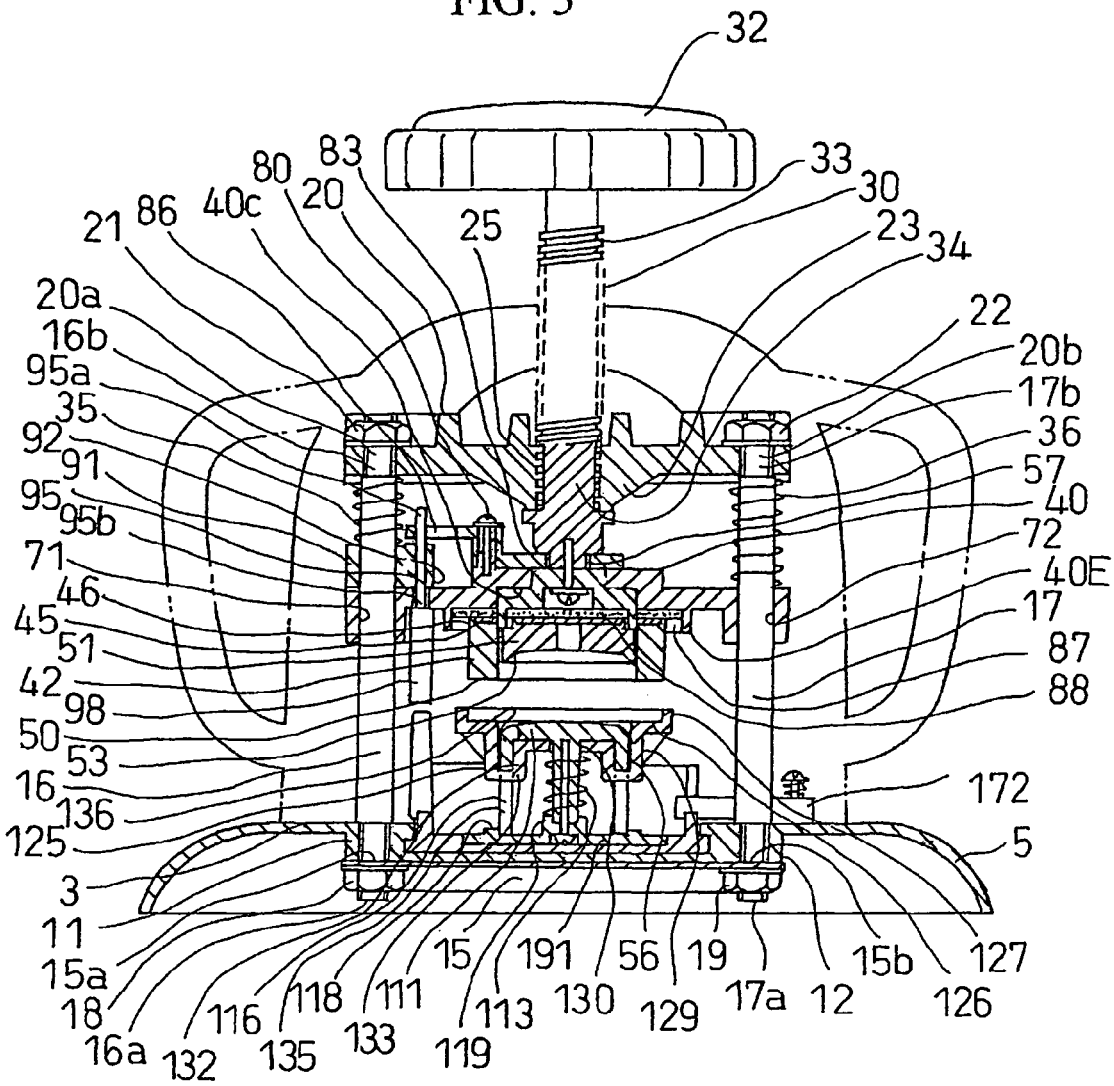
FIG. 5 is an overall front elevation cross sectional view showing a first pressed mold.
Figure 6:
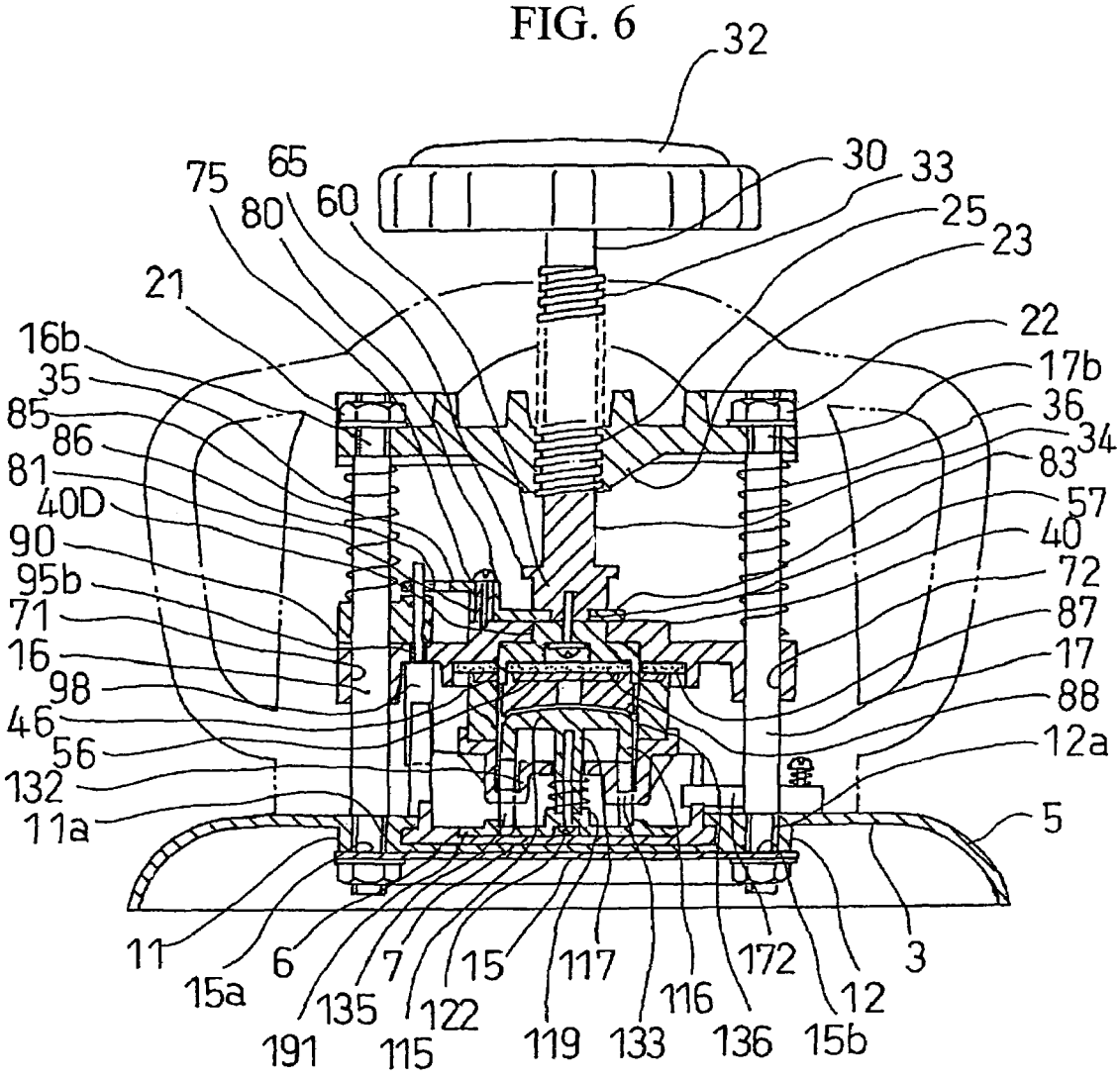
FIG. 6 is an overall front elevation cross sectional view describing the movement in FIG. 5.
Figure 7:
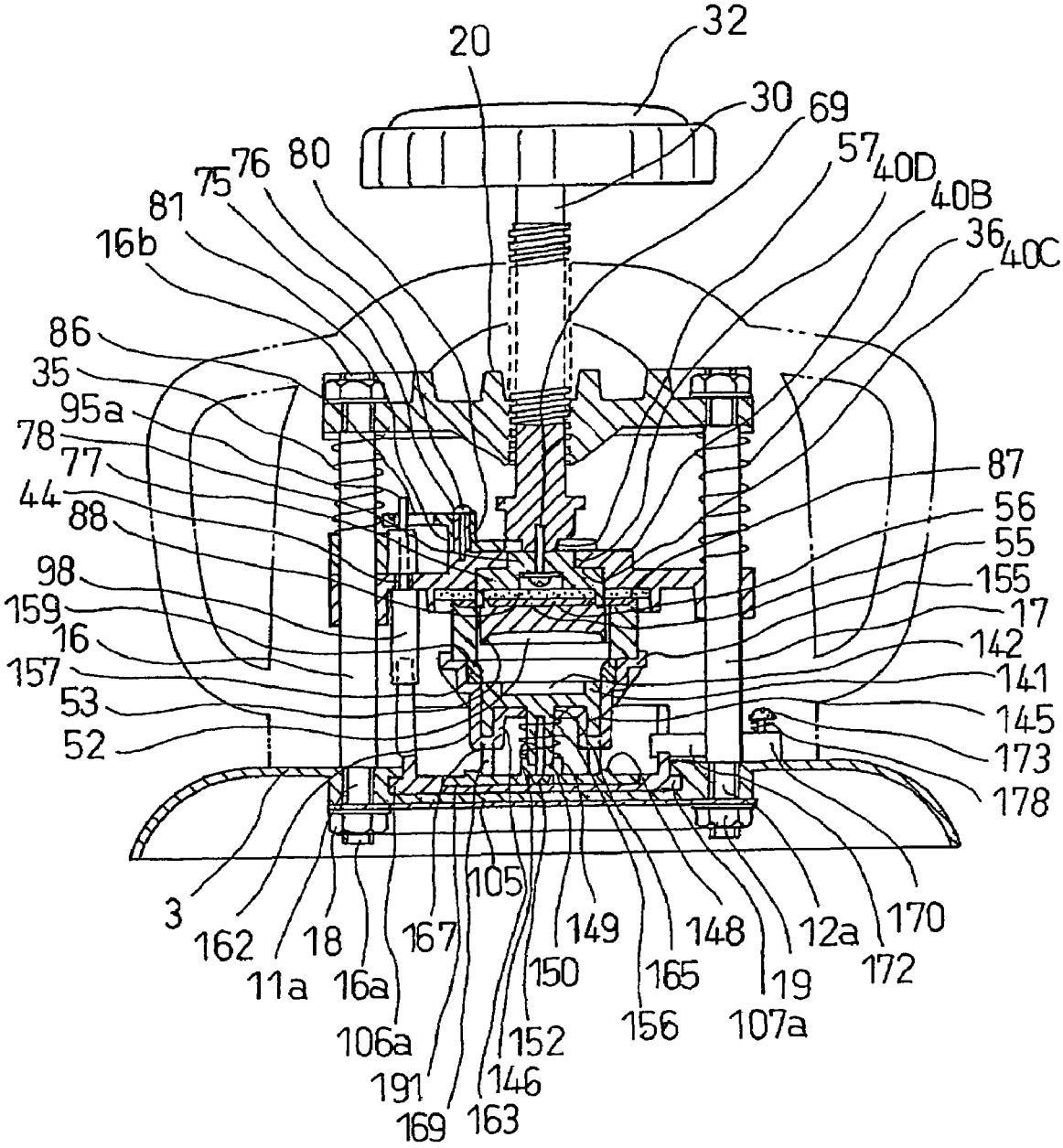
FIG. 7 is an overall front elevation cross sectional view showing a second pressed mold.
Figure 8:
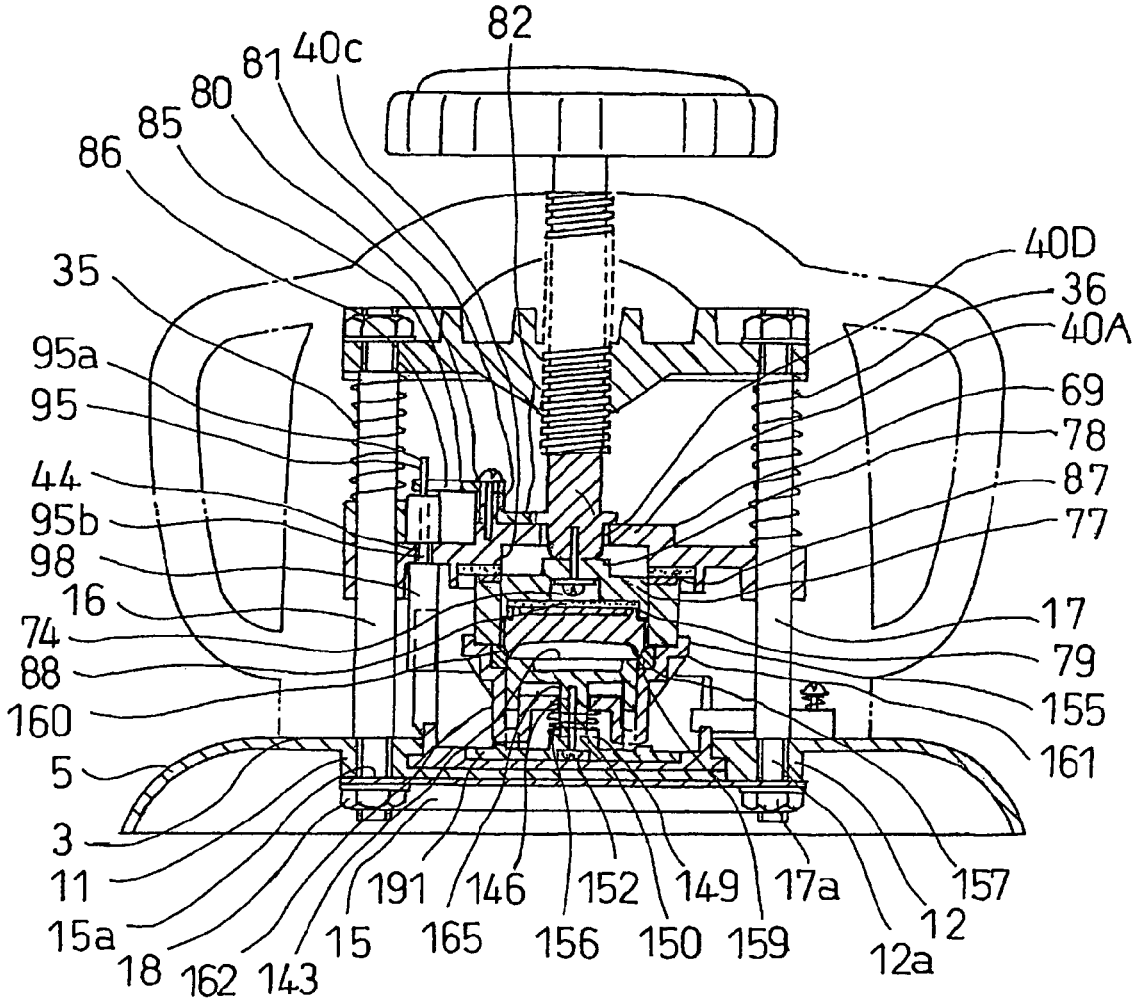
FIG. 8 is an overall front elevation cross sectional view describing the movement in FIG. 7.
Figure 9:
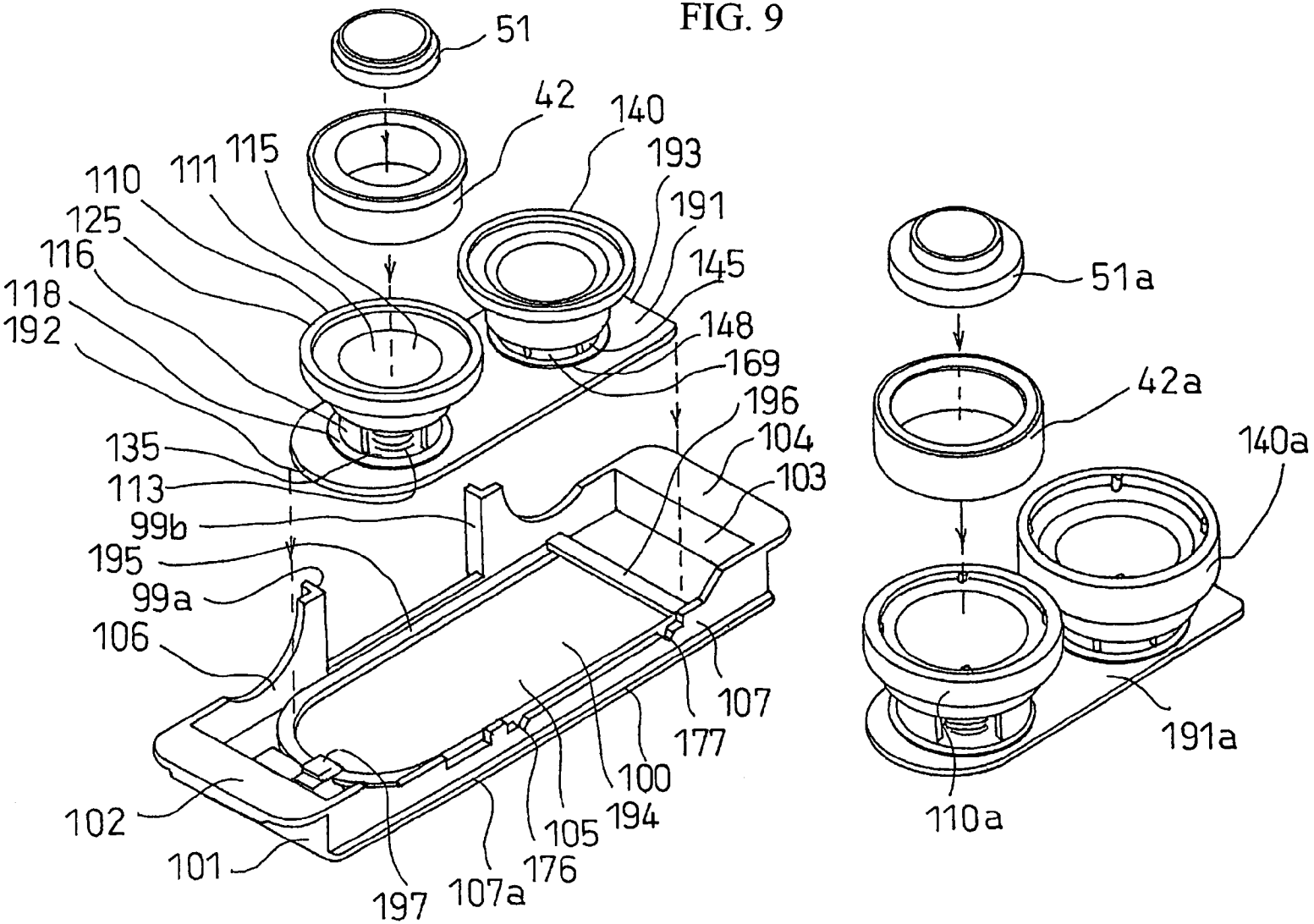
FIG. 9 is an enlarged perspective view showing the essential parts of a button making device.

One embodiment of a button making device of the present invention will now be described based on FIG. 1 to FIG. 9. FIG. 1 is an overall perspective view showing a button making device of the present invention. FIG. 2 is an overall perspective view describing the movement in FIG. 1. FIG. 3 is an overall plan view describing the movement in FIG. 1. FIG. 4 is an overall side cross sectional view of FIG. 1. FIG. 5 is an overall front elevation cross sectional view showing a first pressed mold. FIG. 6 is an overall front elevation cross sectional view describing the movement in FIG. 5. FIG. 7 is an overall front elevation cross sectional view showing a second pressed mold. FIG. 8 is an overall front elevation cross sectional view describing the movement in FIG. 7. FIG. 9 is an enlarged perspective view showing essential parts of a button making device.

The button making device 1 makes a button 200 comprising a front cover 201 having a substantially circular front surface plate 202 and a peripheral edge 203 extending further down than the front surface plate 202, and a rear cover 205 having a substantially circular rear surface plate 206 and a peripheral edge 209 extending further up than the rear surface plate 206, with the front cover 201 engaged with the rear cover 205 so that the peripheral edge 209 of the rear cover 205 and the peripheral edge 203 of the front cover 201 come into contact.

The button making device 1 comprises a base 2, a sliding platform 100 provided on an upper surface of the base 2 capable of reciprocating, first and second pressed molds 110, 140 arranged at either side in the direction of reciprocation of the sliding platform 100, a fixed member 20 fixed on an upper part of the base 2 via struts 16, 17, a pressing shaft 30 provided on the fixed member 20 capable of movement in the vertical direction, a pressing mold 40 provided on a lower end of the pressing shaft 30 for making a button 200 by being brought into contact with the first pressed mold (first front cover mounting mold) 110 and the second pressed mold (first rear cover mounting mold) 140, and an operation means 32 for operating the pressing shaft 30. The first pressed mold (first front cover mounting mold) 110 and the second pressed mold (first rear cover mounting mold) 140 are provided on an attachment member 191 removably attached to the sliding platform 100. The pressing mold 40 is removably attached to the lower end of the pressing shaft 30 by magnetic force.

The button making device 1 forms a button 200 by placing a sheet body 213 on the front surface plate 202 of the front cover 201, and fitting the front cover 201 into the rear cover 205 so that the edge of the sheet body 213 is gripped between the peripheral edge 209 of the rear cover 205 and the peripheral edge 203 of the front cover 201.

The first pressed mold (first front cover mounting mold) 110 comprises a first mounting platform 111 for mounting the front cover 201, and a guide platform 125 provided at the periphery of the first mounting platform 111 for mounting a sheet body 213. The guide platform 125 is provided so as to be capable of upward and downward movement and is pressed upwards by an elastic member 113. The second pressed mold (first rear cover mounting mold) 140 comprises a second mounting platform 141 for mounting the rear cover 205, and a processing platform 155 provided around the second mounting platform 141 for folding a peripheral edge 203 of the front cover 201 towards the peripheral edge 209 of the rear cover 205 so that the edge of the sheet body 213 is gripped by the peripheral edge 203 of the front cover 201 and the peripheral edge 209 of the rear cover 205. The processing platform 155 is capable of upward and downward movement and is pressed upwards by an elastic member 156.

The pressing mold 40 comprises a pressing mold body 40A, an outer layer frame 42, and an inner layer frame 51 that is shallower than the outer layer frame 42 and is provided inside the outer layer frame 42. The outer layer frame 42 and the inner layer frame 51 are removably attached to the pressing mold body 40A by magnetic force. The pressing mold body 40A has a detachment means 26, for causing the outer layer frame 42 and inner layer frame 51 that are attached by magnetic force to be detached against the magnetic force. The pressing mold body 40A also has a switching member 80, for switching the timing at which the outer layer frame 42 and inner layer frame 51 respectively begin to move downwards, when the pressing shaft 30 begins to move downwards, depending on the position of the first pressed mold (first front cover mounting mold) 110 and the second pressed mold (first rear cover mounting mold) 140. That is, when the first pressed mold (first front cover mounting mold) 110 is positioned substantially directly below the pressing mold 40, the switching member 80 causes the outer layer frame 42 and the inner layer frame 51 to move downwards at the same time accompanying downward movement of the pressing shaft 30.

When the sliding platform 100 moves and the second pressed mold (first rear cover mounting mold) 140 is positioned substantially directly below the pressing mold 40, the switching member 80 first of all causes only the inner layer frame 51 to move downwards accompanying downward movement of the pressing shaft 30. After the pressing shaft 30 has been moved down by a specified distance, the switching member 80 allows the outer layer frame 42 to move. In this way, if the operation means 32 is operated to move the pressing shaft 30 downwards when the first pressed mold (first front cover mounting mold) 110 is positioned substantially directly below the pressing mold 40, the outer layer frame 42 and the inner layer frame 51 begin to move downwards simultaneously. The outer layer frame 42 then comes into contact with the guide platform 125 of the first pressed mold (first front cover mounting mold) 110 so that the guide platform 125 is pressed down against the resilience of the elastic member 113, and the sheet body 213 is folded along the peripheral edge 203 of the front cover 201.

Also, if the operation means 32 is operated to cause the pressing shaft 30 to move downwards when the second pressed mold (first rear cover mounting mold) 140 is positioned substantially directly below the pressing mold 40, first of all the inner layer frame 51 begins to move downwards. After the pressing shaft 30 has moved downwards for a specified distance, the outer layer frame 42 then begins to move. If the pressing shaft 30 is caused to move further downwards, the outer layer frame 42 and the inner layer frame 51 both come into contact with the processing platform 155 of the second pressed mold (first rear cover mounting mold) 140 to press the processing platform 155 down against the resilience of the elastic member 156. The peripheral edge 203 of the front cover 201 is then folded towards the peripheral edge 209 of the rear cover 205 so that the edge of the sheet body 213 is gripped between the peripheral edge 203 of the front cover 201 and the peripheral edge 209 of the rear cover 205.

The sheet body 213 described above is formed of a transparent material, and it is possible to place a design sheet 211 printed with a representation of characters, a pattern, a design, or any combination of these, between the sheet body 213 and the surface plate 202 of the front cover 201.

The pressing shaft 30 described above has a male threaded section 33 capable of moving in an axial direction by being screwed into a female threaded section 25 provided on the fixed member 20, the pressing mold 40 rotatably provided on a lower end, and an operating handle 32 provided on an upper part as operation means. The male threaded section 33 is configured so that before the pressing mold 40 comes into contact with the fixed member 20 as a result of upwards movement of the pressing shaft 30, it is separated from the female threaded section 25 of the fixed member 20, and the pressing shaft 30 slackens off.

Figure 10:
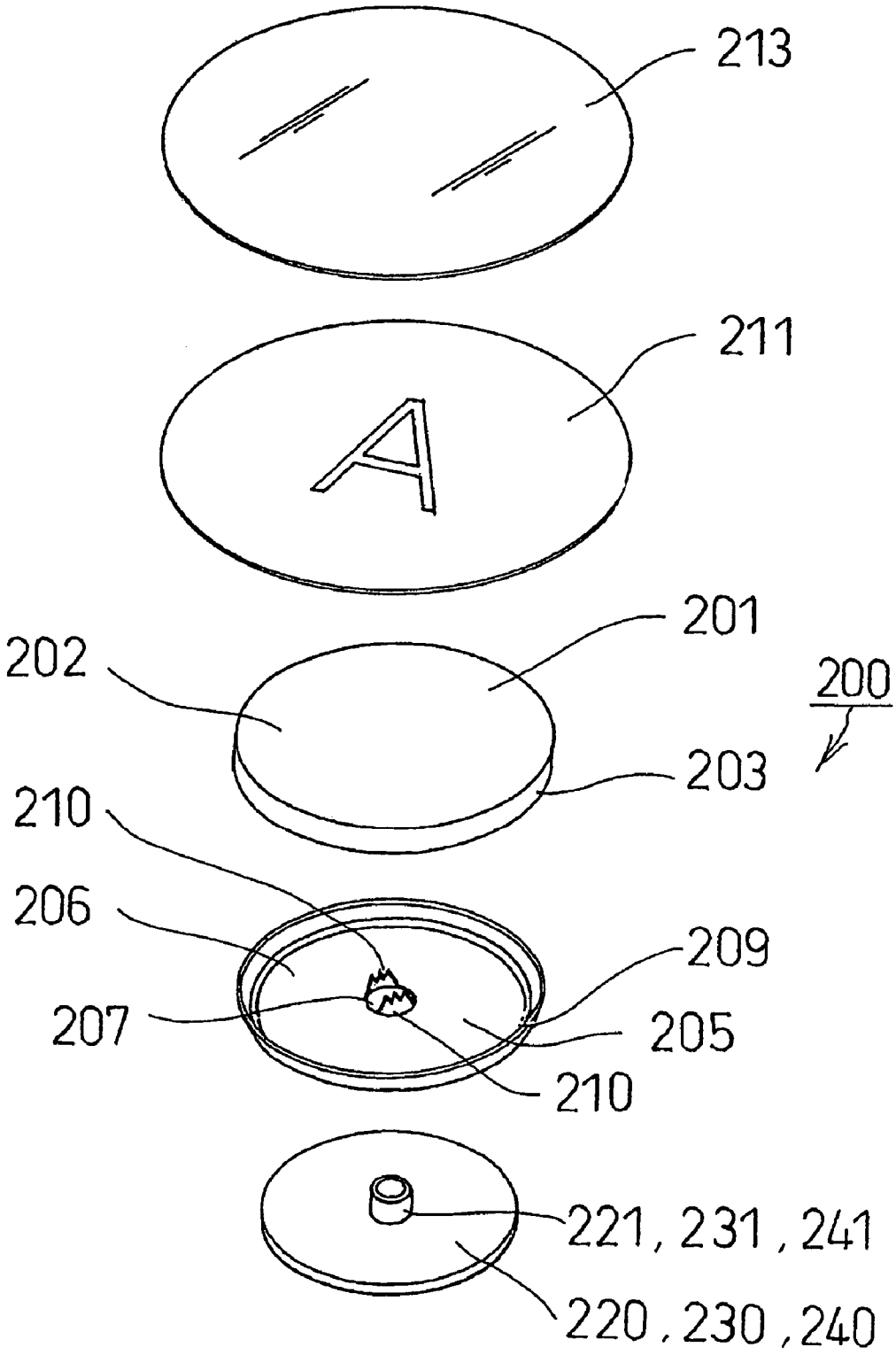
FIG. 10 is an overall exploded view showing a button of the present invention.
Figure 11:
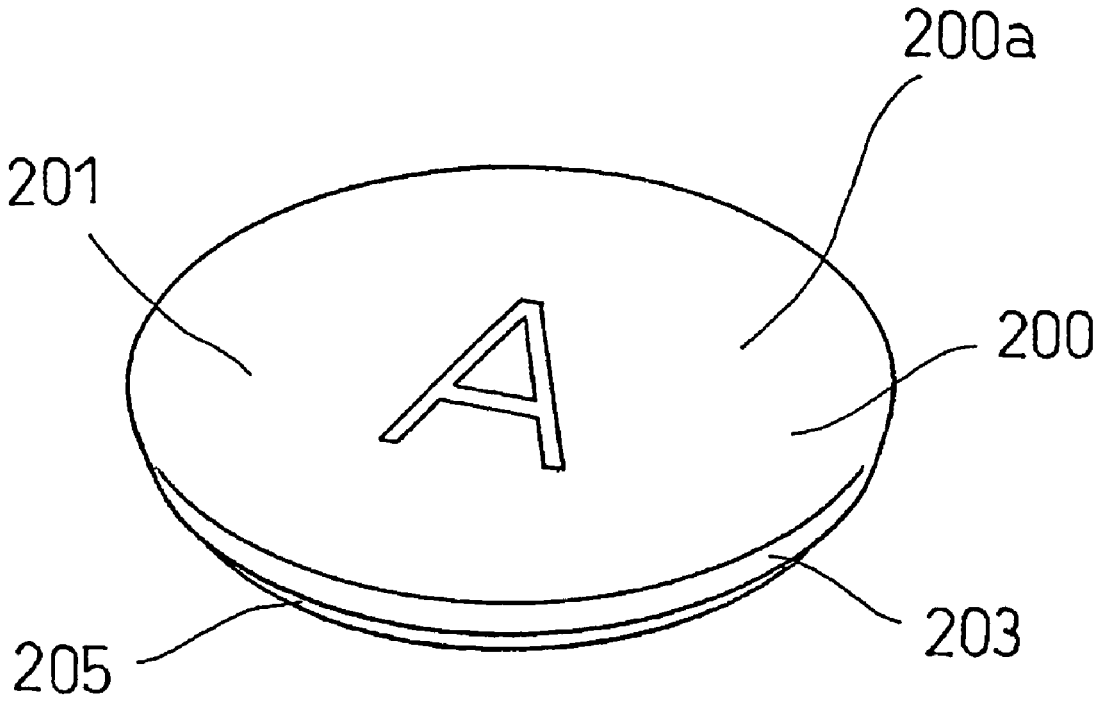
FIG. 11 is an overall perspective view of FIG. 10 assembled.
Figure 12:
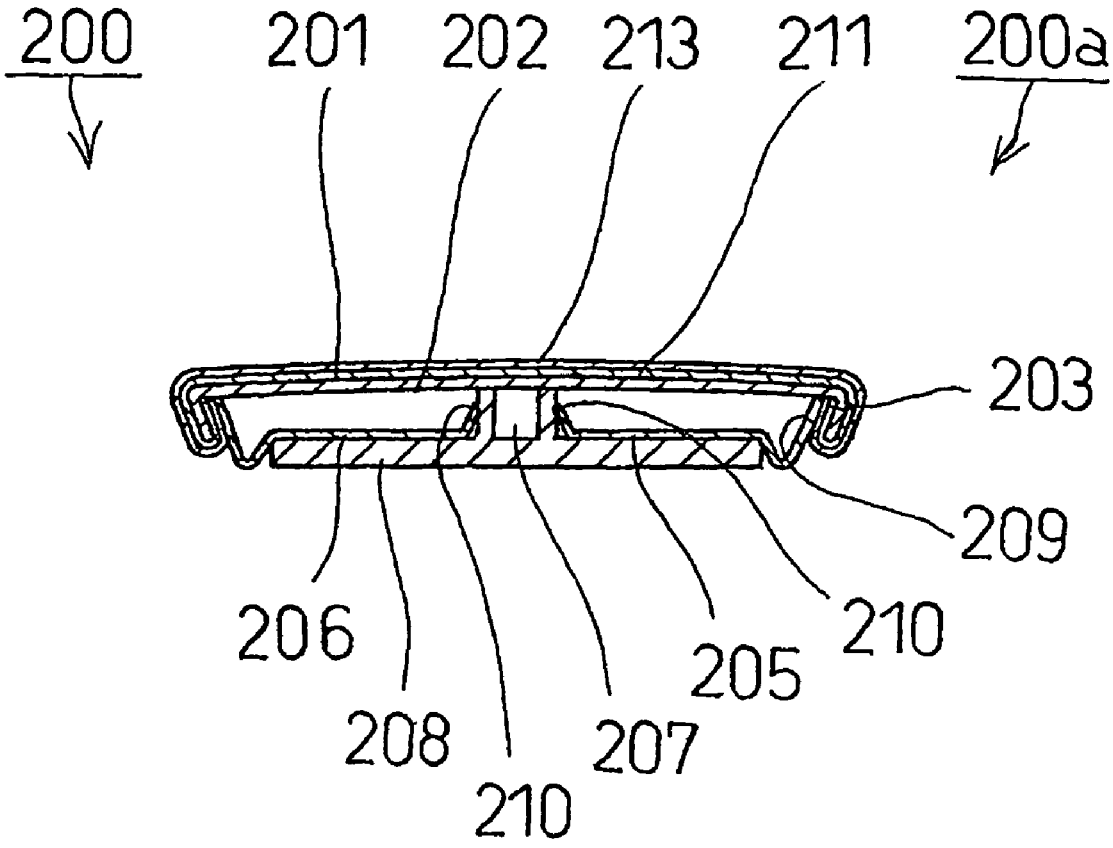
FIG. 12 is a side cross sectional view of FIG. 11.
Figure 13:
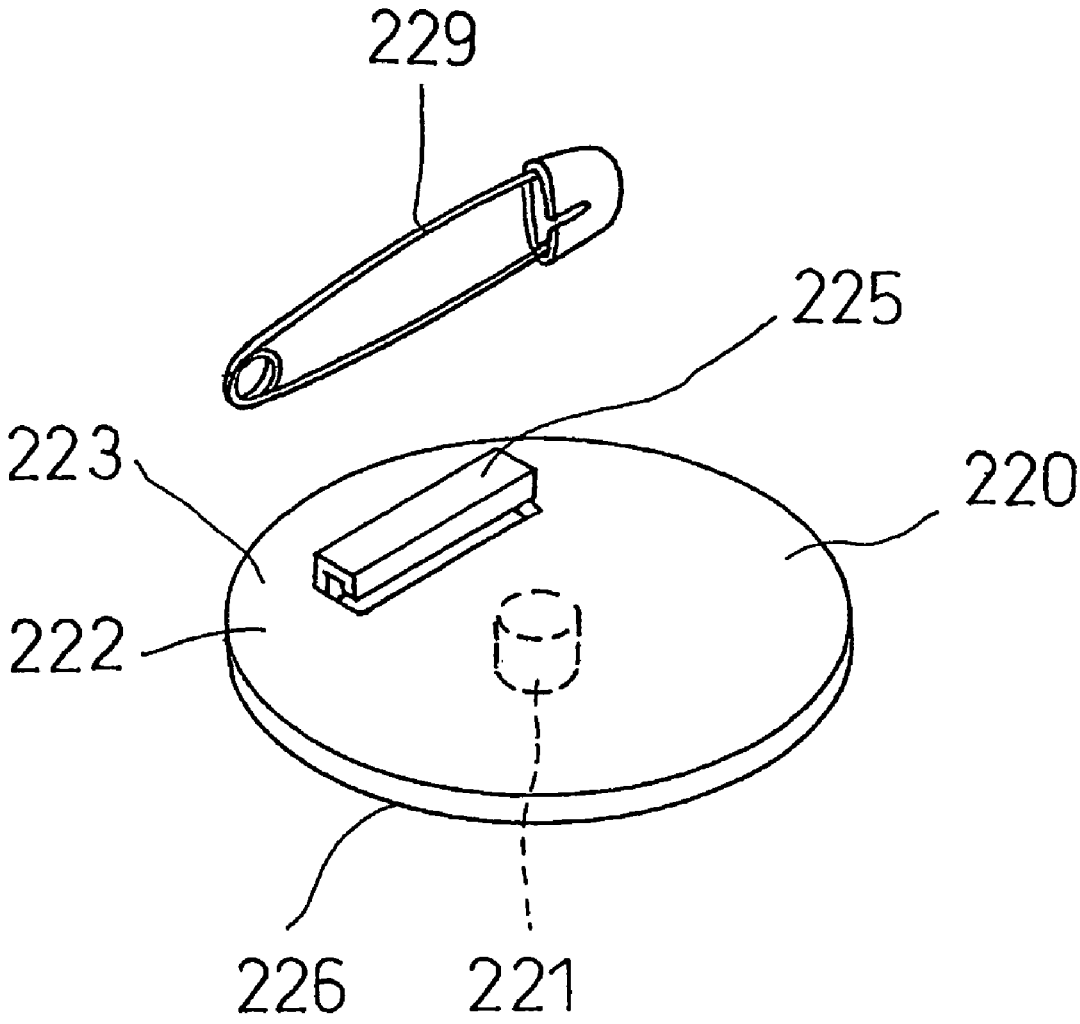
FIG. 13 is a perspective view showing one embodiment of a mounting means of the present invention.
Figure 14:
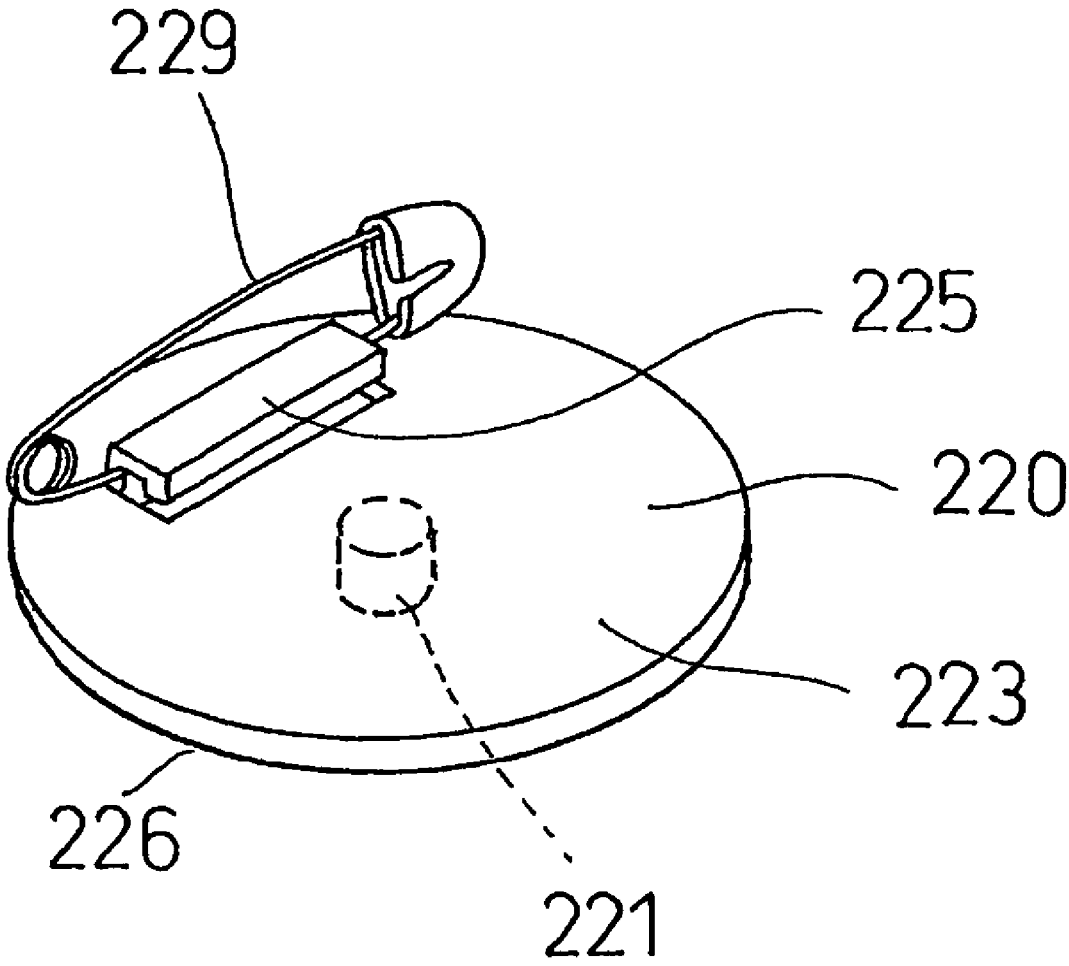
FIG. 14 is a perspective view showing the state where a detachable pin is attached to the mounting means of FIG. 13.
Figure 15:
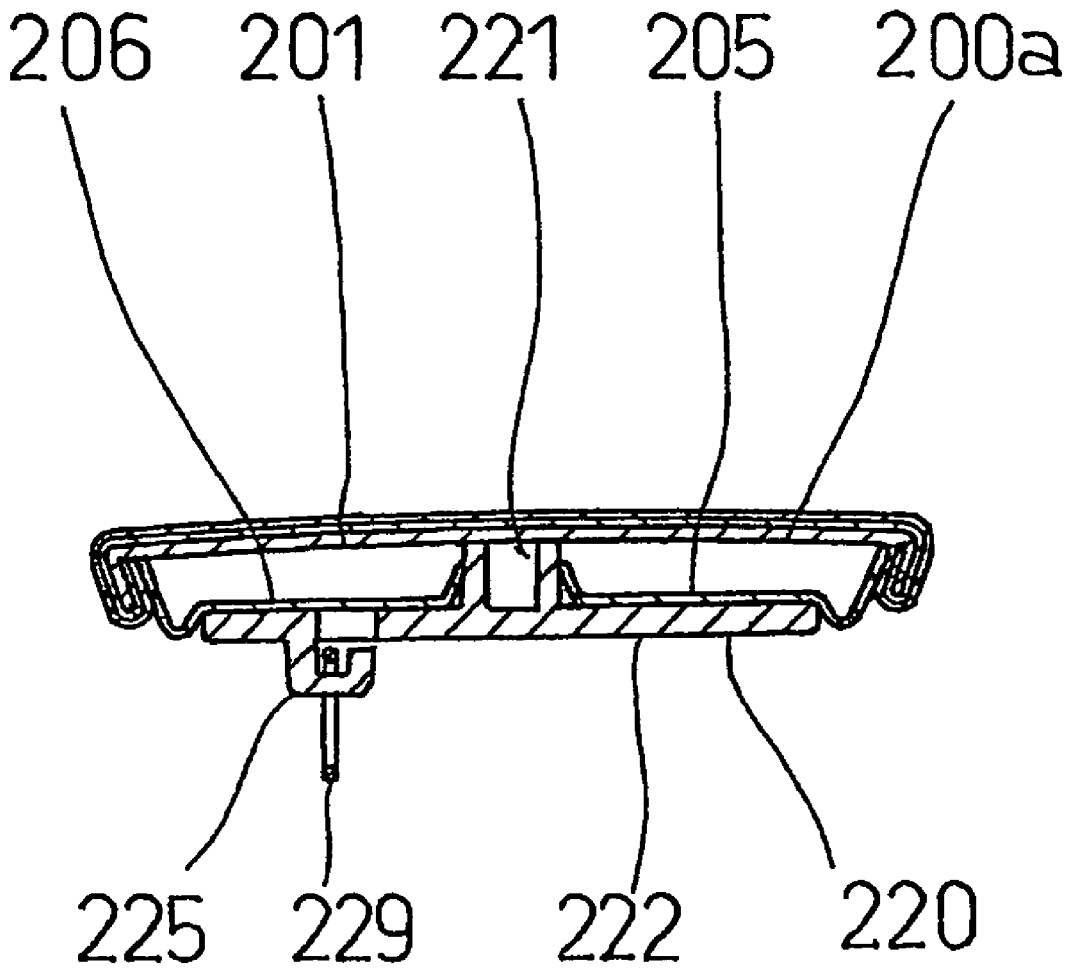
FIG. 15 is a side cross sectional view of a whole button with the mounting means of FIG. 14 attached to a rear cover.
Figure 16:
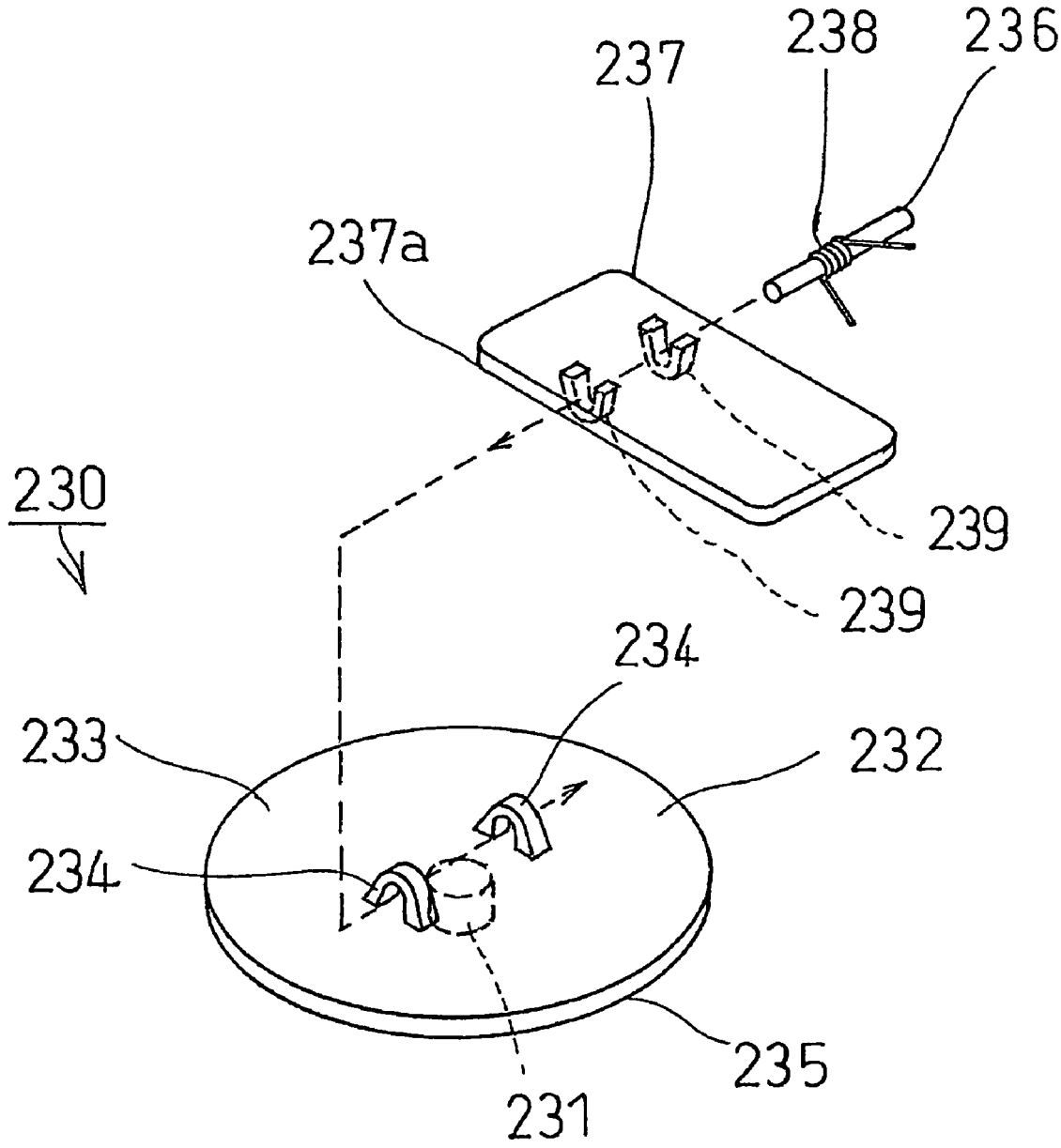
FIG. 16 is a perspective view showing another embodiment of the mounting means of the present invention.
Figure 17:
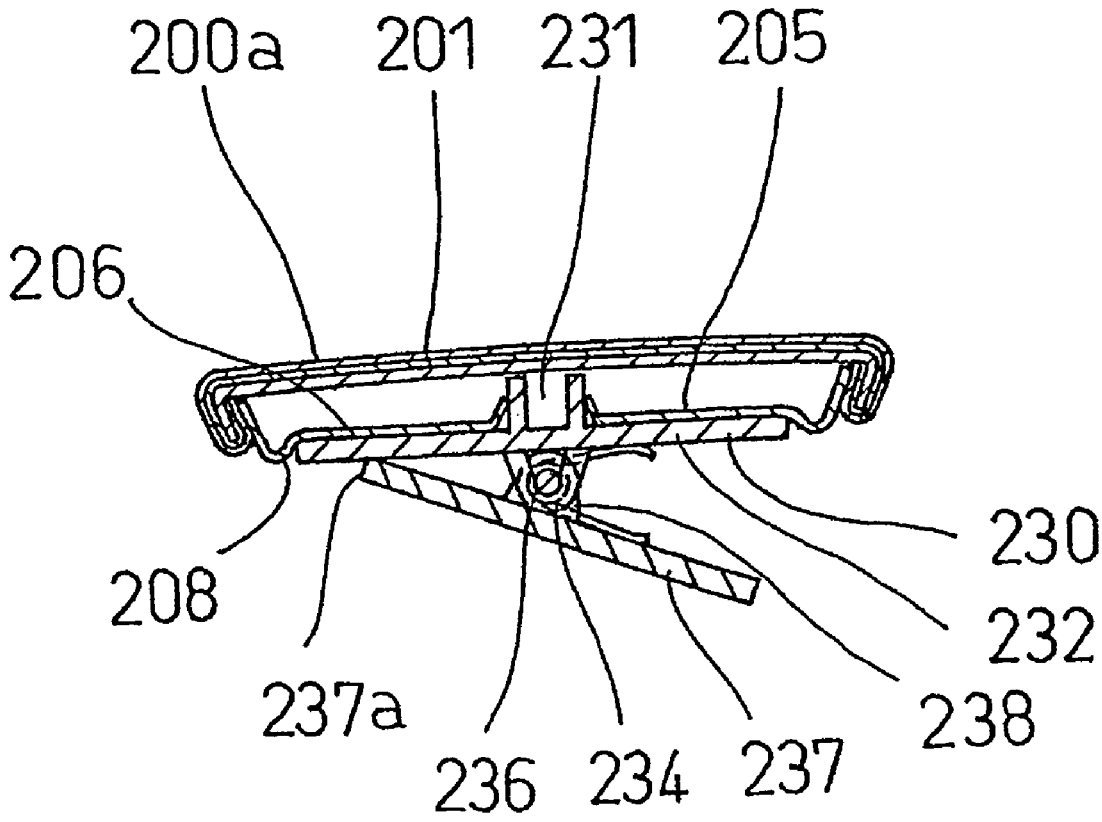
FIG. 17 is an overall side cross sectional view of a button with the mounting means of FIG. 16 having gripping plates attached to a rear cover.
Figure 18:
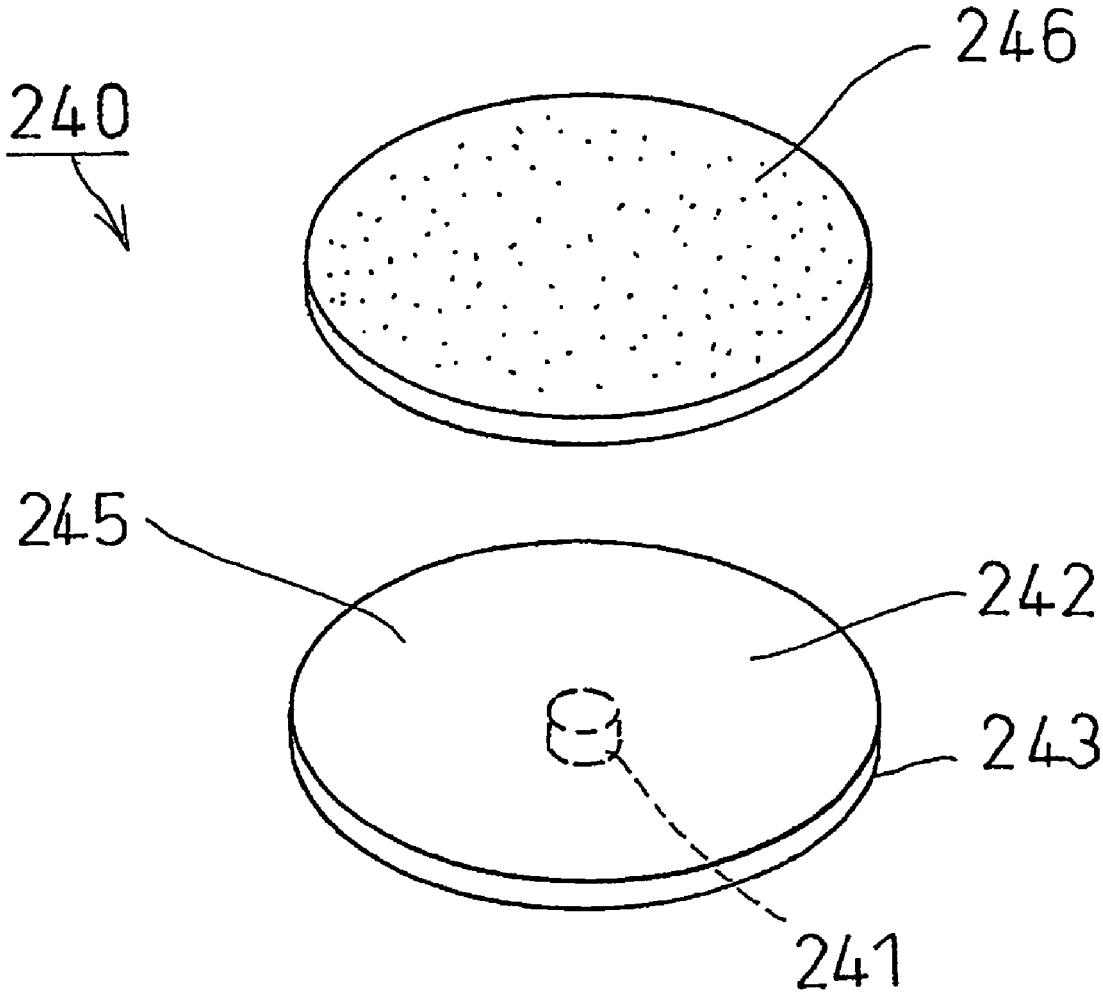
FIG. 18 is a perspective view showing another embodiment of a mounting means of the present invention.
Figure 19:
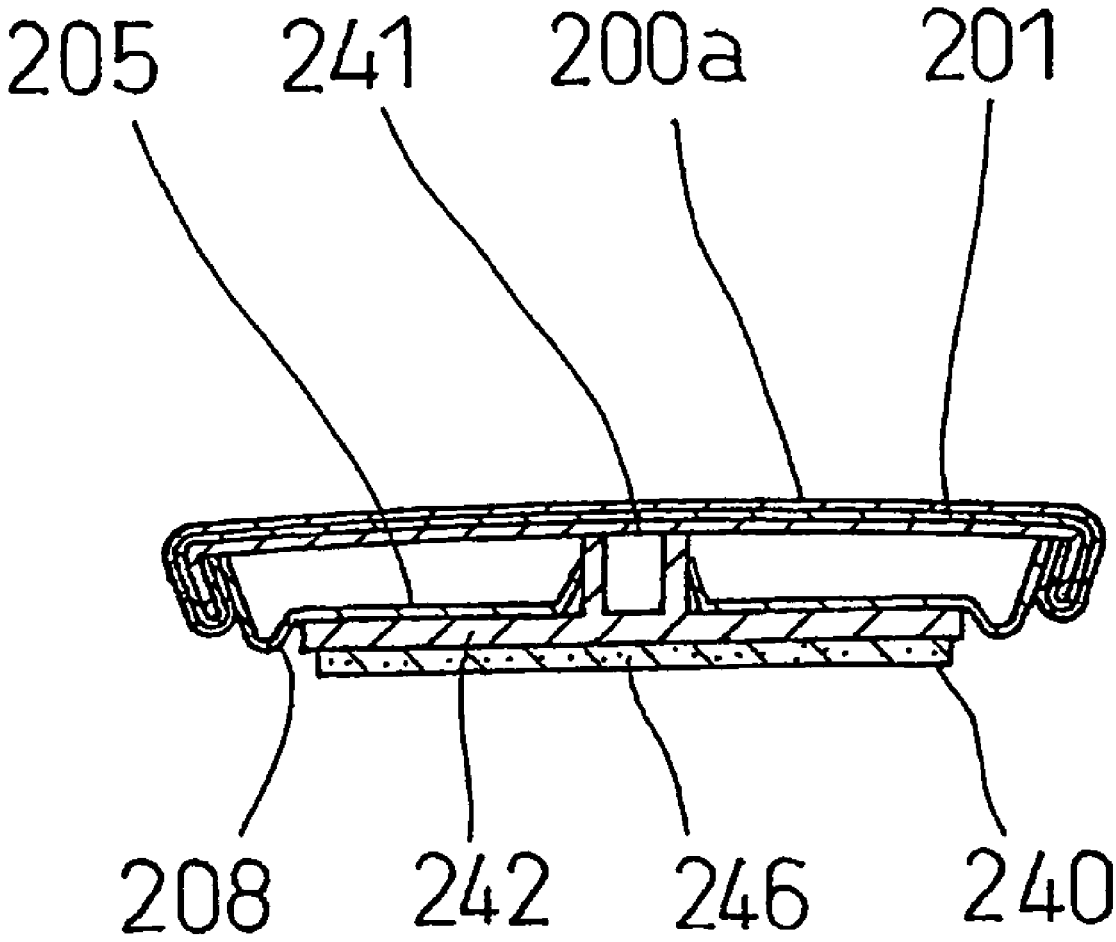
FIG. 19 is an overall side cross sectional view of a button with the mounting means of FIG. 18 having a magnetic plate attached to a rear cover.

The button making device 1 will be described in more detail later, but now detailed description of an embodiment of the button will be given based on FIG. 10 to FIG. 19. FIG. 10 is an overall exploded view showing a button of the present invention. FIG. 11 is an overall perspective view of FIG. 10 assembled. FIG. 12 is a side cross sectional view of FIG. 11. FIG. 13 is a perspective view showing one embodiment of the mounting means of the present invention. FIG. 14 is a perspective view showing a state where a detachable pin is attached to the mounting means of FIG. 13. FIG. 15 is a side cross sectional view of a whole button with the mounting means of FIG. 14 attached to a rear cover. FIG. 16 is a perspective view showing another embodiment of the mounting means of the present invention. FIG. 17 is an overall side cross sectional view of a button with the mounting means of FIG. 16 having gripping plates attached to a rear cover. FIG. 18 is a perspective view showing another embodiment of the mounting means of the present invention. FIG. 19 is an overall side cross sectional view of a button with the mounting means of FIG. 18 having a magnetic plate attached to a rear cover.

The button 200 comprises a rear cover 205 having a peripheral edge 209 facing upwards, a front cover 201 having a peripheral edge 203 facing downwards, and a mounting means 220. The rear cover 205 is attached to the front cover 201 by folding the peripheral edge 203 of the front cover 201, and has an attachment hole 207 formed in a substantially central part. The mounting means. 220, 230, 240 can be mounted on an item, such as a clothing, a hat or a bag, and are provided with attachment shafts 221, 231, 241 for rotatably attaching to the attachment hole 207 of the rear cover 205.

The button will now be described. The button 200 comprises the body 200*a* and the mounting means 220, as shown in FIG. 11. The button body 200*a* comprises the front cover 201, the rear cover 205, the design sheet 211, and a sheet body 213. Before processing, the front cover 201 has a curved front plate 202, and the peripheral edge 203 is bent substantially at a right angle to face downwards with respect to the front plate 202. Before processing, the rear cover 205 has the rear plate 206 formed with an attachment hole 207 for attaching the mounting means 220, the peripheral edge 209 bent almost at a right angle to face upwards with respect to the rear surface plate 206, and a circular indent 208 formed in the rear surface plate 206.

The design sheet 211 is a circular piece of paper, and can be a cut-out from a magazine or the like. The sheet body 213 is formed of thin transparent synthetic resin. It is also possible to print the representation of characters, a design, a pattern or a combination of these, directly on the sheet body 213. In that case, there may not be a design sheet. The button body 200*a* is made by overlapping the design sheet 211 and the sheet body 213 on an upper surface of the front cover 201, and bending the peripheral edge 203 of the front cover 201 so that the peripheries of the design sheet 211 and the sheet body 213 are gripped between the peripheral edge 203 of the front cover 201 and the peripheral edge 209 of the rear cover 205. A pair of latch claws 210, 210 are formed in a protruding manner on an outer edge of the attachment hole 207 facing inwards.

As shown in FIG. 13 to FIG. 15, the mounting means 220 comprises a base plate 222, a substantially L-shaped engagement section 225 formed on the surface 223 of the base plate 222, and an attachment shaft 221 formed in a protruding manner at a substantially central part of the rear surface 226 of the base plate 222, and is integrally formed using synthetic resin. The mounting means 220 has a detachable pin 229 attached to the engagement section 225, and the attachment shaft 221 is fitted into the attachment hole 207 of the rear cover 205 so as to engage with an indent 208 of the rear cover 205. If the attachment shaft 221 is fitted into the attachment hole 207, it engages with the latch claws 210, 210 formed at the edge of the attachment hole 207.

As shown in FIG. 16 and FIG. 17, the mounting means 230 comprises a base plate 232, a pair of substantially U-shaped bearing pieces 234, 234 formed substantially in the middle of the front surface 233 of the base plate 232, and an attachment shaft 231 formed in a protruding manner at a substantially central part of the rear surface 235 of the base plate 232, and is integrally formed using synthetic resin. The mounting means 230 has a gripping plate 237 rotatably attached between the pair of bearing pieces 234, 234 via a strut 236, and one end 237*a* of the gripping plate 237 is pressed against the rear surface 235 of the base plate 232 by a elastic member 238 such as a spring.

Specifically, the gripping plate 237 has a pair of substantially U-shaped bearing pieces 239, 239 interposed between the pair of bearing pieces 234, 234, the strut 236 fitted between the pair of bearing pieces 234, 234 and the pair of bearing pieces 239, 239 to rotatably attach the gripping plate 237 to the base plate 232. The attachment shaft 231 is fitted into the attachment hole 207 of the rear cover 205 so as to engage with the indent 208 of the rear cover 205. If the attachment shaft 231 is fitted into the attachment hole 207, it engages with the latch claws 210, 210 formed at the edge of the attachment hole 207.

As shown in FIG. 18 and FIG. 19, the mounting means 240 comprises a base plate 242, and an attachment shaft 241 formed projecting out in a substantially central part of the rear surface 243 of the base plate 242, and is integrally formed of synthetic resin. The mounting means 240 has a magnetic plate 246 attached to the front surface 245 of the base plate 242 using adhesive, and the attachment shaft 241 is fitted into the attachment hole 207 of the rear cover 205 so as to engage with the indent 208 of the rear cover 205. If the attachment shaft 241 is fitted into the attachment hole 207, it latches with the latch claws 210, 210 formed at the edge of the attachment hole 207.

The button making device 1 will now be described. The base 2 is integrally formed using synthetic resin and comprises an upper wall 3 and a peripheral wall 5 formed in a curved fashion at the peripheral edge of the upper wall 3. The upper wall 3 has a substantially angular U-shaped guide groove 6 extending in a front to rear direction. The guide groove 6 has a bottom wall 7 and side walls 9 and 10, with guide projections 9*a* and 10*a* formed on upper parts of the side walls 9 and 10. Also, bosses 11 and 12 having substantially the same height as the bottom wall 7 of the guide groove 6 are formed at a substantially central part of the upper wall 3 of the base 2, on either side at a right angle to the guide groove 6 (lateral direction), sandwiching the guide groove 6. Bosses 11 and 12 have through holes 11*a* and 12*a* extending to the upper wall 3.

A reinforcement member 15 having a substantially angular U-shaped cross section is formed in the bottom wall 7 of the guide groove 6 of the base 2 at a right angle to the guide groove 6 (lateral direction). This reinforcement member 15 is made of steel material. The reinforcement member 15 contacts the bosses 11 and 12, and holes 15*a* and 15*b* are formed on either side at positions that are the same as the through holes 11*a* and 12*a* of the bosses 11 and 12. Struts 16 and 17 having a substantially circular cross section are erected on the base 2. The struts 16 and 17 are made of steel material.

One strut 16 has a male threaded section 16*a* formed on a lower part, which is inserted into the through hole 11*a* of the boss 11 and a hole 15*a* of the reinforcement member 15 and is fastened using a nut 18. One strut 16 is thus fixed substantially perpendicularly to the boss 11 and the reinforcement member 15. The other strut 17 has a male threaded section 17*a* formed on a lower part, which is inserted into the through hole 12*a* of the boss 12 and a hole 15*b* of the reinforcement member 15 and is fastened using a nut 19. The other strut 17 is thus fixed substantially perpendicular to the boss 12 and the reinforcement member 15.

The fixed member 20 having a substantially H-shaped cross section is fixed substantially horizontally to an upper part of the base 2 via the struts 16 and 17. The fixed member 20 is integrally formed of hard synthetic resin having durability and abrasion resistance, such as polycarbonate. The one strut 16 has a male threaded section 16*b* formed on an upper part, which is inserted into a hole 20*a* formed in one end of the fixed member 20 and is fastened using a nut 21. The one strut 16 thus fixes the fixed member 20. The other strut 17 has a male threaded section 17*b* formed on an upper part, which is inserted into a hole 20*b* formed in the other end of the fixed member 20 and is fastened using a nut 22. The other strut 17 thus fixes the fixed member 20.

The fixed member 20 has an inverse triangle-shaped thickened section 23 formed substantially in the middle, and a female threaded section 25 is formed in this thickened section 23. The pressing shaft 30 is integrally formed of hard synthetic resin having durability and abrasion resistance, such as polycarbonate. A male threaded section 33 is formed capable of moving in the axial direction by being screwed into a female threaded section 25 provided on the fixed member 20. The pressing mold 40 is rotatably attached to the lower end of the pressing shaft 30, and an operating handle 32 is provided on an upper section of the pressing shaft 30 as operation means.

As shown in FIG. 5, the male threaded section 33 is formed so that before the pressing mold 40 comes into contact with the fixed member 20 as a result of upwards movement of the pressing shaft 30, it is separated from the male threaded section 33 of the fixed member 20 and the pressing shaft 30 slackens off. That is, a non-threaded section 34 where the male threaded section 33 is not formed is provided on a lower part of the pressing shaft 30. The operating handle 32 has a rectangular attachment hole formed substantially in the middle, and this attachment hole engages with a rectangular shaft formed on an upper part of the pressing shaft 30 to attach to an upper part of the pressing shaft 30.

The pressing shaft 30 has a pressing mold 40 for engaging with a first pressed mold (first front cover mounting mold) 110 or a second pressed mold (first rear cover mounting mold) 140, which will be described later, on a lower end. The pressing mold 40 comprises a pressing mold body 40A, and an outer layer frame 42, and an inner layer frame 51. The pressing mold body 40A has a plate shaped vertically movable member 41. This vertically movable member 41 has a substantially circular projection 40B formed substantially in the middle on an upper surface, and a substantially circular indent 40C formed substantially in the middle on a lower surface.

The vertically movable member 41 also has an opening 40D linking the substantial center of the circular projection 40B and the substantial center of the circular indent 40C formed substantially in the center. An annular guide wall 40E is also formed projecting out on a lower surface of the vertically movable member 41, with the center of the circular indent 40C as a substantial center. An annular magnetic body 87 is attached to the inside of the annular guide wall 40E, at the lower surface of the vertically movable member 41. This magnetic body 87 is formed using a magnetic member, such as a magnet or magnetic rubber.

The pressing shaft 30 has a pressing section 60 formed on a lower part of the non-threaded section 34. The pressing section 60 is formed having almost the same diameter as the opening 40D, so that it can pass through the opening 40D. That is, by passing the pressing section 60 through the opening 40D, the pressing shaft 30 becomes capable of moving vertically relative to the pressing mold body 40A. Also, if the pressing shaft 30 moves down and the pressing section 60 passes through the opening 40D until a flange section 65 formed on an upper part of the non-threaded section 34 comes into contact with the edge of the opening 40D, the pressing shaft 30 can no longer move any further downwards relative to the pressing mold body 40A. So the pressing shaft 30 and the pressing mold body 40A move downwards together. An engagement indent 57 is provided by forming the lower part of the pressing section 60 as a cylinder having a slightly smaller radius than the radius of the pressing shaft 30.

A mounting member 77 is rotatably attached to the lower end of the pressing shaft 30, that is, the end section of the cylindrical engagement indent 57 provided on the lower part of the pressing section 60, using screws. The mounting member 77 is provided on the circular indent 40C of the pressing mold body 40A so that it can be fitted together and pulled apart, with a circular projection 78 formed on an upper surface, and an annular guide projection 79 formed on the lower surface edge. The circular projection 78 is formed to have almost the same diameter as the opening 40D, capable of passing through the opening 40D. Accordingly, when the mounting member 77 moves downwards together with the pressing shaft 30 and the pressing section 60 of the pressing shaft 30 has passed through the opening 40D, it can move relatively downwards from the pressing mold body 40A by the extent to which it has passed through the opening 40D. Also, the mounting member 77 has an indent 74 formed in a substantially lower middle section, and the heads of the screws 69 are housed inside this indent 74. A circular plate-shaped magnetic body 88 is attached inside the annular guide projection 79, at the lower surface of the mounting member 77. This magnetic body 88 is formed using a magnetic member such as a magnet or magnetic rubber.

The outer layer frame 42 is formed in a ring shape, with a lower end forming an annular pressing section 50, has a storage indent 45 formed on the upper surface, and has a magnetic body 46 formed of a ferromagnetic material such as iron attached inside the storage indent 45. The outer layer frame 42 is guided in the guide projection 79 of the mounting member 77, and is attached to the annular magnetic body 87 attached to the lower surface of the pressing mold body 40A by magnetic force of the magnetic body 46. The magnetic body 87 can be a ferromagnetic material such as iron, and the magnetic body 46 can be a magnetic member such as a magnet or magnetic rubber.

The inner layer frame 51 is provided inside the outer layer frame 42, and is shallower than the outer layer frame 42. The inner layer frame 51 has a curved section 52 formed on a lower surface, and a contact edge 53 for contacting the peripheral edge 203 of the front cover 201 of the button formed on the edge of the curved section 52, which will be described later. A storage indent 55 is formed on the upper surface of the inner layer frame 51, and the magnetic body 56, which is made of a ferromagnetic material such as iron, is attached inside the storage indent 55. The inner layer frame 51 is attached to the magnetic body 88 attached to the lower surface of the mounting member 77 by magnetic force of the magnetic body 56. The magnetic body 88 can be a ferromagnetic material such as iron, and the magnetic body 56 can be a magnetic member such as a magnet or magnetic rubber.

The vertically movable member 41 is formed in a plate shape and has guide holes 71 and 72 slidably guided in the struts 16 and 17 provided at the left and right ends, and is guided so as to be able to move up and down only by these guide holes 71 and 72. An indication plate for enabling confirmation of the positions of these guide holes is integrally formed on one end of the vertically movable member 41. The pressing mold 40 also has a switching member 80 for switching the timing at which the outer layer frame 42 and the inner layer frame 51 respectively start to move downwards when the pressing shaft 30 begins moving downwards in the axial direction, depending on the positions of the first pressed mold (first front cover mounting mold) 110 and the second pressed mold (first rear cover mounting mold) 140.

A bearing section 75 is formed in the pressing mold 40, namely the circular projection 40B of the vertically movable member 41, and the switching member 80 is rotatably attached to this bearing section 75 using a screw 76. The switching member 80 comprises a boss section 81 rotatably attached to the bearing section 75 using the screw 76, a first arm member 82 provided on the boss section 81, a semi-ring shaped engagement section 83 provided on the first arm member 82, capable of engaging with the engagement indent 57 of the pressing section 60, and a second arm member 85 provided at a position of the boss section 81 substantially opposite to the first arm member 82. An elongated hole shaped engagement groove 86 is formed in the second arm member 85.

A swing member 90 is provided on one strut 16 and capable of rocking freely so as to move up and down together with the pressing mold 40. The swing member 90 comprises a boss section 91 attached to the strut 16, an arm section 92 provided on one side of the boss section 91, and a spring mounting hook 93 provided on the other side of the boss section 91. An engagement shaft 95 is formed substantially vertically on the arm section 92. The engagement shaft 95 has an upper section 95*a* engaging with the engagement groove 86 of the switching member 80, with a lower part 95*b* projecting from an elongated hole 44 formed in the vertically movable member 41, and an engagement rod 98 is provided on the lower part 95*b*.

A spring mounting hook 96 is provided on a rear section of the vertically movable member 41. A spring 97 is placed between this spring mounting hook 96 and the spring mounting hook 93 of the swing member 90. The engagement section 83 of the switching member 80 is brought into contact with an engagement indent 57 of the pressing section 60 via the swing member 90 under resilience of this spring 97. Coil spring type elastic members 35, 36 are provided on the struts 16, 17 between the fixed member 20 and the pressing mold 40. The pressing mold 40 (vertically movable member 41) is pressed downwards by these elastic members 35, 36, and pressure is applied in a direction for the male threaded section 33 of the pressing shaft 30 to screw in to the female threaded section 25 of the fixed member 20.

The pressing mold body 40A, specifically the vertically movable member 41, has a detachment means 26 for detaching the outer layer frame 42 attached by magnetic force against the magnetic force. The detachment means 26 comprises a push-out rod 27 slidably provided in the guide hole 37 formed substantially vertically in the circular projection 40B, an operating button 28 provided on an upper end of the push-out rod 27, and a spring shaped elastic member 29 provided between the circular projection 40B and the operating button 28, wrapping around the push-out rod 27 to press the push-out rod 27 upwards.

A sliding platform 100 is provided in the guide groove 6 of the base 2 so as to be capable of reciprocating. The sliding platform 100 comprises a bottom wall 105, a front wall 101 provided on a front end of the bottom wall 105, a rear wall 103 provided on a rear end of the bottom wall 105, a left wall 106 provided on a left end of the bottom wall 105, and a right wall 107 provided on a right end of the bottom wall 105. A handle 102 is provided on a front wall 101, and a handle 104 is provided on the rear wall 103.

Engagement edges 106*a*, 107*a* for slidably engaging with guide projections 9*a*, 10*a* formed on side walls 9, 10 of a guide groove 6 are formed on the left wall 106 and the right wall 107. The sliding platform 100 is configured so as to slide only in the front to rear direction of the base 2. Also, a front engagement wall 99*a* and a rear engagement wall 99*b* for engaging with an engagement rod 98 of the engagement shaft 95 are formed on the left wall 106. The right wall 107 is formed with a first latch indent 176 and a second latch indent 177 for latching with the latch projection 175 of a latch plate 172 that will be described later.

An attachment member (first attachment member) 191 provided with the first pressed mold (first front cover mounting mold) 110 and the second pressed mold (first rear cover mounting mold) 140, which will be described in detail later, is removably attached to the bottom wall 105 of the sliding platform 100. The attachment member (first attachment member) 191 is formed in a flat plate shape, and a front edge 192 is formed into a semicircle. A peripheral wall 195 defining an engagement indent 194 for engaging with the attachment member (first attachment member) 191 is formed on the bottom wall 105. A substantially L-shaped engagement member (engagement means) 196 for engaging with a rear edge 193 of the attachment member (first attachment member) 191 is provided at a rear end of the peripheral wall 195. Also, a lock piece (locking means) 197 for locking the front edge 192 of the attachment member (first attachment member) 191, and a spring-type elastic member 198 arranged between the lock piece (locking means) 197 and the front wall 101 for pressing the lock piece (locking means) 197 in a locking direction, are provided on a semicircular front edge of the peripheral wall 195.

The first pressed mold (first front cover mounting mold) 110 and the second pressed mold (first rear cover mounting mold) 140 are provided on the attachment member (first attachment member) 191 so as to be positioned on either side of the sliding platform 100 in the reciprocating direction. The first pressed mold (first front cover mounting mold) 110 comprises a first mounting platform 111 for mounting the front cover 201, and a guide platform 125 provided at the periphery of the first mounting platform 111 for mounting a sheet body 213 and a design sheet 211 in layers. The guide platform 125 is provided to be capable of upward and downward movement and is pressed upwards by an elastic member 113. The first mounting platform 111 comprises a gently curved upper wall 115, a peripheral wall 116 formed on a lower peripheral edge of the upper wall 115, and a cylindrical fixed shaft 117 formed substantially in the center of a lower surface of the upper wall 115.

The first mounting platform 111 has a lower part of the peripheral wall 116 engaged with an annular guide projection 118 provided on the attachment member (first attachment member) 191, and a lower end of the fixed shaft 117 engaged in an indent 120 of the boss section 119 formed on the attachment member (first attachment member) 191. The first mounting platform 111 is thus fixed to the attachment member (first attachment member) 191 by passing a screw 122 from the rear surface of the attachment member (first attachment member) 191 through a through hole formed in the attachment member (first attachment member) 191 and screwing into the fixed shaft 117.

The guide platform 125 is formed in an annular shape, and has a ring-shaped mounting section 126 for mounting the design sheet 211 and sheet body 213 in layers, and a guide wall 127 formed at a peripheral edge of the mounting section 126, for guiding peripheral edges of the design sheet 211 and the sheet body 213, each formed at an upper section. A pressing section 50 of the outer layer frame 42 engages with the guide wall 127 of the guide platform 125, and the pressing section 50 is pressed into contact with the mounting section 126. The mounting section 126 has a cylinder 129 sliding up and down along the peripheral wall 116 of the first mounting platform 111 in an inner lower surface.

The guide platform 125 also has a guide cylinder 132 for moving the inside of the peripheral wall 116 of the first mounting platform 111 up and down. The guide cylinder 132 has a guide hole 130 for inserting the fixed shaft 117 of the first mounting platform 111 to be capable of sliding. A lower end of the guide cylinder 132 and a lower end of the cylinder 129 are integrally linked by a linking piece 133. This linking piece 133 is fitted into an elongated groove 135 formed by vertically cutting a slot in the peripheral wall 116 of the first mounting platform 111.

The upper wall 115 of the first mounting platform 111 and the mounting section 126 of the guide platform 125 have roughly the same height. A gap 136 is formed between the upper wall 115 and the mounting section 126 for insertion of the curved peripheral edge 203 of the front cover 201. The guide platform 125 is pressed upwards by a spring (elastic member) 113 wrapped around the fixed shaft 117 of the first mounting platform 111.

The second pressed mold (first rear cover mounting mold) 140 comprises a second mounting platform 141 for mounting the rear cover 205, and a processing platform 155, provided around the second mounting platform 141, for folding the peripheral edge 203 of the front cover 201 towards the peripheral edge 209 of the rear cover 205 so that peripheries of the design sheet 211 and the sheet body 213 are gripped by the peripheral edge 203 of the front cover 201 and the peripheral edge 209 of the rear cover 205. The processing platform 155 is capable of up and down movement and is pressed upwards by an elastic member 156. The second mounting platform 141 comprises an upper wall 143 where a circular indent 142 is formed, a peripheral wall 145 formed at a lower peripheral edge of the upper wall 143, and a cylindrical fixed shaft 146 formed substantially in the center of a lower surface of the upper wall 143.

The second mounting platform 141 has a lower part of the peripheral wall 145 engaged with an annular guide projection 148 provided on the attachment member (first attachment member) 191, and a lower end of the fixed shaft 146 engaged in an indent 150 of the boss section 149 formed on the attachment member (first attachment member) 191. The second mounting platform 141 is thus fixed to the attachment member (first attachment member) 191 by passing a screw 152 from the rear surface of the attachment member (first attachment member) 191 through a through hole formed in the attachment member (first attachment member) 191 and screwing into the fixed shaft 146.

The processing platform 155 is formed in an annular shape, and has an engagement step section 157 formed on an upper part. A metal ring 159 engages with this engagement step section 157. This metal ring 159 has an inclined edge 160 for bending the peripheral edge 203 of the front cover 201 to the side of the peripheral edge 209 of the rear cover 205 so as to grip the peripheral edges of the design sheet 211 and the sheet body 213 between the peripheral edge 203 of the front cover 201 and the peripheral edge 209 of the rear cover 205 while folding them inwards. It is also possible to form the inclined edge 160 directly on an upper part of the processing platform 155.

An indent 161 for engaging the pressing section 50 of the outer layer frame 42 is provided on an upper part of the inclined edge 160. A cylindrical section 162 sliding up and down along the peripheral wall 145 of the second mounting platform 141 is formed in a lower part of the engagement step section 157. The processing platform 155 also has a guide cylinder 163 for moving the inside of the peripheral wall of the second mounting platform 141 up and down.

The guide cylinder 163 has a guide hole 165 for inserting the fixed shaft 146 of the second mounting platform 141 to be capable of sliding. A lower end of the guide cylinder 163 and a lower end of the cylindrical section 162 are integrally linked by a linking piece 167. This linking piece 167 is fitted into a elongated groove 169 formed by vertically cutting a slot in the peripheral wall 145 of the second mounting platform 141. The processing platform 155 is pressed upwards by a spring (elastic member) 156 wrapped around the fixed shaft 146 of the second mounting platform 141.

The base 2 has a positioning member 170 for positioning the sliding platform 100. The positioning member 170 is provided close to the guide groove 6, has a latch plate 172 pressed by a spring-type elastic member 178 attached by a screw 173, and has a latch projection 175 formed on a lower surface of the latch plate 172.

The sliding platform 100 has a first latch indent 176 and a second latch indent 177 for being latched by the latch projection 175 of the latch plate 172. If the latch projection 175 of the latch plate 172 engages with the first latch indent 176 of the sliding platform 100, the first pressed mold (first front cover mounting mold) 110 is positioned almost directly below the pressing mold 40. If the engagement latch 175 of the latch plate 172 engages with the second latch indent 177 of the sliding platform 100, the second pressed mold (first rear cover mounting mold) 140 is positioned almost directly below the pressing mold 40.

Also, if the first pressed mold (first front cover mounting mold) 110 is positioned almost directly below the pressing mold 40, the front engagement wall 99*a* of the sliding platform 100 engages with the engagement rod 98 of the engagement shaft 95 of the switching member 80. At this time, the half-ring shaped engagement section 83 rotates in one direction against the elasticity of the spring 97 with the bearing section 75 as a center, and engages with the engagement indent 57 of the pressing section 60. Therefore, since the pressing section 60 can no longer pass through the opening 40D even if the pressing shaft 30 moves downwards, when the pressing shaft 30 starts to move downwards, the mounting member 77 (and the inner layer frame 51 attached to the mounting member 77 by magnetic force) and the pressing mold body 40A (and the outer layer frame 42 attached to the pressing mold body 40A by magnetic force) begin to move downwards at the same time. If the second pressed mold (first rear cover mounting mold) 140 is positioned almost directly below the pressing mold 40, the rear engagement wall 99*b* of the sliding platform 100 engages with the engagement rod 98 of the engagement shaft 95 of the switching member 80. At this time, the half-ring shaped engagement section 83 rotates in the other direction against the elasticity of the spring 97 with the bearing section 75 as a center, and moves away from the engagement indent 57 of the pressing section 60. Therefore, if the pressing shaft 30 begins to move downwards, first of all the pressing section 60 of the pressing shaft 30 passes through the opening 40D, and the mounting member 77 (and the inner layer frame 51 attached to the mounting member 77 by magnetic force) moves downwards relative to the pressing mold body 40A to the extent that the pressing section 60 has passed through the opening 40D. When the pressing shaft 30 moves further down, and the flange section 65 on the upper part of the pressing section 60 comes into contact with the edge of the opening 40D, the pressing mold body 40A (and the outer layer frame 42 attached to the pressing mold body 40A by magnetic force) begins to move downwards.

Reference numeral 180 is a cover. The cover 180 is attached to the base 2 using a screw or the like, and has first and second openings 181 and 182 formed in a front section and a rear section so that sliding of the sliding platform 100 is not obstructed. The first pressed mold (first front cover mounting mold) 110 emerges from the first opening 181, and the second pressed mold (first rear cover mounting mold) 140 emerges from the second opening 182. This cover 180 prevents a hand from getting close to the first pressed mold (first front cover mounting mold) 110, when the first pressed mold (first front cover mounting mold) 110 is substantially directly below the pressing mold 40, that is, when the first pressed mold (first front cover mounting mold) 110 has moved to a position where it is possible to engage with the pressing mold 40. At this time, since the second pressed mold (first rear cover mounting mold) 140 projects to the outside of the cover 180 from the second opening 182, it is possible to place the rear cover. A hand is also prevented from getting close to the second pressed mold (first rear cover mounting mold) 140 by the cover 180, when the second pressed mold (first rear cover mounting mold) 140 is substantially directly below the pressing mold 40, that is, at a position where it is possible to engage with the pressing mold 40. The cover 180 has an elongated hole through which it possible to see the indication plate of the vertically movable member 41. It is possible to confirm the position of the pressing mold 40 by looking at the indication plate from this elongated hole.

Operation of the button making device 1 of the present invention will now be described. If the handle 102 provided on the front wall 101 of the sliding platform 100 is held, the first pressed mold (first front cover mounting mold) 110 is taken out from the first opening 181 of the cover 180, and the front cover 201 is placed on the upper wall 115 of the first mounting platform 111, as a result the peripheral edge 203 is inserted into the gap 136 between the upper wall 115 and the mounting section 126. Next, after overlapping the sheet body 213 on the design sheet 211, the design sheet 211 is placed on the mounting section 126 of the guide platform 125. Also, the outer layer frame 42 and inner layer frame 51 are placed on the first pressed mold (first front cover mounting mold) 110.

If the handle 102 of the front wall 101 is held and the sliding platform 100 is pressed in, the latch projection 175 of the latch plate 172 engages with the first latch indent 176 of the sliding platform 100, the first pressed mold (first front cover mounting mold) 110 is positioned almost directly below the pressing mold 40, and the second pressed mold (first rear cover mounting mold) 140 projects from the second opening 182 of the cover 180. If the operating handle 32 is turned in one direction, the pressing shaft 30 rotates clockwise, the male threaded section 33 is screwed into the female threaded section 25 of the fixed member 20 by the elastic members 35, 36, and the pressing shaft 30 moves downwards. If the pressing shaft 30 begins to move downwards, the pressing section 60 provided on the lower part of the pressing shaft 30 tries to pass through the opening 40D. However, since this is hindered by the engagement section 83 of the switching member 80, the mounting member 77 provided on the lower end of the pressing shaft 30 can not move downwards relative to the pressing mold body 40A. That is, the pressing mold body 40A and the mounting member 77 begin to move downwards simultaneously. If the pressing shaft 30 moves further downwards, the magnetic body 87 provided on the lower surface of the pressing mold body 40A and the magnetic body 46 provided on the upper surface of the outer layer frame 42 come into contact, and the outer layer frame 42 is fixed to the pressing mold body 40A by magnetic force.

If the pressing shaft 30 is pressed further downwards, the pressing section 50 of the outer layer frame 42 affixed to the pressing mold body 40A engages with a guide wall 127 of the guide platform 125 to be pressed against the mounting section 126, and the guide platform 125 is pressed down against the resilience of the elastic member 113. The peripheries of the sheet body 213 and the design sheet 211 placed on the guide platform 125 in layers are bent downwards, and come into contact with the peripheral edge 203 of the front cover 201 placed on the first mounting platform 111. As a result of the pressing shaft 30 moving further downwards, the magnetic body 88 provided on the lower surface of the mounting member 77 is pressed against the magnetic body 56 provided on the upper surface of the inner layer frame 51 of the first mounting platform 111, and the inner layer frame 51 is affixed to the mounting member 77 by magnetic force. At this time, the position of the pressing mold 40 can be confirmed by looking at the indication plate.

If the operating handle 32 is turned in the other direction, the pressing shaft 30 rotates counterclockwise and the pressing shaft 30 moves upwards by a female threaded section 33. Accompanying this, the entire pressing mold 40 moves upwards and the vertically movable member 41 also slides upwards. At this time, the outer layer frame 42 and the inner layer frame 51 are respectively affixed to the pressing mold body 40A and the mounting member 77 by magnetic force, which means that they move upwards together with the vertically movable member 41. The front cover 201 in a state where the peripheries of the sheet body 213 and the design sheet 211 are bent downwards and are in contact with the peripheral edge 203, is pulled up while still being fitted inside the outer layer frame 42 and is detached from the first pressed mold (first front cover mounting mold) 110. Since the male threaded section 33 of the pressing shaft 30 is removed from the female threaded section 25 of the fixed member 20 immediately before the pressing section 60 comes into contact with the thickened section 23, the pressing mold 40 no longer moves upwards, the pressing shaft 30 slackens off, and the pressing section 60 is not pressed against the thickened section 23. As a result, the pressing section 60 and the pressing mold 40 are not broken.

If the rear cover 205 is mounted on the upper wall 143 of the second mounting platform 141 of the second pressed mold (first rear cover mounting mold) 140 projecting from the second opening 182 of the cover 180, with the peripheral edge 209 facing upwards, the attachment hole 207 for attaching the detachable pin 229 is protected by the indent 142, and the peripheral edge 209 is guided and positioned in an inner surface of the cylindrical section 162 of the processing platform 155.

If the handle 104 of the rear wall 103 is held and the sliding platform 100 is pressed in, the latch projection 175 of the latch plate 172 engages with the second latch indent 177 of the sliding platform 100, the second pressed mold (first rear cover mounting mold) 140 is positioned almost directly below the pressing mold 40, and the first pressed mold (first front cover mounting mold) 110 projects from the first opening 181 of the cover 180. If the second pressed mold (first rear cover mounting mold) 140 is positioned almost directly below the pressing mold 40, the rear engagement wall 99*b* with the engagement rod 98 of the engagement shaft 95 of the switching member 80, the half-ring shaped engagement section 83 rotates against the elasticity of the spring 97 with the bearing section 75 as a center, and moves away from the engagement indent 57 of the pressing member 60.

If the operating handle 32 is turned in one direction, then as described previously, the pressing shaft 30 rotates clockwise, and the pressing shaft 30 starts to move downwards. As a result, the pressing section 60 provided on the lower part of the pressing shaft 30 passes through the opening 40D and moves the mounting member 77 and inner layer frame 51 downwards relative to the pressing mold body 40A. At this time, the contact edge 53 of the inner layer frame 51 comes into contact with the upper edge of the front cover 201, and the front cover 201 is pressed down to the vicinity of the lower surface of the outer layer frame 42. If the pressing shaft 30 moves further downwards, the pressing mold body 40A and the outer layer frame 42 begin to move downwards as a result of the flange section 65 provided on the pressing shaft 30 coming into contact with the opening 40D peripheral edge. If the pressing shaft 30 continues to move further downwards, the outer layer frame 42 contacts the processing platform 155, and the processing platform 155 is pressed down against the resilient force of the elastic member 156. At about the same time, the peripheries of the sheet body 213 and design sheet 211, which have been pressed down to the vicinity of the lower surface of the outer layer frame 42 by the inner layer frame 51, come into contact with an inclined edge 160 of the processing platform 155 and are folded inwards. Then the peripheral edge 203 of the front cover 201 is also pressed against the inclined edge 160.

If the pressing shaft 30 moves further downwards and moves to an extent that the lower end of the processing platform 155 comes into contact with the sliding platform 100 and the processing platform 155 is no longer pressed down, the peripheral edge 203 of the front cover 201 is folded further inwards by the inclined edge 160, and the peripheries of the sheet body 213 and the design sheet 211 are folded by the inclined edge 160 and the edge of the second mounting platform 141 until they face upwards. At this time, the rear cover 205 on the second mounting platform 141 is affixed to the front cover 201 in such a manner that the peripheries of the sheet body 213 and the design sheet 211 are gripped by the peripheral edge 209 of the rear cover 205 and the peripheral edge 203 of the front cover 201, to form the button body 200*a*.

If the operating handle 32 is turned in the other direction, the pressing shaft 30 rotates counterclockwise, and the pressing shaft 30 moves upwards. Accompanying this, the entire pressing mold 40 moves upwards, and the vertically movable member 41 also slides upwards. The button body 200*a* remains loaded in the second pressed mold (first rear cover mounting mold) 140. If the handle 104 provided in the rear wall 103 of the sliding platform 100 is held, and the second pressed mold (first rear cover mounting mold) 140 is taken out from the second opening 182 of the cover 180, it is possible to easily remove the button body 200*a* from the second pressed mold (first rear cover mounting mold) 140. Making of the button 200 is completed upon inserting the attachment shaft 221 (or 231, 241) of the previously described mounting means 220 (or 230, 240) in the attachment hole 207 of the button body 200*a*.

The above described button making device 1 can easily replace the outer layer frame 42 and inner layer frame 51 of the pressing mold 40, and the first pressed mold (first front cover mounting mold) 110 and second pressed mold (first rear cover mounting mold) 140, in accordance with the size of a button 200 to be made. Since the outer layer frame 42 is affixed by the magnetic body 87 and the magnetic body 46, it is possible to easily remove the outer layer frame 42 from the pressing mold body 40A by applying a separation force greater than this magnetic force. Also, as shown in FIG. 4, if the operating button 28 of the detachment means 26 is pressed against the resilience of the elastic member 29, the tip of the push-out rod 27 presses down one side of the outer layer frame 42 and separates the outer layer frame 42 from the magnetic body 87. Thus it is easy to detach the outer layer frame 42 from the pressing mold body 40A. Similarly, since the inner layer frame 51 is affixed by the magnetic body 88 and the magnetic body 56, it is possible to remove the inner layer frame 51 from the pressing mold body 40A by applying a separation force greater than this magnetic force.

As shown in FIG. 9, with the above described button making device 1, in order to change the size of a button 200 to be made, an outer layer frame 42*a* that is larger than the outer layer frame 42 and an inner layer frame 51*a* that is larger than the inner layer frame 51 are attached to the pressing mold body 40A by magnetic force of the magnetic body 87 and the magnetic body 88. Since the above described first pressed mold (first front cover mounting mold) 110 and second pressed mold (first rear cover mounting mold) 140 are provided together on an attachment member 191 removably attached to the sliding platform 100, it is possible to easily replace them. Specifically, it is possible to attach and detach the first pressed mold (first front cover mounting mold) 110 and the second pressed mold (first rear cover mounting mold) 140 at the same time by attaching and detaching the attachment member 191. For example, as shown in FIG. 9, it is possible to attach an attachment member 191*a*, on which the first pressed mold (first front cover mounting mold) 110*a* larger than the first pressed mold (first front cover mounting mold) 110 and the second pressed mold (first rear cover mounting mold) 140*a* larger than the second pressed mold (first rear cover mounting mold) 140 are provided, to the sliding platform 100.

The button making device forms a substantially square shaped frame using the fixed member 20, struts 16 and 17 and reinforcement member 15. Thus, strength is increased, and it is possible to perform press operations inside this strong frame. Also, if the pressing shaft 30 is turned, the pressing mold 40 is lowered, the first pressed mold (first front cover mounting mold) 110 or the second pressed mold (first rear cover mounting mold) 140 is relatively raised, and the button body 200*a* is made using a pincer force from both of the pressing mold 40 and the first pressed mold (first front cover mounting mold) 110 or the second pressed mold (first rear cover mounting mold) 140. Therefore, the base 2 is not squeezed, and it is not necessary to place the base at a stable location. It is also possible to carry out operation at an unstable place, for example, while the base 2 is being held. Also, since the male threaded section 33 is used in pressing the pressing mold 40, it is possible to reduce the operating space.

Figure 20:
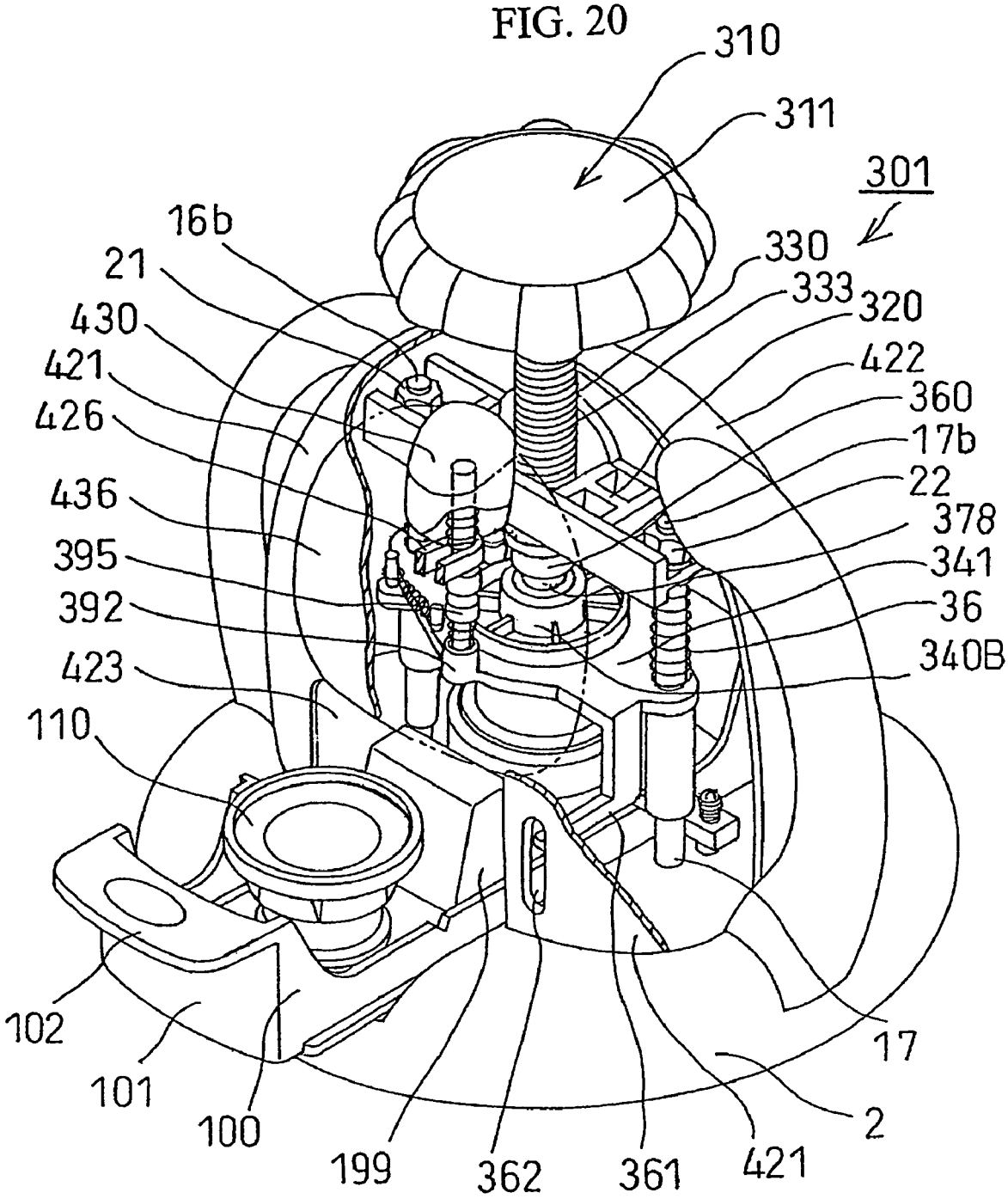
FIG. 20 is an exploded perspective view showing another embodiment of a button making device of the present invention.
Figure 21:
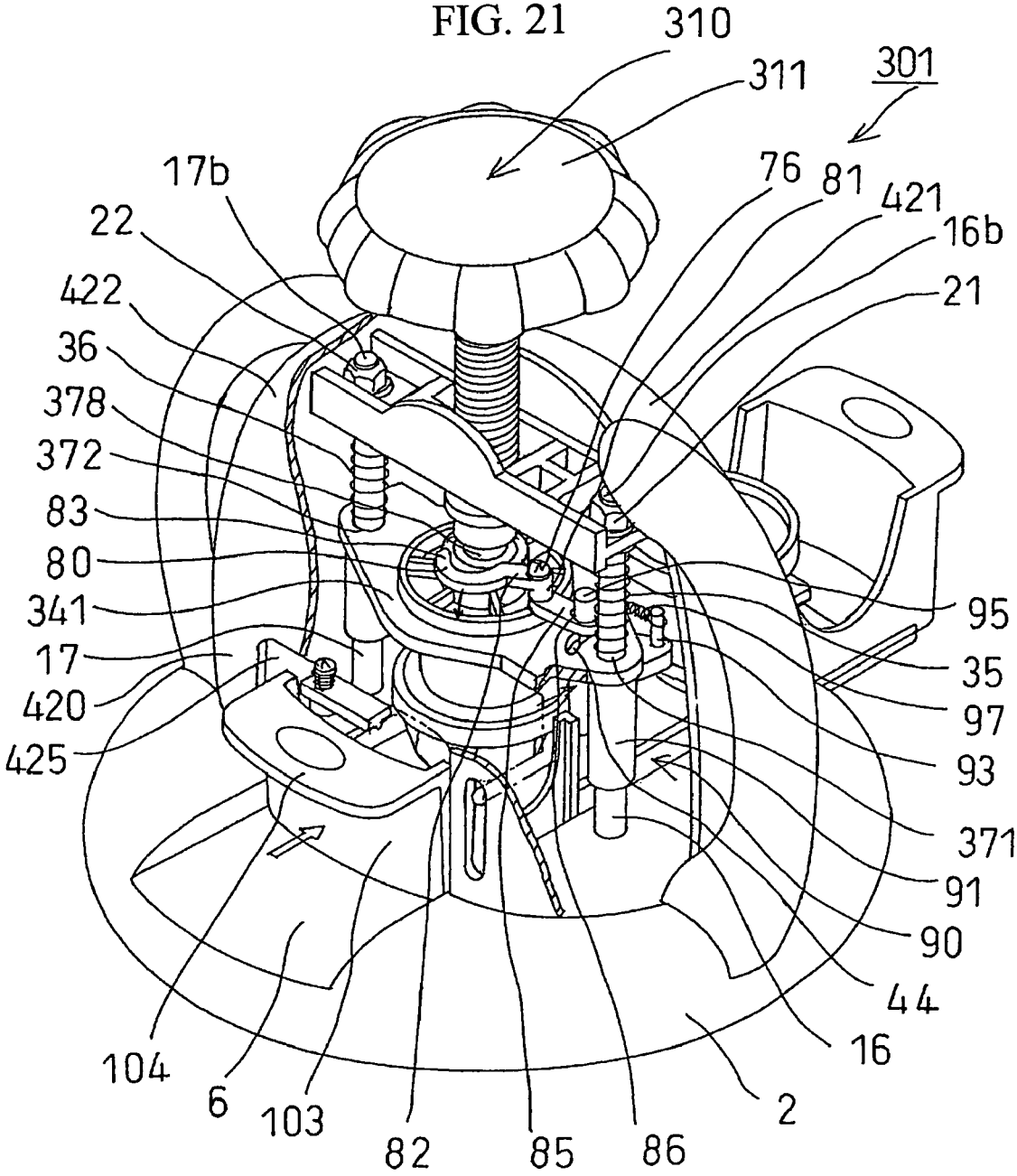
FIG. 21 is an overall perspective view of the button making device of FIG. 20 looking from another direction.
Figure 22:
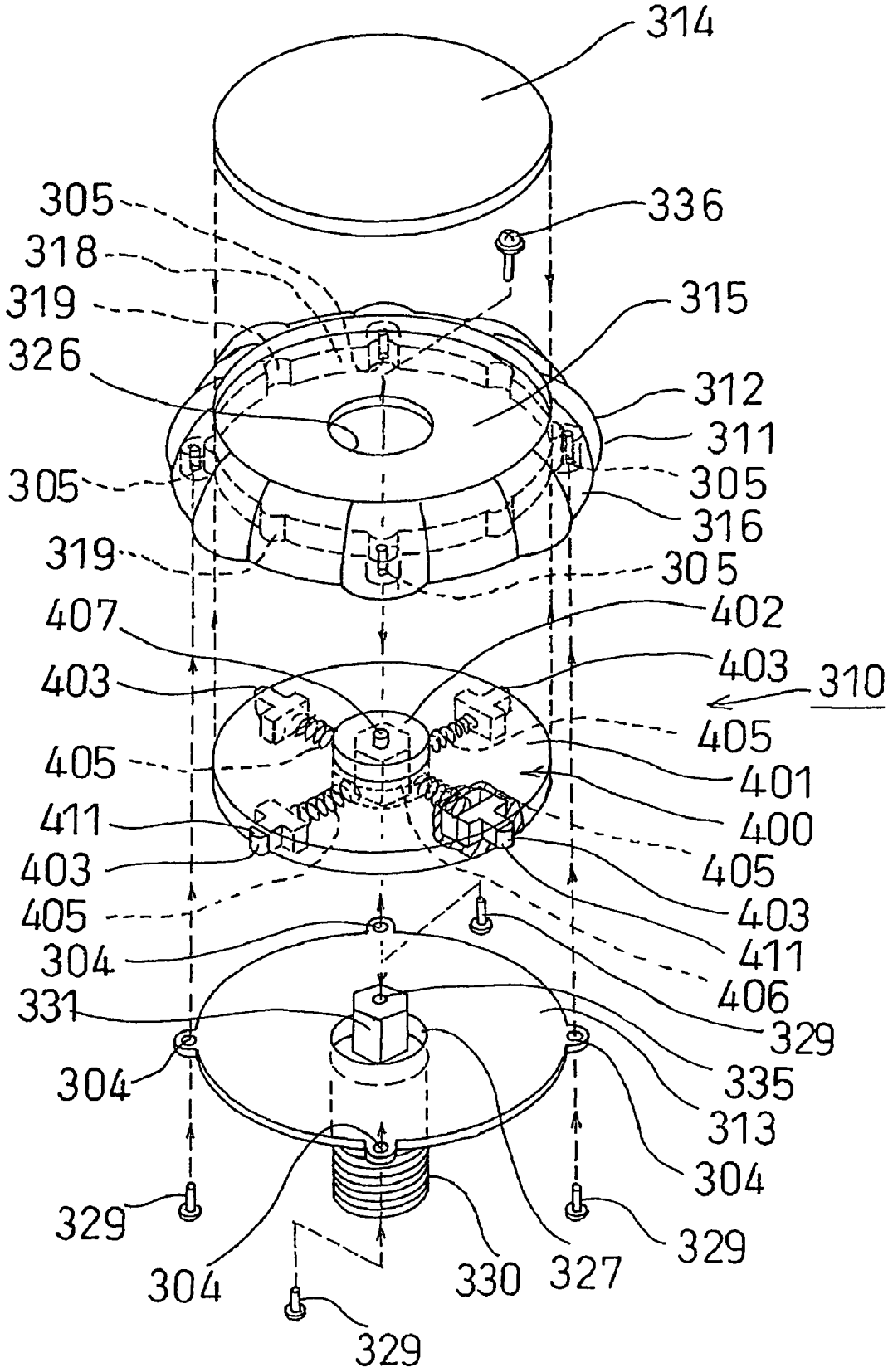
FIG. 22 is a partial perspective view of an operation means of the button making device of FIG. 20.
Figure 23:
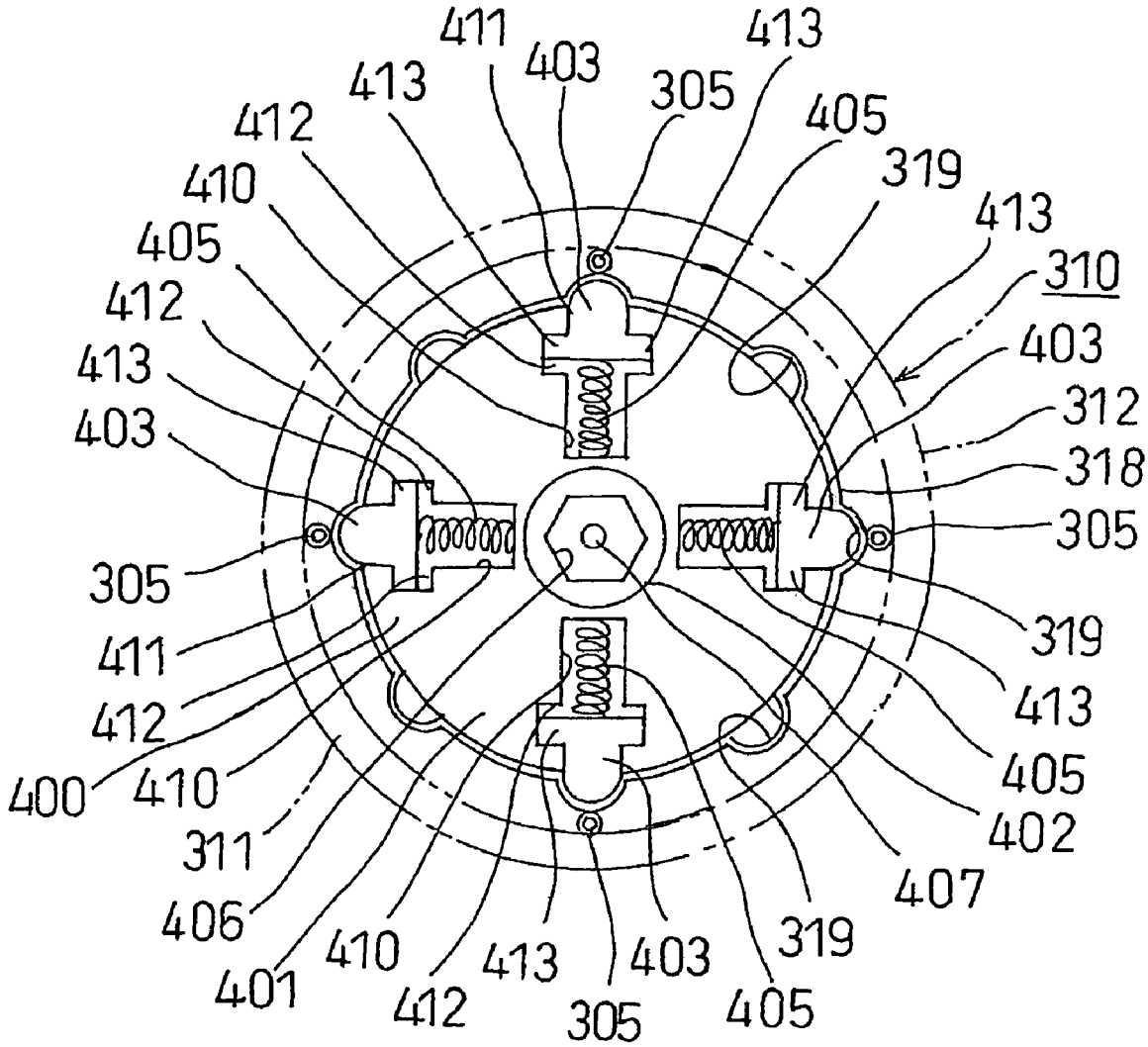
FIG. 23 is a plan view of the operation means in FIG. 22.
Figure 24:
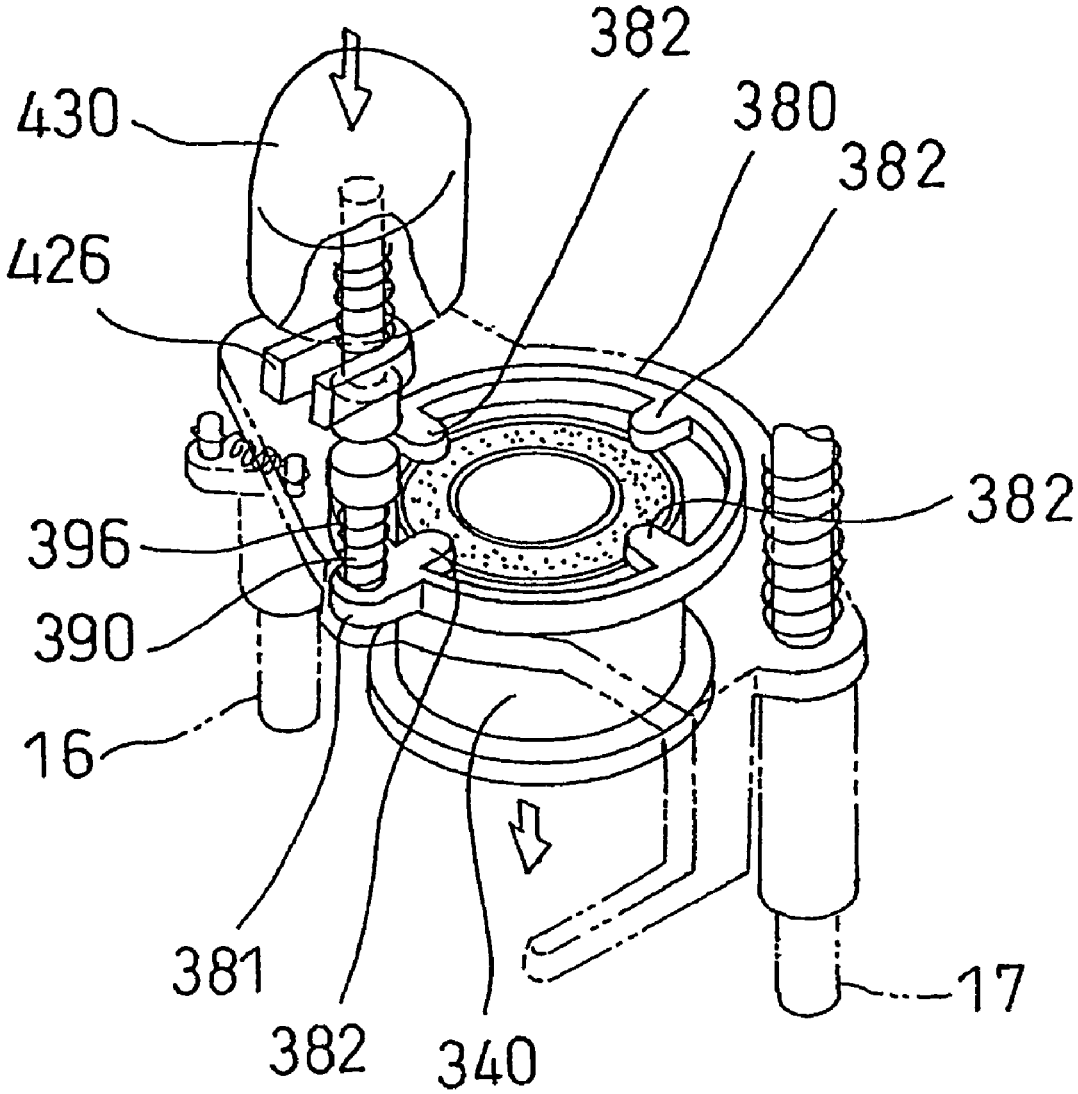
FIG. 24 is a perspective view showing the essential parts of a detachable ring of the button making device of FIG. 20.
Figure 25:
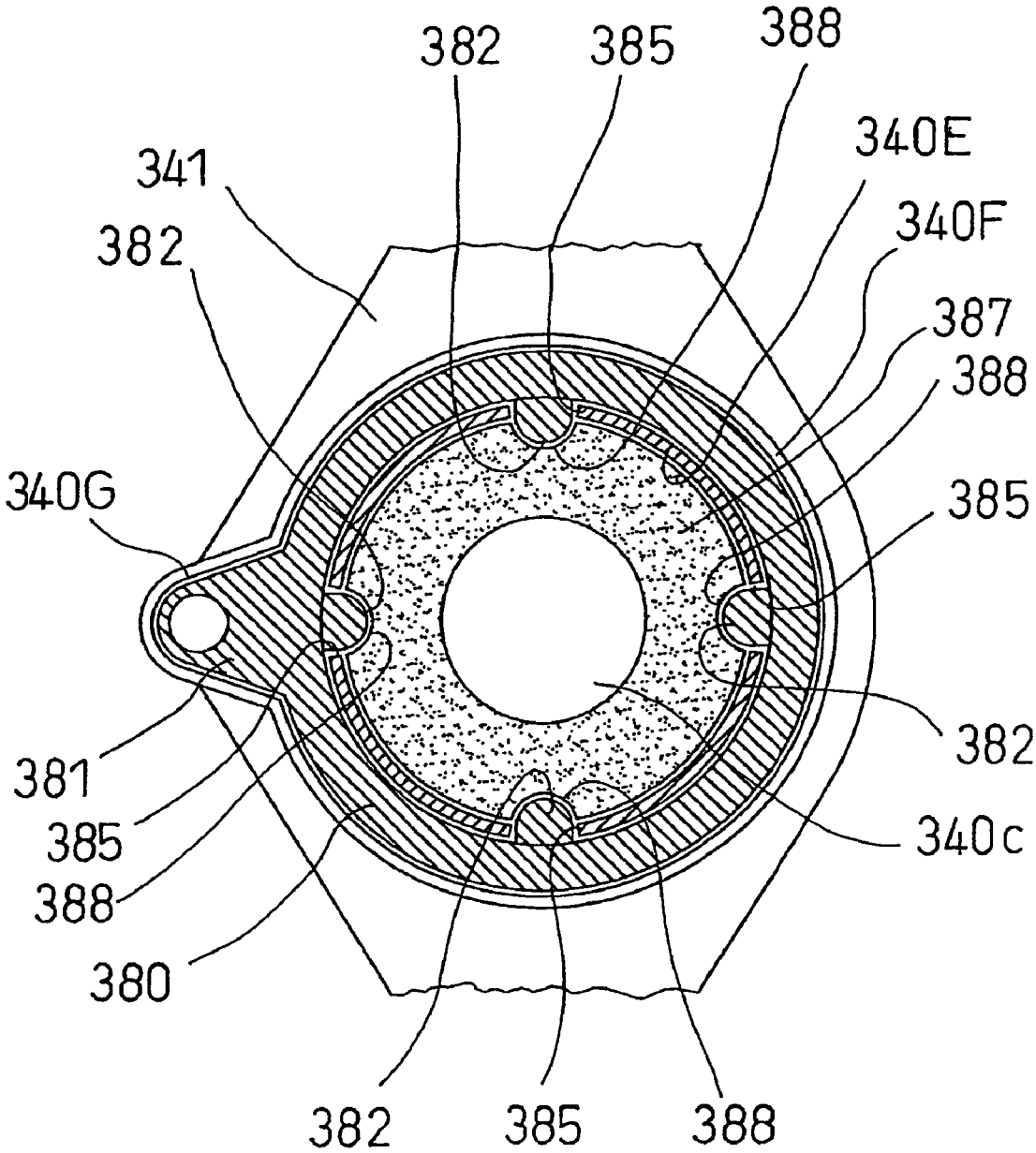
FIG. 25 is a plan view of a vertically movable member of the button making device of FIG. 20 looking from below.
Figure 26:
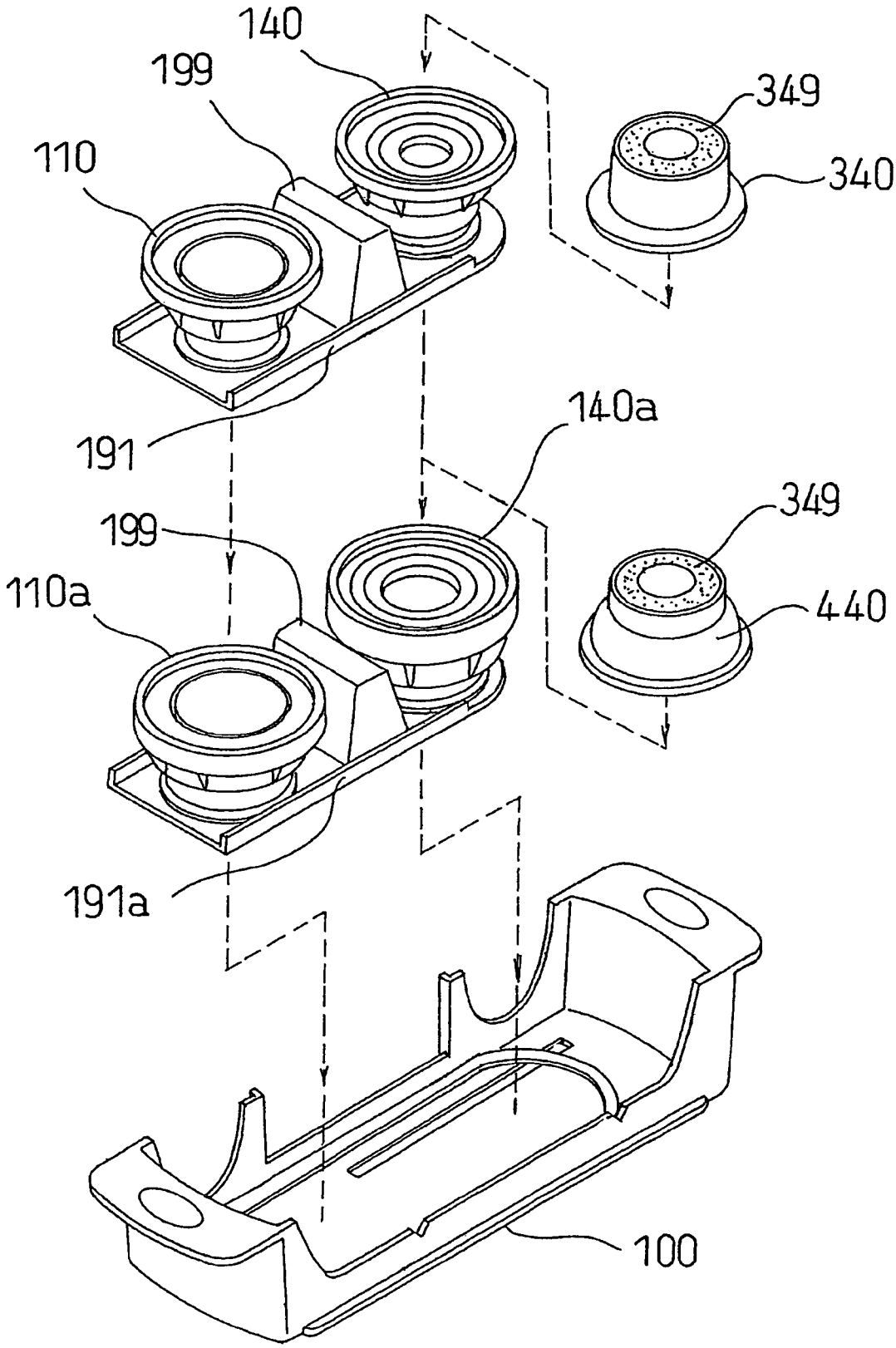
FIG. 26 is a perspective explanatory view showing a sliding platform of the button making device of FIG. 20.
Figure 27:
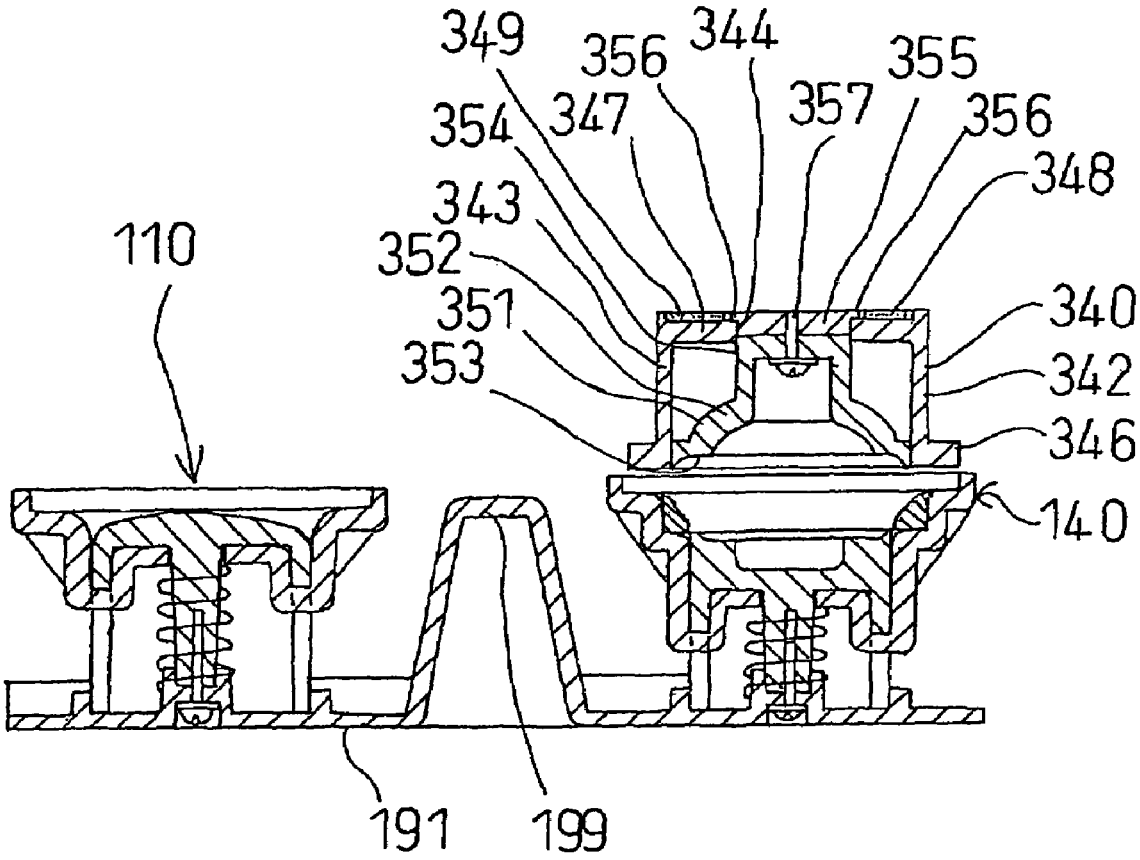
FIG. 27 is a cross sectional view of the essential parts describing the movement in the button making device of FIG. 20.
Figure 28:
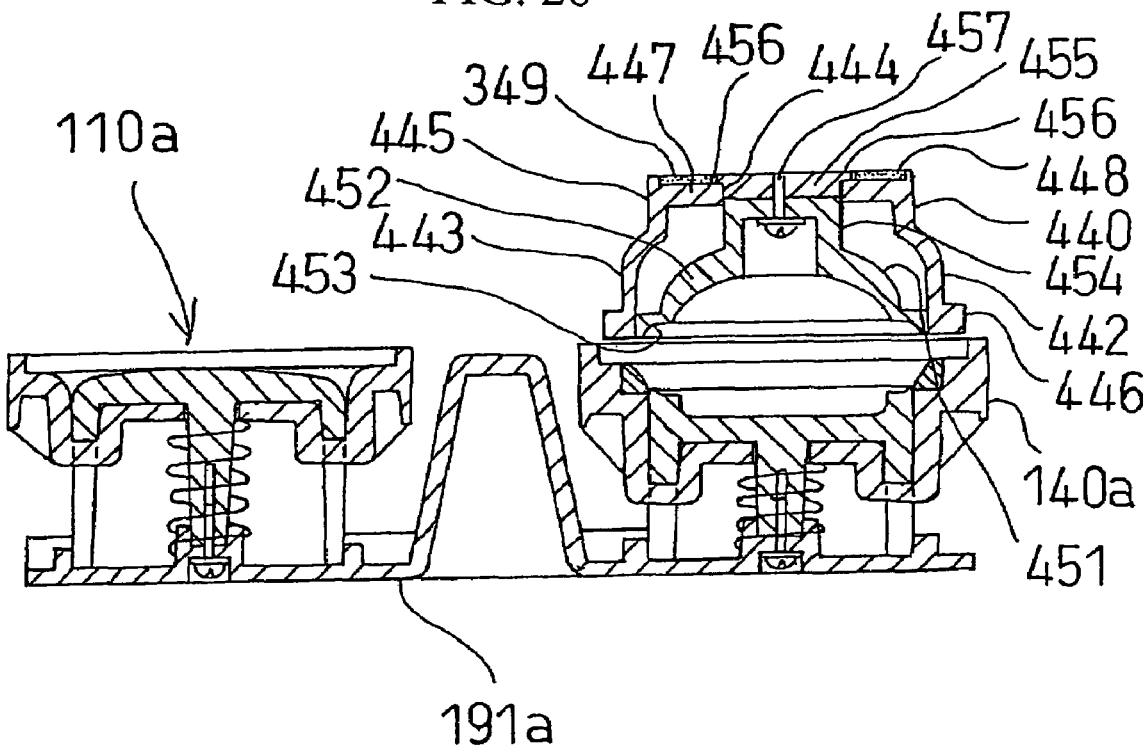
FIG. 28 is a cross sectional view of the essential parts describing the movement in the button making device of FIG. 20.

The button making device 301 will now be described based on FIG. 20 to FIG. 32. FIG. 20 is an overall perspective view showing another embodiment of a button making device of the present invention. FIG. 21 is an overall perspective view of the button making device of FIG. 20 looking from another direction. FIG. 22 is a partial perspective view of an operation means of the button making device of FIG. 20. FIG. 23 is an overall plan view of the operation means in FIG. 22. FIG. 24 is a perspective view of the essential parts of a detachable ring of the button making device of FIG. 20. FIG. 25 is a plan view looking from below a vertically movable member of the button making device of FIG. 20. FIG. 26 is a perspective explanatory view showing a sliding platform of the button making device of FIG. 20. FIG. 27 is a side elevational view of the essential parts describing the movement in the button making device of FIG. 20. FIG. 28 is a side elevational view of the essential parts describing the movement in the button making device of FIG. 20. FIG. 29 to FIG. 32 are overall side cross sectional views of the button making device of FIG. 20. The base 2 and the struts 16, 17 are as described above, and so description of these parts is omitted.

A fixed member 320 having a substantially reverse C-shaped cross section is fixed substantially horizontally to an upper part of the base 2 via the struts 16 and 17. A fixed member 320 is integrally formed using hard synthetic resin having durability and abrasion resistance, such as polycarbonate. One strut 16 has a male threaded section 16*b* formed on an upper part inserted into a hole formed in one end of the fixed member 320 and is fastened using a nut 21, so as to fix the fixed member 320. The other strut 17 has a male threaded section 17*b* formed on an upper part inserted into a hole formed in the other end of the fixed member 320 and is fastened using a nut 22, so as to fix the fixed member 320.

The fixed member 320 has a boss section 323 formed substantially at the center, and a female threaded section 325 is formed on this boss section 323. The pressing shaft 330 is integrally formed using hard synthetic resin having durability and abrasion resistance, such as polycarbonate. The processing shaft 330 has a male threaded section 333 capable of moving in the axial direction by being screwed into the female threaded section 325 provided on the fixed member 320. The processing shaft 330 also has a vertically movable member 341 rotatably provided on the lower end, and operation means 310 provided on an upper part.

Figure 29:
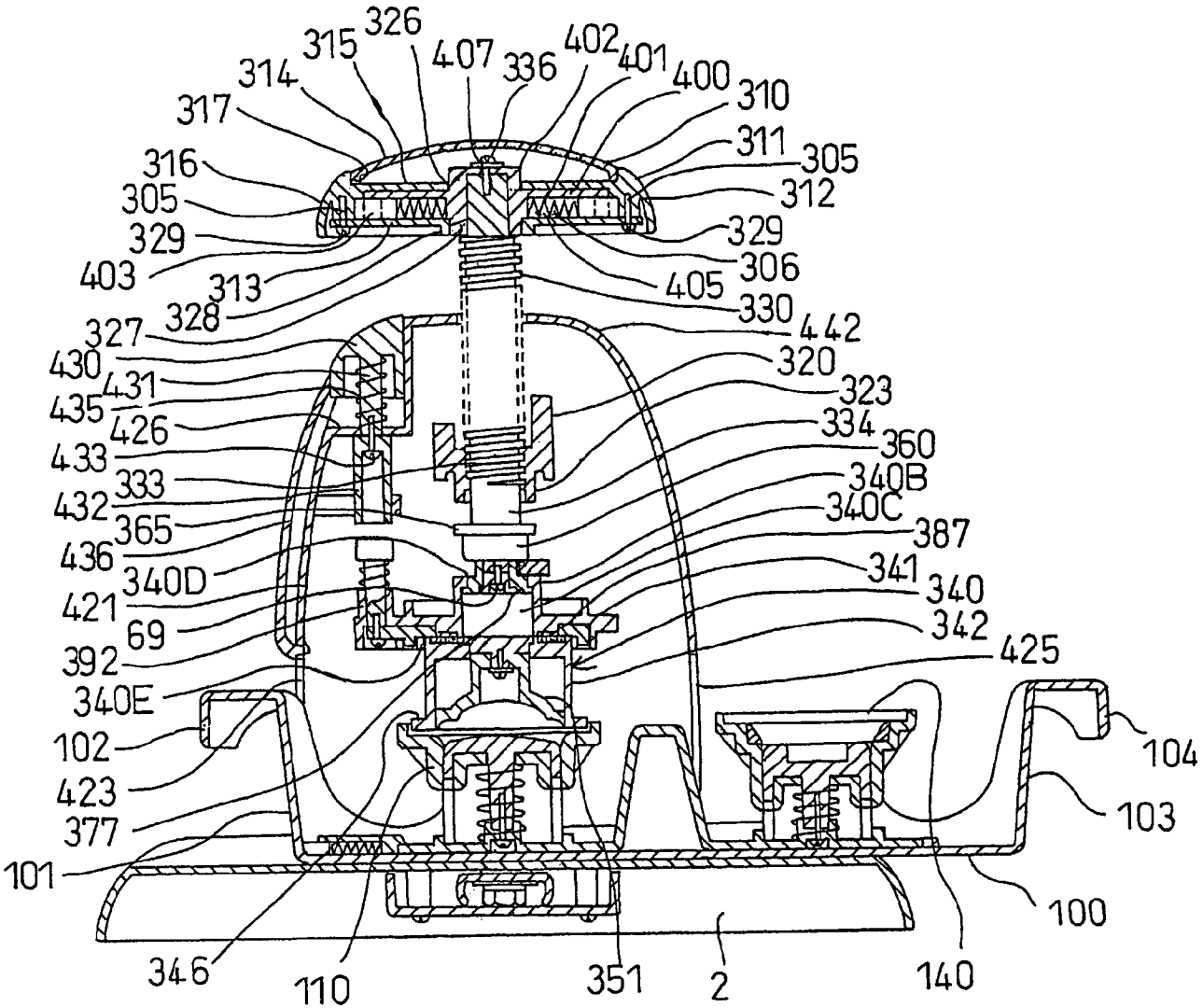
FIG. 29 is an overall side cross sectional view of the button making device of FIG. 20.
Figure 30:
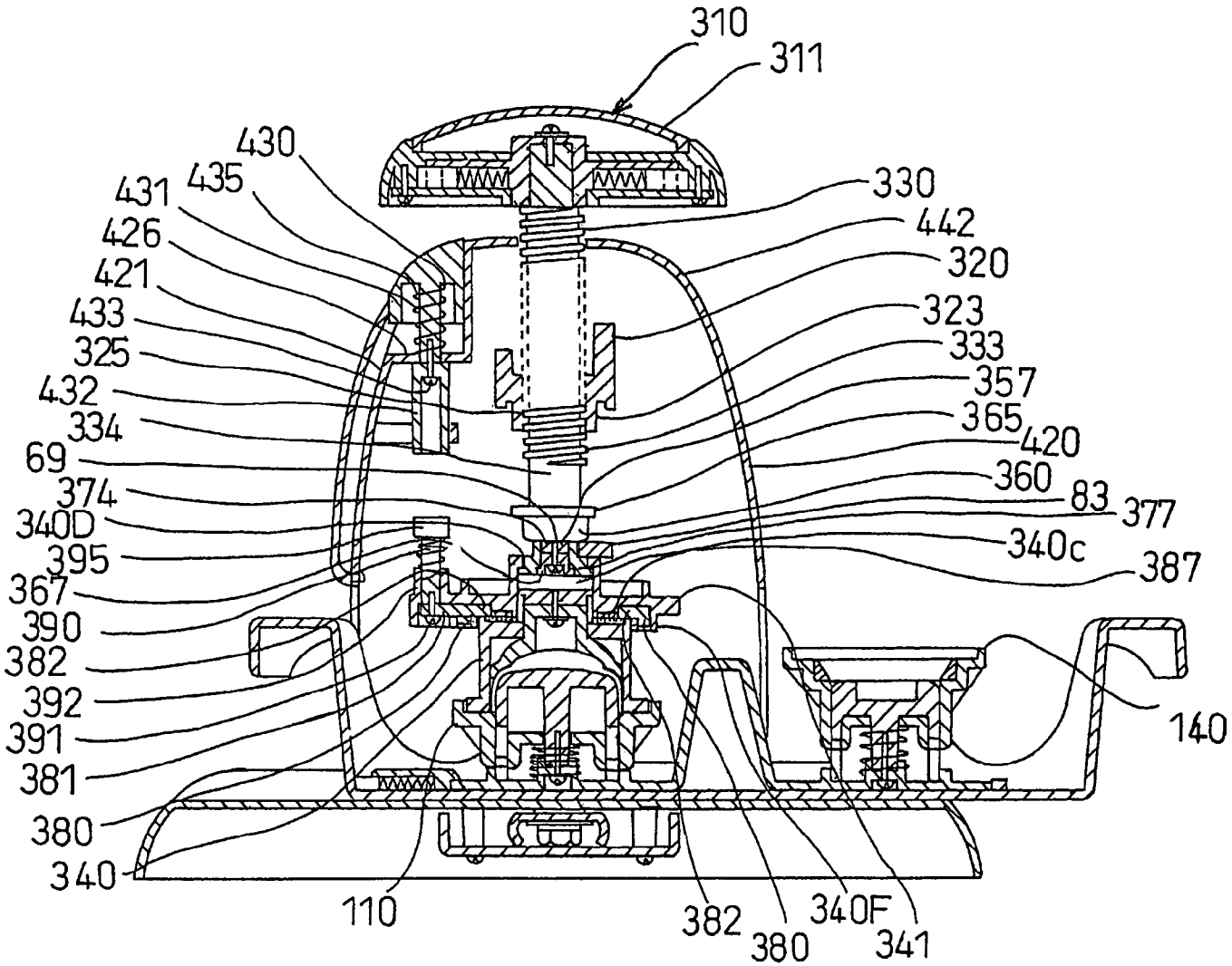
FIG. 30 is an overall side cross sectional view of the button making device of FIG. 20.
Figure 31:
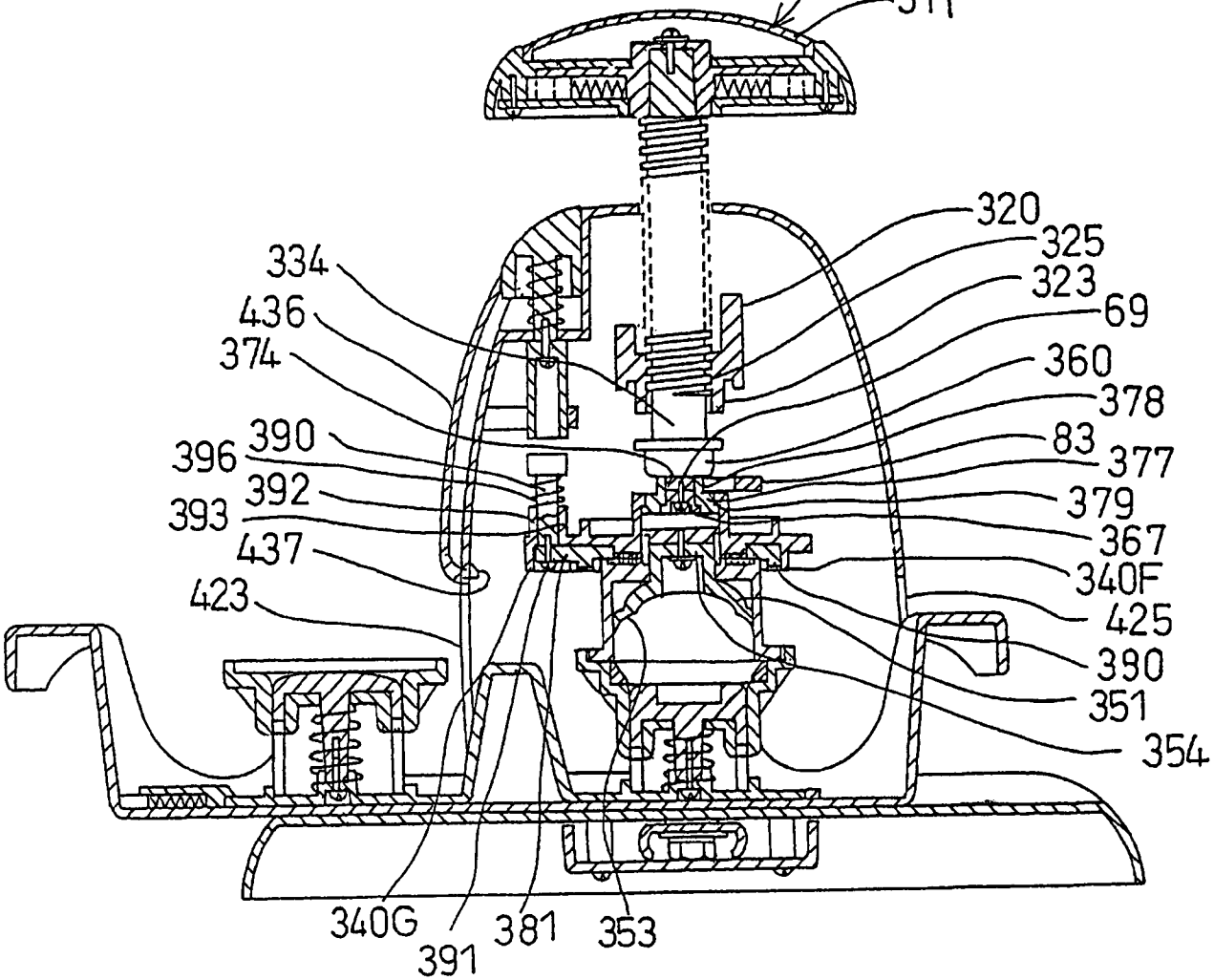
FIG. 31 is an overall side cross sectional view of the button making device of FIG. 20.
Figure 32:
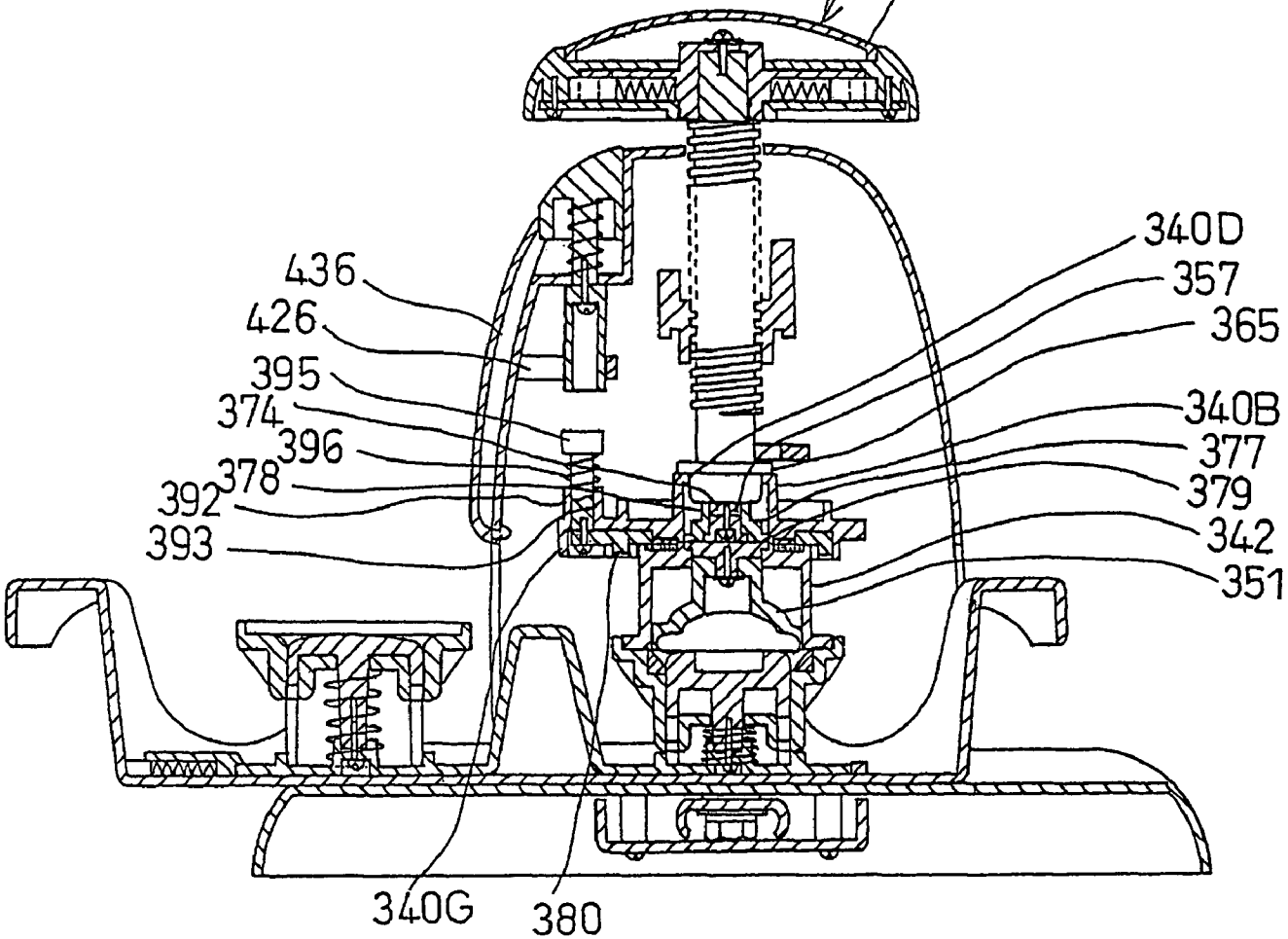
FIG. 32 is an overall side cross sectional view of the button making device of FIG. 20.

As shown in FIG. 29, the male threaded section 333 is formed so that before the pressing shaft 330 is moved upwards and the vertically movable member 341 comes into contact with the fixed member 320, it moves away from the female threaded section 325 of the fixed member 320, and the pressing shaft 330 slackens off. That is, a non-threaded section 334 where the male threaded section 333 is not formed is provided on a lower part of the pressing shaft 330. The pressing shaft 330 has a hexagonal shaft 331 formed at the upper end, and a pressing mold 340 for engaging with a first pressed mold (first front cover mounting mold) 110 or a second pressed mold (first rear cover mounting mold) 140 at the lower end.

As shown in FIGS. 22, 23 and 29, the operation means 310 comprises an operating handle 311 and a clutch 400. The operating handle 311 comprises a circular disk-shaped upper case 312, a lower cover 313, and an upper cover 314. The upper case 312 comprises an upper wall 315, and a peripheral wall 316 extending from an upper edge of an annular side wall 317 provided on the peripheral edge of the upper wall 315. In order to make it easy to grip the peripheral wall 316, a convex section is formed. The upper wall 315 has an annular guide wall 318 provided on a lower surface. Latch indents 319 are formed at eight places in the guide wall 218 with a specified distance apart from each other. A bearing piece hole 326 is formed at a substantially central part of the upper wall 315 of the upper case 312.

The upper cover 314 is dome-wise curved in a dome shape, and is fitted into the side wall 317 of the upper wall 315. The lower cover 313 is formed in a circular plate shape, and a boss section 328 is formed with a bearing piece hole 327 provided at a substantially central part. The lower cover 313 is attached to a lower part of the operating handle 311 by inserting screws 329 through holes 304 formed at four places in the lower cover 313 into screw holes 305 formed at four places in the lower surface of the upper wall 315 of the operating handle 311. Thus, a storage space 306 is formed inside the operating handle 311.

The clutch 400 is rotatably housed inside the storage space 306, and comprises a circular disc-shaped rotating body 401, a rotation shaft 402 formed substantially in the center of the rotating body 401, latch projections 403 formed capable of moving in and out of four places on the edge of the rotating body 401, and an elastic member 405 for pressing the latch projection in a projection direction. The rotation shaft 402 is rotatably pivoted at a bearing piece hole 326 of the upper wall 315 and a bearing piece hole 327 of the lower cover 313, and has an attachment hole 406 having a hexagonal cross section substantially in the center of the lower surface, and a screw through hole 407 for linking to the attachment hole 406 in an upper surface.

Also, the rotating body 401 has a guide indent 410 stretching radially. The guide indent 410 links to an opening 411 formed at an edge of the rotating body 401, and engagement grooves 412, 412 are formed on both sides of the guide indent 410. The latch projections 403 have front tips formed in a semicircular shape, and engagement projections 413, 413 for engaging with the engagement grooves 412, 412 are formed in the rear tips so that the front tips engage with and disengage from the latch indents 319 of the guide wall 318.

A spring-type elastic member 405 is provided inside the guide indent 410, and the latch projections 403 are pressed in a projection direction by this elastic member 405. If an external force greater than a specified value is applied, the latch projections 403 are deeply inserted against the resilience of the elastic member 405. The moving in and out of the latch projections 403 occurs in a range in which the engagement projections 413, 413 contact both ends of the engagement grooves 412, 412.

The operation means 310 described above is attached to the pressing shaft 330 by fitting the hexagonal shaft 331 of the pressing shaft 330 into the attachment hole 406 of the clutch 400, and screwing the screw 336 into the screw hole 335 formed on the upper end of the hexagonal shaft 331 via the screw through hole 407.

A pressing mold 340, for engaging with the first pressed mold (first front cover mounting mold) 110 or the second pressed mold (first rear cover mounting mold) 140, is provided on a lower end of the pressing screw shaft 330. The pressing mold 340 has an outer layer frame 342 and an inner layer frame 351, and is removably attached to a vertically movable member 341. The vertically movable member 341 is formed in a plate shape, with a circular projection 340B formed substantially in the center of the upper surface of this vertically movable member 341, and a circular indent 340C formed substantially in the center of the lower surface of the vertically movable member 341.

Also, an opening 340D for linking the substantial center of the circular projection 340B and the substantial center of the circular indent 340C is formed substantially in the center of the vertically movable member 341. An annular guide wall 340E is formed projecting out on the lower surface of the vertically movable member 341, with the center of the circular indent 340C as a center. An annular magnetic body 387, having magnetic force, is attached inside the annular guide wall 340E at the lower surface of the vertically movable member 341. This magnetic body 387 is formed using a magnetic member such as a magnet or magnetic rubber.

The pressing shaft 330 has an engagement section 360 formed at a lower part of a non-threaded section 334. The engagement section 360 is formed having almost the same diameter as the opening 340D, so as to be capable of passing through the opening 340D. That is, by passing the engagement section 360 through the opening 340D, the pressing shaft 330 becomes capable of moving vertically relative to the vertically movable member 341. Also, if the pressing shaft 330 is moved downwards and the engagement section 360 is inserted through until the flange section 365 formed on the upper part of the non-threaded section 334 comes into contact with the edge of the opening 340D, the pressing shaft 330 can no longer move vertically relative to the vertically movable member 341, and the pressing shaft 330 and the vertically movable member 341 move vertically together. The engagement section 360 has an engagement shaft 357 having a slightly smaller diameter than the diameter of the pressing shaft 330 at a lower part.

A pressing member 377 is rotatably attached to the lower end of the engagement section 360, that is, the end of the engagement shaft 357, using a screw 69. The pressing member 377 is slidably provided inside the circular indent 340C of the vertically movable member 341, and has an engagement indent 378 at an upper part, and an annular guide projection 379 on a lower surface edge. The pressing member 377 has almost the same diameter as the opening 340D, so that it is capable of passing through the opening 340D. Accordingly, if the pressing member 377 moves downwards together with the pressing shaft 330 and the engagement section 360 of the pressing shaft 330 is inserted into the opening 340D, the pressing member 377 is capable of moving vertically relative to the vertically movable member 341 to the extent of the insertion. The guide projection 379 comes into contact with the edge of the opening 340D so that it can not project any further upwards than that.

Also, the pressing member 377 has an engagement hole 374 having a step section formed substantially in the center. The engagement shaft 357 is rotatably engaged in this engagement hole 374, a seat 367 is rotatably attached to the engagement hole 374, and the screw 69 is screwed into the seat 367 and the engagement shaft 357 so that the pressing member 377 is rotatably attached to the lower end of the pressing shaft 330.

An annular guide wall 340F is formed around the guide wall 340E at the lower surface of the vertically movable member 341. This guide wall 340F has a front section cut away, and a substantially triangular guide wall 340G is formed at this cut-away section. A removable ring 380 is provided between this guide wall 340F and the guide wall 340E.

The removable ring 380 is provided with an engaging piece 381 for engaging inside the guide wall 340G, and projecting pieces 382 projecting at four places at equal intervals around an inner edge. The projecting pieces 382 project from the cut-away 385 formed in the guide wall 340E to inside the guide wall 340E, and engage with either indents 388 formed in the magnetic body 387. The projecting pieces 382 and the magnetic body 387 are substantially coplanar with each other.

The piece 381 of the removable ring 380 is attached to a lower end of a push-out rod 390 by a screw 391. The push-out rod 390 is slidably attached to a guide hole 393 of a boss 392 formed on an upper surface of the vertically movable member 341. Also, the push-out rod 390 has a head section 395 formed on an upper part, is pressed upwards by a spring-shaped elastic member 396 wrapped around between this head section 395 and the boss 392, and has the removable ring 380 pressed to the lower surface of the vertically movable member 341.

A cover 420 comprising a front half body 421 and a rear half body 422 is removably attached to the base. A first opening 423 is formed in the front half body 421, and a second opening 425 is formed in the rear half body 422. A step section 426 is provided on an upper part of the front half body 421. An operating button 430 is arranged on the step section 426. The operating button 430 has a strut 431 integrally formed at a lower section, and the pressing shaft 432 is attached to a lower end of the strut 431 using a screw 433. The pressing shaft 432 is pressed against a rear surface of the step section 426 by a spring shaped elastic member 435 wrapped around between the operating button 430 and the step section 426. An ornamental cover 436 for covering the step section 426 is removably attached to the front half body 421 using a latch piece 437.

The pressing mold 340 comprises the outer layer frame 342, and the inner layer frame 351 which is slidably attached to the inside of the outer layer frame 342 and is shallower than the outer layer frame 342. The outer layer frame 342 comprises a cylindrical peripheral wall 343, a pressing member 346 formed at a lower outer edge of the peripheral wall 343, and an upper wall 347 formed on an upper end of the peripheral wall 343. A substantially circular indent 348 is formed on the upper wall 347, and an annular magnetic body 349 is attached to the indent 348. The magnetic body 349 is preferably compatible with the magnetic body 387 with respect to attachment, and is formed using a magnetic material such as a magnet, magnetic rubber or a ferromagnetic body. A guide hole 344 is formed substantially in the center of the upper wall 347.

The inner layer frame 351 comprises a curved section 352 formed in an inverse bowl shape, a contact edge 353 formed on the lower peripheral edge of the curved section 352 for contacting the peripheral edge 203 of the front cover 201 of the button, and a neck section (guide projection) 354 formed on an upper part of the curved section 352 and slidably guided in the guide hole 344 of the outer layer frame 342. A sliding member 355 similarly slidably guided in the guide hole 344 is attached to the neck section (guide projection) 354 using a screw 357, and an engagement projection 356 for engaging with the upper wall 347 of the outer layer frame 342 is formed on an upper peripheral edge of the sliding member 355. Therefore, in a range where the engagement projection 356 and the curved section 352 contact the upper wall 347, it is possible for the inner layer frame 351 to slide up and down with respect to the outer layer frame 342, and the engagement projection 356 engages with the upper wall 347 as a result of its own weight. In this way, by attaching the inner layer frame 351 inside of the outer layer frame 342, inconveniences such as one of them being lost or being assembled incorrectly is prevented.

A pressing mold 440 is formed larger than the pressing mold 340, and comprises an outer layer frame 442 and an inner layer frame 451 which is slidably attached to the inside of the outer layer frame 442 and is shallower than the outer layer frame 442. The outer layer frame 442 comprises an outer curved section 443 formed in an inverse bowl shape, a pressing section 446 formed on a lower peripheral edge of the outer curved section 443, a cylindrical peripheral wall 445 formed at an upper part of the outer curved section 443, and an upper wall 447 formed on an upper end of the peripheral wall 445. A substantially circular indent 448 is formed in the upper wall 447, and the magnetic body 349 is attached to this indent 448. A guide hole 444 is formed substantially in the center of the upper wall 447.

The inner layer frame 451 comprises a curved section 452 formed in an inverse bowl shape, a contact edge 453 formed on the lower peripheral edge of the curved section 452 for contacting the peripheral edge 203 of the front cover 201 of the button, and a neck section (guide projection) 454 formed on an upper part of the curved section 452 and slidably guided in a guide hole 444 of the outer layer frame 442. A sliding member 455 similarly slidably guided in the guide hole 444 is attached to the neck section (guide projection) 454 using a screw 457, and an engagement projection 456 for engaging with the upper wall 447 of the outer layer frame 442 is formed on an upper peripheral edge of the sliding member 455. Therefore, in a range where the engagement projection 456 and the curved section 452 contact the upper wall 447, it is possible for the inner layer frame 451 to slide up and down with respect to the outer layer frame 442, and the engagement projection 456 is engaged with the upper wall 447 as a result of its own weight. In this way, by attaching the inner layer frame 451 inside the outer layer frame 442, inconveniences such as one of them being lost or being assembled incorrectly is prevented.

The vertically movable member 341 is formed in a plate shape, has guide holes 371 and 372 slidably guided in the struts 16 and 17 provided at the left and right ends, and is guided so as to be able to move up and down only by these guide holes 371 and 372. An indication plate 361 for enabling confirmation of the positions of these guide holes is integrally formed on one end of the vertically movable member 341. This indication plate 361 can be observed from an elongated hole 362 formed in the front half body 421 of the cover 420. Also, a switching member 80 is provided in the vertically movable member 341. The switching member 80 switches between a state where sections that move downwards together with downward movement of the pressing shaft 330 are only the vertically movable member 341 and the outer layer frame 342, and a state where the sections are the vertically movable member 341, the outer layer frame 342, the pressing member 377, and the inner layer frame 351. The switching member 80 does this by allowing or preventing the pressing shaft 330 to pass through the opening 340D of the engagement section 360 according to the position of the first pressed mold (first front cover mounting mold) 110 or the second pressed mold (first rear cover mounting mold) 140.

The switching member 80 is rotatably attached to the vertically movable member 341 by a screw 76. The switching member 80 comprises a boss section 81 rotatably attached using the screw 76, a first arm member 82 provided on the boss section 81, a semi-ring shaped engagement section 83 provided on the first arm member 82, capable of engaging with the engagement indent 378 of the pressing member 377, and a second arm member 87 provided at a position of the boss section 81 substantially opposite to the first arm member 82. An elongated hole shaped engagement groove 86 is formed in the second arm member 85.

A swing member 90 is provided in a freely rocking manner on one strut 16 so as to move up and down together with the vertically movable member 341. The swing member 90 comprises a boss section 91 attached to the strut 16, an arm section 92 provided on one side of the boss section 91, and a spring mounting hook 93 provided on the other side of the boss section 91. An engagement shaft 95 is formed substantially vertically on the arm section 92. The engagement shaft 95 has an upper section 95*a* engaging with the engagement groove 86 of the switching member 80, with a lower part 95*b* projecting from an elongated hole 44 formed in the vertically movable member 41, and an engagement rod is provided on the lower part 95*b*.

A spring mounting hook 96 is provided on a rear section of the vertically movable member 341. A spring 97 is placed between this spring mounting hook 96 and the spring mounting hook 93 of the swing member 90. The engagement section 83 of the switching member 80 is brought into contact with an engagement indent 378 of the pressing member 377 via the swing member 90 under resilience of this spring 97. Coil spring-shaped elastic members 35, 36 are provided on struts 16, 17 between the fixed member 320 and the vertically movable member 341. The vertically movable member 341 is pressed downwards by these elastic members 35, 36. A male threaded section 333 of the pressing shaft 330 is pressed in a direction to be screwed in to the female threaded section 325 of the fixed member 320.

The sliding platform 100 and attachment member (first attachment member) 191 are as described above, and so description will be omitted here except for the following. A substantially platform-shaped bent section 199 is formed at a substantially middle section of the attachment member (first attachment member) 191, and the attachment member (first attachment member) 191 is strengthened by this bent section 199. Also, molded components formed using the first pressed mold (first front cover mounting mold) 110 are prevented from moving into the second pressed mold (first rear cover mounting mold) 140, and molded components formed using the second pressed mold (first rear cover mounting mold) 140 are prevented from moving into the first pressed mold (first front cover mounting mold) 110.

Operation of the button making device 301 of the present invention will now be described. If the handle 102 provided on the front wall 101 of the sliding platform 100 is held, the first pressed mold (first front cover mounting mold) 110 is taken out from the first opening 181 of the cover 420, and the front cover 201 is placed on the upper wall 115 of the first mounting platform 111, the peripheral edge 203 is inserted into the gap 136 between the upper wall 115 and the mounting section 126. Next, after overlapping the sheet body 213 on the design sheet 211, the design sheet 211 is placed on the mounting section 126 of the guide platform 125. Further, the outer layer frame 342 and the inner layer frame 351 slidably attached inside the outer layer frame 342 are mounted on the first pressed mold (first front cover mounting mold) 110.

If the handle 102 of the front wall 101 is held and the sliding platform 100 is pressed in, the latch projection 175 of the latch plate 172 engages with the first latch indent 176 of the sliding platform 100, the first pressed mold (first front cover mounting mold) 110 is positioned almost directly below the pressing mold 40, and the second pressed mold (first rear cover mounting mold) 140 projects from the second opening 182 of the cover 420. If the operating handle 311 is rotated in one direction, the pressing shaft 330 rotates clockwise, the male threaded section 333 is screwed into the female threaded section 325 of the fixed member 20 by the elastic members 35, 36, and the pressing shaft 330 moves downwards. Since the engagement section 360 provided on the lower part of the pressing shaft 330 is prevented from passing through the opening 340D by the engagement section 83 of the switching member 80, the pressing member 377 can not move downwards relative to the vertically movable member 341. However, since the engagement section 83 of the switching member 80 is in contact with the vertically movable member 341, the pressing shaft 330 moves downwards, and the vertically movable member 341 slides downwards together with the pressing shaft 330 as a result of the engagement section 360 pressing the engagement section 83 of the switching member 80, and presses the pressing mold 340 downwards. As a result of the pressing shaft 330 moving further downwards, the magnetic body 387 provided on the lower surface of the vertically movable member 341 and the magnetic body 349 on the outer layer frame 342 of the first pressed mold (first front cover mounting mold) 110 are brought into contact, and the outer layer frame 342 is affixed to the vertically movable member 341.

The pressing section 346 of the outer layer frame 342 engages with the guide wall 127 of the guide platform 125, contacts the mounting section 126, and presses the guide platform 125 downwards against the resilience of the elastic member 113. The inner layer frame 351 is in a free state with respect to the outer layer frame 342, which means that it does not press the first pressed mold (first front cover mounting mold) 110. The peripheries of the sheet body 213 and the design sheet 211 placed on the guide platform 125 in layers are bent downwards, and come into contact with the peripheral edge 203 of the front cover 201 placed on the first mounting platform 111. At this time, a hand is prevented from getting close to the first pressed mold (first front cover mounting mold) 110 by the cover 420. The position where this pressing mold 340 has been pressed downwards can be confirmed by looking at the indication plate 361.

If the operating handle 311 is turned in the other direction, the pressing shaft 330 rotates counterclockwise, and the pressing shaft 330 moves upwards by a male threaded section 333. Accompanying this, the vertically movable member 341, the outer layer frame 342 affixed to the vertically movable member 341, and the inner layer frame 351 attached inside the outer layer frame 342, also slide upwards. The front cover 201 in a state where the peripheries of the sheet body 213 and the design sheet 211 are bent downwards and are in contact with the peripheral edge 203 is pulled up while still being fitted inside the outer layer frame 342 and is detached from the first pressed mold (first front cover mounting mold) 110. Because the male threaded section 333 of the pressing shaft 330 comes away from the female threaded section 325 of the fixed member 320 immediately before the engagement section 360 comes into contact with the boss section 323, the pressing shaft 330 slackens off, the pressing mold 340 no longer moves upwards, and the engagement section 360 is no longer pressed against the boss section 323. As a result, the engagement section 360 and the pressing mold 340 are not broken.

If the rear cover 205 is mounted on the upper wall 143 of the second mounting platform 141 of the second pressed mold (first rear cover mounting mold) 140 projecting from the second opening 182 of the cover 420, with the peripheral edge 209 facing upwards, the attachment hole 207 for attaching the detachable pin 229 is protected by the indent 142, and the peripheral edge 209 is guided and positioned in an inner surface of the cylindrical section 162 of the processing platform 155.

If the handle 104 of the rear wall 103 is held and the sliding platform 100 is pressed in, the latch projection 175 of the latch plate 172 engages with the second latch indent 177 of the sliding platform 100, the second pressed mold (first rear cover mounting mold) 140 is positioned almost directly below the pressing mold 40, and the first pressed mold (first front cover mounting mold) 110 projects from the first opening 423 of the cover 420. If the second pressed mold (first rear cover mounting mold) 140 is positioned almost directly below the pressing mold 340, the rear engagement wall 99*b* of the sliding platform 100 engages with the engagement rod 98 of the engagement shaft 95 of the switching member 80, the half-ring shaped engagement section 83 rotates against the elasticity of the spring 97 with the bearing section 75 as a center, and moves away from the engagement indent 378 of the pressing member 377.

If the operating handle 311 is turned in one direction, the pressing shaft 330 rotates clockwise and the pressing shaft 330 moves downwards as described above. At this time, since the engagement section 83 of the switching member 80 is removed from the engagement indent 378 of the pressing member 377, the engagement section 360 provided on the lower part of the pressing shaft 330 passes through the opening 340D. Together with this, the pressing member 377 moves downwards relative to the vertically movable member 341, makes contact with the neck section 354 of the inner layer frame 351 of the pressing mold 340, and presses the inner layer frame 351 downwards. The contact edge 353 of the inner layer frame 351 contacts the upper edge of the front cover 201 and the front cover 201 is pushed down to the vicinity of a lower surface of the outer layer frame 342. If the pressing shaft 330 is moved further downwards, the vertically movable member 341 and the outer layer frame 342 also begin to move downwards together with the pressing shaft 330 due to the fact that the flange section 365 of the pressing shaft 330 is in contact with the opening 340D. If the pressing shaft 330 is moved still further downwards, the outer layer frame 342 comes into contact with the processing platform 155, and presses the processing platform 155 down against the resilient force of the elastic member 156. In doing this, at almost the same time, the peripheries of the sheet body 213 and the design sheet 211 that have been pressed down until they are close to the lower surface of the outer layer frame 342 by the inner layer frame 351 come into contact with the inclined surface 160 of the processing platform 155 to be folded inwards. Then the peripheral edge 203 of the front cover 201 also comes into contact with this inclined surface 160.

If the pressing shaft 330 moves further downwards and the lower end of the processing platform 155 comes into contact with the sliding platform 100 so that the processing platform 155 can no longer be pressed downwards, the peripheral edge 203 of the front cover 201 is folded further inwards by the inclined edge 160, and the peripheries of the sheet body 213 and the design sheet 211 are folded until they face upwards by the inclined surface 160 and the edge of the second mounting platform 141. At this time, the rear cover 205 having the shape of the second mounting platform 141 engages with the front cover 201 so that the peripheries of the sheet body 213 and the design sheet 211 are gripped by the peripheral edge 209 of the rear cover 205 and the peripheral edge 203 of the front cover 201, to make the button 200*a*.

At this time, even if the operating handle 311 is operated by applying an external force greater than a specified value so as to cause the pressing shaft 330 to move downwards, since the latch projections 403 provided on the clutch 400 inside the operating handle 311 are removed from the latch indents 319, the operating handle 311 slackens off with respect to the pressing shaft 330, and the pressing mold 840 and the button 200 will not be broken.

If the operating handle 311 is turned in the other direction, the pressing shaft 330 rotates counterclockwise, and the pressing shaft 330 moves upwards. Accompanying this, the vertically movable member 341 also slides upwards. The button body 200*a* remains loaded in the second pressed mold (first rear cover mounting mold) 140. If the handle 104 provided in the rear wall 103 of the sliding platform 100 is held, the second pressed mold (first rear cover mounting mold) 140 is taken out from the second opening 182 of the cover 420, and it is possible to easily remove the button body 200*a* from the second pressed mold (first rear cover mounting mold) 140. Making of the button 200 is completed upon inserting the attachment shaft 221 (or 231, 241) of the previously described mounting means 220 (or 230, 240) in the attachment hole 207 of the button body 200*a*.

With the above described button making device 301, it is easy to replace the pressing mold 340 depending on the size of a button 200 to be made. If the operating button 430 provided on the cover 420 is pressed down against the resilience of the elastic member 435, the removable ring 380 is pressed down against the resilience of the elastic member 396 via the strut 431, pressing shaft 432, and push-out rod 390, the projecting piece 382 of the removable ring 380 resists the elasticity of the magnetic body 387 and the magnetic body 349, and the pressing mold 340 can be easily removed.

As shown in FIG. 28, with the button making device 301, in order to change the size of button 200 being made, a pressing mold 440 that is larger than the pressing mold 340 is attached to the vertically movable member 341 by magnetic force of the magnetic body 387 and the magnetic body 349. Since the first pressed mold (first front cover mounting mold) 110 and the second pressed mold (first rear cover mounting mold) 140 are provided together on the attachment member 191 removably attached to the sliding platform 100, it is possible to change them over more easily. That is, it is possible to change the first pressed mold (first front cover mounting platform) 110 and the second pressed mold (first rear cover mounting platform) 140 at the same time. For example, as shown in FIG. 28, an attachment member 191*a* on which a first pressed mold (second front cover mounting mold) 110*a* that is larger than the first pressed mold (first front cover mounting mold) 110 and a second pressed mold (second rear cover mounting mold) 140*a* that is larger than the second pressed mold (first rear cover mounting mold) 140 are provided can be simply attached to the sliding platform 100.

Figure 33:
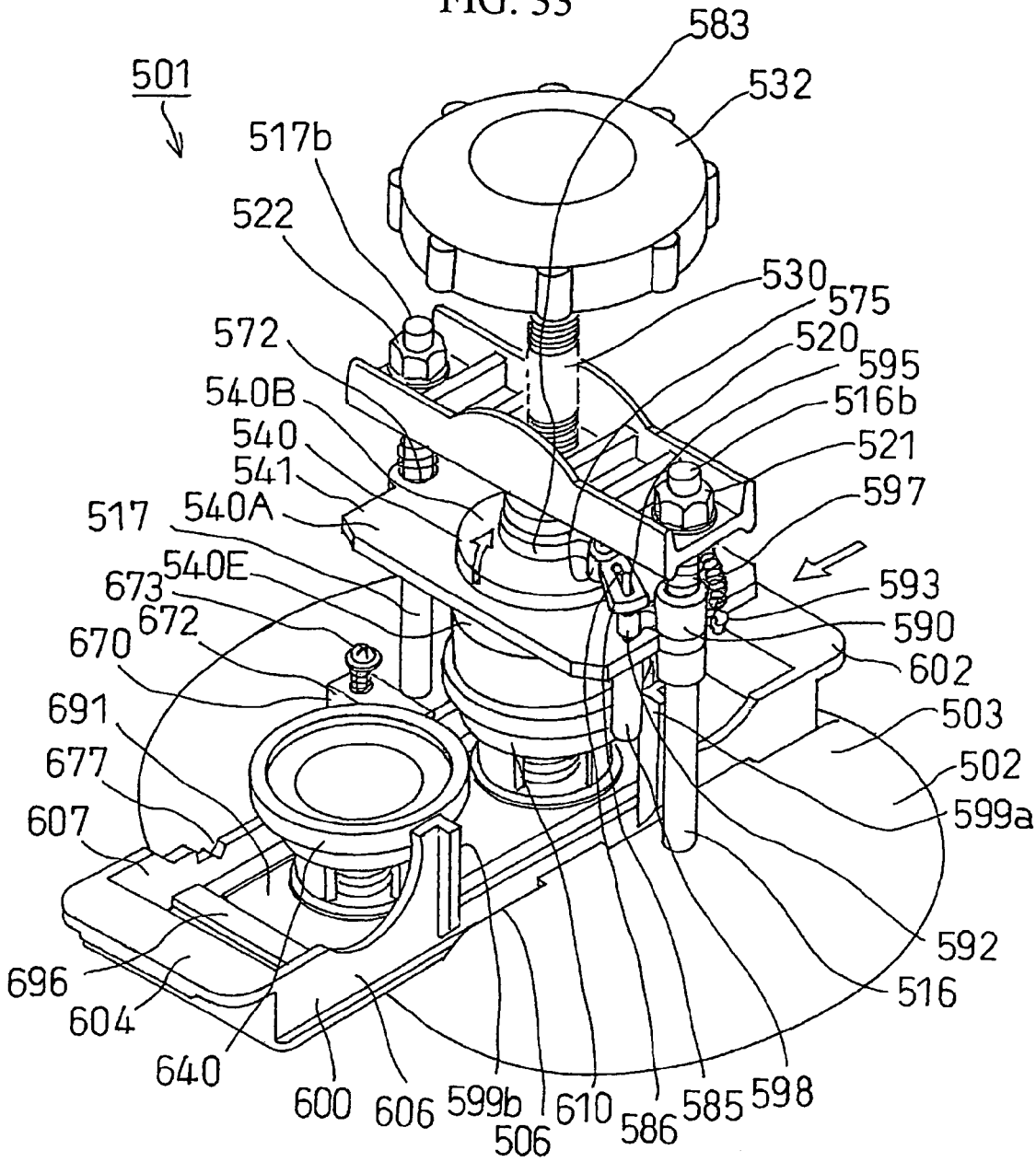
FIG. 33 is an overall perspective view showing a button making device of the present invention.
Figure 34:
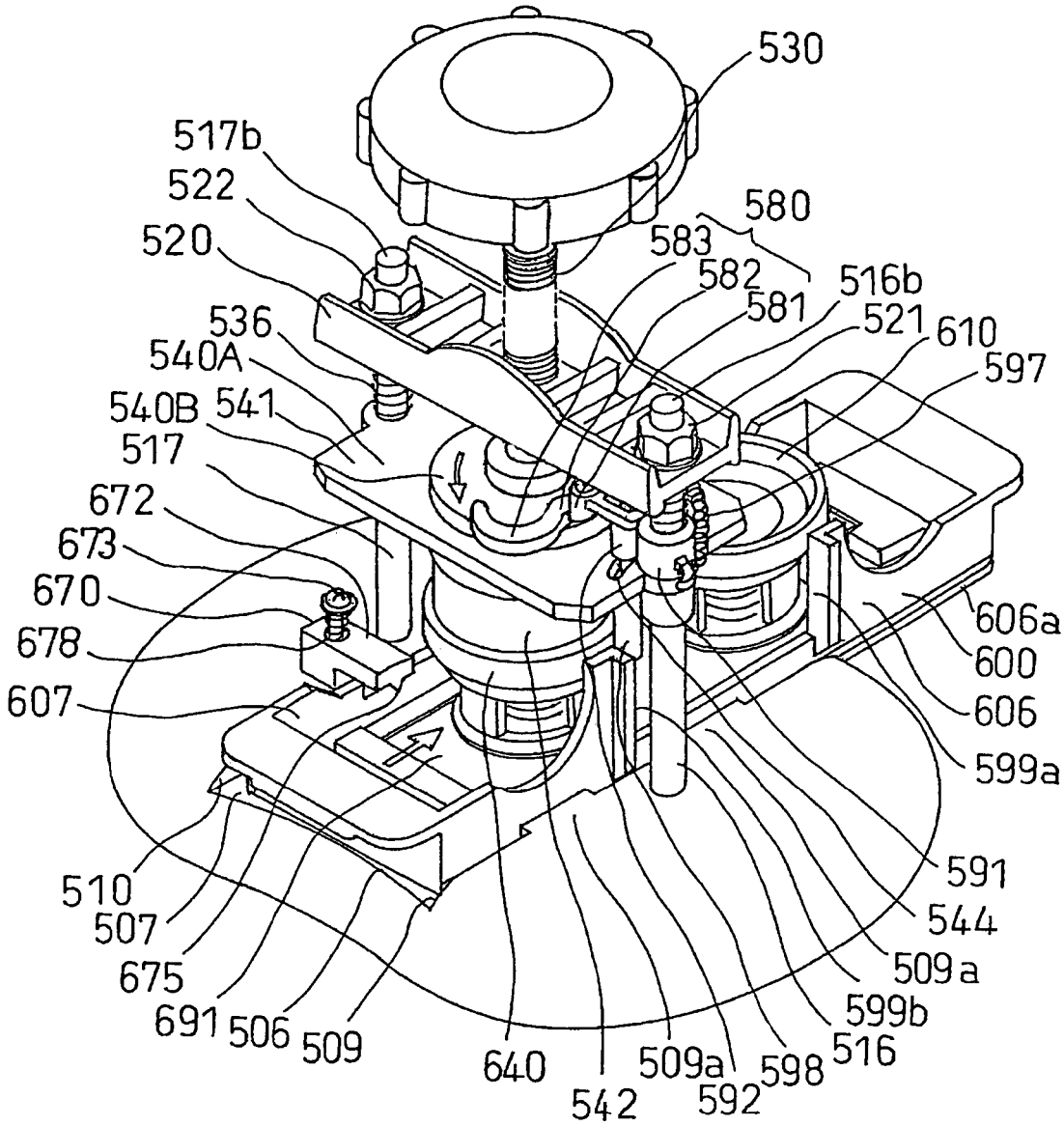
FIG. 34 is an overall perspective view describing the movement in FIG. 33.
Figure 35:
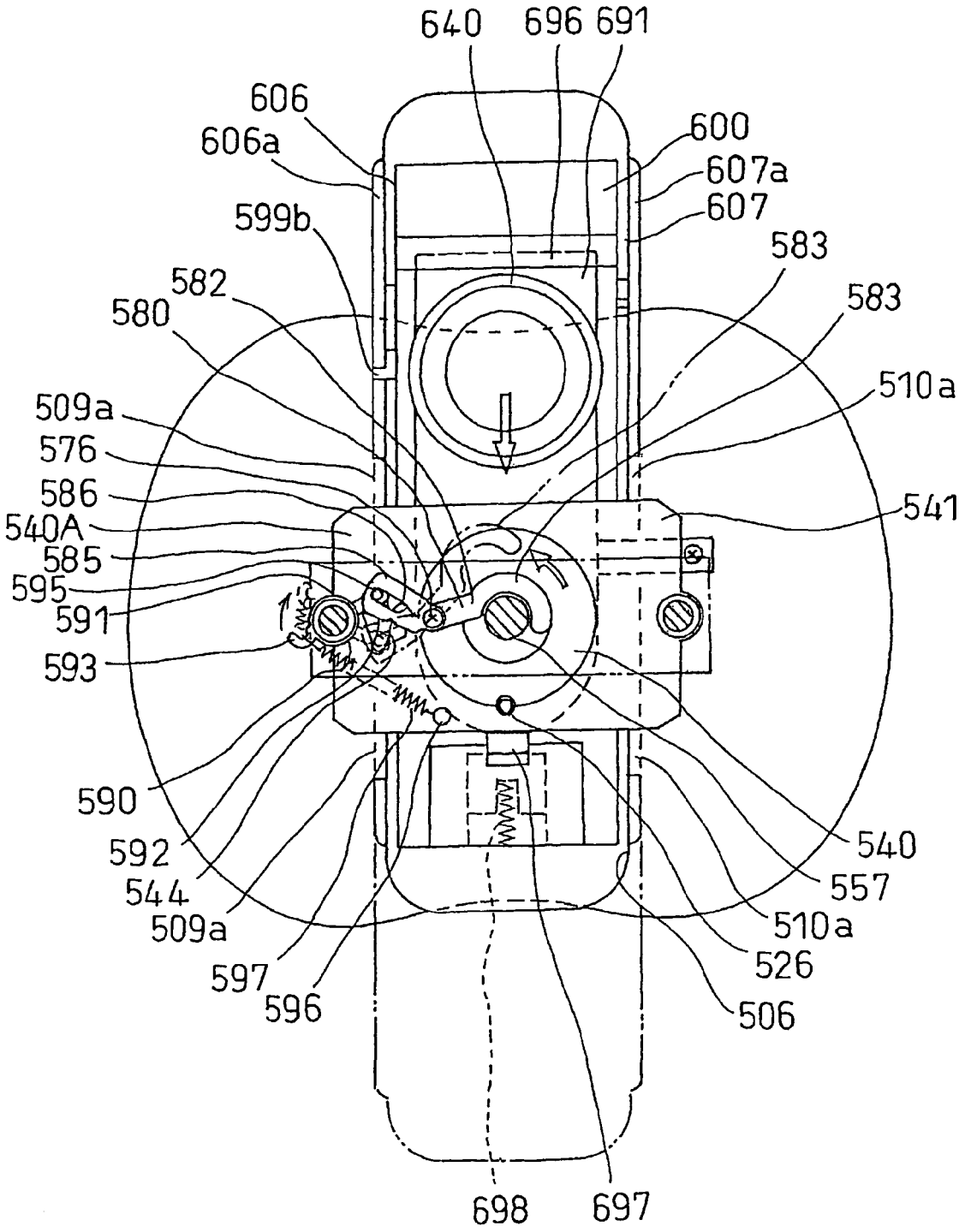
FIG. 35 is an overall plan view describing the movement in FIG. 33.
Figure 36:
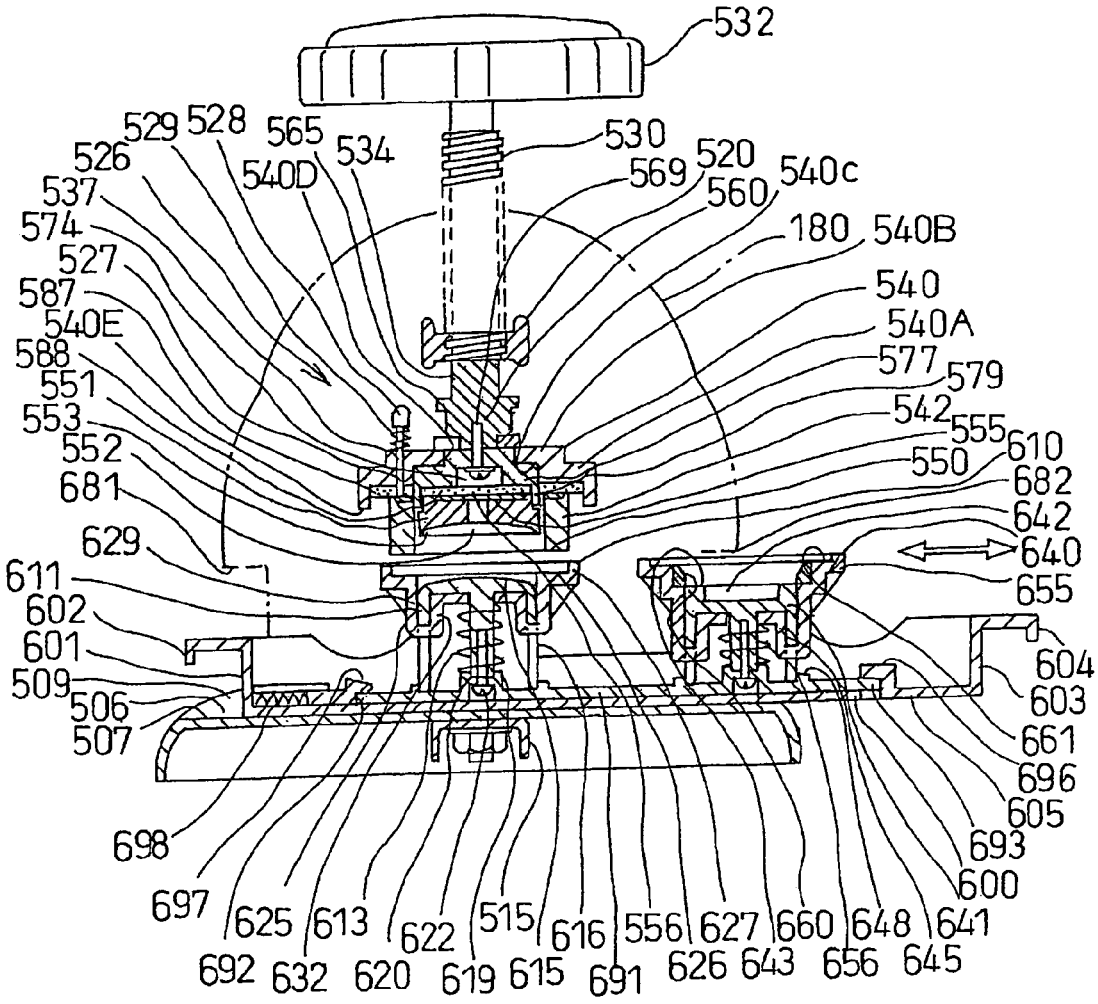
FIG. 36 is an overall side cross sectional view of FIG. 33.
Figure 37:
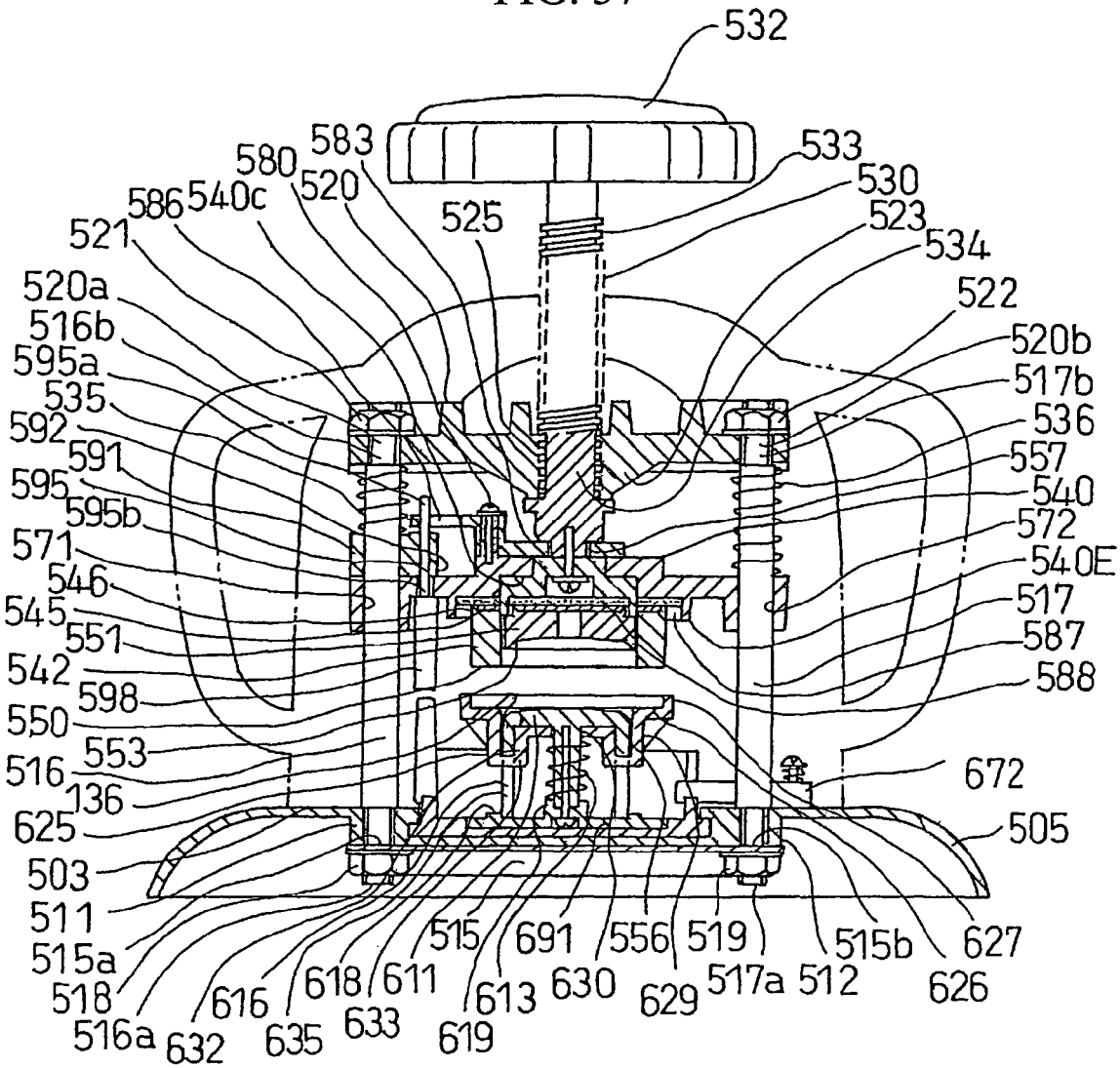
FIG. 37 is an overall front elevation cross sectional view showing a first pressed mold.
Figure 38:
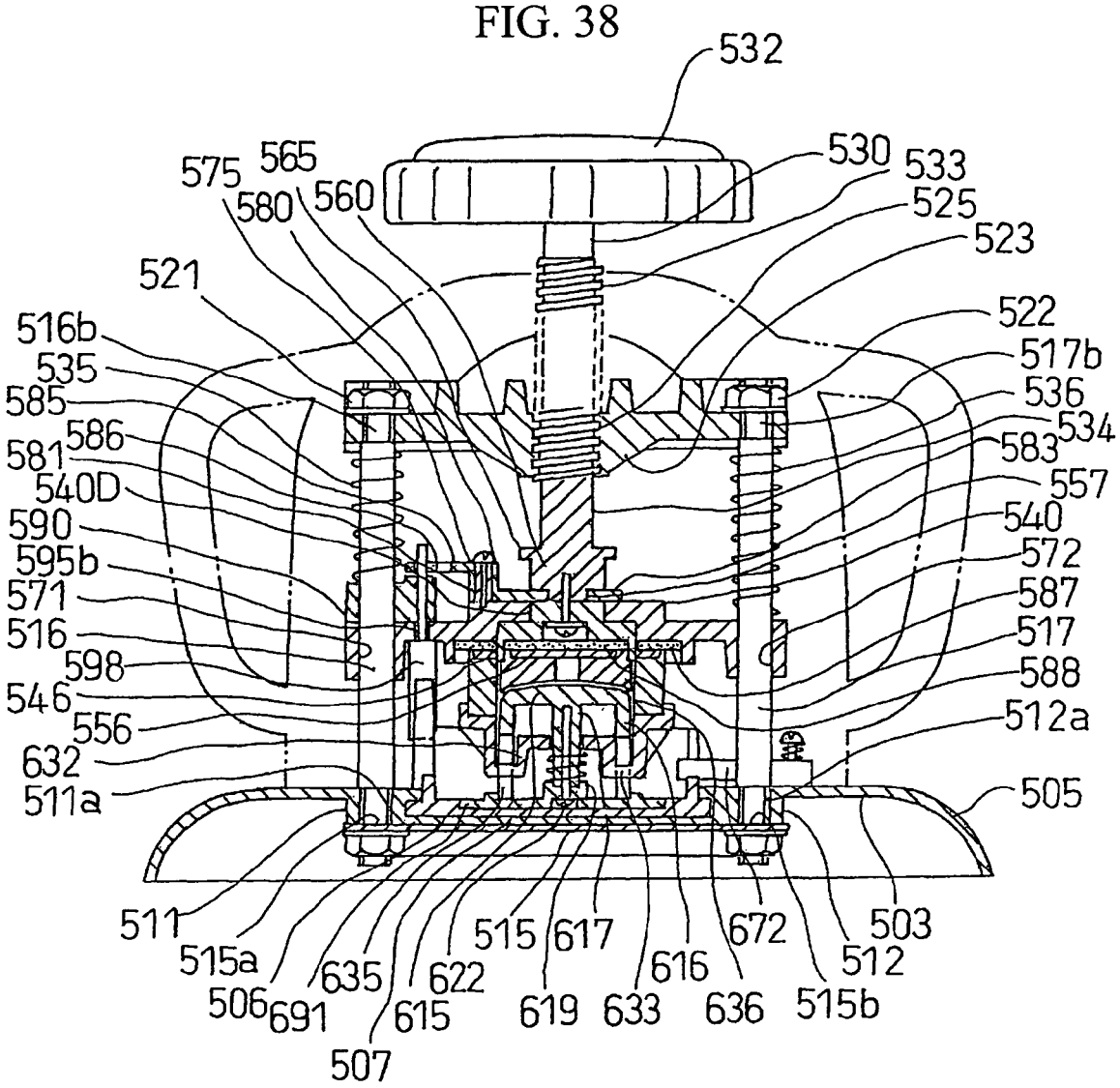
FIG. 38 is an overall front elevation cross sectional view describing the movement in FIG. 37.
Figure 39:
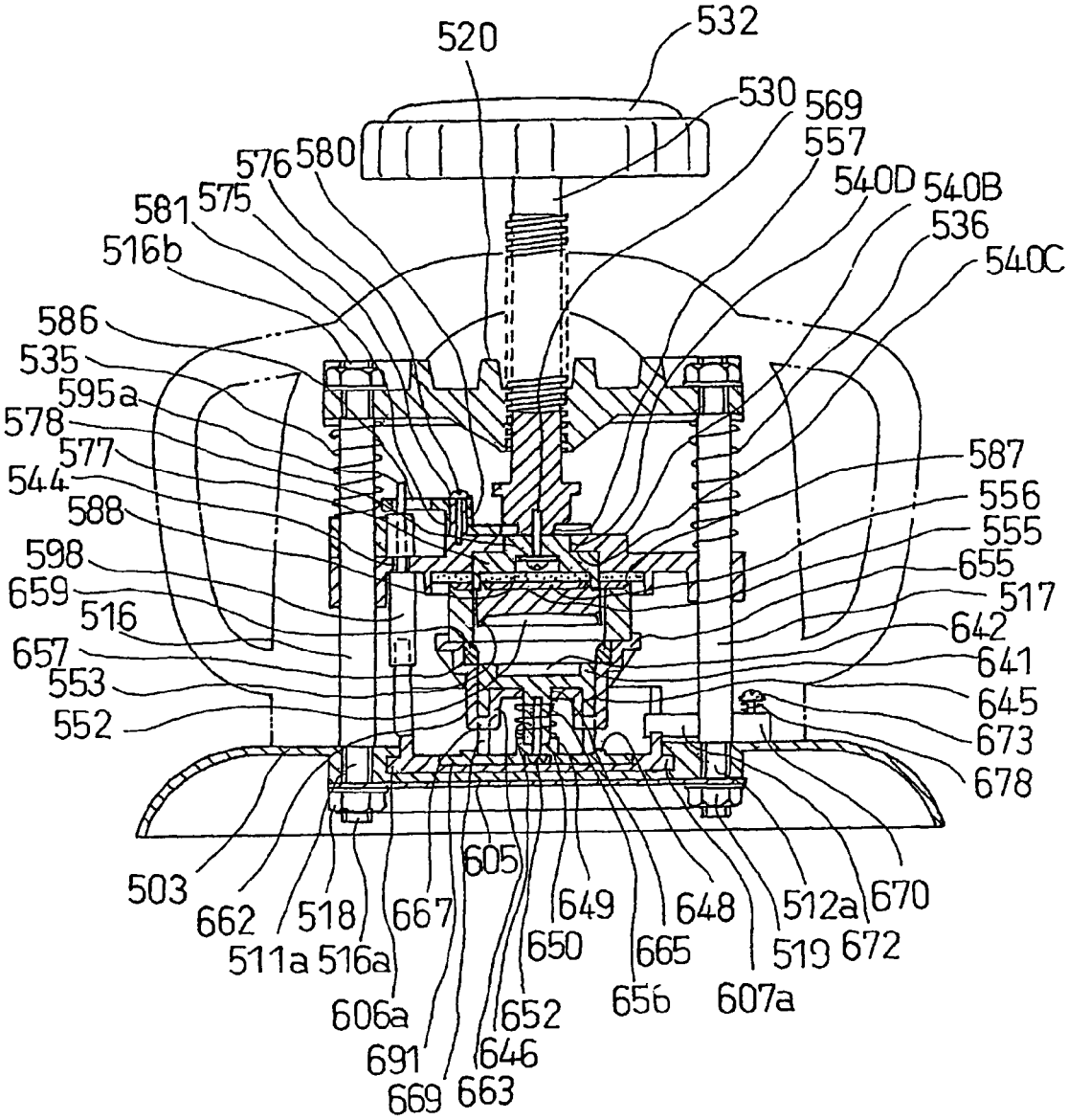
FIG. 39 is an overall front elevation cross sectional view showing a second pressed mold.
Figure 40:
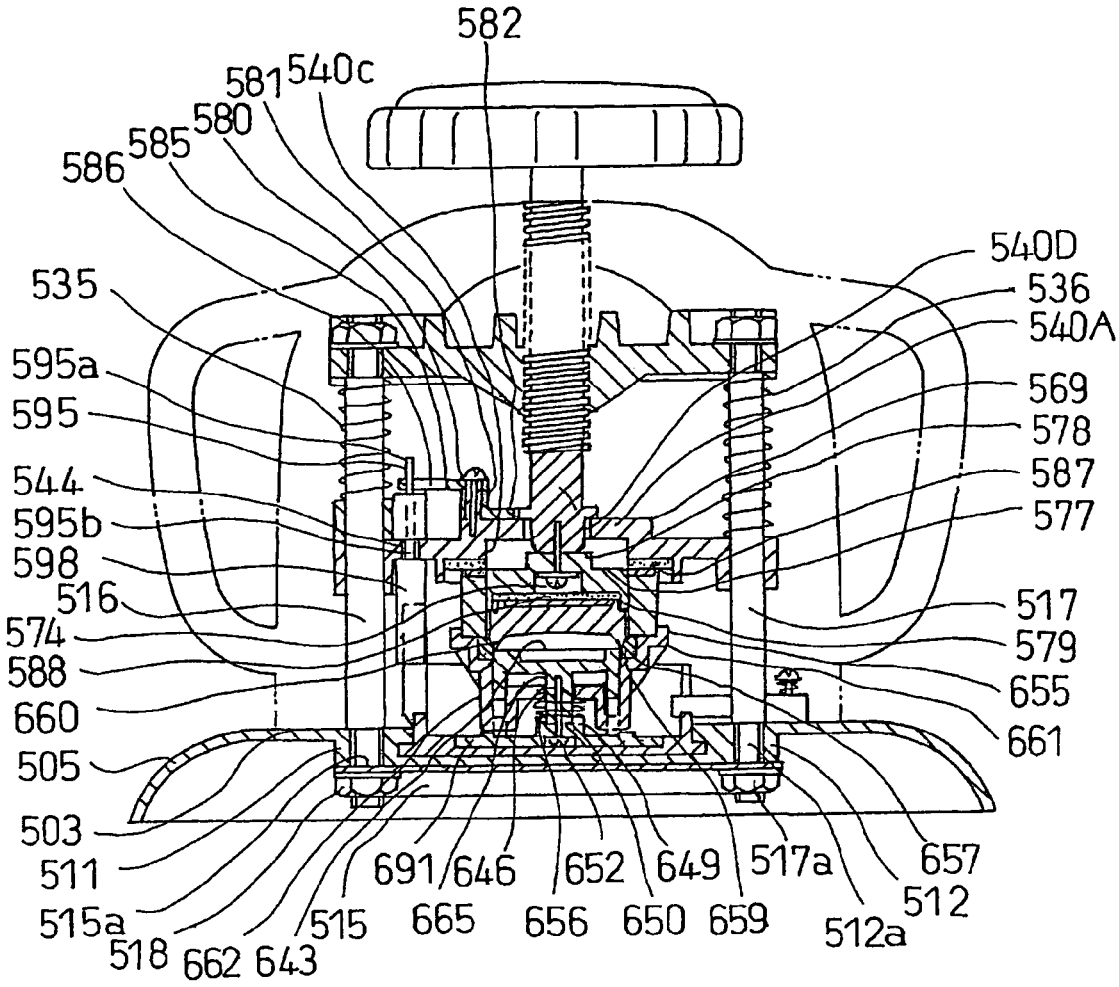
FIG. 40 is an overall front elevation cross sectional view describing the movement in FIG. 39.
Figure 41:
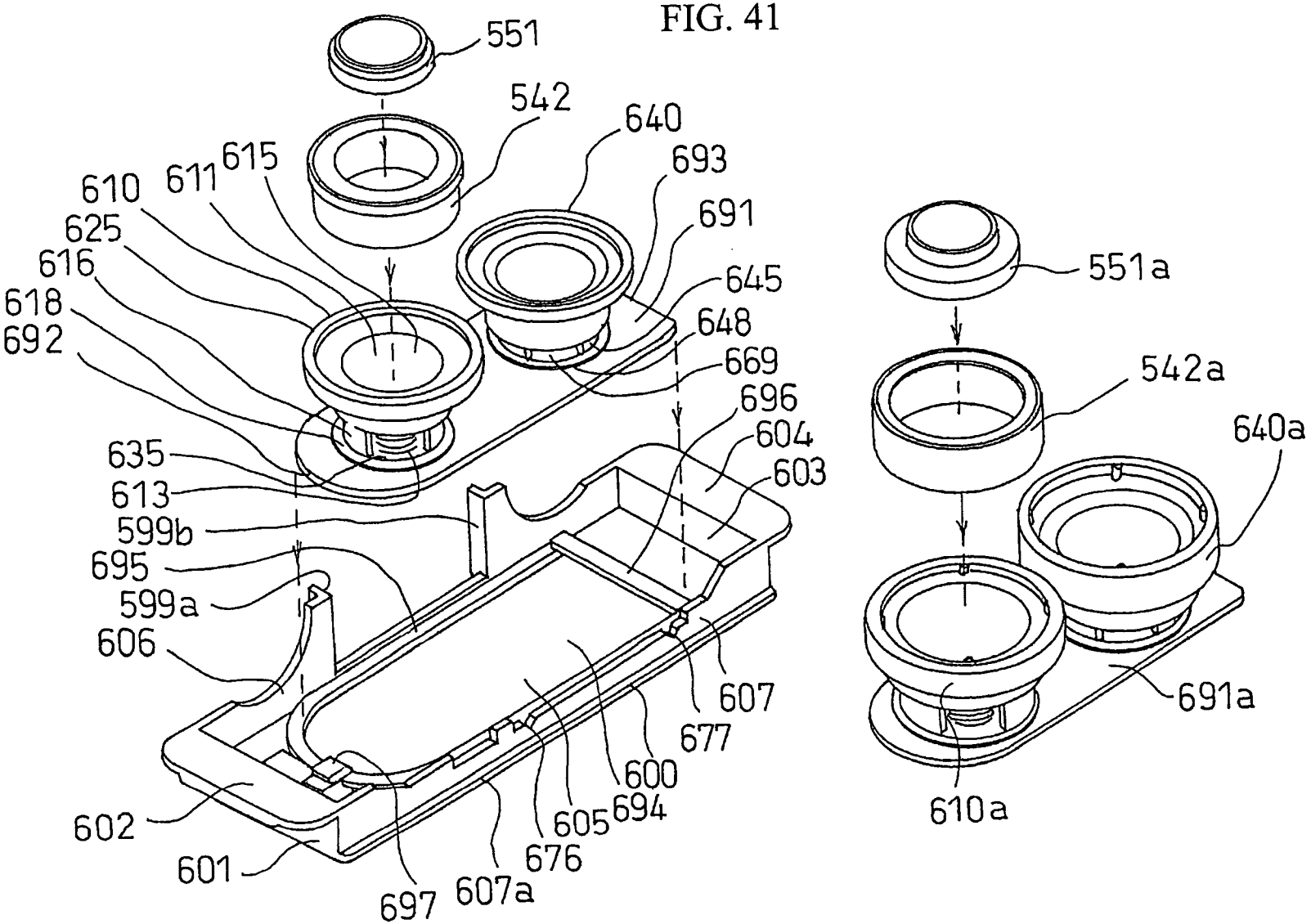
FIG. 41 is an enlarged perspective view showing the essential parts of a button making device.

Further, one embodiment of a button making device of the present invention will now be described based on FIG. 33 to FIG. 41. FIG. 33 is an overall perspective view showing a button making device of the present invention. FIG. 34 is an overall perspective view describing the movement in FIG. 33. FIG. 35 is an overall plan view describing the movement in FIG. 33. FIG. 36 is an overall cross sectional side view of FIG. 33. FIG. 37 is an overall front elevation cross sectional view showing a first pressed mold. FIG. 38 is an overall front elevation cross sectional view describing the movement in FIG. 37. FIG. 39 is an overall front elevation cross sectional view showing a second pressed mold. FIG. 40 is an overall front elevation cross sectional view describing the movement in FIG. 39. FIG. 41 is an enlarged perspective view showing essential parts of a button making device.

The button making device 501 makes a button 700 comprising a front cover 701 having a substantially circular front surface plate 702 and a peripheral edge 703 extending further down than the front surface plate 702, and a rear cover 705 having a substantially circular rear surface plate 706 and a peripheral edge 709 extending further up than the rear surface plate 706, with the front cover 701 engaged with the rear cover 705 so that the peripheral edge 709 of the rear cover 705 and the peripheral edge 703 of the front cover 701 come into contact.

The button making device 501 comprises a base 502, a sliding platform 600 provided on an upper surface of the base 502 capable of reciprocating, first and second pressed molds 610, 640 arranged at either side in the direction of reciprocation of the sliding platform 600, a fixed member 520 fixed on an upper part of the base 502 via struts 516, 517, a pressing shaft 530 provided on the fixed member 520 capable of movement in the vertical direction, a pressing mold 540 provided on a lower end of the pressing shaft 530 for making a button 700 by being brought into contact with the first pressed mold (first front cover mounting mold) 610 and the second pressed mold (first rear cover mounting mold) 640, and an operation means 532 for operating the pressing shaft 530. The first pressed mold 610 (first front cover mounting mold) and the second pressed mold 640 (first rear cover mounting mold) are provided on an attachment member (first attachment member) 691 removably attached to the sliding platform 600. The pressing mold 540 is removably attached to the lower end of the pressing shaft 530 by magnetic force.

The button making device 501 forms a button 700 by placing a sheet body 713 on the front surface plate 702 of the front cover 701, and fitting the front cover 701 into the rear cover 705 so that the edge of the sheet body 713 is gripped between the peripheral edge 709 of the rear cover 705 and the peripheral edge 703 of the front cover 701.

The first pressed mold (first front cover mounting mold) 610 comprises a first mounting platform 611 for mounting the front cover 701, and a guide platform 625 provided at the periphery of the first mounting platform 611 for mounting a sheet body 713. The guide platform 625 is provided so as to be capable of up and down movement and is pressed upwards by an elastic member 613. The second pressed mold (first rear cover mounting mold) 640 comprises a second mounting platform 641 for mounting the rear cover 705, and a processing platform 655 provided around the second mounting platform 641 for folding a peripheral edge 703 of the front cover 701 towards the peripheral edge 709 of the rear cover 705 so that the edge of the sheet body 713 is gripped by the peripheral edge 703 of the front cover 701 and the peripheral edge 709 of the rear cover 705. The processing platform 655 is capable of upward and downward movement and is pressed upwards by an elastic member 656.

The pressing mold 540 comprises a pressing mold body 540A, an outer layer frame 542, and an inner layer frame 551 that is shallower than the outer layer frame 542 and is provided inside the outer layer frame 542. The outer layer frame 542 and the inner layer frame 551 are removably attached to the pressing mold body 540A by magnetic force. The pressing mold body 540A has a detachment means 526, for causing the outer layer frame 542 and inner layer frame 551 that are attached by magnetic force to be detached against the magnetic force. The pressing mold body 540A also has a switching member 580, for switching the timing at which the outer layer frame 542 and inner layer frame 551 respectively begin to move downwards, when the pressing shaft 530 begins to move downwards, depending on the position of the first pressed mold (first front cover mounting mold) 610 and the second pressed mold 640 (first rear cover mounting mold). That is, when the first pressed mold (first front cover mounting mold) 610 is positioned substantially directly below the pressing mold 540, the switching member 580 causes the outer layer frame 542 and the inner layer frame 551 to move downwards at the same time accompanying downward movement of the pressing shaft 530.

When the sliding platform 600 moves and the second pressed mold (first rear cover mounting mold) 640 is positioned substantially directly below the pressing mold 540, the switching member 580 first of all causes only the inner layer frame 551 to move downwards accompanying downward movement of the pressing shaft 530. After the pressing shaft 530 has moved down for a specified distance, the switching member 580 allows the outer layer frame 542 to move. In this way, if the operation means 532 is operated to move the pressing shaft 530 downwards when the first pressed mold (first front cover mounting mold) 610 is positioned substantially directly below the pressing mold 540, the outer layer frame 542 and the inner layer frame 551 begin to move downwards simultaneously. The outer layer frame 542 then comes into contact with the guide platform 625 of the first pressed mold (first front cover mounting mold) 610 so that the guide platform 625 is pressed down against the resilience of the elastic member 613, and the sheet body 713 is folded along the peripheral edge 703 of the front cover 701.

Also, if the operation means 532 is operated to cause the pressing shaft 530 to move downwards when the second pressed mold (first rear cover mounting mold) 640 is positioned substantially directly below the pressing mold 540, first of all, the inner layer frame 551 begins to move downwards. After the pressing shaft 530 has moved downwards for a specified distance, the outer layer frame 542 then begins to move. If the pressing shaft 530 is caused to move further downwards, the outer layer frame 542 and the inner layer frame 551 both come into contact with the processing platform 655 of the second pressed mold (first rear cover mounting mold) 640 to press the processing platform 655 down against the resilience of the elastic member 656. The peripheral edge 703 of the front cover 701 is then folded towards the peripheral edge 709 of the rear cover 705 so that the edge of the sheet body 713 is gripped between the peripheral edge 703 of the front cover 701 and the peripheral edge 709 of the rear cover 705.

The sheet body 713 described above is formed of a transparent material, and it is possible to place a design sheet 711 printed with a representation of characters, a pattern, a design, or any combination of these, between the sheet body 713 and the surface plate 702 of the front cover 701.

The pressing shaft 530 described above has a male threaded section 533 capable of moving in an axial direction by being screwed into a female threaded section 525 provided on the fixed member 520, the pressing mold 540 rotatably provided on a lower end, and an operating handle 532 provided on an upper part as an operation means. The male threaded section 533 is configured so that before the pressing mold 540 comes into contact with the fixed member 520 as a result of upwards movement of the pressing shaft 530, it is separated from the female threaded section 525 of the fixed member 520, and the pressing shaft 530 slackens off.

Figure 42:
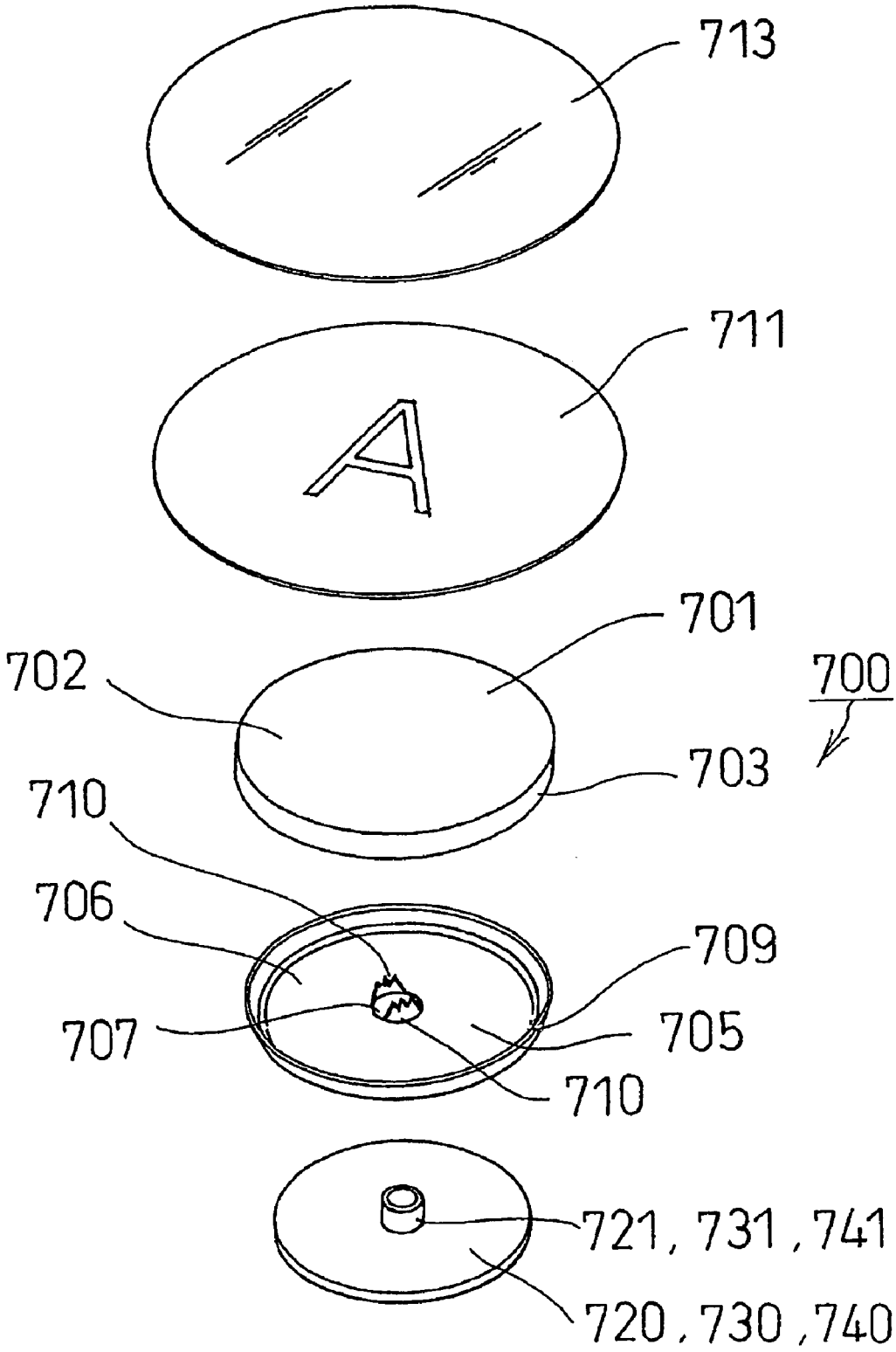
FIG. 42 is an overall exploded view showing a button of the present invention.
Figure 43:
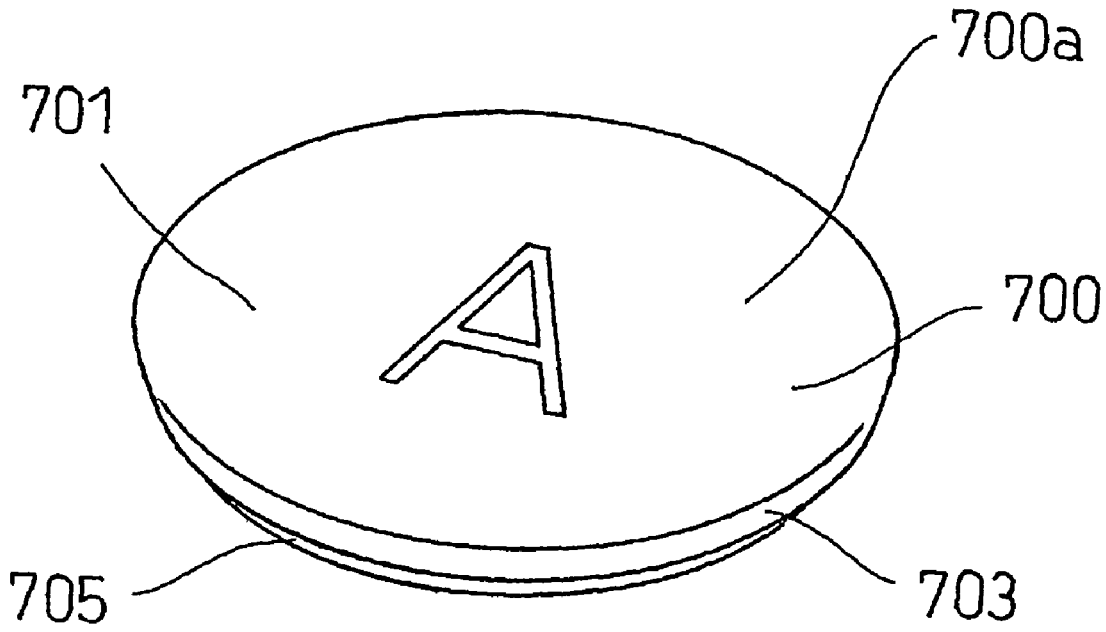
FIG. 43 is an overall perspective view of FIG. 42 assembled.
Figure 44:
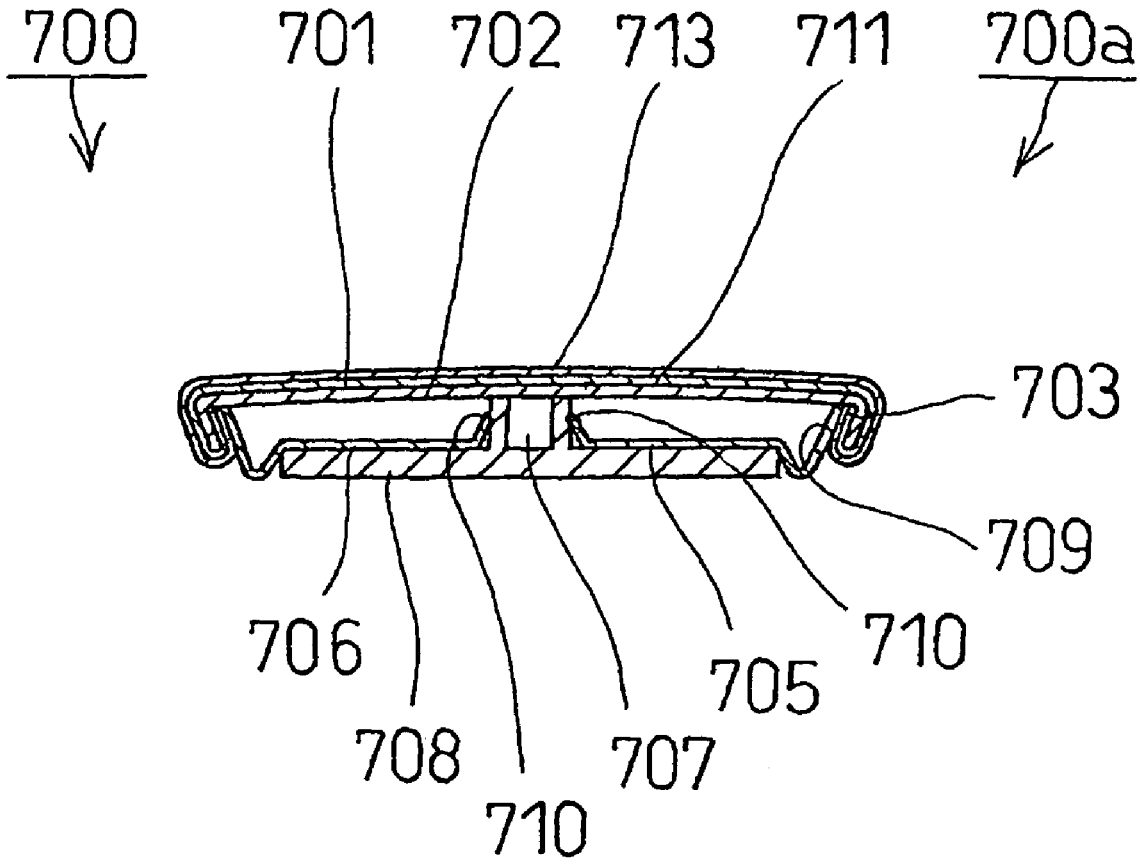
FIG. 44 is a side cross sectional view of FIG. 43.
Figure 45:
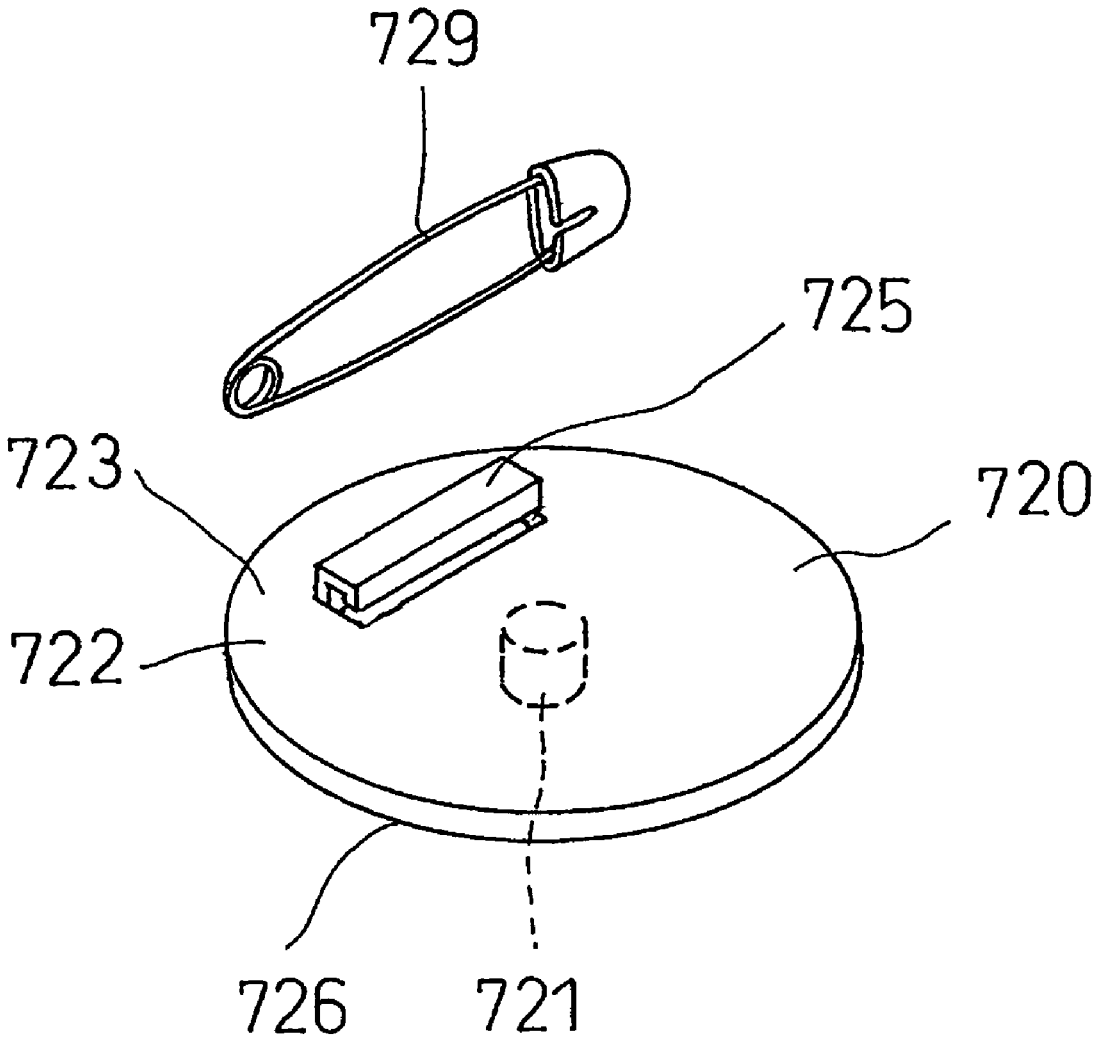
FIG. 45 is a perspective view showing one embodiment of the mounting means of the present invention.
Figure 46:
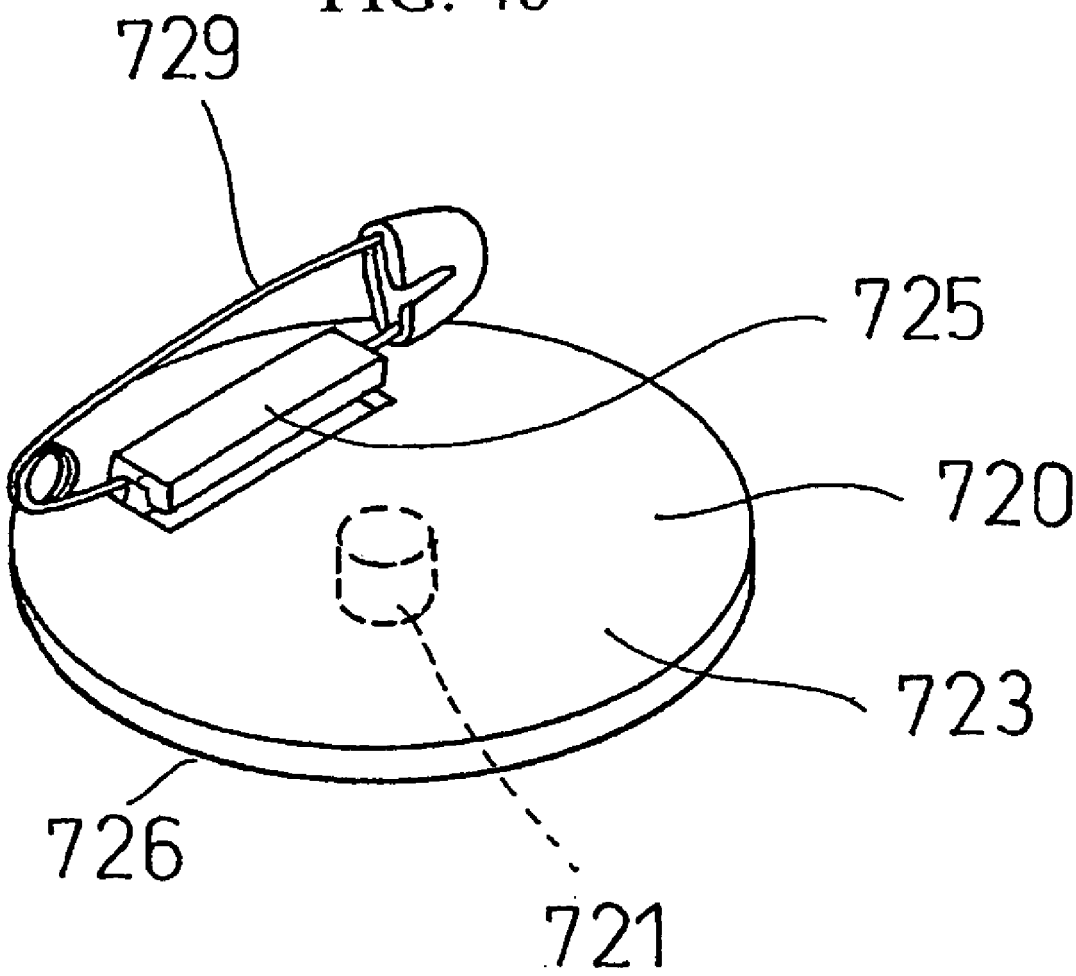
FIG. 46 is a perspective view showing the state where a detachable pin is attached to the mounting means of FIG. 45.
Figure 47:
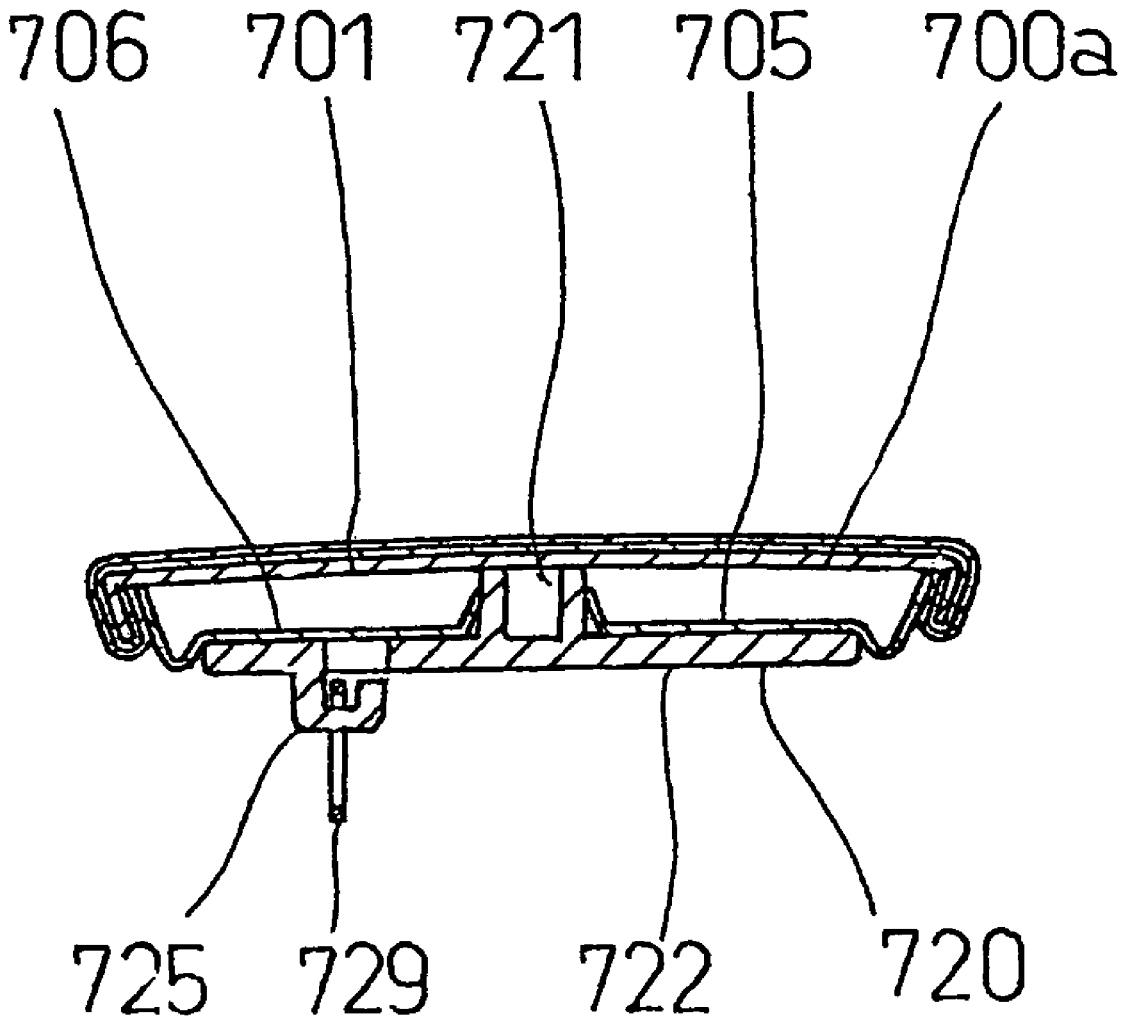
FIG. 47 is a side cross sectional view of a whole button with the mounting means of FIG. 46 attached to a rear cover.
Figure 48:
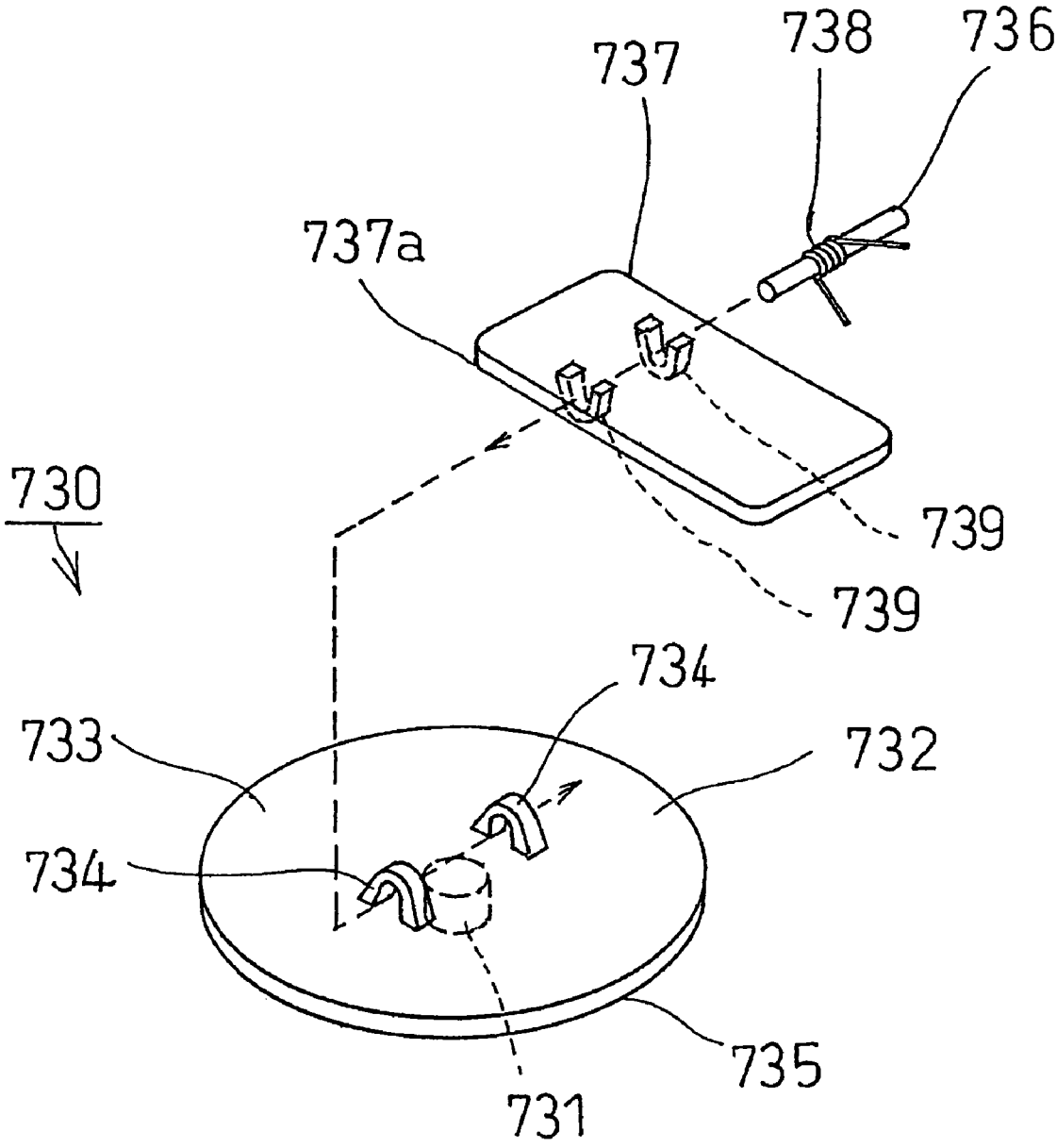
FIG. 48 is a perspective view showing another embodiment of the mounting means of the present invention.
Figure 49:
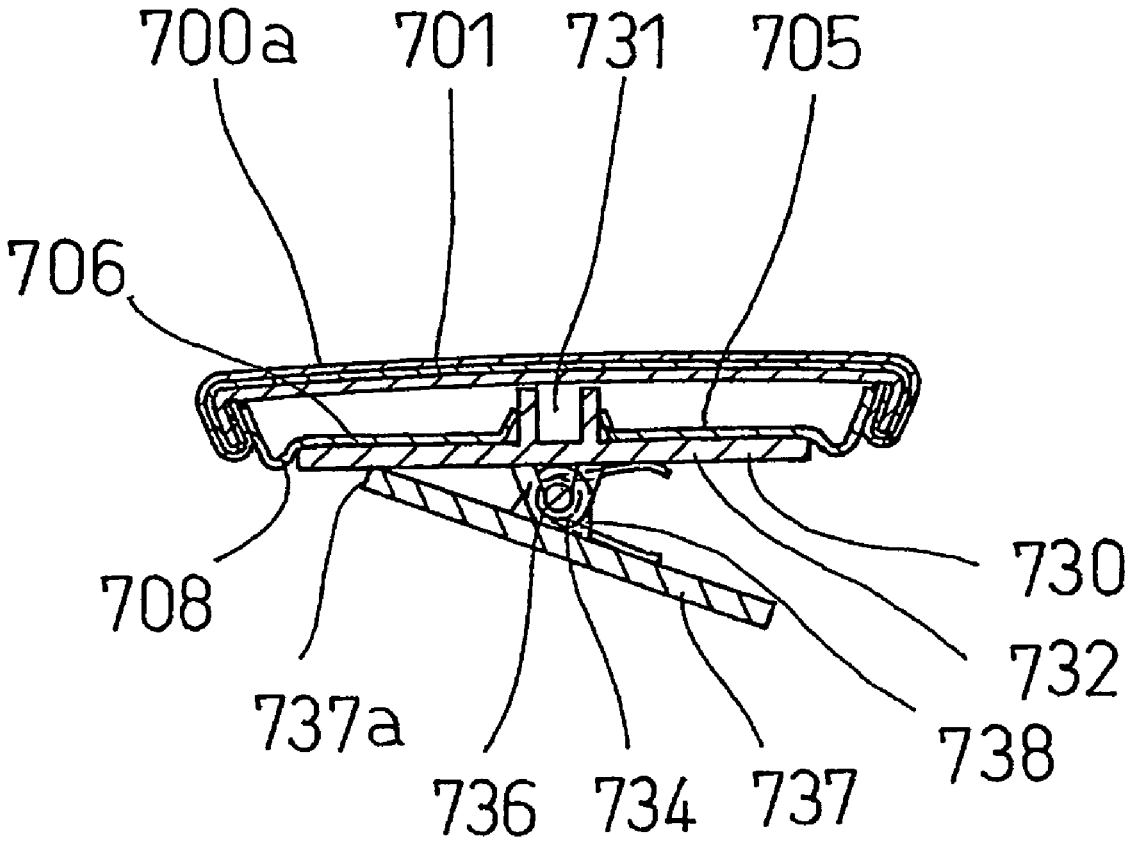
FIG. 49 is an overall side cross sectional view of a button with the mounting means of FIG. 48 having gripping plates attached to a rear cover.
Figure 50:
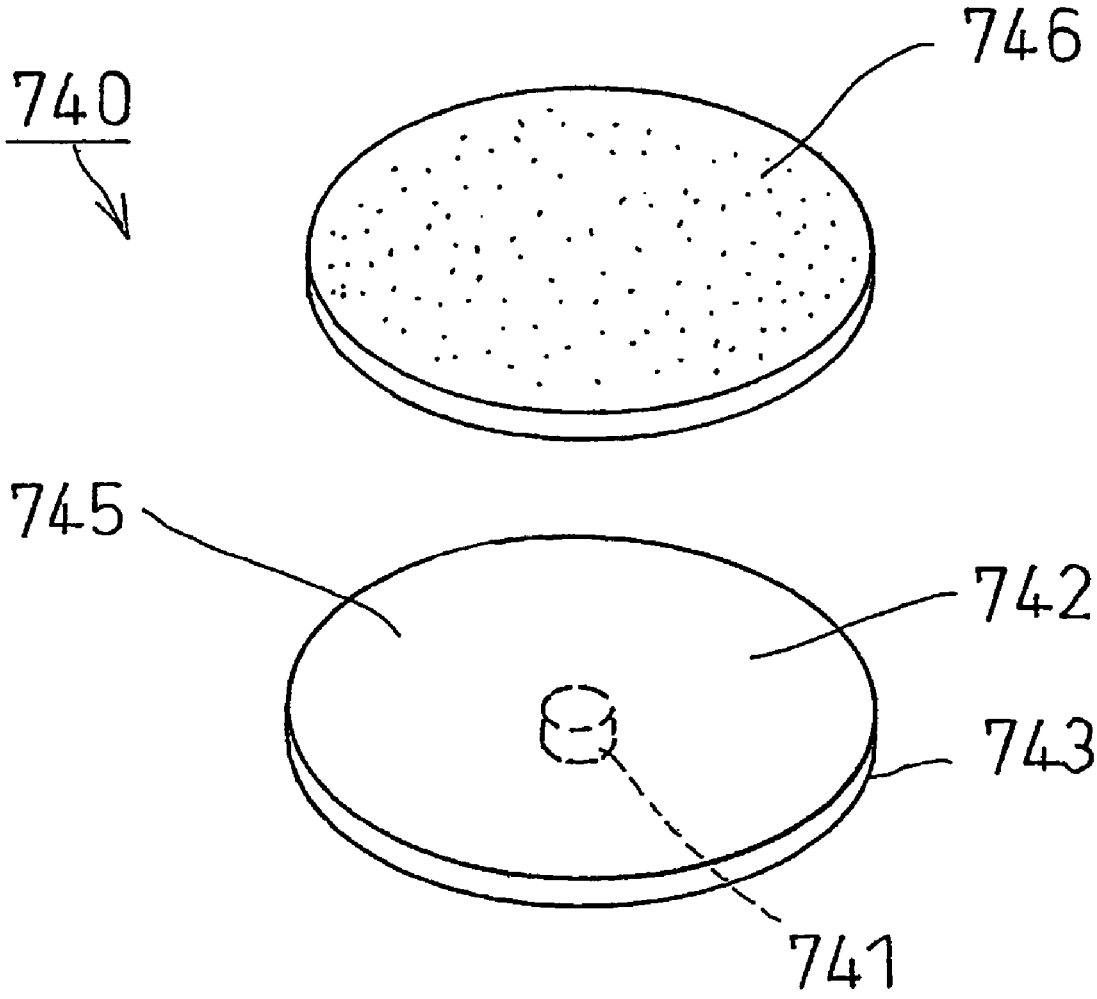
FIG. 50 is a perspective view showing another embodiment of the mounting means of the present invention.
Figure 51:
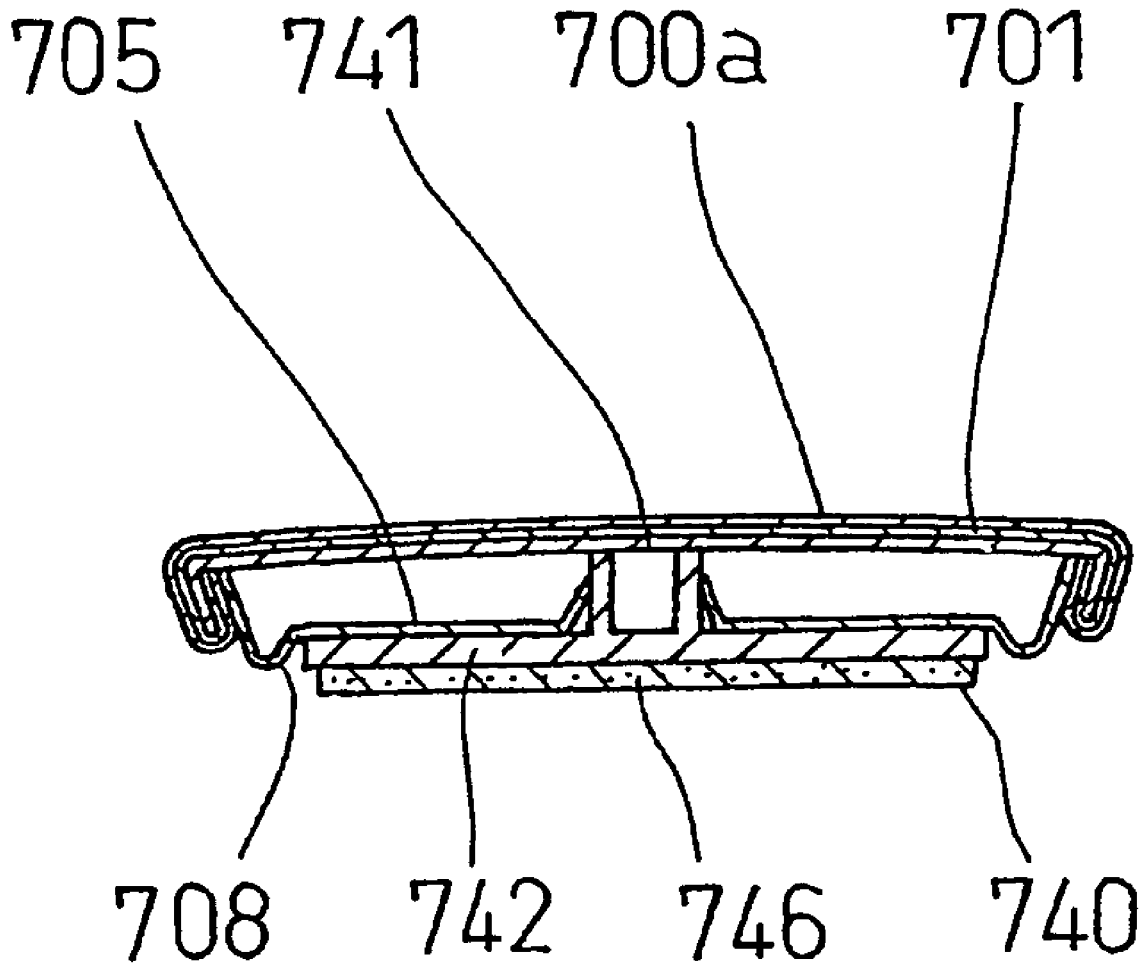
FIG. 51 is an overall side cross sectional view of a button with the mounting means of FIG. 50 having a magnetic plate attached to a rear cover.

The button making device 501 will be described in more detail later, but now detailed description of an embodiment of the button will be given based on FIG. 42 to FIG. 51. FIG. 42 is an overall exploded view showing a button of the present invention. FIG. 43 is an overall perspective view of FIG. 42 assembled. FIG. 44 is a side cross sectional view of FIG. 43. FIG. 45 is a perspective view showing one embodiment of a mounting means of the present invention. FIG. 46 is a perspective view showing a state where a detachable pin is attached to the mounting means of FIG. 45. FIG. 47 is a side cross sectional view of a whole button with the mounting means of FIG. 46 attached to a rear cover. FIG. 48 is a perspective view showing another embodiment of the mounting means of the present invention. FIG. 49 is an overall side cross sectional view of a button with the mounting means of FIG. 48 having gripping plates attached to a rear cover. FIG. 50 is a perspective view showing another embodiment of the mounting means of the present invention. FIG. 51 is an overall side cross sectional view of a button with the mounting means of FIG. 50 having a magnetic plate attached to a rear cover.

The button 700 comprises the rear cover 705 having the peripheral edge 709 facing upwards, the front cover 701 having the peripheral edge 703 facing downwards, and a mounting means 720. The rear cover 705 is attached to the front cover 701 by folding the peripheral edge 703 of the front cover 701, and has an attachment hole 707 formed in a substantially central part. The mounting means 720, 730, 740 can be mounted on an item, such as a clothing, a hat or a bag, and are provided with attachment shafts 721, 731, 741 for rotatably attaching to the attachment hole 707 of the rear cover 705.

The button will now be described. The button 700 comprises the body 700*a* and the mounting means 720, as shown in FIG. 43. The button body 700*a* comprises the front cover 701, the rear cover 705, the design sheet 711, and a sheet body 713. Before processing, the front cover 701 has a curved front plate 702, and the peripheral edge 703 is bent substantially at a right angle to face downwards with respect to the front plate 702. Before processing, the rear cover 705 has the rear plate 706 formed with an attachment hole 707 for attaching the mounting means 720, the peripheral edge 709 bent almost at a right angle to face upwards with respect to the rear surface plate 706, and a circular indent 708 formed in the rear surface plate 706.

The design sheet 711 is a circular piece of paper, and can be a cut-out from a magazine or the like. The sheet body 713 is formed of thin transparent synthetic resin. It is also possible to print the representation of characters, a design, a pattern or a combination of these, directly on the sheet body 713. In that case, there may not be a design sheet. The button body 700*a* is made by overlapping the design sheet 711 and the sheet body 713 on an upper surface of the front cover 701, and bending the peripheral edge 703 of the front cover 701 so that the peripheries of the design sheet 711 and the sheet body 713 are gripped between the peripheral edge 703 of the front cover 701 and the peripheral edge 709 of the rear cover 705. A pair of latch claws 710, 710 are formed in a protruding manner on an outer edge of the attachment hole 707 facing inwards.

As shown in FIG. 45 to FIG. 47, the mounting means 720 comprises a base plate 722, a substantially L-shaped latch section 725 formed on the surface 723 of the base plate 722, and an attachment shaft 721 formed in a protruding manner at a substantially central part of the rear surface 726 of the base plate 722, and is integrally formed using synthetic resin. The mounting means 720 has a detachable pin 729 attached to the latch section 725, and the attachment shaft 721 is fitted into the attachment hole 707 of the rear cover 705 so as to engage with an indent 708 of the rear cover 705. If the attachment shaft 721 is fitted into the attachment hole 707, it engages with the latch claws 710, 710 formed at the edge of the attachment hole 707.

As shown in FIG. 48 and FIG. 49, the mounting means 730 comprises a base plate 732, a pair of substantially U-shaped bearing pieces 734, 734 formed substantially in the middle of the front surface 733 of the base plate 732, and an attachment shaft 731 formed in a protruding manner at a substantially central part of the rear surface 735 of the base plate 732, and is integrally formed using synthetic resin. The mounting means 730 has a gripping plate 737 rotatably attached between the pair of bearing pieces 734, 734 via a strut 736, and one end 737*a* of the gripping plate 737 is pressed against the rear surface 735 of the base plate 732 by a elastic member 738 such as a spring.

Specifically, the gripping plate 737 has a pair of substantially U-shaped bearing pieces 739, 739 interposed between the pair of bearing pieces 734, 734, the strut 736 fitted between the pair of bearing pieces 734, 734 and the pair of bearing pieces 739, 739 to rotatably attach the gripping plate 737 to the base plate 732. The attachment shaft 731 is fitted into the attachment hole 707 of the rear cover 705 so as to engage with the indent 708 of the rear cover 705. If the attachment shaft 731 is fitted into the attachment hole 707, it engages with the latch claws 710, 710 formed at the edge of the attachment hole 707.

As shown in FIG. 50 and FIG. 51, the mounting means 740 comprises a base plate 742, and an attachment shaft 741 formed projecting out in a substantially central part of the rear surface 743 of the base plate 742, and is integrally formed of synthetic resin. The mounting means 740 has a magnetic plate 746 attached to the front surface 745 of the base plate 742 using adhesive, and the attachment shaft 741 is fitted into the attachment hole 707 of the rear cover 705 so as to engage with the indent 708 of the rear cover 705. If the attachment shaft 741 is fitted into the attachment hole 707, it latches with the latch claws 710, 710 formed at the edge of the attachment hole 707.

The button making device 501 will now be described. The base 502 is integrally formed using synthetic resin and comprises an upper wall 503 and a peripheral wall 505 formed in a curved fashion at the peripheral edge of the upper wall 503. The upper wall 503 has a substantially angular U-shaped guide groove 506 extending in a front to rear direction. The guide groove 506 has a bottom wall 507 and side walls 509 and 510, with guide projections 509*a* and 510*a* formed on upper parts of the side walls 509 and 510. Also, bosses 511 and 512 having substantially the same height as the bottom wall 507 of the guide groove 506 are formed at a substantially central part of the upper wall 503 of the base 502, on either side at a right angle to the guide groove 506 (lateral direction), sandwiching the guide groove 506. Bosses 511 and 512 have through holes 511*a* and 512*a* extending to the upper wall 503.

A reinforcement member 515 having a substantially angular U-shaped cross section is formed in the bottom wall 507 of the guide groove 506 of the base 502 at a right angle to the guide groove 506 (lateral direction). This reinforcement member 515 is made of steel material. The reinforcement member 515 contacts the bosses 511 and 512, and holes 515*a* and 515*b* are formed on either side at positions that are the same as the through holes 511*a* and 512*a* of the bosses 511 and 512. Struts 516 and 517 having a substantially circular cross section are erected on the base 502. The struts 516 and 517 are made of steel material.

One strut 516 has a male threaded section 516*a* formed on a lower part, which is inserted into the through hole 511*a* of the boss 511 and a hole 515*a* of the reinforcement member 515 and is fastened using a nut 518. One strut 516 is thus fixed substantially perpendicular to the boss 511 and the reinforcement member 515. The other strut 517 has a male threaded section 517*a* formed on a lower part, which is inserted into the through hole 512*a* of the boss 512 and a hole 515*b* of the reinforcement member 515 and is fastened using a nut 519. The other strut 517 is thus fixed substantially perpendicular to the boss 512 and the reinforcement member 515.

The fixed member 520 having a substantially H-shaped cross section is fixed substantially horizontally to an upper part of the base 502 via the struts 516 and 517. The fixed member 520 is integrally formed of hard synthetic resin having durability and abrasion resistance, such as polycarbonate. The one strut 516 has a male threaded section 516*b* formed on an upper part, which is inserted into a hole 520*a* formed in one end of the fixed member 520 and is fastened using a nut 521. The one strut 516 thus fixes the fixed member 520. The other strut 517 has a male threaded section 517*b* formed on an upper part, which is inserted into a hole 520*b* formed in the other end of the fixed member 520 and is fastened using a nut 522. The other strut 517 thus fixes the fixed member 520.

The fixed member 520 has an inverse triangle-shaped thickened section 523 formed substantially in the middle, and a female threaded section 525 is formed in this thickened section 523. The pressing shaft 530 is integrally formed of hard synthetic resin having durability and abrasion resistance, such as polycarbonate. A male threaded section 533 is formed capable of moving in the axial direction by being screwed into a female threaded section 525 provided on the fixed member 520. The pressing mold 540 is rotatably attached to the lower end of the pressing shaft 530, and an operating handle 532 is provided on an upper section of the pressing shaft 530 as an operation means.

As shown in FIG. 37, the male threaded section 533 is formed so that before the pressing mold 540 comes into contact with the fixed member 520 as a result of upwards movement of the pressing shaft 530, it is separated from the female threaded section 525 of the fixed member 520 and the pressing shaft 530 slackens off. That is, a non-threaded section 534 where the male threaded section 533 is not formed is provided on a lower part of the pressing shaft 530. The operating handle 532 has a rectangular attachment hole formed substantially in the middle, and this attachment hole engages with a rectangular shaft formed on an upper part of the pressing shaft 530 to attach to an upper part of the pressing shaft 530.

The pressing shaft 530 has a pressing mold 540 for engaging with a first pressed mold 610 (first front cover mounting mold) or a second pressed mold (first rear cover mounting mold) 640, which will be described later, on a lower end. The pressing mold 540 comprises a pressing mold body 540A, and an outer layer frame 542, and an inner layer frame 551. The pressing mold body 540A has a plate shaped vertically movable member 541. This vertically movable member 541 has a substantially circular projection 540B formed substantially in the middle on an upper surface, and a substantially circular indent 540C formed substantially in the middle on a lower surface.

The vertically movable member 541 also has an opening 540D linking the substantial center of the circular projection 540B and the substantial center of the circular indent 540C formed substantially in the center. An annular guide wall 540E is also formed projecting out on a lower surface of the vertically movable member 541, with the center of the circular indent 540C as a substantial center. An annular magnetic body 587 is attached to the inside of the annular guide wall 540E, at the lower surface of the vertically movable member 541. This magnetic body 587 is formed using a magnetic member, such as a magnet or magnetic rubber.

The pressing shaft 530 has a pressing section 560 formed on a lower part of the non-threaded section 534. The pressing section 560 is formed having almost the same diameter as the opening 540D, so that it can pass through the opening 540D. That is, by passing the pressing section 560 through the opening 540D, the pressing shaft 530 becomes capable of moving vertically relative to the pressing mold body 540A. Also, if the pressing shaft 530 moves down and the pressing section 560 passes through the opening 540D until a flange section 565 formed on an upper part of the non-threaded section 534 comes into contact with the edge of the opening 540D, the pressing shaft 530 can no longer move any further downwards relative to the pressing mold body 540A. So the pressing shaft 530 and the pressing mold body 540A move downwards together. An engagement indent 557 is provided by forming the lower part of the pressing section 560 as a cylinder having a slightly smaller radius than the radius of the pressing shaft 530.

A mounting member 577 is rotatably attached to the lower end of the pressing shaft 530, that is, the end section of the cylindrical engagement indent 557 provided on the lower part of the pressing section 560 using screws. The mounting member 577 is provided on the circular indent 540C of the pressing mold body 540A so that it can be fitted together and pulled apart, with a circular projection 578 formed on an upper surface, and an annular guide projection 579 formed on the lower surface edge. The circular projection 578 is formed to have almost the same diameter as the opening 540D, capable of passing through the opening 540D. Accordingly, when the mounting member 577 moves downwards together with the pressing shaft 530 and the pressing section 560 of the pressing mold 540 has passed through the opening 540D, it can move relatively downwards from the pressing mold body 540A by the extent to which it has passed through the opening 540D. Also, the mounting member 577 has an indent 574 formed in a substantially lower middle section, and the heads of the screws 569 are housed inside this indent 574. A circular plate-shaped magnetic body 588 is attached inside the annular guide projection 579, at the lower surface of the mounting member 577. This magnetic body 588 is formed using a magnetic member such as a magnet or magnetic rubber.

The outer layer frame 542 is formed in a ring shape, with a lower end forming an annular pressing section 550, has a storage indent 545 formed on the upper surface, and has a magnetic body 546 formed of a ferromagnetic material such as iron attached inside the storage indent 545. The outer layer frame 542 is guided in the guide projection 579 of the mounting member 577, and is attached to the annular magnetic body 587 attached to the lower surface of the pressing mold body 540A by magnetic force of the magnetic body 546. The magnetic body 587 can be a ferromagnetic material such as iron, and the magnetic body 546 can be a magnetic member such as a magnet or magnetic rubber.

The inner layer frame 551 is provided inside the outer layer frame 542, and is shallower than the outer layer frame 542. The inner layer frame 551 has a curved section 552 formed on a lower surface, and a contact edge 553 for contacting the peripheral edge 703 of the front cover 701 of the button formed on the edge of the curved section 552, which will be described later. A storage indent 555 is formed on the upper surface of the inner layer frame 551, and the magnetic body 556, which is made of a ferromagnetic material such as iron, is attached inside the storage indent 555. The inner layer frame 551 is attached to the magnetic body 588 attached to the lower surface of the mounting member 577 by magnetic force of the magnetic body 556. The magnetic body 588 can be a ferromagnetic material such as iron, and the magnetic body 556 can be a magnetic member such as a magnet or magnetic rubber.

The vertically movable member 541 is formed in a plate shape and has guide holes 571 and 572 slidably guided in the struts 516 and 517 provided at the left and right ends, and is guided so as to be able to move up and down only by these guide holes 571 and 572. An indication plate for enabling confirmation of the positions of these guide holes is integrally formed on one end of the vertically movable member 541. The pressing mold 540 also has a switching member 580 for switching the timing at which the outer layer frame 542 and the inner layer frame 551 respectively start to move downwards when the pressing shaft 530 begins moving downwards in the axial direction, depending on the positions of the first pressed mold 610 and the second pressed mold 640.

A bearing section 575 is formed in the pressing mold 540, namely the circular projection 540B of the vertically movable member 541, and the switching member 580 is rotatably attached to this bearing section 575 using a screw 576. The switching member 580 comprises a boss section 581 rotatably attached to the bearing section 575 using the screw 576, a first arm member 582 provided on the boss section 581, a semi-ring shaped engagement section 583 provided on the first arm member 582, capable of engaging with the engagement indent 557 of the pressing section 560, and a second arm member 585 provided at a position of the boss section 581 substantially opposite to the first arm member 582. An elongated hole shaped engagement groove 586 is formed in the second arm member 585.

A swing member 590 is providing on one strut 516 capable of rocking freely so as to move up and down together with the pressing mold 540. The swing member 590 comprises a boss section 591 attached to the strut 516, an arm section 592 provided on one side of the boss section 591, and a spring mounting hook 593 provided on the other side of the boss section 591. An engagement shaft 595 is formed substantially vertically on the arm section 592. The engagement shaft 595 has an upper section 595*a* engaging with the engagement groove 586 of the switching member 580, with a lower part 595*b* projecting from an elongated hole 544 formed in the vertically movable member 541, and an engagement rod 598 is provided on the lower part 595*b*.

A spring mounting hook 596 is provided on a rear section of the vertically movable member 541. A spring 597 is placed between this spring mounting hook 596 and the spring mounting hook 593 of the swing member 590. The engagement section 583 of the switching member 580 is brought into contact with an engagement indent 557 of the pressing section 560 via the swing member 590 under resilience of this spring 597. Coil spring type elastic members 535, 536 are provided on the struts 516, 517 between the fixed member 520 and the pressing mold 540. The pressing mold 540 (vertically movable member 541) is pressed downwards by these elastic members 535, 536, and pressure is applied in a direction for the male threaded section 533 of the pressing shaft 530 to screw in to the female threaded section 525 of the fixed member 520.

The pressing mold body 540A, specifically the vertically movable member 541, has a detachment means 526 for detaching the outer layer frame 542 attached by magnetic force against the magnetic force. The detachment means 526 comprises a push-out rod 527 slidably provided in the guide hole 537 formed substantially vertically in the circular projection 540B, an operating button 528 provided on an upper end of the push-out rod 527, and a spring shaped elastic member 529 provided between the circular projection 540B and the operating button 528, wrapping around the push-out rod 527 to press the push-out rod 527 upwards.

A sliding platform 600 is provided in the guide groove 506 of the base 502 so as to be capable of reciprocating. The sliding platform 600 comprises a bottom wall 605, a front wall 601 provided on a front end of the bottom wall 605, a rear wall 603 provided on a rear end of the bottom wall 605, a left wall 606 provided on a left end of the bottom wall 605, and a right wall 607 provided on a right end of the bottom wall 605. A handle 602 is provided on a front wall 601, and a handle 604 is provided on the rear wall 603.

Engagement edges 606*a*, 607*a* for slidably engaging with guide projections 509*a*, 510*a* formed on side walls 509, 510 of a guide groove 506 are formed on the left wall 606 and the right wall 607. The sliding platform 600 is configured so as to slide only in the front to rear direction of the base 502. Also, a front engagement wall 599*a* and a rear engagement wall 599*b* for engaging with an engagement rod 598 of the engagement shaft 595 are formed on the left wall 606. The right wall 607 is formed with a first latch indent 676 and a second latch indent 677 for latching with the latch projection 675 of a latch plate 672 that will be described later.

An attachment member (first attachment member) 691 provided with the first pressed mold (first front cover mounting mold) 610 and the second pressed mold (first rear cover mounting mold) 640, which will be described in detail later, is removably attached to the bottom wall 605 of the sliding platform 600. The attachment member (first attachment member) 691 is formed in a flat plate shape, and a front edge 692 is formed into a semicircle. A peripheral wall 695 defining an engagement indent 694 for engaging with the attachment member (first attachment member) 691 is formed on the bottom wall 605. A substantially L-shaped engagement member (engagement means) 696 for engaging with a rear edge 693 of the attachment member (first attachment member) 691 is provided at a rear end of the peripheral wall 695. Also, a lock piece (locking means) 697 for locking the front edge 692 of the attachment member (first attachment member) 691, and a spring-type elastic member 698 arranged between the lock piece (locking means) 697 and the front wall 601 for pressing the lock piece (locking means) 697 in a locking direction, are provided on a semicircular front edge of the peripheral wall 695.

The first pressed mold (first front cover mounting mold) 610 and the second pressed mold (first rear cover mounting mold) 640 are provided on the attachment member (first attachment member) 691 so as to be positioned on either side of the sliding platform 600 in the reciprocating direction. The first pressed mold (first front cover mounting mold) 610 comprises a first mounting platform 611 for mounting the front cover 701, and a guide platform 625 provided at the periphery of the first mounting platform 611 for mounting a sheet body 713 and a design sheet 711 in layers. The guide platform 625 is provided to be capable of upward and downward movement and is pressed upwards by an elastic member 613. The first mounting platform 611 comprises a gently curved upper wall 615, a peripheral wall 616 formed on a lower peripheral edge of the upper wall 615, and a cylindrical fixed shaft 617 formed substantially in the center of a lower surface of the upper wall 615.

The first mounting platform 611 has a lower part of the peripheral wall 616 engaged with an annular guide projection 618 provided on the attachment member (first attachment member) 691, and a lower end of the fixed shaft 617 engaged in an indent 620 of the boss section 619 formed on the attachment member (first attachment member) 691. The first mounting platform 611 is thus fixed to the attachment member (first attachment member) 691 by passing a screw 622 from the rear surface of the attachment member (first attachment member) 691 through a through hole formed in the attachment member (first attachment member) 691 and screwing into the fixed shaft 617.

The guide platform 625 is formed in an annular shape, and has a ring-shaped mounting section 626 for mounting the design sheet 711 and sheet body 713 in layers, and a guide wall 627 formed at a peripheral edge of the mounting section 626, for guiding peripheral edges of the design sheet 711 and the sheet body 713, each formed at an upper section. A pressing section 550 of the outer layer frame 542 engages with the guide wall 627 of the guide platform 625, and the pressing section 550 is pressed into contact with the mounting section 626. The mounting section 626 has a cylinder 629 sliding up and down along the peripheral wall 616 of the first mounting platform 611 in an inner lower surface.

The guide platform 625 also has a guide cylinder 632 for moving the inside of the peripheral wall 616 of the first mounting platform 611 up and down. The guide cylinder 632 has a guide hole 630 for inserting the fixed shaft 617 of the first mounting platform 611 to be capable of sliding. A lower end of the guide cylinder 632 and a lower end of the cylinder 629 are integrally linked by a linking piece 633. This linking piece 633 is fitted into an elongated groove 635 formed by vertically cutting a slot in the peripheral wall 616 of the first mounting platform 611.

The upper wall 615 of the first mounting platform 611 and the mounting section 626 of the guide platform 625 have roughly the same height. A gap 636 is formed between the upper wall 615 and the mounting section 626 for insertion of the curved peripheral edge 703 of the front cover 701. The guide platform 625 is pressed upwards by a spring (elastic member) 613 wrapped around the fixed shaft 617 of the first mounting platform 611.

The second pressed mold (first rear cover mounting mold) 640 comprises a second mounting platform 641 for mounting the rear cover 705, and a processing platform 655, provided around the second mounting platform 641, for folding the peripheral edge 703 of the front cover 701 towards the peripheral edge 709 of the rear cover 705 so that peripheries of the design sheet 711 and the sheet body 713 are gripped by the peripheral edge 703 of the front cover 701 and the peripheral edge 709 of the rear cover 705. The processing platform 655 is capable of up and down movement and is pressed upwards by an elastic member 656. The second mounting platform 641 comprises an upper wall 643 where a circular indent 642 is formed, a peripheral wall 645 formed at a lower peripheral edge of the upper wall 643, and a cylindrical fixed shaft 646 formed substantially in the center of a lower surface of the upper wall 643.

The second mounting platform 641 has a lower part of the peripheral wall 645 engaged with an annular guide projection 648 provided on the attachment member (first attachment member) 691, and a lower end of the fixed shaft 646 engaged in an indent 650 of the boss section 649 formed on the attachment member (first attachment member) 691. The second mounting platform 641 is thus fixed to the attachment member (first attachment member) 691 by passing a screw 652 from the rear surface of the attachment member (first attachment member) 691 through a through hole formed in the attachment member (first attachment member) 691 and screwing into the fixed shaft 646.

The processing platform 655 is formed in an annular shape, and has an engagement step section 657 formed on an upper part. A metal ring 659 engages with this engagement step section 657. This metal ring 659 has an inclined edge 660 for bending the peripheral edge 703 of the front cover 701 to the side of the peripheral edge 709 of the rear cover 705 so as to grip the peripheral edges of the design sheet 711 and the sheet body 713 between the peripheral edge 703 of the front cover 701 and the peripheral edge 709 of the rear cover 705 while folding them inwards. It is also possible to form the inclined edge 660 directly on an upper part of the processing platform 655.

An indent 661 for engaging the pressing section 550 of the outer layer frame 542 is provided on an upper part of the inclined edge 660. A cylindrical section 662 sliding up and down along the peripheral wall 645 of the second mounting platform 641 is formed in a lower part of the engagement step section 657. The processing platform 655 also has a guide cylinder 663 for moving the inside of the peripheral wall of the second mounting platform 641 up and down.

The guide cylinder 663 has a guide hole 665 for inserting the fixed shaft 646 of the second mounting platform 641 to be capable of sliding. A lower end of the guide cylinder 663 and a lower end of the cylindrical section 662 are integrally linked by a linking piece 667. This linking piece 667 is fitted into a elongated groove 669 formed by vertically cutting a slot in the peripheral wall 645 of the second mounting platform 641. The processing platform 655 is pressed upwards by a spring (elastic member) 656 wrapped around the fixed shaft 646 of the second mounting platform 641.

The base 502 has a positioning member 670 for positioning the sliding platform 600. The positioning member 670 is provided close to the guide groove 506, has a latch plate 672 pressed by a spring-type elastic member 678 attached by a screw 673, and has a latch projection 675 formed on a lower surface of the latch plate 672.

The sliding platform 600 has a first latch indent 676 and a second latch indent 677 for being latched by the latch projection 675 of the latch plate 672. If the latch projection 675 of the latch plate 672 engages with the first latch indent 676 of the sliding platform 600, the first pressed mold (first front cover mounting mold) 610 is positioned almost directly below the pressing mold 540. If the engagement latch 675 of the latch plate 672 engages with the second latch indent 677 of the sliding platform 600, the second pressed mold (first rear cover mounting mold) 640 is positioned almost directly below the pressing mold 540.

Also, if the first pressed mold (first front cover mounting mold) 610 is positioned almost directly below the pressing mold 540, the front engagement wall 599*a* of the sliding platform 600 engages with the engagement rod 598 of the engagement shaft 595 of the switching member 580. At this time, the half-ring shaped engagement section 583 rotates in one direction against the elasticity of the spring 597 with the bearing section 575 as a center, and engages with the engagement indent 557 of the pressing section 560. Therefore, since the pressing section 560 can no longer pass through the opening 540D even if the pressing shaft 530 moves downwards, when the pressing shaft 530 starts to move down, the mounting member 577 (and the inner layer frame 551 attached to the mounting member 577 by magnetic force) and the pressing mold body 540A (and the outer layer frame 542 attached to the pressing mold body 540A by magnetic force) begin to move downwards at the same time. If the second pressed mold (first rear cover mounting mold) 640 is positioned almost directly below the pressing mold 540, the rear engagement wall 599*b* of the sliding platform 600 engages with the engagement rod 598 of the engagement shaft 595 of the switching member 580. At this time, the half-ring shaped engagement section 583 rotates in the other direction against the elasticity of the spring 597 with the bearing section 575 as a center, and moves away from the engagement indent 557 of the pressing section 560. Therefore, if the pressing shaft 530 begins to move downwards, first of all the pressing section 560 of the pressing shaft 530 passes through the opening 540D, and the mounting member 577 (and the inner layer frame 551 attached to the mounting member 577 by magnetic force) moves downwards relative to the pressing mold body 540A to the extent that the pressing section 560 has passed through the opening 540D. When the pressing shaft 530 moves further down, and the flange section 565 on the upper part of the pressing section 560 comes into contact with the edge of the opening 540D, the pressing mold body 540A (and the outer layer frame 542 attached to the pressing mold body 540A by magnetic force) begins to move downwards.

Reference numeral 680 is a cover. The cover 680 is attached to the base 502 using a screw or the like, and has first and second openings 681 and 682 formed in a front section and a rear section so that sliding of the sliding platform 600 is not obstructed. The first pressed mold (first front cover mounting mold) 610 emerges from the first opening 681, and the second pressed mold (first rear cover mounting mold) 640 emerges from the second opening 682. This cover 680 prevents a hand from getting close to the first pressed mold (first front cover mounting mold) 610, when the first pressed mold (first front cover mounting mold) 610 is substantially directly below the pressing mold 540, that is, when the first pressed mold (first front cover mounting mold) 610 has moved to a position where it is possible to engage with the pressing mold 540. At this time, since the second pressed mold (first rear cover mounting mold) 640 projects to the outside of the cover 680 from the second opening 682, it is possible to place the rear cover. A hand is also prevented from getting close to the second pressed mold (first rear cover mounting mold) 640 by the cover 680, when the second pressed mold (first rear cover mounting mold) 640 is substantially directly below the pressing mold 540, that is, at a position where it is possible to engage with the pressing mold 540. The cover 680 has an elongated hole through which it possible to see the indication plate of the vertically movable member 541. It is possible to confirm the position of the pressing mold 540 by looking at the indication plate from this elongated hole.

Operation of the button making device 501 of the present invention will now be described. If the handle 602 provided on the front wall 601 of the sliding platform 600 is held, the first pressed mold (first front cover mounting mold) 610 is taken out from the first opening 681 of the cover 680, and the front cover 701 is placed on the upper wall 615 of the first mounting platform 611, as a result the peripheral edge 703 is inserted into the gap 636 between the upper wall 615 and the mounting section 626. Next, after overlapping the sheet body 713 on the design sheet 711, the design sheet 711 is placed on the mounting section 626 of the guide platform 625. Also, the outer layer frame 542 and inner layer frame 551 are placed on the first pressed mold (first front cover mounting mold) 610.

If the handle 602 of the front wall 601 is held and the sliding platform 600 is pressed in, the latch projection 675 of the latch plate 672 engages with the first latch indent 676 of the sliding platform 600, the first pressed mold (first front cover mounting mold) 610 is positioned almost directly below the pressing mold 540, and the second pressed mold (first rear cover mounting mold) 640 projects from the second opening 682 of the cover 680. If the operating handle 532 is turned in one direction, the pressing shaft 530 rotates clockwise, the male threaded section 533 is screwed into the female threaded section 525 of the fixed member 520 by the elastic members 535, 536, and the pressing shaft 530 moves downwards. If the pressing shaft 530 begins to move downwards, the pressing section 560 provided on the lower part of the pressing shaft 530 tries to pass through the opening 540D. However, since this is hindered by the engagement section 583 of the switching member 580, the mounting member 577 provided on the lower end of the pressing shaft 530 can not move downwards relative to the pressing mold body 540A. That is, the pressing mold body 540A and the mounting member 577 begin to move downwards simultaneously. If the pressing shaft 530 moves further downwards, the magnetic body 587 provided on the lower surface of the pressing mold body 540A and the magnetic body 546 provided on the upper surface of the outer layer frame 542 come into contact, and the outer layer frame 542 is fixed to the pressing mold body 540A by magnetic force.

If the pressing shaft 530 is pressed further downwards, the pressing section 550 of the outer layer frame 542 affixed to the pressing mold body 540A engages with a guide wall 627 of the guide platform 625 to be pressed against the mounting section 626, and the guide platform 625 is pressed down against the resilience of the elastic member 613. The peripheries of the sheet body 713 and the design sheet 711 placed on the guide platform 625 in layers are bent downwards, and come into contact with the peripheral edge 703 of the front cover 701 placed on the first mounting platform 611. As a result of the pressing shaft 530 moving further downwards, the magnetic body 588 provided on the lower surface of the mounting member 577 is pressed against the magnetic body 556 provided on the upper surface of the inner layer frame 551 of the first mounting platform 611, and the inner layer frame 551 is affixed to the mounting member 577 by magnetic force. At this time, the position of the pressing mold 540 can be confirmed by looking at the indication plate.

If the operating handle 532 is turned in the other direction, the pressing shaft 530 rotates counterclockwise and the pressing shaft 530 moves upwards by a female threaded section 533. Accompanying this, the entire pressing mold 540 moves upwards and the vertically movable member 541 also slides upwards. At this time, the outer layer frame 542 and the inner layer frame 551 are respectively affixed to the pressing mold body 540A and the mounting member 577 by magnetic force, which means that they move upwards together with the vertically movable member 541. The front cover 701 in a state where the peripheries of the sheet body 713 and the design sheet 711 are bent downwards and are in contact with the peripheral edge 703 is pulled up while still being fitted inside the outer layer frame 542 and is detached from the first pressed mold (first front cover mounting mold) 610. Since the male threaded section 533 of the pressing shaft 530 is removed from the female threaded section 525 of the fixed member 520 immediately before the pressing section 560 comes into contact with the thickened section 523, the pressing mold 540 no longer moves upwards, the pressing shaft 530 slackens off, and the pressing section 560 is not pressed against the thickened section 523. As a result, the pressing section 560 and the pressing mold 540 are not broken.

If the rear cover 705 is mounted on the upper wall 643 of the second mounting platform 641 of the second pressed mold (first rear cover mounting mold) 640 projecting from the second opening 682 of the cover 680, with the peripheral edge 709 facing upwards, the attachment hole 707 for attaching the detachable pin 729 is protected by the indent 642, and the peripheral edge 709 is guided and positioned in an inner surface of the cylindrical section 662 of the processing platform 155.

If the handle 604 of the rear wall 603 is held and the sliding platform 600 is pressed in, the latch projection 675 of the latch plate 672 engages with the second latch indent 677 of the sliding platform 600, the second pressed mold (first rear cover mounting mold) 640 is positioned almost directly below the pressing mold 540, and the first pressed mold (first front cover mounting mold) 610 projects from the first opening 681 of the cover 680. If the second pressed mold (first rear cover mounting mold) 640 is positioned almost directly below the pressing mold 540, the rear engagement wall 599*b* engages with the engagement rod 598 of the engagement shaft 595 of the switching member 580, the half-ring shaped engagement section 583 rotates against the elasticity of the spring 597 with the bearing section 575 as a center, and moves away from the engagement indent 557 of the pressing section 560.

If the operating handle 532 is turned in one direction, then as previously described, the pressing shaft 530 rotates clockwise, and the pressing shaft 530 starts to move downwards. As a result, the pressing section 560 provided on the lower part of the pressing shaft 530 passes through the opening 540D and moves the mounting member 577 and inner layer frame 551 downwards relative to the pressing mold body 540A. At this time, the contact edge 553 of the inner layer frame 551 comes into contact with the upper edge of the front cover 701, and the front cover 701 is pressed down to the vicinity of the lower surface of the outer layer frame 542. If the pressing shaft 530 moves downwards further, the pressing mold body 540A and the outer layer frame 542 begin to move downwards as a result of the flange section 565 provided on the pressing shaft 530 coming into contact with the opening 540D peripheral edge. If the pressing shaft 530 continues to move further downwards, the outer layer frame 542 contacts the processing platform 655, and the processing platform 655 is pressed down against the resilient force of the elastic member 656. At about the same time, the peripheries of the sheet body 713 and design sheet 711, which have been pressed down to the vicinity of the lower surface of the outer layer frame 542 by the inner layer frame 551, come into contact with an inclined edge 660 of the processing platform 655 and are folded inwards. Then the peripheral edge 703 of the front cover 701 is also pressed against the inclined edge 660.

If the pressing shaft 530 moves further downwards and moves to an extent that the lower end of the processing platform 655 comes into contact with the sliding platform 600 and the processing platform 655 is no longer pressed down, the peripheral edge 703 of the front cover 701 is folded further inwards by the inclined edge 660, and the peripheries of the sheet body 713 and the design sheet 711 are folded by the inclined edge 660 and the edge of the second mounting platform 641 until they face upwards. At this time, the rear cover 705 on the second mounting platform 641 is affixed to the front cover 701 in such a manner that the peripheries of the sheet body 713 and the design sheet 711 are gripped by the peripheral edge 709 of the rear cover 705 and the peripheral edge 703 of the front cover 701, to form the button body 700*a*.

If the operating handle 532 is turned in the other direction, the pressing shaft 530 rotates counterclockwise, and the pressing shaft 530 moves upwards. Accompanying this, the entire pressing mold 540 moves upwards, and the vertically movable member 541 also slides upwards. The button body 700*a* remains loaded in the second pressed mold (first rear cover mounting mold) 640. If the handle 604 provided in the rear wall 603 of the sliding platform 600 is held, and the second pressed mold (first rear cover mounting mold) 640 is taken out from the second opening 682 of the cover 680, it is possible to easily remove the button body 700*a* from the second pressed mold (first rear cover mounting mold) 640. Making of the button 700 is completed upon inserting the attachment shaft 721 (or 731, 741) of the previously described mounting means 720 (or 730, 740) in the attachment hole 707 of the button body 700*a*.

The above described button making device 501 can easily replace the outer layer frame 542 and inner layer frame 551 of the pressing mold 540, and the first pressed mold (first front cover mounting mold) 610 and second pressed mold (first rear cover mounting mold) 640, in accordance with the size of a button 700 to be made. Since the outer layer frame 542 is affixed by the magnetic body 587 and the magnetic body 546, it is possible to easily remove the outer layer from 542 from the pressing mold body 540A by applying a separation force greater than this magnetic force. Also, as shown in FIG. 36, if the operating button 528 of the detachment means 526 is pressed against the resilience of the elastic member 529, the tip of the push-out rod 527 presses down one side of the outer layer frame 542 and separates the outer layer frame 542 from the magnetic body 587. Thus it is easy to detach the outer layer frame 542 from the pressing mold body 540A. Similarly, since the inner layer frame 551 is affixed by the magnetic body 588 and the magnetic body 556, it is possible to remove the inner layer frame 551 from the pressing mold body 540A by applying a separation force greater than this magnetic force.

As shown in FIG. 41, with the above described button making device 501, in order to change the size of a button 700 to be made, an outer layer frame 542*a* that is larger than the outer layer frame 542 and an inner layer frame 551*a* that is larger than the inner layer frame 551 are attached to the pressing mold body 540A by magnetic force of the magnetic body 587 and the magnetic body 588. Since the above described first pressed mold (first front cover mounting mold) 610 and second pressed mold (first rear cover mounting mold) 640 are provided together on an attachment member 691 removably attached to the sliding platform 600, it is possible to easily replace them. Specifically, it is possible to attach and detach the first pressed mold (first front cover mounting mold) 610 and the second pressed mold (first rear cover mounting mold) 640 at the same time by attaching and detaching the attachment member 691. For example, as shown in FIG. 41, it is possible to attach an attachment member 691*a*, on which the first pressed mold (first front cover mounting mold) 610*a* larger than the first pressed mold (first front cover mounting mold) 610 and the second pressed mold (first rear cover mounting mold) 640*a* larger than the second pressed mold (first rear cover mounting mold) 640 are provided, to the sliding platform 600.

The button making device 501 forms a substantially square shaped frame using the fixed member 520, struts 516 and 517 and reinforcement member 515. Thus, strength is increased, and it is possible to perform press operations inside this strong frame. Also, if the pressing shaft 530 is turned, the pressing mold 540 is lowered, the first pressed mold (first front cover mounting mold) 610 or the second pressed mold (first rear cover mounting mold) 640 is relatively raised, and the button body 700*a* is made using a pincer force from both of the pressing mold 540 and the first pressed mold (first front cover mounting mold) 610 or the second pressed mold (first rear cover mounting mold) 640. Therefore, the base 502 is not squeezed, and it is not necessary to place the base at a stable location. It is also possible to carry out operation at an unstable place, for example, while the base 502 is being held. Also, since the male threaded section 533 is used in pressing the pressing mold 540, it is possible to reduce the operating space.

Figure 52:
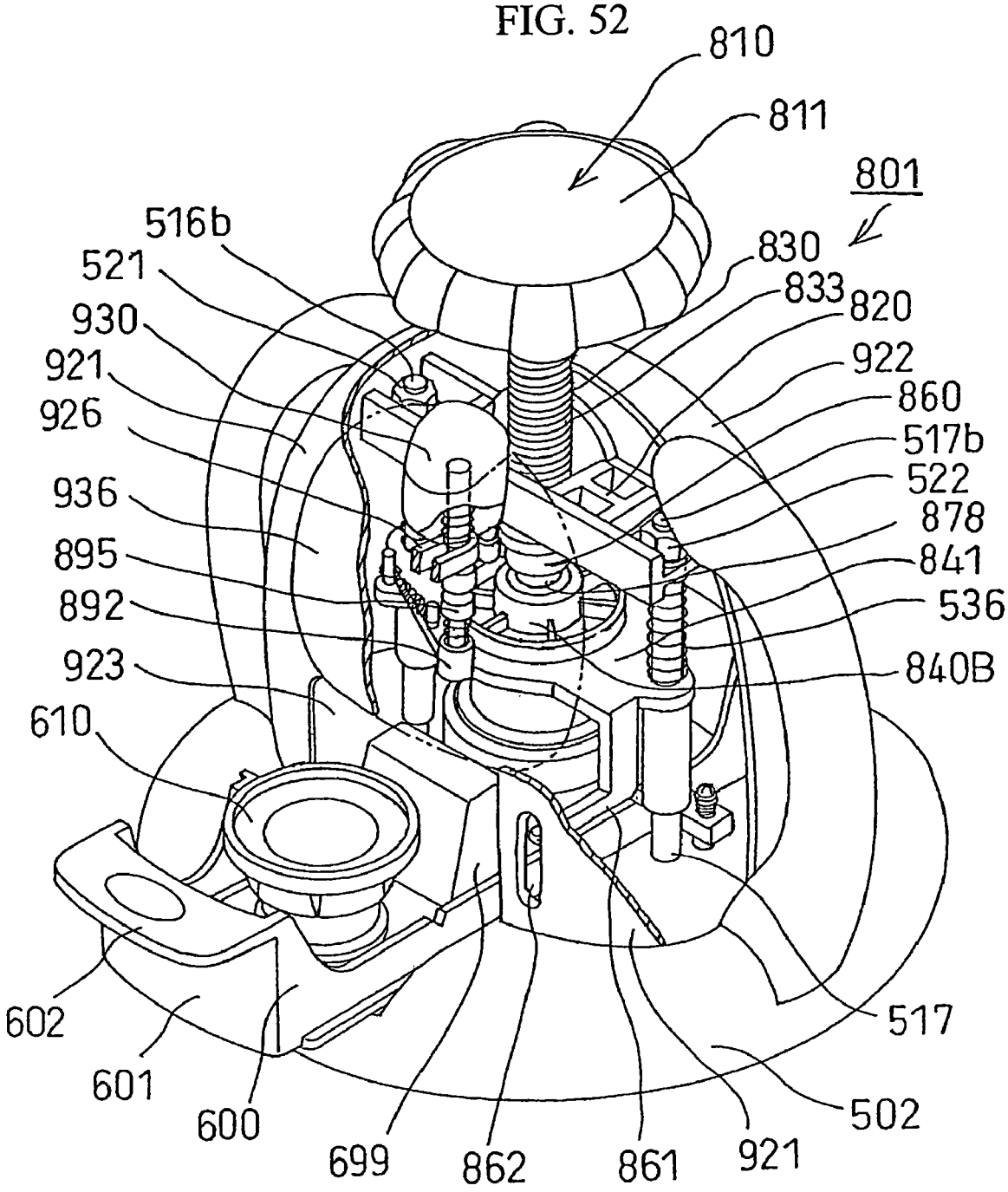
FIG. 52 is an exploded perspective view showing another embodiment of a button making device of the present invention.
Figure 53:
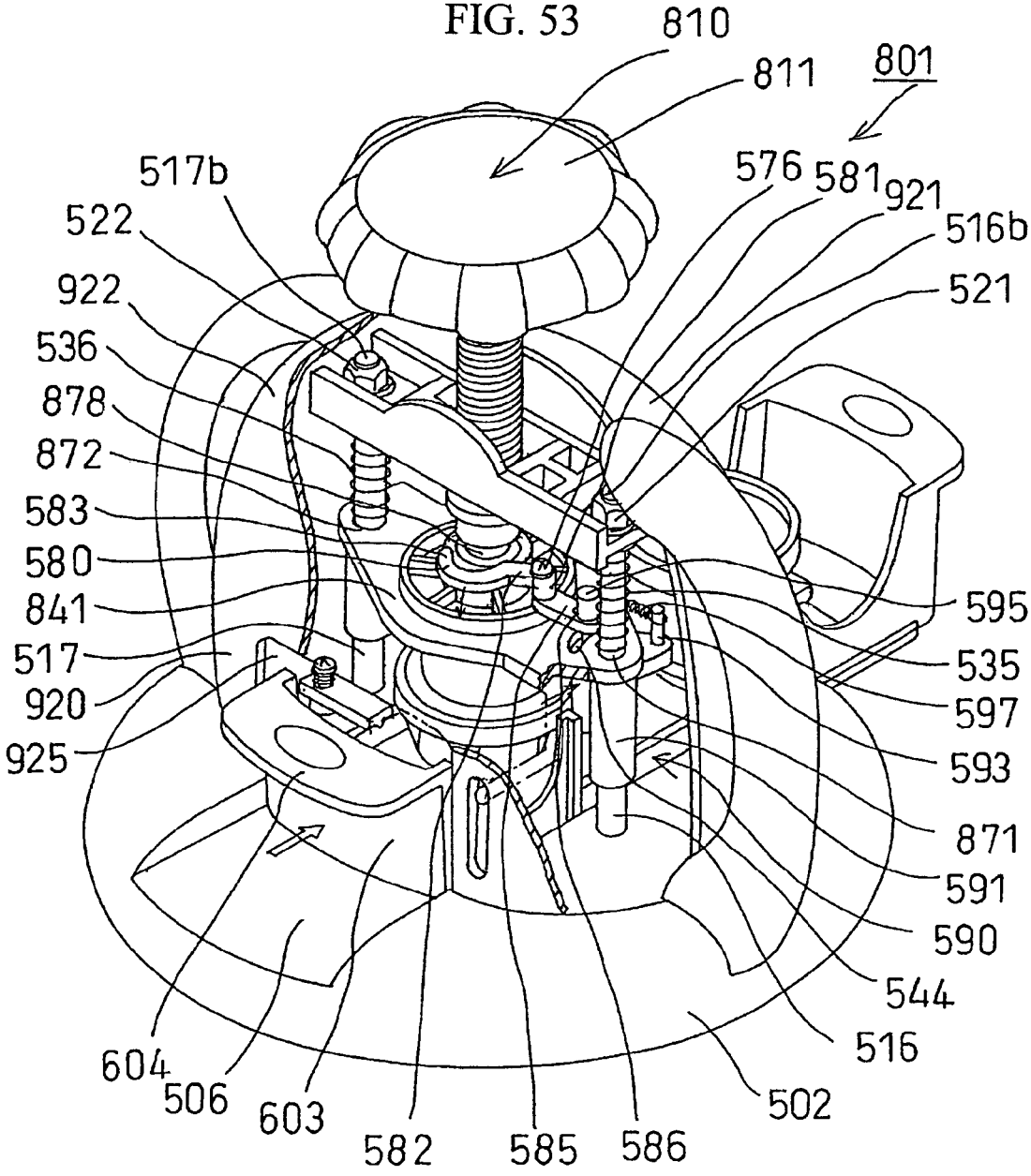
FIG. 53 is an overall perspective view of the button making device of FIG. 52 looking from another direction.
Figure 54:
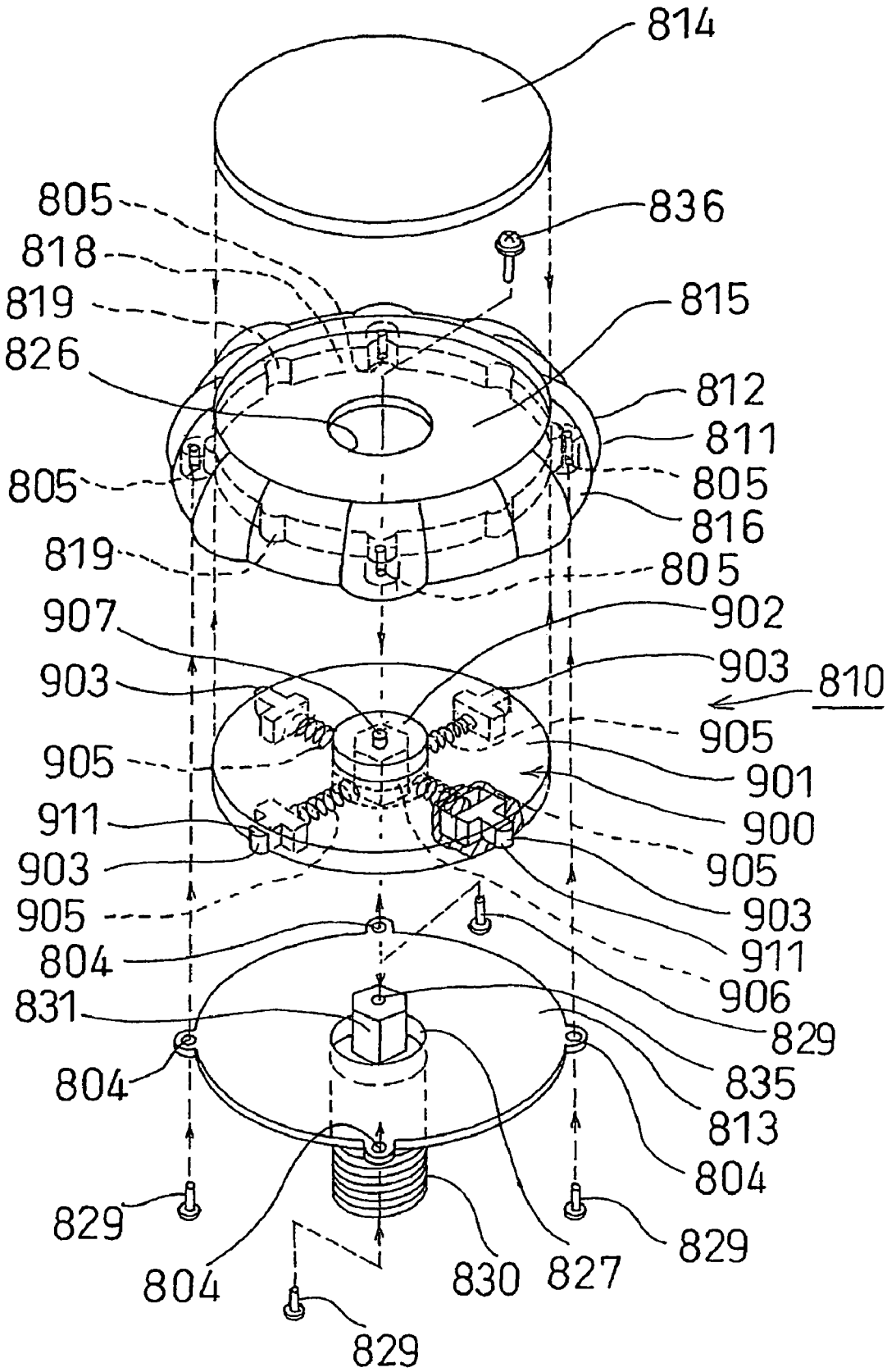
FIG. 54 is a partial perspective view of the operation means of the button making device of FIG. 52.
Figure 55:
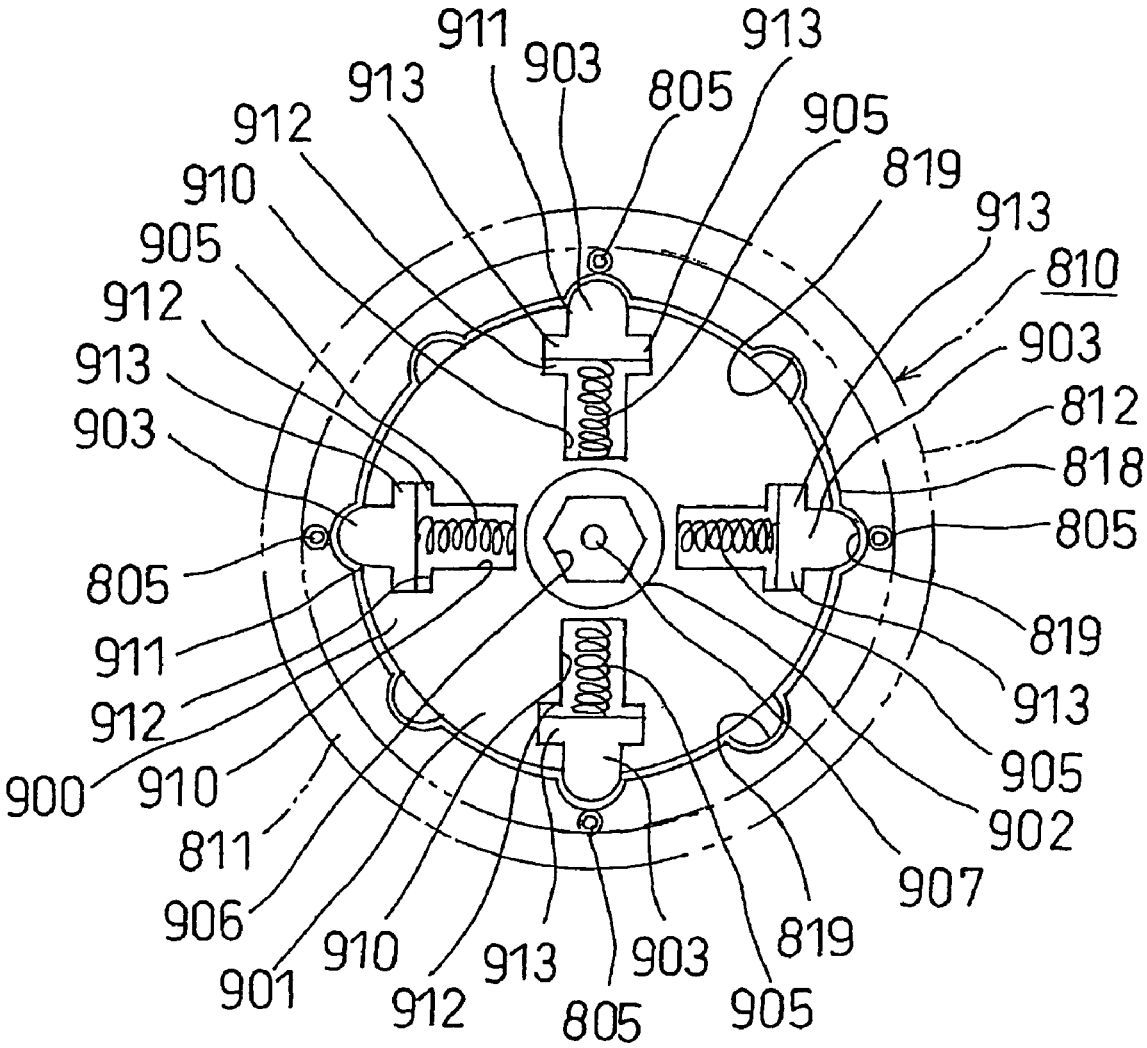
FIG. 55 is a plan view of the operation means in FIG. 54.
Figure 56:
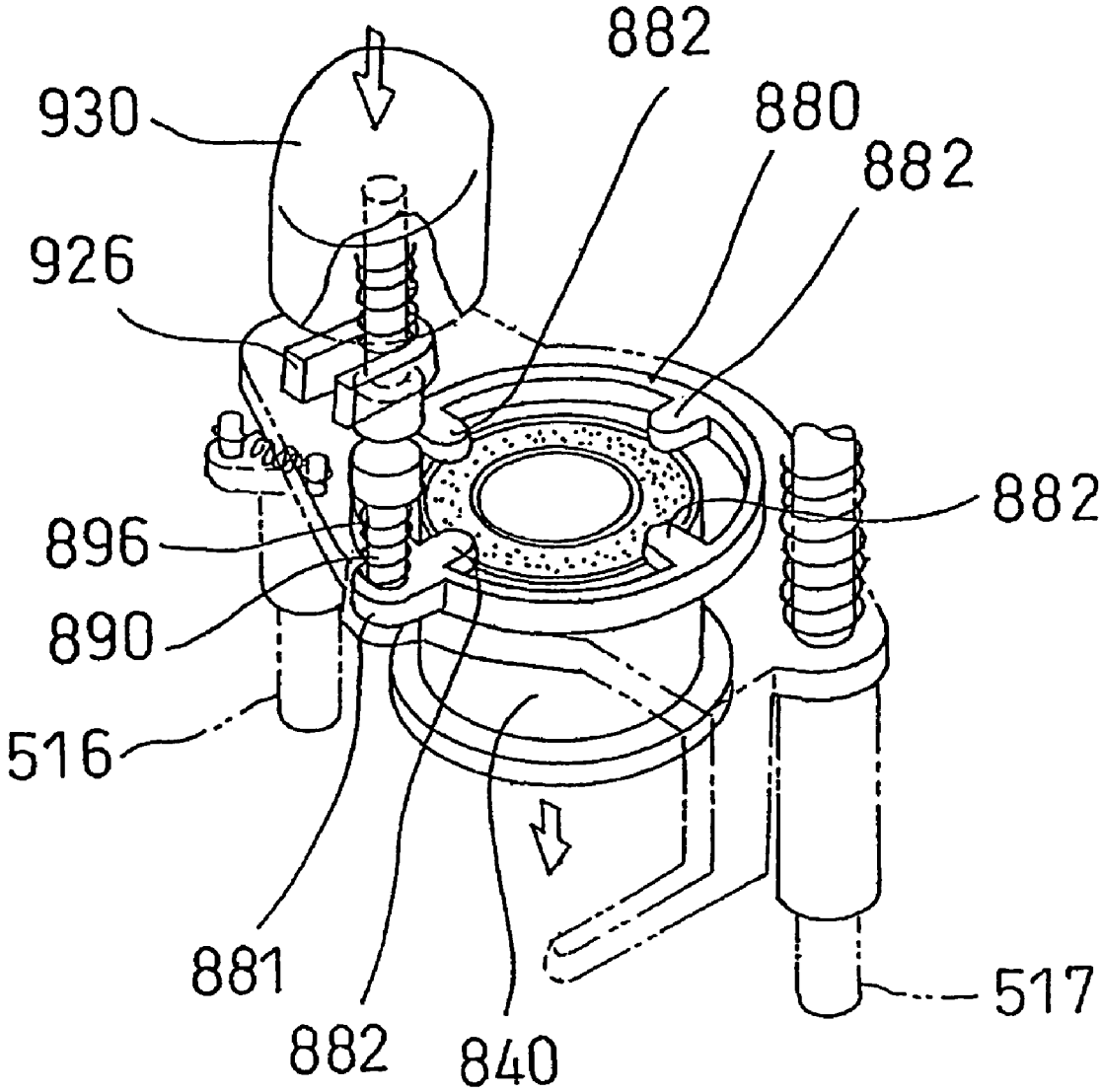
FIG. 56 is a perspective view showing the essential parts of a detachable ring of the button making device of FIG. 52.
Figure 57:
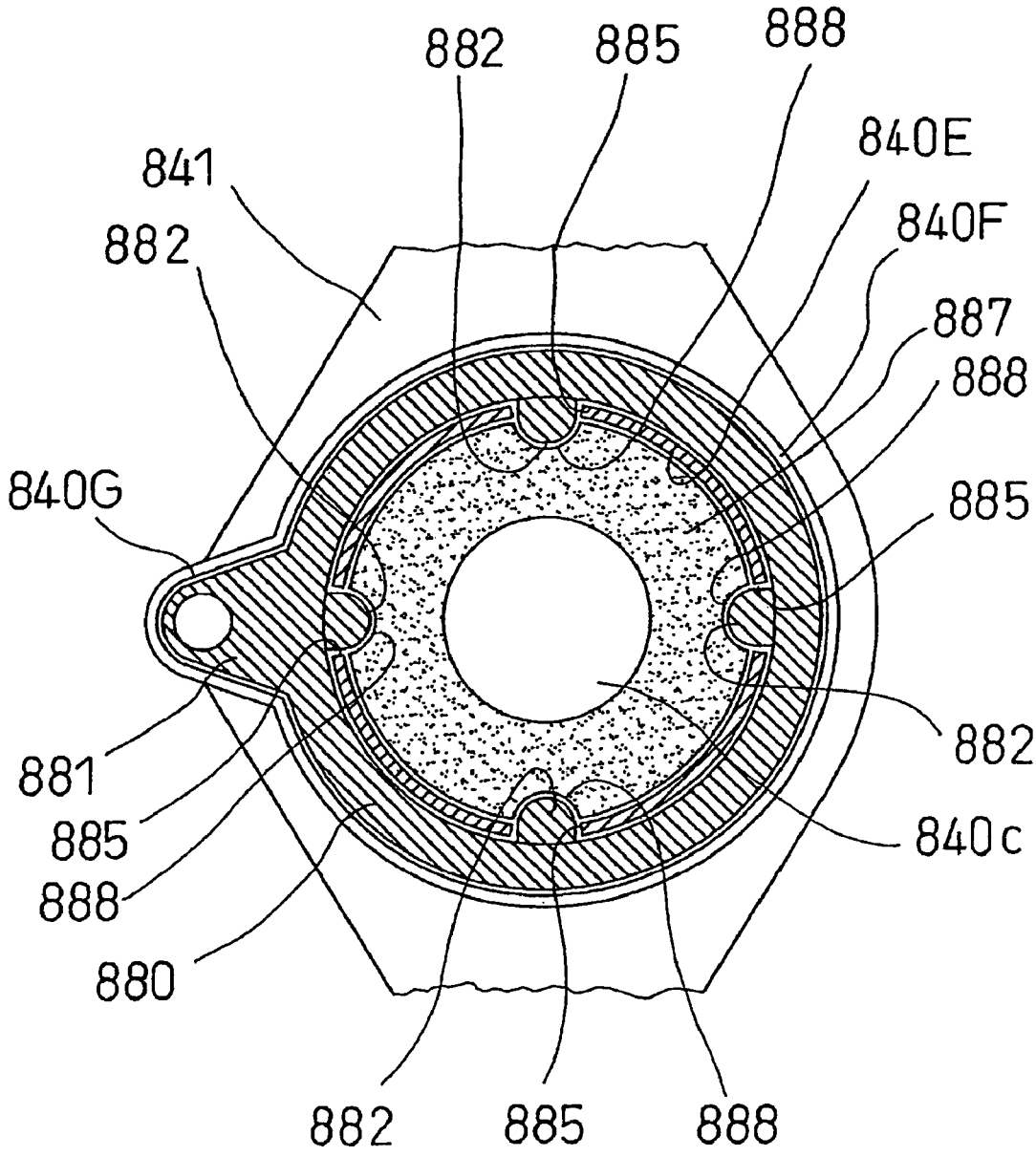
FIG. 57 is a plan view of a vertically movable member of the button making device of FIG. 52 looking from below.
Figure 58:
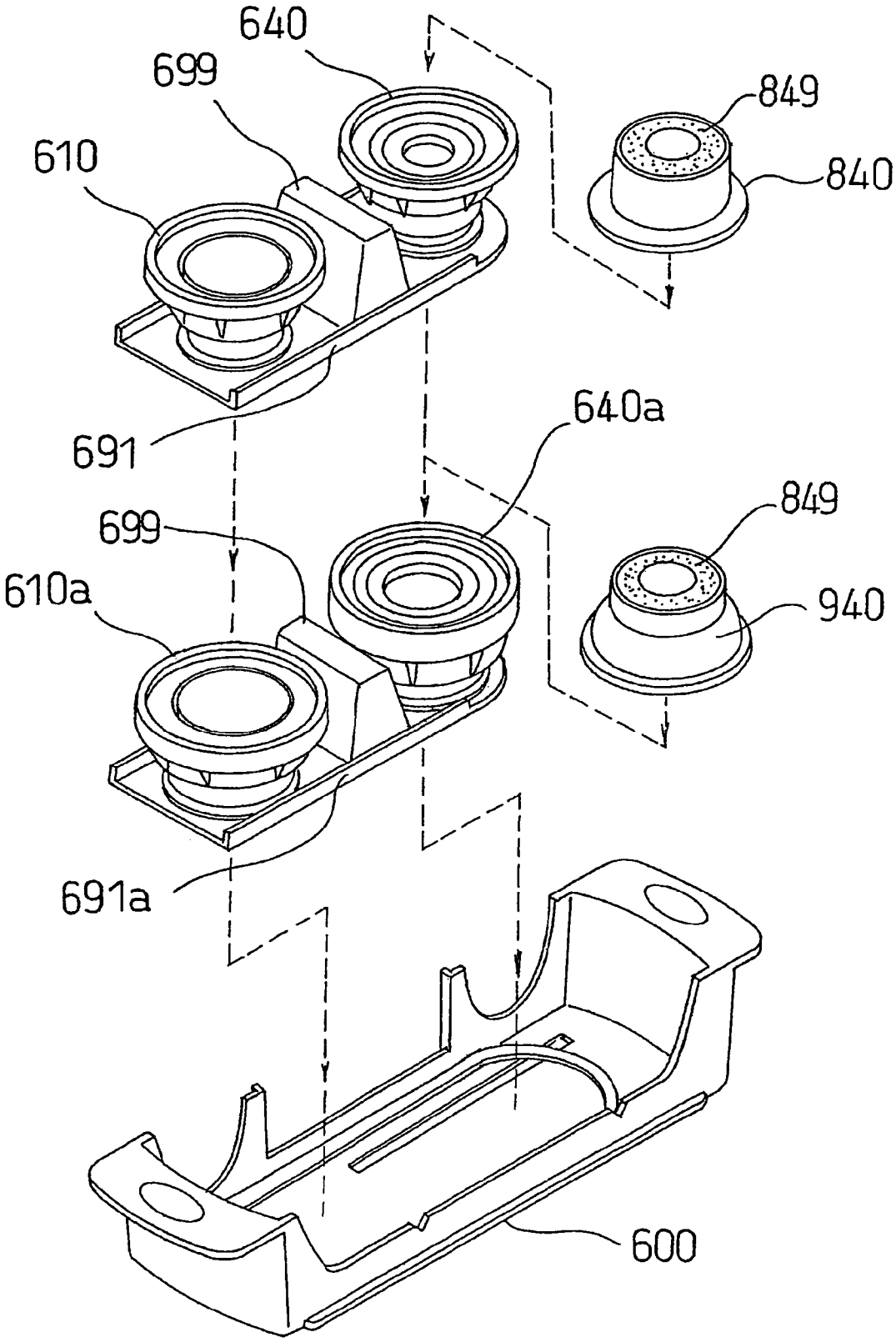
FIG. 58 is a perspective explanatory view showing a sliding platform of the button making device of FIG. 52.
Figure 59:
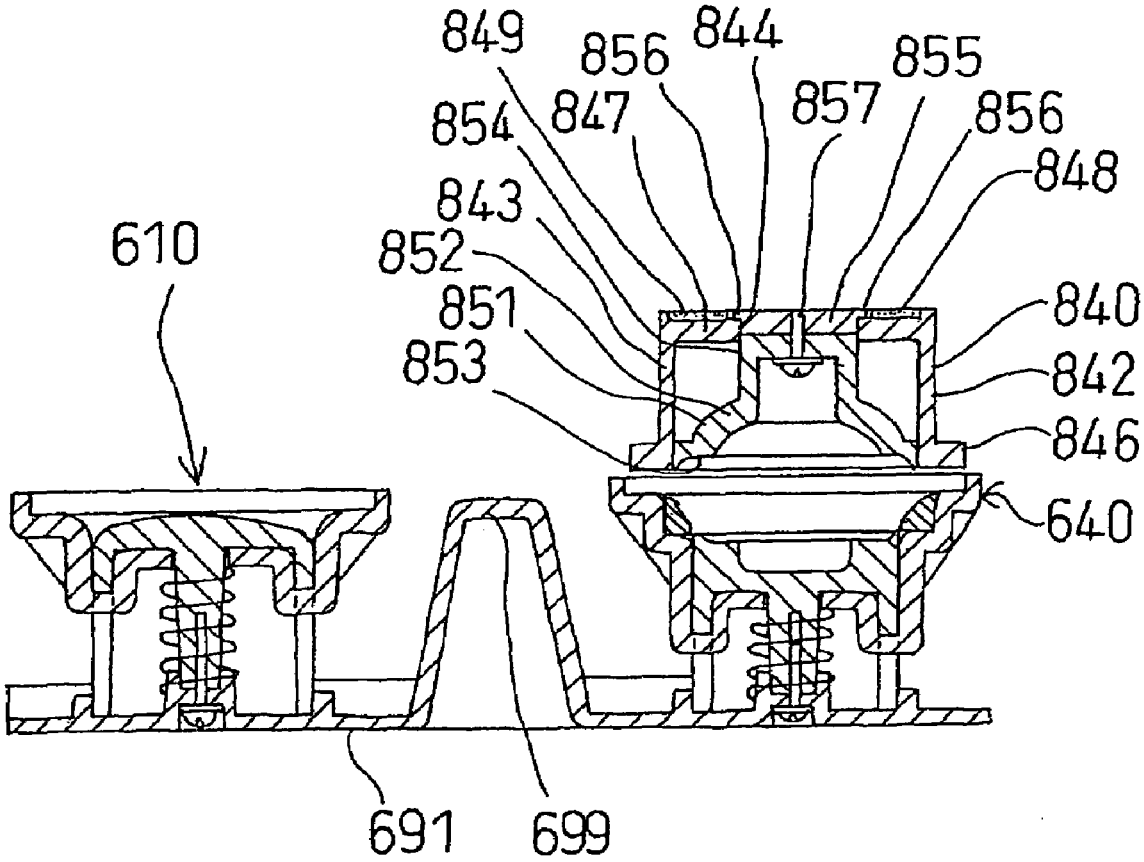
FIG. 59 is a cross sectional view of the essential parts describing the movement in the button making device of FIG. 52.
Figure 60:
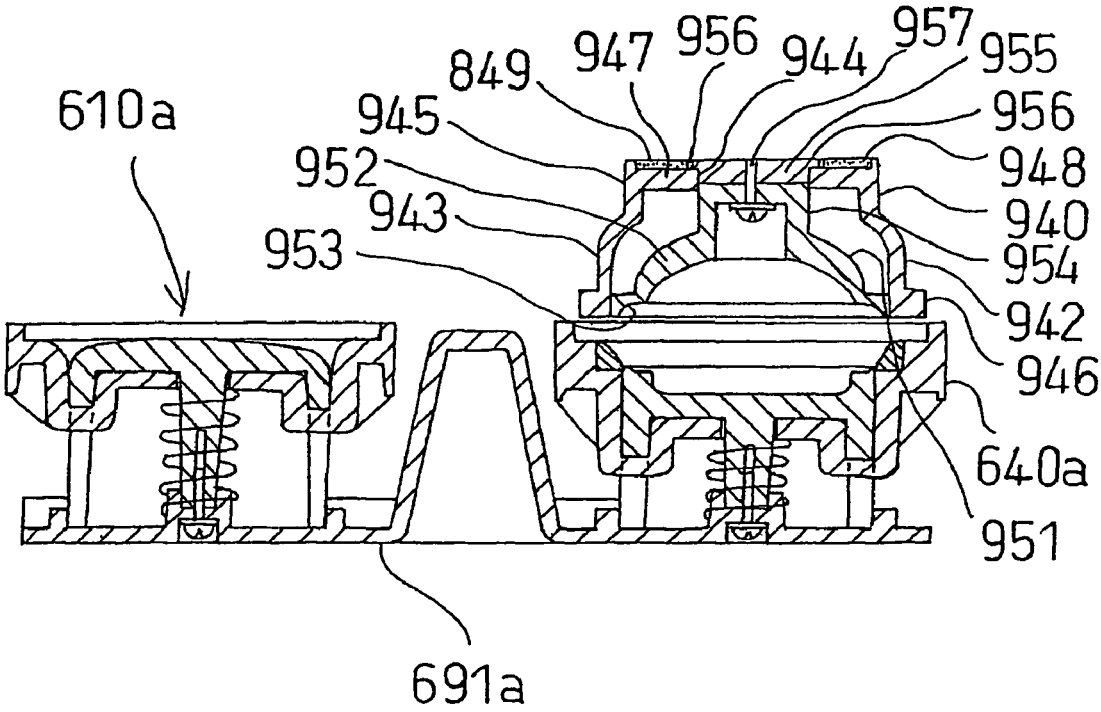
FIG. 60 is a cross sectional view of the essential parts describing the movement in the button making device of FIG. 52.

The button making device 801 will now be described based on FIG. 52 to FIG. 64. FIG. 52 is an overall perspective view showing another embodiment of a button making device of the present invention. FIG. 53 is an overall perspective view of the button making device of FIG. 52 looking from another direction. FIG. 54 is a partial perspective view of an operation means of the button making device of FIG. 52. FIG. 55 is an overall plan view of the operation means in FIG. 54. FIG. 56 is a perspective view of the essential parts of a detachable ring of the button making device of FIG. 52. FIG. 57 is a plan view looking from below a vertically movable member of the button making device of FIG. 52. FIG. 58 is a perspective explanatory view showing a sliding platform of the button making device of FIG. 52. FIG. 59 is a side elevation of the essential parts describing the movement in the button making device of FIG. 52. FIG. 60 is a side elevation of the essential parts describing the movement in the button making device of FIG. 52. FIG. 61 to FIG. 64 are overall side cross sectional views of the button making device of FIG. 52. The base 502 and struts 516, 517 are as described above, and so description of these parts is omitted.

A fixed member 820 having a substantially reverse C-shaped cross section is fixed substantially horizontally to an upper part of the base 502 via the struts 516 and 517. A fixed member 820 is integrally formed using hard synthetic resin having durability and abrasion resistance, such as polycarbonate. One strut 516 has a male threaded section 516*b* formed on an upper part inserted into a hole formed in one end of the fixed member 820 and is fastened using a nut 521, so as to fix the fixed member 820. The other strut 517 has a male threaded section 517*b* formed on an upper part inserted into a hole formed in the other end of the fixed member 820 and is fastened using a nut 522, so as to fix the fixed member 820.

The fixed member 820 has a boss section 823 formed substantially at the center, and a female threaded section 825 is formed on this boss section 823. The pressing shaft 830 is integrally formed using hard synthetic resin having durability and abrasion resistance, such as polycarbonate. The processing shaft 830 has a male threaded section 833 capable of moving in the axial direction by being screwed into the female threaded section 825 provided on the fixed member 820. The processing shaft 830 also has a vertically movable member 841 rotatably provided on the lower end, and operation means 810 provided on an upper part.

Figure 61:
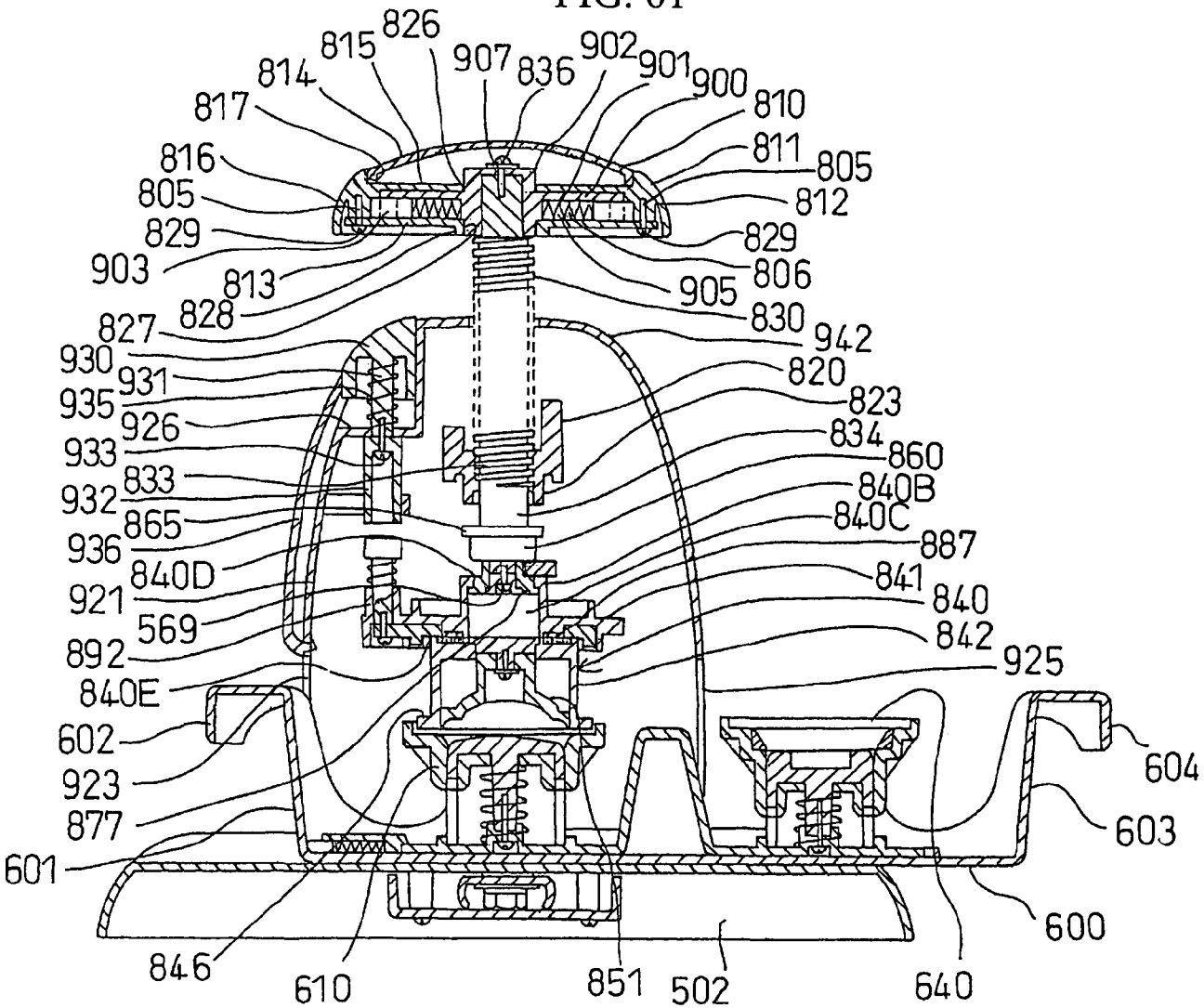
FIG. 61 is an overall side cross sectional view of the button making device of FIG. 52.
Figure 62:
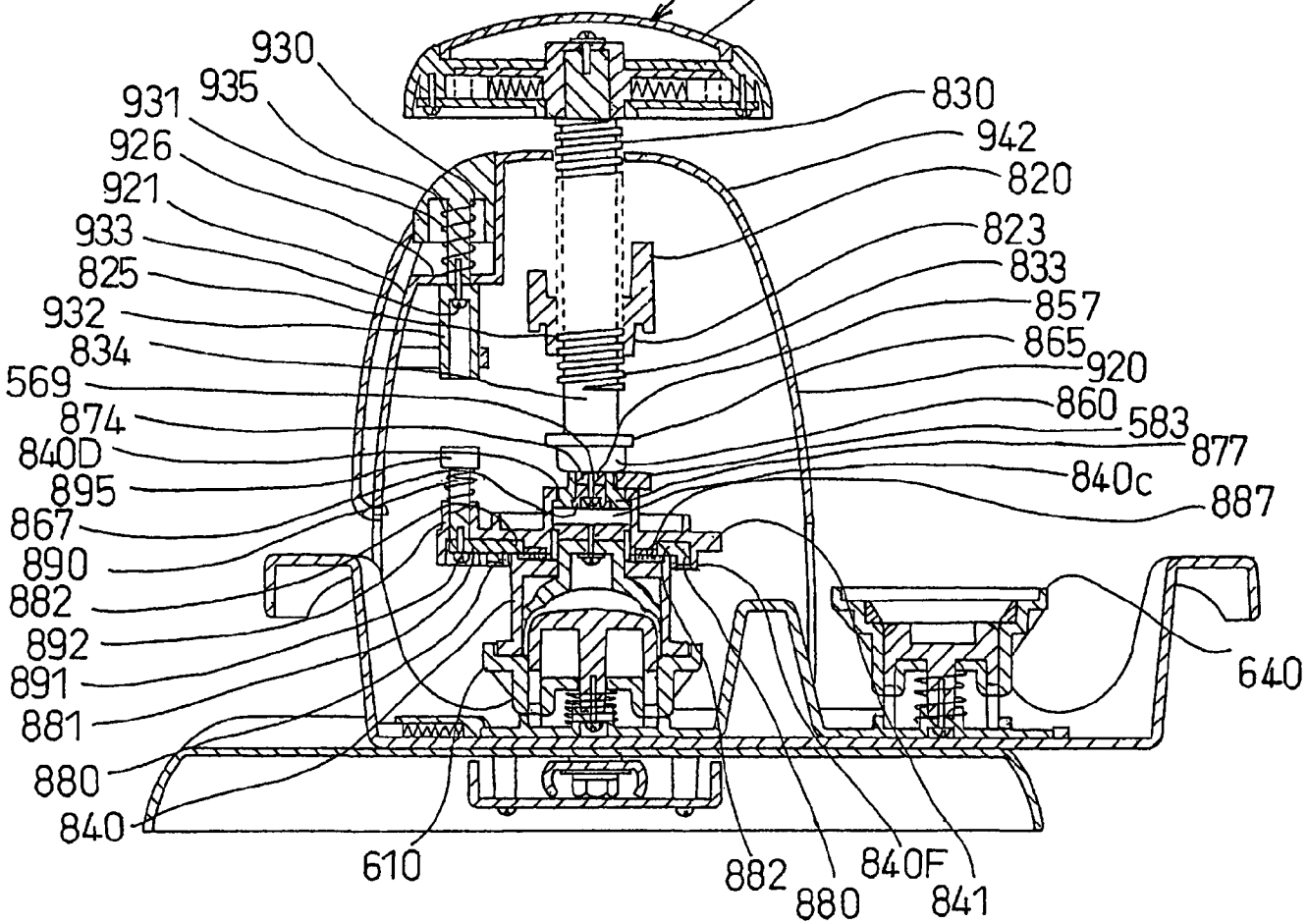
FIG. 62 is an overall side cross sectional view of the button making device of FIG. 52.
Figure 63:
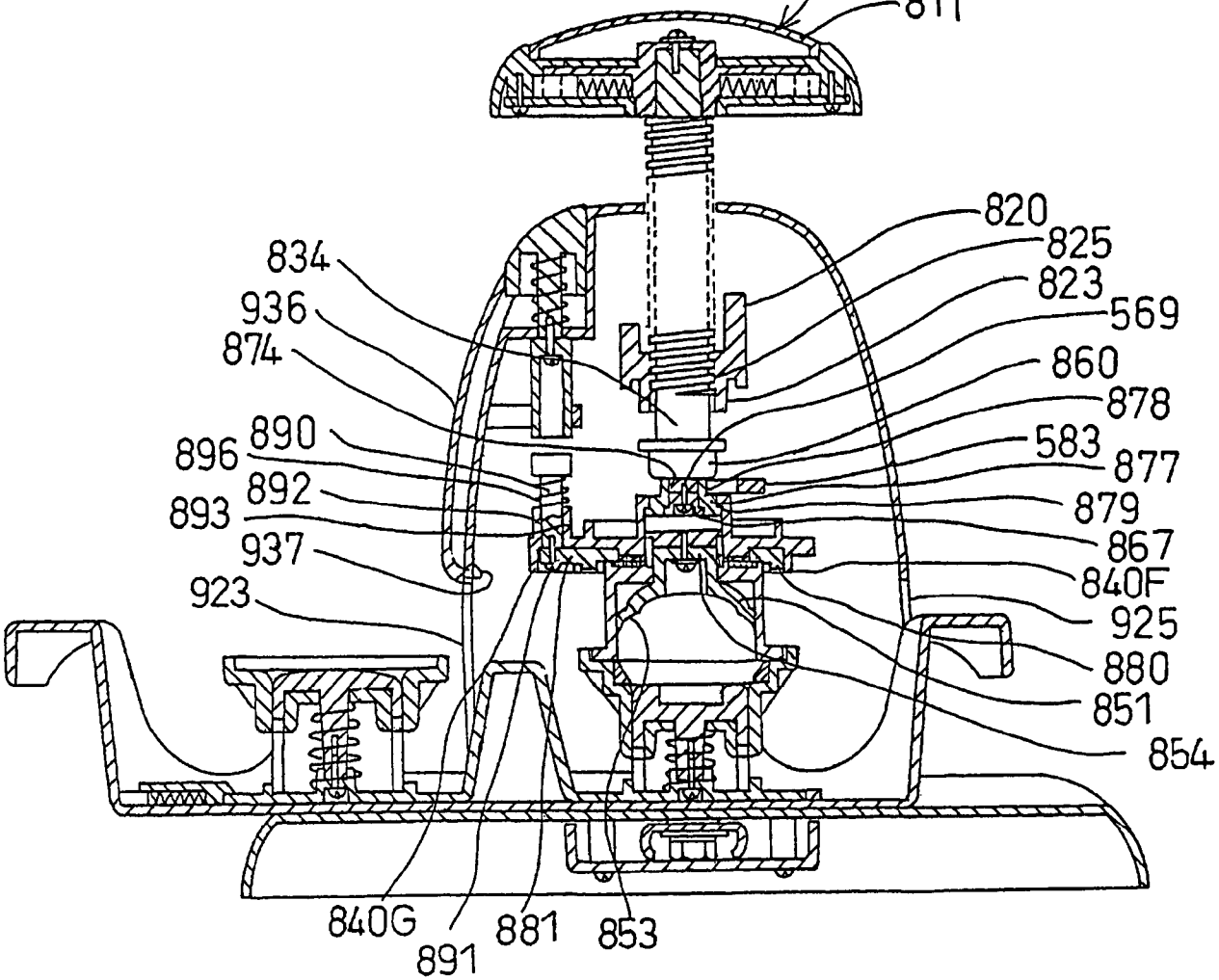
FIG. 63 is an overall side cross sectional view of the button making device of FIG. 52.
Figure 64:
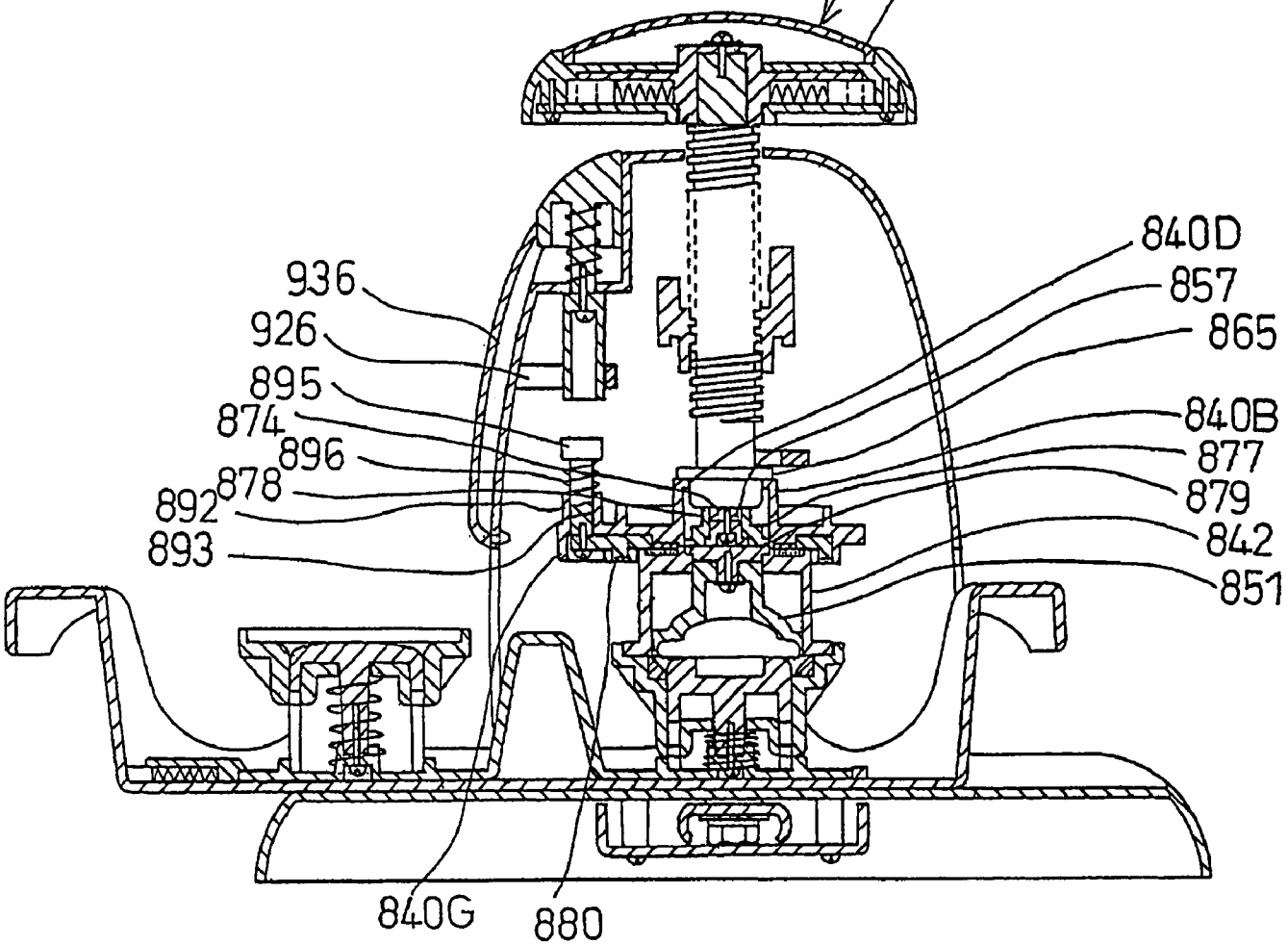
FIG. 64 is an overall side cross sectional view of the button making device of FIG. 52.

As shown in FIG. 61, the male threaded section 833 is formed so that before the pressing shaft 830 is moved upwards and the vertically movable member 841 comes into contact with the fixed member 820, it moves away from the female threaded section 825 of the fixed member 820, and the pressing shaft 830 slackens off. That is, a non-threaded section 834 where the male threaded section 833 is not formed is provided on a lower part of the pressing shaft 830. The pressing shaft 830 has a hexagonal shaft 831 formed at the upper end, and a pressing mold 840 for engaging with a first pressed mold 610 or a second pressed mold 640 at the lower end.

As shown in FIGS. 54, 55 and 61, the operation means 810 comprises an operating handle 811 and a clutch 900. The operating handle 811 comprises a circular disk-shaped upper case 812, a lower cover 813, and an upper cover 814. The upper case 812 comprises an upper wall 815, and a peripheral wall 816 extending from an upper edge of an annular side wall 817 provided on the peripheral edge of the upper wall 815. In order to make it easy to grip the peripheral wall 816, a convex section is formed. The upper wall 815 has an annular guide wall 818 provided on a lower surface. Latch indents 819 are formed at eight places in the guide wall 718 with a specified distance apart from each other. A bearing piece hole 826 is formed at a substantially central part of the upper wall 815 of the upper case 812.

The upper cover 814 is dome-wise curved in a dome shape, and is fitted into the side wall 817 of the upper wall 815. The lower cover 813 is formed in a circular plate shape, and a boss section 828 is formed with a bearing piece hole 827 provided at a substantially central part. The lower cover 813 is attached to a lower part of the operating handle 811 by inserting screws 829 through holes 804 formed at four places in the lower cover 813 into screw holes 805 formed at four places in the lower surface of the upper wall 815 of the operating handle 811. Thus, a storage space 806 is formed inside the operating handle 811.

The clutch 900 is rotatably housed inside the storage space 806, and comprises a circular disc-shaped rotating body 901, a rotation shaft 902 formed substantially in the center of the rotating body 901, latch projections 903 formed capable of moving in and out at four places on the edge of the rotating body 901, and an elastic member 905 for pressing the latch projection in a projection direction. The rotation shaft 902 is rotatably pivoted at a bearing piece hole 826 of the upper wall 815 and a bearing piece hole 827 of the lower cover 813, and has an attachment hole 906 having a hexagonal cross section substantially in the center of the lower surface, and a screw through hole 907 for linking to the attachment hole 906 in an upper surface.

Also, the rotating body 901 has a guide indent 910 stretching radially. The guide indent 910 links to an opening 911 formed at an edge of the rotating body 901, and engagement grooves 912, 912 are formed on both sides of the guide indent 910. The latch projections 903 have front tips formed in a semicircular shape, and engagement projections 913, 913 for engaging with the engagement grooves 912, 912 are formed in the rear tips so that the front tips engage with and disengage from the latch indents 819 of the guide wall 818.

A spring-type elastic member 905 is provided inside the guide indent 910, and the latch projections 903 are pressed in a projection direction by this elastic member 905. If an external force greater than a specified value is applied, the latch projections 903 are deeply inserted against the resilience of the elastic member 905. The moving in and out of the latch projections 903 occurs in a range in which the engagement projections 913, 913 contact both ends of the engagement grooves 912, 912.

The operation means 810 described above is attached to the pressing shaft 830 by fitting the hexagonal shaft 831 of the pressing shaft 830 into the attachment hole 906 of the clutch 900, and screwing the screw 836 into the screw hole 835 formed on the upper end of the hexagonal shaft 831 via the screw through hole 907.

A pressing mold 840, for engaging with the first pressed mold (first front cover mounting mold) 610 or the second pressed mold (first rear cover mounting mold) 640, is provided on a lower end of the pressing screw shaft 830. The pressing mold 840 has an outer layer frame 842 and an inner layer frame 851, and is removably attached to a vertically movable member 841. The vertically movable member 841 is formed in a plate shape, with a circular projection 840B formed substantially in the center of the upper surface of this vertically movable member 841, and a circular indent 840C formed substantially in the center of the lower surface of the vertically movable member 841.

Also, an opening 840D for linking the substantial center of the circular projection 840B and the substantial center of the circular indent 840C is formed substantially in the center of the vertically movable member 841. An annular guide wall 840E is formed projecting out on the lower surface of the vertically movable member 841, with the center of the circular indent 840C as a center. An annular magnetic body 887, having magnetic force, is attached inside the annular guide wall 840E at the lower surface of the vertically movable member 841. This magnetic body 887 is formed using a magnetic member such as a magnet or magnetic rubber.

The pressing shaft 830 has an engagement section 860 formed at a lower part of a non-threaded section 834. The engagement section 860 is formed having almost the same diameter as the opening 840D, so as to be capable of passing through the opening 840D. That is, by passing the engagement section 860 through the opening 840D, the pressing shaft 830 becomes capable of moving vertically relative to the vertically movable member 841. Also, if the pressing shaft 830 is moved downwards and the engagement section 860 is inserted through until the flange section 865 formed on the upper part of the non-threaded section 834 comes into contact with the edge of the opening 840D, the pressing shaft 830 can no longer move vertically relative to the vertically movable member 841, and the pressing shaft 830 and the vertically movable member 841 move vertically together. The engagement section 860 has an engagement shaft 857 having a slightly smaller diameter than the diameter of the pressing shaft 830 at a lower part.

A pressing member 877 is rotatably attached to the lower end of the engagement section 860, that is, the end of the engagement shaft 857, using a screw 569. The pressing member 877 is slidably provided inside the circular indent 840C of the vertically movable member 841, and has an engagement indent 878 at an upper part, and an annular guide projection 879 on a lower surface edge. The pressing member 877 has almost the same diameter as the opening 840D, so that it is capable of passing through the opening 840D. Accordingly, if the pressing member 877 moves downwards together with the pressing shaft 830 and the engagement section 860 of the pressing shaft 830 is inserted into the opening 840D, the pressing member 877 is capable of moving vertically relative to the vertically movable member 841 to the extent of the insertion. The guide projection 879 comes into contact with the edge of the opening 840D so that it can not project any further upwards than that.

Also, the pressing member 877 has an engagement hole 874 having a step section formed substantially in the center. The engagement shaft 857 is rotatably engaged in this engagement hole 874, a seat 867 is rotatably attached to the engagement hole 874, and the screw 569 is screwed into the seat 867 and the engagement shaft 857 so that the pressing member 877 is rotatably attached to the lower end of the pressing shaft 830.

An annular guide wall 840F is formed around the guide wall 840E at the lower surface of the vertically movable member 841. This guide wall 840F has a front section cut away, and a substantially triangular guide wall 840G is formed at this cut-away section. A removable ring 880 is provided between this guide wall 840F and the guide wall 840E.

The removable ring 880 is provided with an engaging piece 881 for engaging inside the guide wall 840G, and projecting pieces 882 projecting at four places at equal intervals around an inner edge. The projecting pieces 882 project from the cut-away 885 formed in the guide wall 840E to inside the guide wall 840E, and engage with either indents 888 formed in the magnetic body 887. The projecting pieces 882 and the magnetic body 887 are substantially coplanar with each other.

The piece 881 of the removable ring 880 is attached to a lower end of a push-out rod 890 by a screw 891. The push-out rod 890 is slidably attached to a guide hole 893 of a boss 892 formed on an upper surface of the vertically movable member 841. Also, the push-out rod 890 has a head section 895 formed on an upper part, is pressed upwards by a spring-shaped elastic member 896 wrapped around between this head section 895 and the boss 892, and has the removable ring 880 pressed to the lower surface of the vertically movable member 841.

A cover 920 comprising a front half body 921 and a rear half body 922 is removably attached to the base. A first opening 923 is formed in the front half body 921, and a second opening 925 is formed in the rear half body 922. A step section 926 is provided on an upper part of the front half body 921. An operating button 930 is arranged on the step section 926. The operating button 930 has a strut 931 integrally formed at a lower section, and the pressing shaft 932 is attached to a lower end of the strut 931 using a screw 933. The pressing shaft 932 is pressed against a rear surface of the step section 926 by a spring shaped elastic member 935 wrapped around between the operating button 930 and the step section 926. An ornamental cover 936 for covering the step section 926 is removably attached to the front half body 921 using a latch piece 937.

The pressing mold 840 comprises the outer layer frame 842, and the inner layer frame 851 which is slidably attached to the inside of the outer layer frame 842 and is shallower than the outer layer frame 842. The outer layer frame 842 comprises a cylindrical peripheral wall 843, a pressing member 846 formed at a lower outer edge of the peripheral wall 843, and an upper wall 847 formed on an upper end of the peripheral wall 843. A substantially circular indent 848 is formed on the upper wall 847, and an annular magnetic body 849 is attached to the indent 848. The magnetic body 849 is preferably compatible with the magnetic body 887 with respect to attachment, and is formed using a magnetic material such as a magnet, magnetic rubber or a ferromagnetic body. A guide hole 844 is formed substantially in the center of the upper wall 847.

The inner layer frame 851 comprises a curved section 852 formed in an inverse bowl shape, a contact edge 853 formed on the lower peripheral edge of the curved section 852 for contacting the peripheral edge 703 of the front cover 701 of the button, and a neck section (guide projection) 854 formed on an upper part of the curved section 852 and slidably guided in the guide hole 844 of the outer layer frame 842. A sliding member 855 similarly slidably guided in the guide hole 844 is attached to the neck section (guide projection) 854 using a screw 857, and an engagement projection 856 for engaging with the upper wall 847 of the outer layer frame 842 is formed on an upper peripheral edge of the sliding member 855.

Therefore, in a range where the engagement projection 856 and the curved section 852 contact the upper wall 847, it is possible for the inner layer frame 851 to slide up and down with respect to the outer layer frame 842, and the engagement projection 856 engages with the upper wall 847 as a result of its own weight. In this way, by attaching the inner layer frame 851 inside of the outer layer frame 842, inconveniences such as one of them being lost or being assembled incorrectly is prevented.

A pressing mold 940 is formed larger than the pressing mold 840, and comprises an outer layer frame 942 and an inner layer frame 951 which is slidably attached to the inside of the outer layer frame 942 and is shallower than the outer layer frame 942. The outer layer frame 942 comprises an outer curved section 943 formed in an inverse bowl shape, a pressing section 946 formed on a lower peripheral edge of the outer curved section 943, a cylindrical peripheral wall 945 formed at an upper part of the outer curved section 943, and an upper wall 947 formed on an upper end of the peripheral wall 945. A substantially circular indent 948 is formed in the upper wall 947, and the magnetic body 849 is attached to this indent 948. A guide hole 944 is formed substantially in the center of the upper wall 947.

The inner layer frame 951 comprises a curved section 952 formed in an inverse bowl shape, a contact edge 953 formed on the lower peripheral edge of the curved section 952 for contacting the peripheral edge 703 of the front cover 701 of the button, and a neck section (guide projection) 954 formed on an upper part of the curved section 952 and slidably guided in a guide hole 944 of the outer layer frame 942. A sliding member 955 similarly slidably guided in the guide hole 944 is attached to the neck section (guide projection) 954 using a screw 957, and an engagement projection 956 for engaging with the upper wall 947 of the outer layer frame 942 is formed on an upper peripheral edge of the sliding member 955. Therefore, in a range where the engagement projection 956 and the curved section 952 contact the upper wall 947, it is possible for the inner layer frame 951 to slide up and down with respect to the outer layer frame 942, and the engagement projection 956 is engaged with the upper wall 947 as a result of its own weight. In this way, by attaching the inner layer frame 951 inside the outer layer frame 942, inconveniences such as one of them being lost or being assembled incorrectly is prevented.

The vertically movable member 841 is formed in a plate shape, has guide holes 871 and 872 slidably guided in the struts 516 and 517 provided at the left and right ends, and is guided so as to be able to move up and down only by these guide holes 871 and 872. An indication plate 861 for enabling confirmation of the positions of these guide holes is integrally formed on one end of the vertically movable member 841. This indication plate 861 can be observed from an elongated hole 862 formed in the front half body 921 of the cover 920. Also, a switching member 580 is provided in the vertically movable member 841. The switching member 580 switches between a state where sections that move downwards together with downward movement of the pressing shaft 830 are only the vertically movable member 841 and the outer layer frame 842, and a state where the sections are the vertically movable member 841, the outer layer frame 842, the pressing member 877, and the inner layer frame 851. The switching member 580 does this by allowing or preventing the pressing shaft 830 from passing through the opening 840D of the engagement section 860 according to the position of the first pressed mold (first front cover mounting mold) 610 or the second pressed mold (first rear cover mounting mold) 640.

The switching member 580 is rotatably attached to the vertically movable member 841 by a screw 576. The switching member 580 comprises a boss section 581 rotatably attached using the screw 576, a first arm member 582 provided on the boss section 581, a semi-ring shaped engagement section 583 provided on the first arm member 582, capable of engaging with the engagement indent 878 of the pressing member 877, and a second arm member 587 provided at a position of the boss section 581 substantially opposite to the first arm member 582. An elongated hole shaped engagement groove 586 is formed in the second arm member 585.

A swing member 590 is provided in a freely rocking manner on one strut 516 so as to move up and down together with the vertically movable member 841. The swing member 590 comprises a boss section 591 attached to the strut 516, an arm section 592 provided on one side of the boss section 591, and a spring mounting hook 593 provided on the other side of the boss section 591. An engagement shaft 595 is formed substantially vertically on the arm section 592. The engagement shaft 595 has an upper section 595*a* engaging with the engagement groove 586 of the switching member 580, with a lower part 595*b* projecting from an elongated hole 544 formed in the vertically movable member 541, and an engagement rod is provided on the lower part 595*b*.

A spring mounting hook 596 is provided on a rear section of the vertically movable member 841. A spring 597 is placed between this spring mounting hook 596 and the spring mounting hook 593 of the swing member 590. The engagement section 583 of the switching member 580 is brought into contact with an engagement indent 878 of the pressing member 877 via the swing member 590 under resilience of this spring 597. Coil spring-shaped elastic members 535, 536 are provided on struts 516, 517 between the fixed member 820 and the vertically movable member 841. The vertically movable member 841 is pressed downwards by these elastic members 535, 536. A male threaded section 833 of the pressing shaft 830 is pressed in a direction to be screwed in to the female threaded section 825 of the fixed member 820.

The sliding platform 600 and attachment member (first attachment member) 691 are as described above, and so description will be omitted here except for the following. A substantially platform-shaped bent section 699 is formed at a substantially middle section of the attachment member (first attachment member) 691, and the attachment member (first attachment member) 691 is strengthened by this bent section 699. Also, molded components formed using the first pressed mold (first front cover mounting mold) 610 are prevented from moving into the second pressed mold (first rear cover mounting mold) 640, and molded components formed using the second pressed mold (first rear cover mounting mold) 640 are prevented from moving into the first pressed mold (first front cover mounting mold) 610.

Operation of the button making device 801 of the present invention will now be described. If the handle 602 provided on the front wall 601 of the sliding platform 600 is held, the first pressed mold (first front cover mounting mold) 610 is taken out from the first opening 681 of the cover 920, and the front cover 701 is placed on the upper wall 615 of the first mounting platform 611, the peripheral edge 703 is inserted into the gap 636 between the upper wall 615 and the mounting section 626. Next, after overlapping the sheet body 713 on the design sheet 711, the design sheet 711 is placed on the mounting section 626 of the guide platform 625. Further, the outer layer frame 842 and the inner layer frame 851 slidably attached inside the outer layer frame 842 are mounted on the first pressed mold (first front cover mounting mold) 610.

If the handle 602 of the front wall 601 is held and the sliding platform 600 is pressed in, the latch projection 675 of the latch plate 672 engages with the first latch indent 676 of the sliding platform 600, the first pressed mold (first front cover mounting mold) 610 is positioned almost directly below the pressing mold 540, and the second pressed mold (first rear cover mounting mold) 640 projects from the second opening 682 of the cover 920. If the operating handle 811 is rotated in one direction, the pressing shaft 830 rotates clockwise, the male threaded section 833 is screwed into the female threaded section 825 of the fixed member 520 by the elastic members 535, 536, and the pressing shaft 830 moves downwards. Since the engagement section 860 provided on the lower part of the pressing shaft 830 is prevented from passing through the opening 840D by the engagement section 583 of the switching member 580, the pressing member 877 can not move downwards relative to the vertically movable member 841. However, since the engagement section 583 of the switching member 580 is in contact with the vertically movable member 841, the pressing shaft 830 moves downwards, and the vertically movable member 841 slides downwards together with the pressing shaft 830 as a result of the engagement section 860 pressing the engagement section 583 of the switching member 580, and presses the pressing mold 840 downwards. As a result of the pressing shaft 830 moving further downwards, the magnetic body 887 provided on the lower surface of the vertically movable member 841 and the magnetic body 849 on the outer layer frame 842 of the first pressed mold (first front cover mounting mold) 610 are brought into contact, and the outer layer frame 842 is affixed to the vertically movable member 841.

The pressing section 846 of the outer layer frame 842 engages with the guide wall 627 of the guide platform 625, contacts the mounting section 626, and presses the guide platform 625 downwards against the resilience of the elastic member 613. The inner layer frame 851 is in a free state with respect to the outer layer frame 842, which means that it does not press the first pressed mold (first front cover mounting mold) 610. The peripheries of the sheet body 713 and the design sheet 711 placed on the guide platform 625 in layers are bent downwards, and come into contact with the peripheral edge 703 of the front cover 701 placed on the first mounting platform 611. At this time, a hand is prevented from getting close to the first pressed mold (first front cover mounting mold) 610 by the cover 920. The position where this pressing mold 840 has been pressed downwards can be confirmed by looking at the indication plate 861.

If the operating handle 811 is turned in the other direction, the pressing shaft 830 rotates counterclockwise, and the pressing shaft 830 moves upwards by a male threaded section 833. Accompanying this, the vertically movable member 841, the outer layer frame 842 affixed to the vertically movable member 841, and the inner layer frame 851 attached inside the outer layer frame 842, also slide upwards. The front cover 701 in a state where the peripheries of the sheet body 713 and the design sheet 711 are bent downwards and are in contact with the peripheral edge 703 is pulled up while still being fitted inside the outer layer frame 842 and is detached from the first pressed mold (first front cover mounting mold) 610. Because the male threaded section 833 of the pressing shaft 830 comes away from the female threaded section 825 of the fixed member 820 immediately before the engagement section 860 comes into contact with the boss section 823, the pressing shaft 830 slackens off, the pressing mold 840 no longer moves upwards, and the engagement section 860 is no longer pressed against the boss section 823. As a result, the engagement section 860 and the pressing mold 840 are not broken.

If the rear cover 705 is mounted on the upper wall 643 of the second mounting platform 641 of the second pressed mold (first rear cover mounting mold) 640 projecting from the second opening 682 of the cover 920, with the peripheral edge 709 facing upwards, the attachment hole 707 for attaching the detachable pin 729 is protected by the indent 642, and the peripheral edge 709 is guided and positioned in an inner surface of the cylindrical section 662 of the processing platform 655.

If the handle 604 of the rear wall 603 is held and the sliding platform 600 is pressed in, the latch projection 675 of the latch plate 672 engages with the second latch indent 677 of the sliding platform 600, the second pressed mold (first rear cover mounting mold) 640 is positioned almost directly below the pressing mold 540, and the first pressed mold (first front cover mounting mold) 610 projects from the first opening 923 of the cover 920. If the second pressed mold (first rear cover mounting mold) 640 is positioned almost directly below the pressing mold 540, the rear engagement wall 599*b* of the sliding platform 600 engages with the engagement rod 598 of the engagement shaft 595 of the switching member 580, the half-ring shaped engagement section 583 rotates against the elasticity of the spring 597 with the bearing section 575 as a center, and moves away from the engagement indent 878 of the pressing member 877.

If the operating handle 811 is turned in one direction, the pressing shaft 830 rotates clockwise and the pressing shaft 830 moves downwards as described above. At this time, since the engagement section 583 of the switching member 580 is removed from the engagement indent 878 of the pressing member 877, the engagement section 860 provided on the lower part of the pressing shaft 830 passes through the opening 840D. Together with this, the pressing member 877 moves downwards relative to the vertically movable member 841, makes contact with the neck section (guide projection) 854 of the inner layer frame 851 of the pressing mold 840, and presses the inner layer frame 851 downwards. The contact edge 853 of the inner layer frame 851 contacts the upper edge of the front cover 701 and the front cover 701 is pushed down to the vicinity of a lower surface of the outer layer frame 842. If the pressing shaft 830 is moved further downwards, the vertically movable member 841 and the outer layer frame 842 also begin to move downwards together with the pressing shaft 830 due to the fact that the flange section 865 of the pressing shaft 830 is in contact with the opening 840D. If the pressing shaft 830 is moved still further downwards, the outer layer frame 842 comes into contact with the processing platform 655, and presses the processing platform 655 down against the resilient force of the elastic member 656. In doing this, at almost the same time, the peripheries of the sheet body 713 and the design sheet 711 that have been pressed down until they are close to the lower surface of the outer layer frame 842 by the inner layer frame 851 come into contact with the inclined surface 660 of the processing platform 655 to be folded inwards. Then the peripheral edge 703 of the front cover 701 also comes into contact with this inclined surface 660.

If the pressing shaft 830 moves further downwards and the lower end of the processing platform 655 comes into contact with the sliding platform 600 so that the processing platform 655 can no longer be pressed downwards, the peripheral edge 703 of the front cover 701 is folded further inwards by the inclined edge 660, and the peripheries of the sheet body 713 and the design sheet 711 are folded until they face upwards by the inclined surface 660 and the edge of the second mounting platform 641. At this time, the rear cover 705 having the shape of the second mounting platform 641 engages with the front cover 701 so that the peripheries of the sheet body 713 and the design sheet 711 are gripped by the peripheral edge 709 of the rear cover 705 and the peripheral edge 703 of the front cover 701, to make the button 700*a*.

At this time, even if the operating handle 811 is operated by applying an external force greater than a specified value so as to cause the pressing shaft 830 to move downwards, since the latch projections 903 provided on the clutch 900 inside the operating handle 811 are removed from the latch indents 819, the operating handle 811 slackens off with respect to the pressing shaft 830, and the pressing mold 840 and the button 700 will not be broken.

If the operating handle 811 is turned in the other direction, the pressing shaft 830 rotates counterclockwise, and the pressing shaft 830 moves upwards. Accompanying this, the vertically movable member 841 also slides upwards. The button body 700*a* remains loaded in the second pressed mold (first rear cover mounting mold) 640. If the handle 604 provided in the rear wall 603 of the sliding platform 600 is held, the second pressed mold (first rear cover mounting mold) 640 is taken out from the second opening 682 of the cover 920, and it is possible to easily remove the button body 700*a* from the second pressed mold (first rear cover mounting mold) 640. Making of the button 700 is completed upon inserting the attachment shaft 721 (or 731, 741) of the previously described mounting means 720 (or 730, 740) in the attachment hole 707 of the button body 700*a*.

With the above described button making device 801, it is easy to replace the pressing mold 840 depending on the size of a button 700 to be made. If the operating button 930 provided on the cover 920 is pressed down against the resilience of the elastic member 935, the removable ring 880 is pressed down against the resilience of the elastic member 896 via the strut 931, pressing shaft 932, and push-out rod 890, the projecting piece 882 of the removable ring 880 resists the elasticity of the magnetic body 887 and the magnetic body 849, and the pressing mold 840 can be easily removed.

As shown in FIG. 60, with the button making device 801 in order to change the size of button 700 being made, a pressing mold 940 that is larger than the pressing mold 840 is attached to the vertically movable member 841 by magnetic force of the magnetic body 887 and the magnetic body 849. Since the first pressed mold (first front cover mounting platform) 610 and the second pressed mold (first rear cover mounting platform) 640 are provided together on the attachment member (first attachment member) 691 removably attached to the sliding platform 600, it is possible to change them over more easily. That is, it is possible to change the first pressed mold (first front cover mounting platform) 610 and the second pressed mold (first rear cover mounting platform) 640 at the same time. For example, as shown in FIG. 60, an attachment member (second attachment member) 691*a* on which a first pressed mold (second front cover mounting platform) 610*a* that is larger than the first pressed mold (first front cover mounting platform) 610 and a second pressed mold (second rear cover mounting platform) 640*a* that is larger than the second pressed mold (first rear cover mounting platform) 640 are provided can be simply attached to the sliding platform 600.

Figure 65:
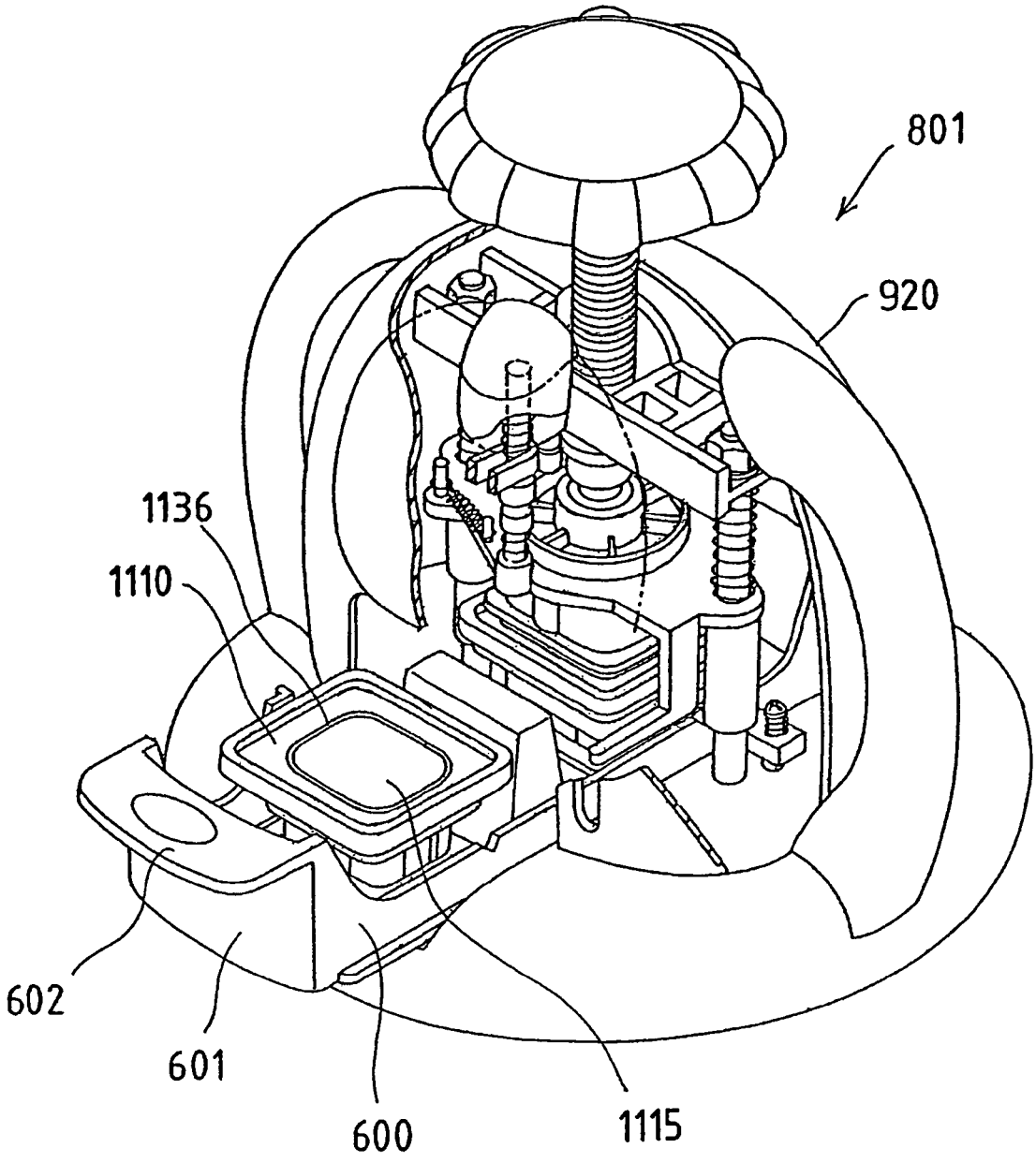
FIG. 65 is an overall perspective view showing a button making device of the present invention.
Figure 66:
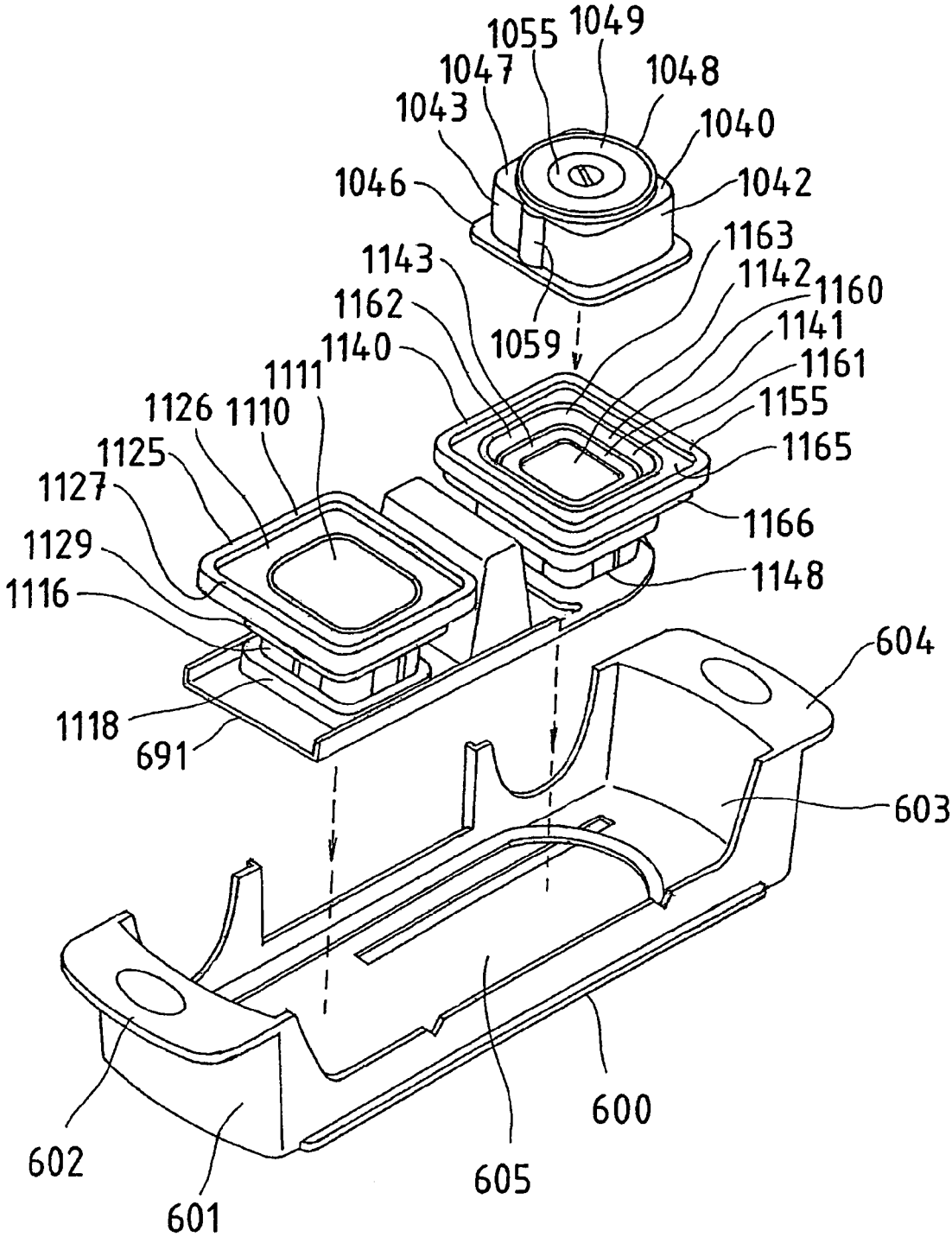
FIG. 66 is a perspective view showing the essential parts of a button making device.
Figure 67:
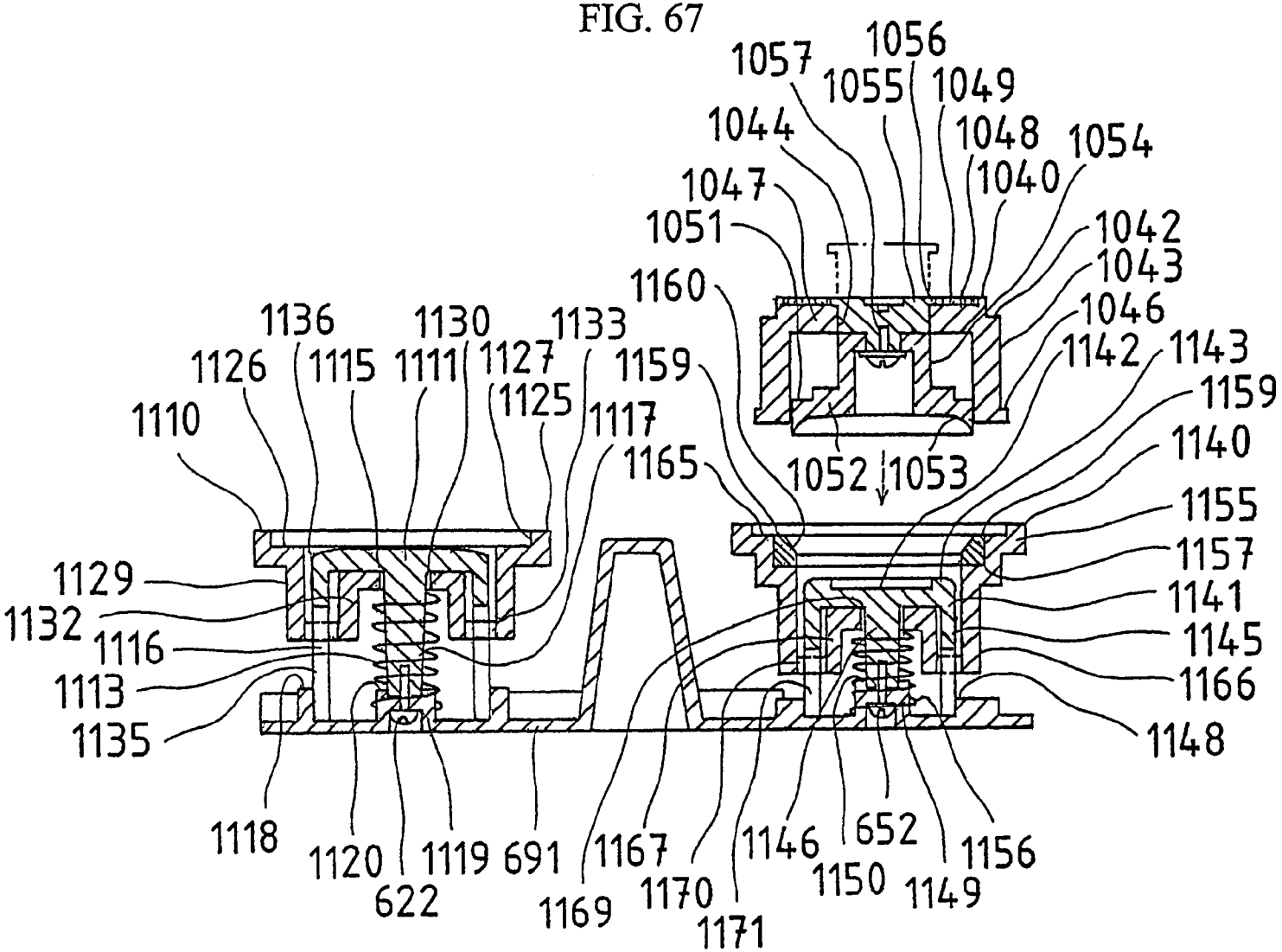
FIG. 67 is a cross sectional view of the essential parts of the button making device of FIG. 65.
Figure 68:
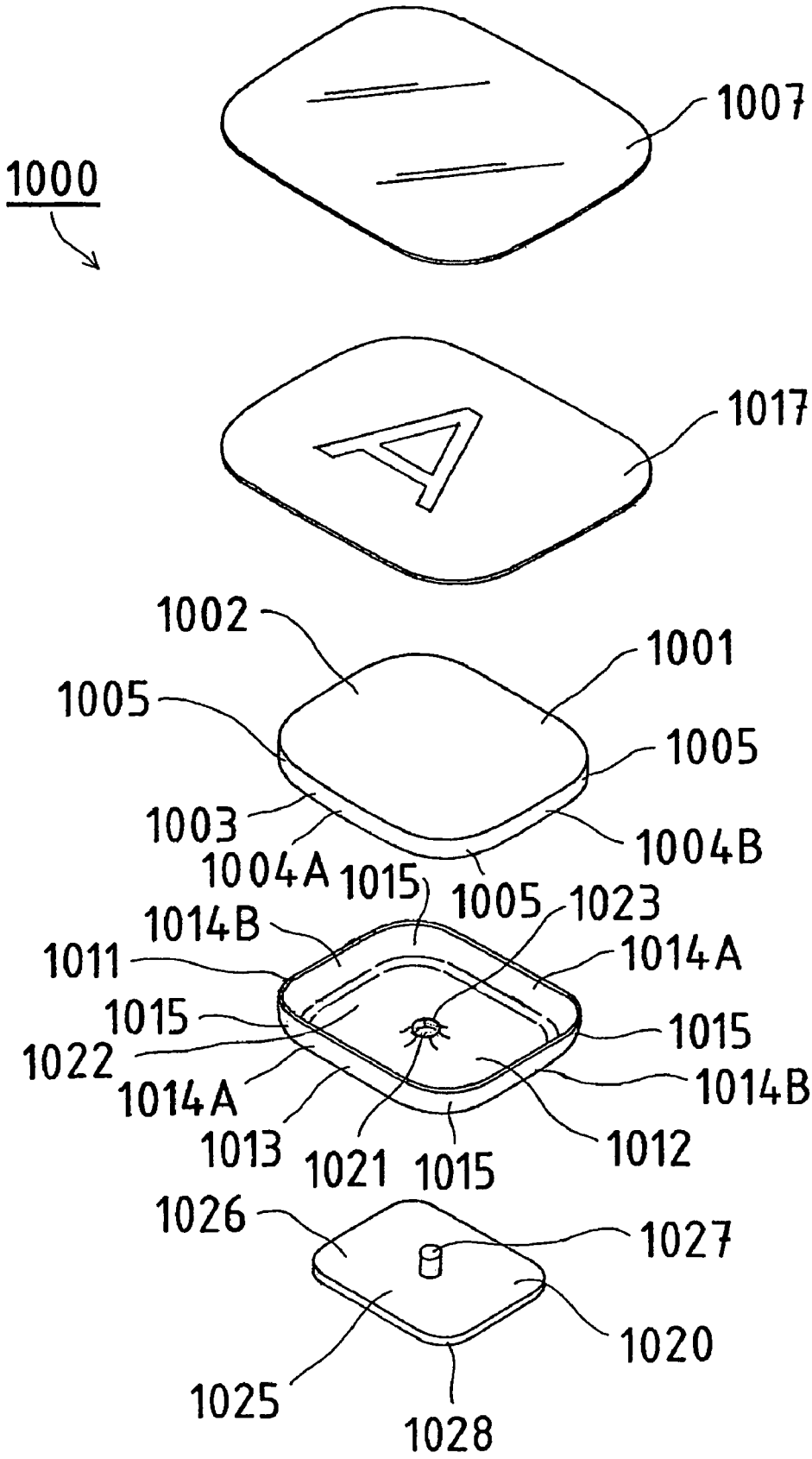
FIG. 68 is an overall exploded view showing a polygonal button of the present invention.
Figure 69:
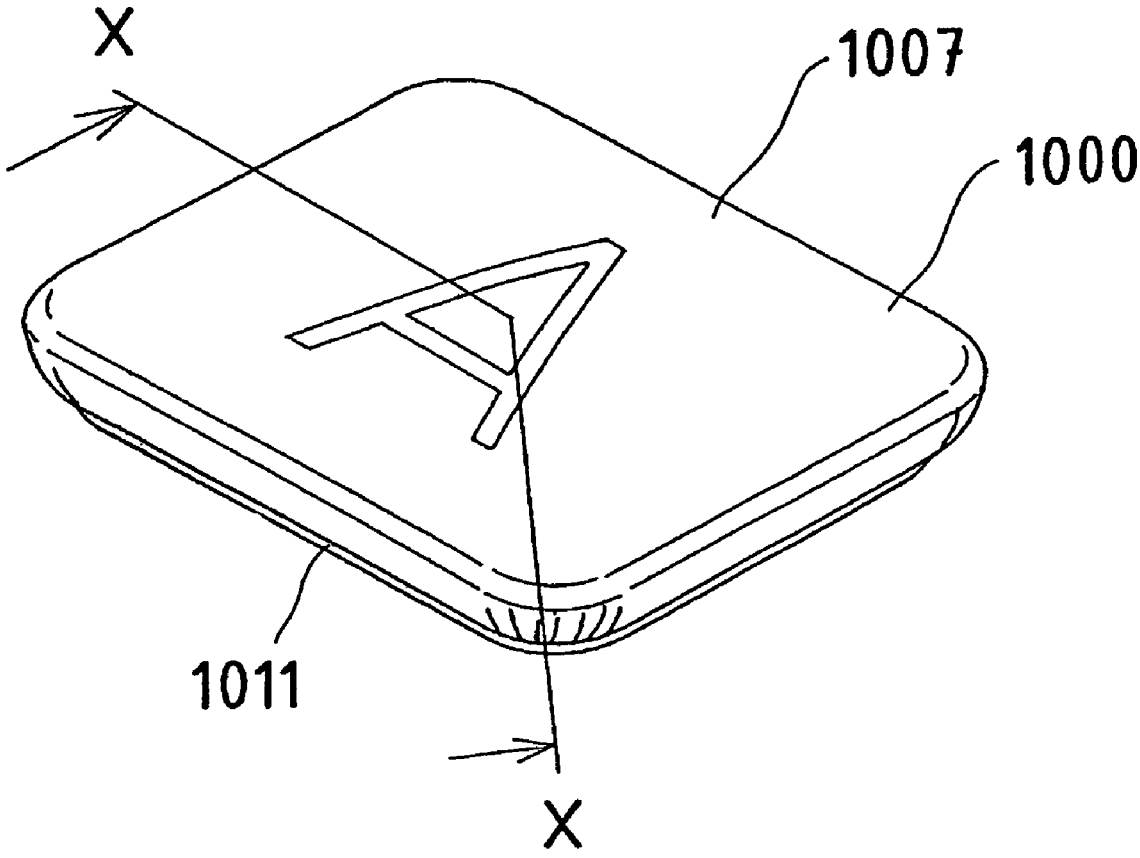
FIG. 69 is an overall perspective view of FIG. 68 assembled.
Figure 70:
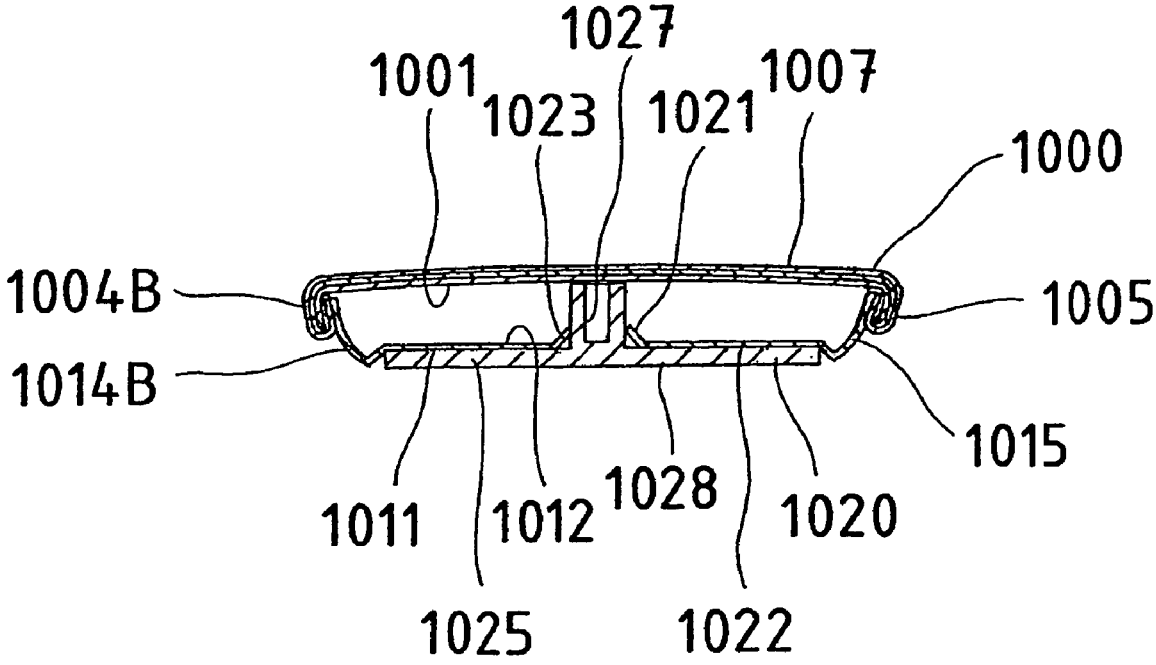
FIG. 70 is a cross sectional view of the button taken along line X-X of FIG. 69.

While the above-mentioned embodiment explained the circular button and the button making device which manufactures the circular button, a polygonal button can also be manufactured using the above-mentioned button making device. One embodiment of a polygonal button and a button making device which manufactures the polygonal button of the present invention will now be described based on FIG. 65 to FIG. 70. FIG. 65 is an overall perspective view showing a button making device of the present invention. FIG. 66 is a perspective view showing the essential parts of the button making device of FIG. 65. FIG. 67 is a cross sectional view of the button making device of FIG. 65. FIG. 68 is an overall exploded view showing a polygon-like button of the present invention. FIG. 69 is an overall perspective view of FIG. 68 assembled. FIG. 70 is a cross sectional view of the button taken along line X-X of FIG. 69.

A button 1000 is formed in the shape of a polygon, and comprises a front cover 1001, a back cover 1011, and a sheet body 1007. The front cover 1001 has a polygonal front surface plate 1002 and a peripheral edge 1003 which extends below the front surface plate 1002. The peripheral edge 1003 comprises straight-line sections 1004A, 1004B, and a corner section 1005 which connects the straight-line sections 1004A, 1004B. A sheet body 1007 is laid on the front surface plate 1002 of the front cover 1001.

The back cover 1011 has a polygonal rear surface plate 1012 and a peripheral edge 1013 which extends above the rear surface plate 1012. The peripheral edge 1013 comprises straight-line sections 1014A, 1014B, and a corner section 1015 which connects the straight-line sections 1014A, 1014B. The front cover 1001 is mounted to the rear cover 1011 by the corner section 1005 of the peripheral edge 1003 attached to the corner section 1015 of the peripheral edge 1013 of the rear cover 1011. A peripheral edge of the above-identified sheet body 1007 is pinched by the peripheral edge 1003 of the front cover 1001 and the peripheral edge 1013 of the rear cover 1011.

The sheet body 1007 is formed by a material which has permeability. A design sheet 1017, on which a character, a pattern, a design, or a combination thereof is printed, is laid between the sheet body 1007 and the front surface plate 1002 of the above-mentioned front cover 1001.

Furthermore, a button is explained. The button 1000 is formed in the shape of a rectangle, and comprises the front cover 1001, the back cover 1011, the design sheet 1017, and the sheet body 1007. The front cover 1001 has the rectangular front surface plate 1002 before processing. The peripheral edge 1003 is bent substantially perpendicularly to the front surface plate 1002 and extends below the front surface plate 1002. The peripheral edge 1003 is facing down and comprises the long straight-line sections 1004A at opposite sides, the short straight-line sections 1004B at opposite sides, and the curved corner section 1005 which connects the straight-line sections 1004A and 1004B.

The rear cover 1011 has the rectangular rear surface plate 1012 before processing. The peripheral edge 1013 is bent substantially perpendicularly to the rear surface plate 1012 and extends above the rear surface plate 1012. The peripheral edge 1013 is facing up and comprises the long straight-line sections 1014A at opposite sides, the short straight-line sections 1014B at opposite sides, and the curved corner section 1015 which connects the straight-line sections 1014A and 1014B. The rear surface plate 1012 has an attachment hole 1021 which attaches a mounting means 1020 and also a rectangular indent 1022. A latch edge 1023 is inwardly formed in the periphery of the attachment hole 1021.

The design sheet 1017 is a rectangular paper and may be a clipping of a magazine or the like. The sheet body 1007 is formed in the shape of a rectangle of the thin transparent synthetic resin material. A character, a pattern, a design, or a combination thereof can be printed directly on the sheet body 1007. In such a case, there may not be any design sheet.

The button 1000 is formed so that the design sheet 1017 and the sheet body 1007 are put on the upper surface of the front cover 1001 in layers, and the peripheral edge 1003 of the front cover 1001 is bent as if the peripheries of the design sheet 1017 and the sheet body 1007 are caught by the peripheral edge 1003 of the front cover 1001 and the peripheral edge 1013 of the rear cover 1011. Also in the peripheral edge 1003, the bending angle of the corner section 1015 is larger than that of the straight-line sections 1004A, 1004B. Therefore, the corner section 1005 is securely attached to the corner section 1015 of the rear cover 1011.

The mounting means 1020 is attached to the button 1000. The mounting means 1020 comprises a rectangular base plate 1025 and an attachment shaft 1027 formed projecting substantially in the center of the rear surface 1026 of the base plate 1025, and is formed of synthetic resin in one piece. The latch section substantially in the shape of a letter L as shown in FIGS. 45-47 is formed in a front surface 1028 of the base plate 1025. An attachment pin is attached to the latch section of the mounting means 1020. An attachment shaft 1027 is inserted in the attachment hole 1021 in the rear cover 1011, and the mounting means 1020 is fit into the indent 1022 in the rear cover 1011. When the attachment shaft 1027 is inserted in the attachment hole 1021, it will be stopped by a latch edge 1023 formed in the periphery of the attachment hole 1021. The mounting means 1020 can be a clip type as shown in FIGS. 48 and 49, or it can be a magnet type as shown in FIGS. 50 and 51.

Further, a first pressed mold 1110 and a second pressed mold 1140 which are used in the button making device 801 manufacturing a polygonal button 1000, are explained in detail. The button making device 801 comprises a base 502, the first pressed mold 1110 and the second pressed mold 1140 which are formed on the base 502, and a pressing mold 1040 which is connected to the above-mentioned first pressed mold 1110 and the second pressed mold 1140 and makes the above-mentioned button 1000. The first pressed mold 1110 has a first mounting platform 1111 which carries the above-mentioned front cover 1001. The second pressed mold 1140 comprises a second mounting platform 1141 which carries the above-mentioned rear cover 1011, and a processing platform 1155 which is provided in the circumference of the second mounting platform 1141 and which bends the peripheral edge 1003 of the front cover 1001 to the peripheral edge 1013 side of the rear cover 1011.

The processing platform 1155 has straight-line inclined edges 1161 and 1162 which bend the straight-line sections 1004A and 1004B of the peripheral edge 1003 of the front cover 1001, and a corner inclined edge 1163 which bends the corner section 1005 of the peripheral edge 1003 of the front cover 1001. The processing platform 1155 makes the corner section 1005 of the peripheral edge 1003 of the front cover 1001 be securely attached to the corner section 1015 of the peripheral edge 1013 of the rear cover 1011 by the corner inclined edge 1163. The attachment member (the first attachment member) 691 has the first pressed mold 1110 and the second pressed mold 1140 which are arranged at either side in the direction of reciprocation of a sliding platform 600. As already mentioned, the attachment member (the first attachment member) 691 is attached to a bottom wall 605 of the sliding platform 600 so as to be able to be freely attached and detached.

The first pressed mold 1110 comprises the first mounting platform 1111 which carries the front cover 1001, and a guide platform 1125 which is provided in the circumference of the first mounting platform 1111 and which carries the design sheet 1017 and the sheet body 1007 in layers. The guide platform 1125 is pressed upward by an elastic member 1113 so as to be able to freely move up-and-down. The first mounting platform 1111 comprises a substantially rectangular upper wall 1115 which is curved gently, a peripheral wall 1116 formed in lower part of the periphery of the upper wall 1115, and a cylindrical fixed shaft 1117 formed substantially in the center of the undersurface of the upper wall 1115.

The first mounting platform 1111 is fixed to the attachment member (the first attachment member) 691 as follows. A lower part of the peripheral wall 1116 engages with a rectangular guide projection 1118 provided in the attachment member (the first attachment member) 691. A lower end of the fixed shaft 1117 engages with the indent 1120 of a boss section 1119 formed in the attachment member (the first attachment member) 691. The fixed shaft 1117 is screwed by a screw 622 through a hole formed in the attachment member (the first attachment member) 691, from the back of the attachment member (the first attachment member) 691.

The guide platform 1125 is formed in the shape of a rectangle. The guide platform 1125 has a rectangular mounting section 1126 which carries the design sheet 1017 and the sheet body 1007 in layers, and a guide wall 1127 which is formed in the periphery of the mounting section 1126 and which guides peripheries of the design sheet 1017 and the sheet body 1007 in the upper part. A pressing member 1046 of the below-mentioned outer layer frame 1042 fits into the guide wall 1127 of this guide platform 1125 so that the pressing member 1046 is pressed onto the mounting section 1126. Moreover, a rectangular cylindrical section 1129, which moves up-and-down along the peripheral wall 1116 of the first mounting platform 1111, is formed in the inner undersurface of the mounting section 1126.

The guide platform 1125 further has a guide cylinder 1132 which moves up-and-down inside of the peripheral wall 1116 of the above-mentioned first mounting platform 1111. The guide cylinder 1132 has a guide hole 1130 into which the fixed shaft 1117 of the above-mentioned first mounting platform 1111 is inserted to be capable of sliding. A lower end of the guide cylinder 1132 and a lower end of the rectangular cylindrical section 1129 are connected in one by a linking piece 1133. This linking piece 1133 is inserted in a long groove 1135 which extends vertically in the peripheral wall 1116 of the first mounting platform 1111.

The upper wall 1115 of the above-mentioned first mounting platform 1111 and the mounting section 1126 of the guide platform 1125 have substantially the same height. A gap 1136 is formed between the upper wall 1115 and the mounting section 1126, in which the peripheral edge 1003 of the front cover can be inserted. The guide platform 1125 is pressed upward by a spring (elastic member) 1113 wrapped around the fixed shaft 1117 of the first mounting platform 1111.

The second pressed mold 1140 comprises the second mounting platform 1141 which carries the rear cover 1011, and a processing platform 1155 which is provided in the circumference of the second mounting platform 1141 and which bends the peripheral edge 1003 of the front cover 1001 to the side of the peripheral edge 1013 of the rear cover 1011 so that peripheries of the design sheet 1017 and the sheet body 1007 are gripped by the peripheral edge 1003 of the front cover 1001 and the peripheral edge 1013 of the rear cover 1011. The processing platform 1125 is pressed upward by an elastic member 1156 so as to be able to freely move up-and-down. The second mounting platform 1141 comprises a substantially rectangular upper wall 1143 on which a substantially rectangular indent 1142 is formed, a peripheral wall 1145 formed in a lower part of the periphery of the upper wall 1143, and a cylindrical fixed shaft 1146 formed substantially in the center of an undersurface of the upper wall 1143.

The second mounting platform 1141 is fixed to the attachment member (the first attachment member) 691 as follows. A lower part of the peripheral wall 1145 fits into a rectangular guide indent 1148 provided in the attachment member (the first attachment member) 691. A lower end of the fixed shaft 1146 fits into the indent 1150 of a boss section 1149 formed in the attachment member (the first attachment member) 691 and is screwed by a screw 652 through a hole formed in the attachment member (the first attachment member) 691 from the back of the attachment member (the first attachment member) 691.

The processing platform 1155 is formed substantially in the shape of a rectangle and has an engagement step section 1157 in the upper part. A rectangular metal ring 1159 fits in this engagement step section 1157. The rectangular metal ring 1159 has an inclined edge 1160. The inclined edge 1160 bends the peripheral edge 1003 of the front cover 1001 to the side of the peripheral edge 1013 of the rear cover 1011 by tucking in peripheries of the design sheet 1017 and the sheet body 1007 inwardly to the peripheral edge 1003 of the front cover 1001 and the peripheral edge 1013 of the rear cover 1011. The inclined edge 1160 may be formed directly in an upper part of the processing platform 1155.

The above-mentioned inclined edge 1160 comprises a first straight-line inclined edge 1161, a second straight-line inclined edge 1162, and a curved corner inclined edge 1163 which connects the first straight-line inclined edge 1161 and the second straight-line inclined edge 1162. The angles of inclination of the first straight-line inclined edge 1161 and of the second straight-line inclined edge 1162 are substantially the same. The angle of inclination of the corner inclined edge 1163 is larger than that of the first straight-line inclined edge 1161 and the second straight-line inclined edge 1162.

An upper part of the inclined edge 1160 has an indent 1165 where a pressing member 1046 of a below-mentioned outer layer frame 1042 fits in. A lower part of an engagement step section 1157 has a rectangular cylindrical section 1166 which moves out up-and-down along the peripheral wall 1145 of the second mounting platform 1141. Furthermore, the processing platform 1155 has the guide cylinder 1167 which moves up-and-down inside of the peripheral wall 1145 of the above-mentioned second mounting platform 1141.

The guide cylinder 1167 has the guide hole 1169 in which the fixed shaft 1146 of the above-mentioned second mounting platform 1141 is inserted to be able to shift freely. A lower end of the guide cylinder 1167 and a lower end of a cylindrical section 1166 are connected in one by the linking piece 1170. This linking piece 1170 is inserted in the long groove 1171 which extends vertically in the peripheral wall 1145 of the second mounting platform 1141. The processing platform 1155 is pressed upward by a spring (elastic member) 1156 wrapped around the fixed shaft 1146 of the second mounting platform 1141.

A pressing mold 1040 comprises the outer layer frame 1042 and an inner layer frame 1051 which is attached inside of the outer layer frame 1042 and is lower than the outer layer frame 1042. The outer layer frame 1042 comprises the rectangular cylindrical peripheral wall 1043, a pressing member 1046 formed in the lower end outer perimeter edge of the peripheral wall 1043, and a rectangular upper wall 1047 formed in the upper end of the peripheral wall 1043. The upper wall 1047 has a substantially circular indent 1048, to which an annular magnetic body 1049 is attached. The magnetic body 1049 can be formed of any magnetic members, such as a magnet, magnetic rubber, and a ferromagnetic substance, which can hold fast to the above-mentioned magnetic body 887. The guide hole 1044 is formed substantially in the center of the upper wall 1047. Also, engaging projections 1059, 1059 in the front and back of the peripheral wall 1043.

The inner layer frame 1051 comprises a rectangular plate section 1052, a rectangular contact edge 1053 which is formed in the lower periphery of the rectangular plate section 1052 and is connected to the peripheral edge 1003 of the front cover 1001 of the button 1000, and a neck section (guide projection) 1054 which is formed in an upper end of the rectangular plate section 1052 and is guided by the guide hole 1044 of the outer layer frame 1042 to be able to shift freely. The neck section (guide projection) 1054 has a sliding member 1055 which is mounted by a screw 1057 and is similarly guided by the guide hole 1044 to be able to shift freely. An upper end of the outer periphery of the sliding member 1055 has an engagement projection 1056 which engages with the upper wall 1047 of the outer layer frame 1042. Therefore, the inner layer frame 1051 is able to move up-and-down against the outer layer frame 1042 within a range in which the engaging projection 1056 and the rectangular plate section 1052 contact the upper wall 1047, and the engagement projection 1056 is engaging with the upper wall 1047 by its own weight. Thus, by attaching the inner layer frame 1051 inside of the outer layer frame 1042, problems such as losing either one of them or mistaking the combination of the outer layer frame and the inner layer frame can be prevented.

Next, operation of the button making device 801 of the present invention will now be described. If the handle 602 provided on the front wall 601 of the sliding platform 600 is held, the first pressed mold 1110 is taken out from the first opening 681 of the cover 920 and the front cover 1001 is placed on the upper wall 1115 of the first mounting platform 1111, and the peripheral edge 1003 is inserted into the gap 1136 between the upper wall 1115 and the mounting section 1126. Next, after overlapping the sheet body 1007 on the design sheet 1017, the design sheet 1017 is placed on the mounting section 1126 of the guide platform 1125. Also, the outer layer frame 1042 and the inner layer frame 1051 which is attached inside of the outer layer frame 1042 to be able to shift freely are placed on the first pressed mold 1110.

If the handle 602 of the front wall 601 is held and the sliding platform 600 is pressed in, the latch projection 675 of the latch plate 672 engages with the first latch indent 676 of the sliding platform 600, the first pressed mold 1110 is positioned almost directly below the pressing mold 1040 and the second pressed mold 1140 projects from the second opening 682 of the cover 920. If the operating handle 811 is turned in one direction, the pressing shaft 830 rotates clockwise, the male threaded section 833 is screwed into the female threaded section 825 of the fixed member 820 by the elastic members 535, 536, and the pressing shaft 30 moves downwards. The engagement section 860 provided in a lower part of the pressing shaft 830 is prevented from inserting in the opening 840D by the engagement section 583 of the switching member 580. Thus, the pressing member 877 does not move downward against a vertically movable member 841. However, since the engagement section 583 of the switching member 580 contacts with an upper surface of the vertically movable member 841, the pressing shaft 830 moves downward. Since the engagement section 860 presses the engagement section 583 of the switching member 580, the vertically movable member 841 shifts downward along with the pressing shaft 830 and presses down the pressing mold 1040. Further, since the pressing shaft 830 moves downward, the magnetic body 887 provided in a rear surface of the vertically movable member 841 and the magnetic body 1049 on the outer layer surface 1042 over the first pressed mold 1110 contact each other, and the outer layer frame 1042 is held fast to the vertically movable member 841.

The pressing member 1046 of the outer layer frame 1042 engages with a guide wall 1127 of the guide platform 1125 to be pressed against the mounting section 1126, and the guide platform 1125 is pressed down against the resilience of the elastic member 1113. Since the inner layer frame 1051 is free against the outer layer frame 1042, it does not press the first pressed mold 1110. The peripheries of the sheet body 1007 and the design sheet 1017 placed on the guide platform 1125 in an overlapping manner are bent downwards, and come into contact with the peripheral edge 1003 of the front cover 1001 placed on the first mounting platform 1111. At this time, a hand cannot go in near the first pressed mold 1110 by the cover 920. The position of the pressing mold 1040 which is pressed down can be confirmed by looking at an indication plate 861.

If the operating handle 811 is turned in the other direction, the pressing shaft 830 rotates counterclockwise, and the pressing shaft 830 is moved upwards by the male threaded section 833. Accompanying this, the vertically movable member 841, the outer layer frame 1042 affixed to the vertically movable member 841, and the inner layer frame 1051 attached inside of the outer layer frame 1042 shift upwards. The front cover 1001 in a state where the peripheries of the sheet body 1007 and the design sheet 1017 are bent downwards and are in contact with the peripheral edge 1003 is pulled up while still being fitted inside the outer layer frame 1042 and is detached from the first pressed mold 1110. Since the male threaded section 833 of the pressing shaft 830 is removed from the female threaded section 825 of the fixed member 820 immediately before the engagement section 860 comes into contact with the boss section 823, the pressing mold 1040 no longer moves upwards, the pressing shaft 830 slackens off, and the engagement section 860 is not pressed against the boss section 823, as a result of which the pressing mold 860 and the pressing mold 1040 are not broken.

If the rear cover 1011 is mounted on the upper wall 1143 of the second mounting platform 1141 of the second pressed mold 1140 projecting from the second opening 682 of the cover 920, with the peripheral edge 1013 facing upwards, the attachment section for attaching the detachable pin is protected by the indent 1142 and the peripheral edge 1013 is guided and positioned in an inner surface of the cylindrical section 1166 of the processing platform 1155.

If the handle 604 of the rear wall 603 is held and the sliding platform 600 is pressed in, the latch projection 675 of the latch plate 672 engages with the second latch indent 677 of the sliding platform 600, the second pressed mold 1140 is positioned almost directly below the pressing mold 1040 and the first pressed mold 1110 projects from the first opening 923 of the cover 920. If the second pressed mold 1140 is positioned almost directly below the pressing mold 1040, the rear engagement wall 599*b* engages with the engagement rod 598 of the engagement shaft 595 of the switching member 580, the half-ring shaped engagement section 583 rotates against the elasticity of the spring 597 with the bearing section 575 as a center, and moves away from the engagement indentation 867 of the pressing member 877.

If the operating handle 811 is turned in one direction, then as described previously, the pressing shaft 830 rotates clockwise and the pressing shaft 830 moves downwards. Since the engagement section 583 of the switching member 580 is detached from the engagement recess 867 of the pressing member 877 at this time, the engagement section 860 provided on the lower part of the pressing shaft 830 passes through the opening 840D. At the same time, the pressing member 877 moves downwards against the vertically movable member 841, contacts with the neck section (guide projection) 854 of the inner layer frame 1051 of the pressing mold 1040, and presses down the inner layer frame 1051. The contact edge 1053 of the inner layer frame 1051 contacts with an upper end periphery of the front cover 1001 and presses down the front cover 1001 to near a rear surface of the outer layer frame 1042. If the pressing shaft 830 moves further downwards, since a flange section 865 of the pressing shaft 830 contacts with a periphery of the opening 840D, the vertically movable member 841 and the outer layer frame 1042 start moving down along with the pressing shaft 830. If the pressing shaft 830 moves down even further, the outer layer frame 1042 contacts with the processing platform 1155 and presses down the processing platform 1155 against the elasticity of the elastic member 1156. At about the same time, peripheries of the sheet body 1007 and the design sheet 1017 which are pressed down to near a rear surface of the outer layer frame 1042 by the inner layer frame 1051 contacts with the inclined edge 1160 of the processing platform 1155 to be bent inwardly. Then, the peripheral edge 1003 of the front cover 1001 is also held fast to the inclined edge 1160.

If the pressing shaft 830 is moved further downwards and moved to an extent that the lower end of the processing platform 1155 comes into contact with the sliding platform 600 and the processing platform 1155 is no longer pressed down, the edge 1003 of the front cover 1001 is folded further inwards by the inclined edge 1160, and the peripheries of the sheet body 1007 and the design sheet 1017 are folded by the inclined edge 1160 and the edge of the second mounting platform 1141 until they face upwards. At this time, the rear cover 1011 on the second mounting platform 1141 engaged in the front cover 1001 so that the peripheries of the sheet body 1007 and the design sheet 1017 are gripped by the edge 1013 of the rear cover 1011 and the edge 1003 of the front cover 1001, to form the button body 1000.

The inclined edge 1160 of the processing platform 1155 comprises a first straight-line inclined edge 1161, a second straight-line inclined edge 1162, and a corner inclined edge 1163. The first straight-line inclined edge 1161 folds the straight line section 1004A of the front cover 1001 inward. The second straight-line inclined edge 1162 folds the straight line section 1004B of the front cover 1001 inward. The corner inclined edge 1163 folds the corner section 1005 of the front cover 1001 inward. An angle of inclination is larger than angles of inclination of the first straight-line inclined edge 1161 and the second straight-line inclined edge. Thus, the corner section 1005 is folded more inward than the straight line section 1004A and the straight line section 1004B, and the corner section 1005 is held fast to the corner section 1015 of the rear cover 1011. The straight line section 1004A and the straight line section 1004B of the front cover 1011 are folded to an extent that they come into contact with the straight line section 1014A and the straight line section 1014B of the front cover 1001 or that there is a tiny gap between them. Thus, the button 1000 is formed so that the corner section 1005 of the front cover 1001 is held fast to the corner section 1015 of the rear cover 1011. The front cover 1001 is formed so that the front surface plate 1002 is formed as a dome due to a big influence of a force toward substantially a center of the front surface plate 1002, since the corner section 1005 is tightened stronger than the straight line section 1004A and the straight line section 1004B.

At this time, even if the operation handle 831 is operated further and more external force than a stipulated amount is added to the operation handle 831 in order to move the pressing shaft 830 downward, the operation handle 831 runs idle against the pressing shaft 830 so that the pressing mold 1040 and the button 1000 will not be broken, since the latch projection 903 formed in a clutch 900 inside the above-mentioned operation handle 831 comes off from the latch indent 819.

If the operating handle 831 is turned in the other direction, the pressing shaft 830 rotates counterclockwise and the pressing shaft 830 moves upwards. Accompanying this, the vertically movable member 841 also slides upwards. The button 1000 remains loaded in the second pressed mold 1140. If the handle 604 provided in the rear wall 603 of the sliding platform 600 is held, the second pressed mold 1140 is taken out from the second opening 682 of the cover 920, the rectangular button 1000 can be easily removed from the second pressed mold 1140. Making of the button 1000 is completed upon inserting the attachment shaft 1027 of the previously described mounting means 1020 in the attachment hole 1021 of the button 1000.

The pressing mold 1040 can be easily replaced in the above-mentioned button making device 801. If an operating button 930 formed in the cover 920 is pressed down against the elasticity of the elastic member 935, a detachable ring 880 is pressed down against the elasticity of the elastic member 896 through a strut 931, a pressing shaft 932, and a push-out rod 890. Then, the pressing mold 1040 is easily removed against adhesion of a projection 882 of the detachable ring 880 to the magnetic body 887 and the magnetic body 849. As shown in FIG. 66, since the engagement projections 1059, 1059 engage with cut-aways 885, 885 formed in the guide wall 840E of the vertically movable member 841, the pressing mold 1040 is positioned where it cannot rotate and is attached to the vertically movable member 841.

While the above-mentioned button 1000 is formed to be rectangular, it is not limited to a rectangle, and any polygon with corner sections, such as a triangle and hexagon, will do.

[Effects of the Invention]

As has been described above, since the button making device of the present invention has a first pressed mold and a second pressed mold provided on an attachment member removably attached to a sliding platform, there is the effect that the attachment member can be easily removed, and it is easy to replace the first pressed mold and the second pressed mold. Also, in the button making device of the present invention, since a pressing mold is removably attached to the lower end of a pressing shaft using magnetic force, there is the effect that the pressed mold can be easily removed and it is easy to replace the pressed mold. In this way, since with the button making device of the present invention it is possible to easily replace the first pressed mold, the second pressed mold, and the pressing mold, a plurality of molds of differing sizes can be prepared, and there is the effect that it is possible to make a plurality of buttons of different sizes.

In addition to the above described effects, since the button making device of the present invention has a pressed mold comprising a pressed mold body, an outer layer frame, and an inner layer frame, with the outer layer frame and inner layer frame being removably attached to the pressed mold body using magnetic force, there are the following effects: the outer layer frame and the inner layer frame can be removed from the pressed mold body using a force greater than the magnetic force; it is possible to easily attach outer layer frames and inner layer frames of different sizes using magnetic force; and it is possible to easily adjust the size of buttons being made. Also, with the button making device of the present invention, since a detachment means for detaching the outer frame attached using magnetic force against that magnetic force is provided on the pressing mold body, there is the effect that it is even easier to remove the outer layer frame from the pressing mold body.

In the button making device of the present invention, the pressing shaft has a male threaded section capable of moving in the axial direction by being screwed into a female threaded section provided in a fixed member, a pressing mold rotatably provided on a lower end of the pressing shaft and an operating handle provided on an upper part as operation means. Thus, if the pressing shaft is turned, the pressing mold is lowered and the first pressed mold and second pressed mold rise up relatively, and it is possible to make a button using a pincer force from both the pressing mold and the first pressed mold and the second pressed mold. Therefore, there is no need for the base to be held tightly as in the related art. As a result, there is no need for the device to be placed at a particularly stable place, and it is possible to carry out processing at an unstable place. Also, since the male threaded section is used to press the pressing mold, there is the effect that it is possible to carry out operations in a confined space. Further with the button making device of the present invention, since the male threaded section is formed so as to come away from the female threaded section of the fixed member to slacken off the pressing shaft before the pressing shaft moves upwards and the pressing mold comes into contact with the fixed member, there is no fear of the pressing mold coming into contact with the fixed member and being broken.

The button according to the present invention is polygonal, comprises a front cover and a rear cover, and is formed so that a corner section of the periphery of the front cover is held fast to a corner section of the periphery of the rear cover. Thus, since a force put on a front surface plate of the front cover heads toward substantially the center, there is the effect that the front surface plate is formed substantially in a dome.

In the button according to the present invention, the front surface plate is formed curved like a dome. Thus, there is the effect that a cover plate can be held fast to the front surface plate, and a design sheet can be placed between the front surface plate and the cover plate so as not to move.

With the button making device according to the present invention, a corner inclined edge of a processing platform holds a corner section of the periphery of the front cover fast to the corner section of the periphery of the rear cover to make a button, the force added to the corner section of the front cover is toward the center of the front surface plate. Thus, there is the effect that a polygonal button with the front surface plate shaped substantially like a dome is produced.

[Explanation of Reference Numerals]

1 button making device, 2 base, 3 upper wall, 5 peripheral wall, 6 guide groove, 7 bottom wall, 9 side wall, 9*a* guide projection, 10 side wall, 10*a* guide projection, 11 boss, 11*a* through hole, 12 boss, 12*a* through hole, 15 reinforcement member, 15*a* hole, 15*b* hole, 16 strut, 16*a* male threaded section, 16*b* male threaded section, 17 strut, 17*a* male threaded section, 17*b* male threaded section, 18 nut, 19 nut, 20 fixed member, 20*a* hole, 20*b* hole, 21 nut, 22 nut, 23 thickened section, 25 female threaded section, 26 detachment means, 27 push-out rod, 28 operating button, 29 elastic member, 30 pressing shaft, 32 operating handle (operation means), 33 male threaded section, 34 non-threaded section, 35 elastic member, 36 elastic member, 37 guide hole, 40 pressing mold (pressing means), 40A pressing mold body, 40B circular projection, 40C indent, 40D opening, 40E guide wall, 41 vertically movable member, 42 outer layer frame, 44 elongated hole, 45 storage indent, 46 magnetic body (joining means), 50 pressing section, 51 inner layer frame, 52 curved section, 53 contact edge, 55 storage indent, 56 magnetic body (joining means), 57 engagement indent, 60 pressing section, 65 flange section, 69 screw, 71 guide hole, 72 guide hole, 74 indent, 75 bearing section, 76 screw, 77 mounting member, 78 circular projection, 79 guide projection, 80 switching member, 81 boss section, 82 first arm member, 83 engagement section, 85 second arm member, 86 engagement groove, 87 magnetic body (joining means), 88 magnetic body (joining means), 90 swing member, 91 boss section, 92 arm section, 93 spring mounting hook, 95 engagement shaft, 95*a* upper part, 95*b* lower part, 96 spring mounting hook, 97 spring, 98 engagement rod, 99*a* front engagement wall, 99*b* rear engagement wall, 100 sliding platform, 101 front wall, 102 handle, 103 rear wall, 104 handle, 105 bottom wall, 106 left wall, 106*a* engagement edge, 107 right wall, 107*a* engagement edge, 110 first pressed mold (first front cover mounting mold), 110*a* first pressed mold (second front cover mounting mold), 111 first mounting platform, 113 elastic member, 115 upper wall, 116 peripheral wall, 117 fixed shaft, 118 guide projection, 119 boss section, 120 indent, 122 screw, 125 guide platform, 126 mounting section, 127 guide wall, 129 cylindrical section, 130 guide hole, 132 guide cylinder, 133 linking piece, 135 elongated groove, 136 gap, 140 second pressed mold (first rear cover mounting mold), 140*a* second pressed mold (second rear cover mounting mold), 141 second mounting platform, 142 indent, 143 upper wall, 145 peripheral wall, 146 fixed shaft, 148 guide projection, 149 boss section, 150 indent, 152 screw, 155 processing platform, 156 elastic member (spring), 157 engagement step section, 159 metal ring, 160 inclined edge, 161 indent, 162 cylindrical section, 163 guide cylinder, 165 guide hole, 167 linking piece, 169 elongated groove, 170 positioning member, 172 latch plate, 173 screw, 175 latch projection, 176 first latch indent, 177 second latch indent, 178 elastic member, 180 cover, 181 first opening, 182 second opening, 191 attachment member (first attachment member), 191*a* attachment member (second attachment member), 192 front edge, 193 rear edge, 194 engagement indent, 195 peripheral wall, 196 engagement member (engagement means), 197 lock piece (locking means), 198 elastic member, 200 button, 200*a* button body, 201 front cover, 202 front surface plate, 203 peripheral edge, 205 rear cover, 206 rear surface plate, 207 attachment hole, 208 indent, 209 peripheral edge, 210 latch claw, 211 design sheet, 213 sheet body, 220 mounting means, 221 attachment shaft, 222 base plate, 223 front surface, 225 latch section, 226 rear surface, 229 detachable pin, 230 mounting means, 231 attachment shaft, 232 base plate, 233 front surface, 234 bearing piece, 235 rear surface, 236 strut, 237 gripping plate, 237*a* one end, 238 elastic member, 239 bearing piece, 240 mounting means, 241 attachment shaft, 242 base plate, 243 rear surface, 245 front surface, 246 magnetic plate, 301 button making device, 304 through hole, 305 screw hole, 306 storage space, 310 operation means, 311 operating handle, 312 upper case, 313 lower cover, 314 upper cover, 315 upper wall, 316 peripheral wall, 317 side wall, 318 guide wall, 319 latch indent, 320 fixed member, 323 boss section, 325 female threaded section, 326 bearing hole, 327 bearing hole, 328 boss section, 329 screw, 330 pressing shaft, 331 hexagonal shaft, 333 male threaded section, 334 non-threaded section, 335 screw hole, 336 screw, 340 pressing mold (pressing means), 340B circular projection, 340C circular indent, 340D opening, 340E guide wall, 340F guide wall, 340G guide wall, 341 vertically movable member, 342 outer layer frame, 343 peripheral wall, 344 guide hole, 346 pressing member, 347 upper wall, 348 indent, 349 magnetic body (joining means), 351 inner layer frame, 352 curved section, 353 contact edge, 354 neck section, 355 sliding member, 356 engagement projection, 357 engagement shaft, 357 screw, 360 engagement section, 365 flange section, 367 seat, 374 engagement hole, 377 pressing member, 378 engagement indent, 379 guide projection, 380 detachable ring, 381 engagement piece, 382 projection, 385 cut-away, 387 magnetic body (joining means), 388 indent, 390 push-out rod, 391 screw, 392 boss, 393 guide hole, 395 head section, 396 elastic member, 400 clutch, 401 rotating body, 402 rotating shaft, 403 latch projection, 405 elastic member, 406 attachment hole, 407 screw through hole, 410 guide indent, 411 opening, 412 engagement groove, 413 engagement projection, 420 cover, 421 front half body, 422 rear half body, 423 opening, 425 opening, 426 step section, 430 operating button, 431 strut, 432 pressing shaft, 433 screw, 435 elastic member, 436 ornamental cover, 437 latch piece, 440 pressing mold (pressing means), 442 outer layer frame, 443 outer curved section, 444 guide hole, 445 peripheral wall, 446 pressing section, 447 upper wall, 448 indent, 451 inner layer frame, 452 curved section, 453 contact edge, 454 neck section, 455 sliding member, 456 engagement projection, 457 screw, 501 button making device, 502 base, 503 upper wall, 505 peripheral wall, 506 guide groove, 507 bottom wall, 509 side wall, 509*a* guide projection, 510 side wall, 510*a* guide projection, 511 boss, 511*a* through hole, 512 boss, 512*a* through hole, 515 reinforcement member, 515*a* hole, 515*b* hole, 516 strut, 516*a* male threaded section, 516*b* male threaded section, 517 strut, 517*a* male threaded section, 517*b* male threaded section, 518 nut, 519 nut, 520 fixed member, 520*a* hole, 520*b* hole, 521 nut, 522 nut, 523 thickened section, 525 female threaded section, 526 detachment means, 527 push-out rod, 528 operating button, 529 elastic member, 530 pressing shaft, 532 operating handle (operation means), 533 male threaded section, 534 non-threaded section, 535 elastic member, 536 elastic member, 537 guide hole, 540 pressing mold (pressing means), 540A pressing mold body, 540B circular projection, 540C indent, 540D opening, 540E guide wall, 541 vertically movable member, 542 outer layer frame, 542*a* outer layer frame, 544 elongated hole, 545 storage indent, 546 magnetic body (joining means), 550 pressing section, 551 inner layer frame, 551*a* inner layer frame, 552 curved section, 553 contact edge, 555 storage indent, 556 magnetic body (joining means), 557 engagement indent, 560 pressing section, 565 flange section, 569 screw, 571 guide hole, 572 guide hole, 574 indent, 575 bearing section, 576 screw, 577 mounting member, 578 circular projection, 579 guide projection, 580 switching member, 581 boss section, 582 first arm member, 583 engagement section, 585 second arm member, 586 engagement groove, 587 magnetic body (joining means), 588 magnetic body (joining means), 590 swing member, 591 boss section, 592 arm section, 593 spring mounting hook, 595 engagement shaft, 595*a* upper part, 595*b* lower part, 596 spring mounting hook, 597 spring, 598 engagement rod, 599*a* front engagement wall, 599*b* rear engagement wall, 600 sliding platform, 601 front wall, 602 handle, 603 rear wall, 604 handle, 605 bottom wall, 606 left wall, 606*a* engagement edge, 607 right wall, 607*a* engagement edge, 610 first pressed mold (first front cover mounting mold), 610*a* first pressed mold (second front cover mounting mold), 611 first mounting platform, 613 elastic member, 615 Upper wall, 616 peripheral wall, 617 fixed shaft, 618 guide projection, 619 boss section, 620 indent, 622 screw, 625 guide platform, 626 mounting section, 627 guide wall, 629 cylindrical section, 630 guide hole, 632 guide cylinder, 633 linking piece, 635 elongated groove, 636 gap, 640 second pressed mold (first rear cover mounting mold), 640*a* second pressed mold (second rear cover mounting mold), 641 second mounting platform, 642 indent, 643 upper wall, 645 peripheral wall, 646 fixed shaft, 648 guide projection, 649 boss section, 650 indent, 652 screw, 655 processing platform, 656 elastic member (spring), 657 engagement step section, 659 metal ring, 660 inclined edge, 661 indent, 662 cylindrical section, 663 guide cylinder, 665 guide hole, 667 linking piece, 669 elongated groove, 670 positioning member, 672 latch plate, 673 screw, 675 latch projection, 676 first latch indent, 677 second latch indent, 678 elastic member, 680 cover, 681 first opening, 682 second opening, 691 attachment member (first attachment member), 691*a* attachment member (second attachment member), 692 front edge, 693 rear edge, 694 engagement indent, 695 peripheral wall, 696 engagement member (engagement means), 697 lock piece (locking means), 698 elastic member, 700 button, 700*a* button body, 701 front cover, 702 front surface plate, 703 peripheral edge, 705 rear cover, 706 rear surface plate, 707 attachment hole, 708 indent, 709 peripheral edge, 710 latch claw, 711 design sheet, 713 sheet body, 720 mounting means, 721 attachment shaft, 722 base plate, 723 front surface, 725 latch section, 726 rear surface, 729 detachable pin, 730 mounting means, 731 attachment shaft, 732 base plate, 733 front surface, 734 bearing piece, 735 rear surface, 736 strut, 737 gripping plate, 737*a* one end, 738 elastic member, 739 bearing piece, 740 mounting means, 741 attachment shaft, 742 base plate, 743 rear surface, 745 front surface, 746 magnetic plate, 801 button making device, 804 through hole, 805 screw hole, 806 storage space, 810 operation means, 811 operating handle, 812 upper case, 813 lower cover, 814 upper cover, 815 upper wall, 816 peripheral wall, 817 side wall, 818 guide wall, 819 latch indent, 820 fixed member, 823 boss section, 825 female threaded section, 826 bearing hole, 827 bearing hole, 828 boss section, 829 screw, 830 pressing shaft, 831 hexagonal shaft, 833 male threaded section, 834 non-threaded section, 835 screw hole, 836 screw, 840 pressing mold (pressing means), 840B circular projection, 840C circular indent, 840D opening, 840E guide wall, 840F guide wall, 840G guide wall, 841 vertically movable member, 842 outer layer frame, 843 peripheral wall, 844 guide hole, 846 pressing member, 847 upper wall, 848 indent, 849 magnetic body (joining means), 851 inner layer frame, 852 curved section, 853 contact edge, 854 neck section (guide projection), 855 sliding member, 856 engagement projection, 857 engagement shaft, 857 screw, 860 engagement section, 865 flange section, 867 seat, 874 engagement hole, 877 pressing member, 878 engagement indent, 879 guide projection, 880 detachable ring, 881 engagement piece, 882 projection, 885 cut-away, 887 magnetic body (joining member), 888 indent, 890 push-out rod, 891 screw, 892 boss, 893 guide hole, 895 head section, 896 elastic member, 900 clutch, 901 rotating body, 902 rotating shaft, 903 latch projection, 905 elastic member, 906 attachment hole, 907 screw through hole, 910 guide indent, 911 opening, 912 engagement groove, 913 engagement projection, 920 cover, 921 front half body, 922 rear half body, 923 opening, 925 opening, 926 step section, 930 operating button, 931 strut, 932 pressing shaft, 933 screw, 935 elastic member, 936 ornamental cover, 937 latch piece, 940 pressing mold (pressing means), 942 outer layer frame, 943 outer curved section, 944 guide hole, 945 peripheral wall, 946 pressing section, 947 upper wall, 948 indent, 951 inner layer frame, 952 curved section, 953 contact edge, 954 neck section (guide projection), 955 sliding member, 956 engagement projection, 957 screw, 1000 button, 1001 front cover, 1002 front surface plate, 1003 peripheral edge, 1004A straight line section, 1004B straight line section, 1005 corner section, 1007 sheet body, 1011 rear cover, 1012 rear surface plate, 1013 peripheral edge, 1014A straight line section, 1014B straight line section, 1015 corner section, 1017 design sheet, 1020 mounting means, 1021 attachment hole, 1022 indent, 1023 latch edge, 1025 base plate, 1026 rear surface, 1027 attachment shaft, 1028 front surface, 1040 pressing mold (pressing means), 1042 outer layer frame, 1043 peripheral wall, 1044 guide hole, 1046 pressing member, 1047 upper wall, 1048 indent, 1049 magnetic body (joining member), 1051 inner layer frame, 1052 rectangular plate section, 1053 contact edge, 1054 neck section (guide projection), 1055 sliding member, 1056 engagement projection, 1057 screw, 1059 engagement projection, 1110 first pressed mold, 1111 first mounting platform, 1113 elastic member, 1115 upper wall, 1116 peripheral wall, 1117 fixed shaft, 1118 guide projection, 1119 boss section, 1120 indent, 1125 guide platform, 1126 mounting section, 1127 guide wall, 1129 rectangular cylindrical section, 1130 guide hole, 1132 guide cylinder, 1133 linking piece, 1135 elongated groove, 1136 gap, 1140 second pressed mold (pressed mold), 1141 second mounting platform, 1142 indent, 1143 upper wall, 1145 peripheral wall, 1146 fixed shaft, 1148 guide projection, 1149 boss section, 1150 indent, 1155 processing platform, 1156 elastic member, 1157 engagement step section, 1159 metal ring, 1160 inclined edge, 1161 first straight-line inclined edge, 1162 second straight-line inclined edge, 1163 corner inclined edge, 1165 indent, 1166 cylindrical section, 1167 guide cylinder, 1169 guide hole, 1170 linking piece, 1171 elongated groove

INDUSTRIAL APPLICABILITY

The present invention can be used for a button making device which can easily form a metal button by press processing which can be used as an accessory adhered to clothes, hats, or the like by a pin or the like.

What is claimed is:

1. A button making device for making a button having a rear cover and a front cover, comprising:

a base;

a first pressed mold on which said front cover can be placed;

a second pressed mold on which said rear cover can be placed;

an attachment member on which said first pressed mold and said second pressed mold are provided;

a pressing mold for making the button by independently engaging with each of said first pressed mold and said second pressed mold; and a pressing shaft for causing said pressing mold to move so as to engage with one of said first pressed mold and said second pressed mold;

wherein said attachment member is removably attached to a sliding platform capable of reciprocating on an upper surface of said base by an attaching and detaching member.

2. The button making device according to claim 1, wherein said attaching and detaching member comprises an engagement member which engages with one side of said attachment member, and a locking member which locks the other side of said attachment member.

3. The button making device according to claim 1, wherein said first pressed mold and said second pressed mold are provided on said attachment member to be positioned at both ends of said sliding platform.

4. The button making device according to claim 1, wherein said pressing mold is removably attached to a lower end of said pressing shaft.

* * * * *